US006485873B1

(12) United States Patent
Ohkura et al.

(10) Patent No.: US 6,485,873 B1
(45) Date of Patent: Nov. 26, 2002

(54) ELECTROPHOTOGRAPHIC PHOTOCONDUCTOR AND ELECTROPHOTOGRAPHIC APPARATUS

(75) Inventors: Kenichi Ohkura, Nagano (JP); Seizou Kitagawa, Nagano (JP); Masaru Takeuchi, Nagano (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 09/561,598

(22) Filed: Apr. 27, 2000

(30) Foreign Application Priority Data

Apr. 30, 1999 (JP) ..... 11-125133

(51) Int. Cl.[7] ..... G03G 5/04

(52) U.S. Cl. ..... 430/83; 430/56; 430/70; 430/72; 430/73; 430/74

(58) Field of Search ..... 430/56, 83, 72, 430/73, 74, 70

(56) References Cited

U.S. PATENT DOCUMENTS 4,806,443 A * 2/1989 Yanus et al. ..... 430/56
5,166,016 A * 11/1992 Badesha et al. ..... 430/56
5,336,577 A * 8/1994 Spiewak et al. ..... 430/56
5,492,784 A * 2/1996 Yoshikawa et al. ..... 430/58
5,773,613 A * 6/1998 Kawaguchi et al. ..... 430/83
6,015,646 A * 1/2000 Iwasaki et al. ..... 430/83
6,090,514 A * 7/2000 Kakui et al. ..... 430/83
6,200,071 B1 * 3/2001 Takeuchi et al. ..... 430/83

FOREIGN PATENT DOCUMENTS

| | | | |
|---|---|---|---|
| EP | 413338 A1 | * | 2/1991 |
| EP | 550161 A1 | * | 7/1993 |
| GB | 1360554 | * | 7/1974 |
| JP | 3075754 A | * | 3/1991 |
| JP | 5-150486 | * | 11/1991 |
| JP | 6-148914 | * | 5/1994 |
| JP | 6-266136 | * | 9/1994 |
| JP | 11-095466 | * | 4/1999 |
| WO | 98/06012 | * | 8/1997 |
| WO | WO98/38551 | * | 9/1998 |

* cited by examiner

*Primary Examiner*—Christopher Rodee
(74) *Attorney, Agent, or Firm*—Darby & Darby

(57) ABSTRACT

A biphenyl derivative is included in a photosensitive layer of an electrophotographic photoconductor. The electrophotographic photoconductor includes a single-layer photosensitive layer coated on a conductive substrate. The photosensitive layer includes a resin binder, a charge generation substance, a hole transport substance, and an electron transport substance. An electrophotographic apparatus using such an electrophotographic photoconductor has excellent electrical characteristics in a positive chargine system and is stable in repeated use.

24 Claims, 1 Drawing Sheet

ELECTROPHOTOGRAPHIC PHOTOCONDUCTOR AND ELECTROPHOTOGRAPHIC APPARATUS

BACKGROUND OF THE INVENTION

The present invention relates to electrophotographic photoconductors having improved electrical characteristics in a positive charging process. The present invention further relates to electrophotographic apparatus using the aforementioned electrophotographic photoconductor.

In recent years, numerous electrophotographic photoconductors using organic photosensitive materials have been proposed and put to practical use. These conventional electrophotographic photoconductors had certain advantages over the prior photoconductors, such as freedom from environmental pollution, low cost, and flexibility of designing electrophotographic characteristics provided by wide variety in material selection.

A photosensitive layer of an organic electrophotographic photoconductor principally consists of a layer having organic photosensitive material dispersed in a resin material. Many types of photosensitive layer structures have been proposed, including laminate structures and single-layer structures. A laminate structure consists of a charge generation layer, containing a charge generation substance, dispersed in a resin, and a charge transport layer, containing charge transport substance, dispersed in a resin. A single-layer structure consists of a single-layer containing both a charge generation substance and a charge transport substance dispersed in a resin.

In conventional functional-separated type photoconductor, a photosensitive layer consists of a charge transport layer and a charge generation layer. The charge transport layer is laminated on a charge generation layer. This type of photoconductor is widely used because of its excellent photoconductor characteristics and durability. The charge transport layer of the function-separated laminate type photoconductor generally uses a hole transport substance. Therefore, the type of photoconductor is utilized in a negative-charging process. Negative polar corona discharge in the negative-charging process is less stable and generates larger amount of ozone as compared to a positive polar corona discharge. This raises problems such as undesirable effects to the photoconductor and hazardous influence to the operation environment.

These problems are effectively solved by an organic electrophotographic photoconductor which can be used in a positive-charging process. Thus, a positive-charging type photoconductor exhibiting high sensitivity is presently desired. Numerous photosensitive layers of the positive-charging type photoconductor have been proposed. A function-separated type photoconductor having a charge generation layer laminated on a hole transport layer has been proposed. Furthermore, a function-separated type photoconductor having an electron transport layer laminated on a charge generation layer has also been proposed. Additionally, a single-layer type photoconductor having a charge generation substance and charge transport substance contained in the same layer has been proposed. However, most of these conventional photoconductors are inferior in electrical characteristics, such as sensitivity, as compared to photosensitive layers of negative-charging function-separated photoconductors.

In the meantime, many kinds of electron transport substances and electrophotographic photoconductors using these electron transport substances have been proposed. Such substances and photoconductors have recently received extensive attention. The references include Japanese Unexamined Patent Application Publication (KOKAI) Nos. H1-206349 and H4-360148, Denshishashin gakkaishi (*Electrophotography*) vol. 30, p. 266–273 (1991), Japanese Unexamined Patent Application Publication (KOKAI) Nos. H3-290666, H5-92936, Preprint p.207–210 of Pan-Pacific Imaging Conference/Japan Hardcopy '98 Jul. 15–17, 1998, J A Hall, Tokyo, Japan, Japanese Unexamined Patent Application Publication (KOKAI) No. H9-151157, Proceedings p.21–24 of Japan Hardcopy '97, Jul. 9–11, 1997, J A Hall, Tokyo, Japan, Japanese Unexamined Patent Application Publication (KOKAI) Nos. H5-279582 and H7-179775, Proceedings p.173–176 of Japan Hardcopy '92, Jul. 6–8, 1992, J A Hall, Tokyo, Japan, and Japanese Unexamined Patent Application Publication (KOKAI) No. H10-73937. A photoconductor having a single-layer photosensitive layer containing an electron transport substance drew attention as possessing high sensitivity. Some of these photoconductors have been put into practice.

Conventional single-layer type electrophotographic photoconductors containing electron transport substance, as disclosed in the above-cited references, exhibit initial electrical characteristics, such as sensitivity and residual potential, better than photoconductors without electron transport substance. There still remains, however, the problem that repeated use of these conventional single-layer type electrophotographic photoconductors deteriorates the electrical characteristics. This problem is remarkable when used in an environment with high temperature and high humidity or with low temperature and low humidity.

Biphenyl derivatives are used as a plasticizer for plastics. Some applications of biphenyl derivatives in an electrophotographic photoconductor, as a plasticizer for relaxation of residual stress, have been proposed in Japanese Unexamined Patent Application Publications (KOKAI) Nos. H3-134670, H6-75394, H6-148914, and H7-92702. Further applications of biphenyl derivatives, as a deactivating agent contemplating stability in repeated use by preventing dimerization or dissociation of certain charge transport substances, have been proposed in Japanese Unexamined Patent Application Publications (KOKAI) Nos. H3-75754, H3-75755, and H3-75756. An additional application of biphenyl derivatives, as an agent for increasing electrostatic force and van der Vaals' force contemplating high image density, is proposed in Japanese Unexamined Patent Application Publication (KOKAI) No. H5-273771. An application of biphenyl derivatives in combination with an undercoat layer containing inorganic pigment for improving resistance to NOx, contemplating stability in repeated use, is disclosed in Japanese Unexamined Patent Application Publication (KOKAI) No. H7-306540. Finally, an application containing the biphenyl derivative in a charge generating layer to improve adhesivity of the charge generating layer to a charge transport layer, an intermediate layer, or a substrate is proposed in Japanese Unexamined Patent Application Publication (KOKAI) No. H10-268532.

OBJECTS AND SUMMARY OF THE INVENTION

It is therefore an object of the present invention to provide an electrophotographic photoconductor having a single-layer photosensitive layer containing electron transport substance that is free from the above faults.

It is a further object of the present invention to provide an electrophotographic photoconductor that exhibits excellent electrical characteristics in a positive charging process and excellent stability in repeated use.

It is also an object of the present invention to provide an electrophotographic apparatus equipped with such a photoconductor.

Briefly stated, the present invention provides a biphenyl derivative included in a photosensitive layer of an electrophotographic photoconductor. The electrophotographic photoconductor includes a single-layer photosensitive layer coated on a conductive substrate. The photosensitive layer includes a resin binder, a charge generation substance, a hole transport substance, and an electron transport substance. An electrophotographic apparatus using such an electrophotographic photoconductor has excellent electrical characteristics in a positive charging system and is stable in repeated use.

According to an embodiment of the present invention, there is provided an electrophotographic photoconductor comprising: a conductive substrate; a single-layer photosensitive layer disposed on the conductive substrate; the single-layer photosensitive layer including a resin binder, a charge generation substance, a hole transport substance, and an electron transport substance; and the single-layer photosensitive layer contains a biphenyl derivative.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
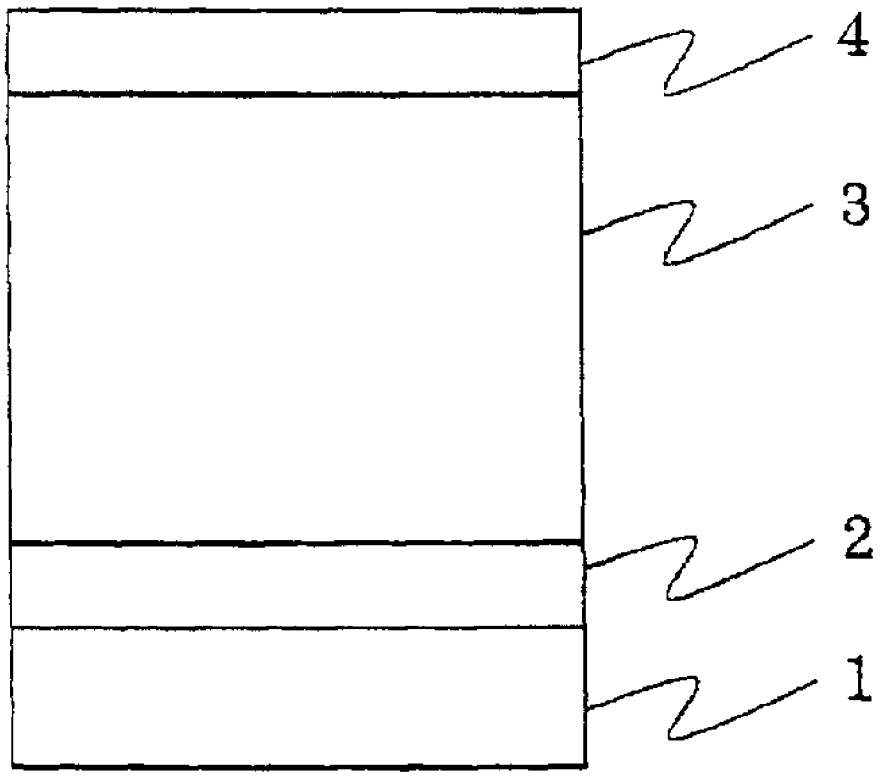
FIG. 1 is a schematic sectional view of an electrophotographic photoconductor according to the present invention.

As a result of intensive studies to accomplish the above object, the inventors of the present invention have found that the stability of electrical characteristics in the positive charging process is improved when a biphenyl derivative is contained in a single-layer photosensitive layer of a photoconductor. The photosensitive layer includes a resin binder, a charge generating substance, a hole transport substance, and an electron transport substance acting as an acceptor compound. The present invention is achieved based on this finding.

The present invention provides an electrophotographic photoconductor comprising a conductive substrate and a single-layer photosensitive layer disposed directly or through an undercoat layer on the substrate. The photosensitive layer includes at least, a resin binder, a charge generating substance, a hole transport substance, and an electron transport substance, wherein the photosensitive layer contains a biphenyl derivative.

According to one aspect of the present invention, the biphenyl derivative has a structure represented by general formula (BP1).

(BP1)

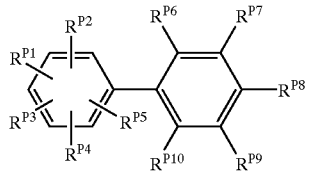

In general formula (BPI), $R^{P1}$ is a hydrogen atom, an optionally substituted aryl group, an optionally substituted aralkyl group, or a cycloalkyl group. Each of $R^{P2}$ to $R^{P10}$ is independently a hydrogen atom, a halogen atom, an alkyl group of 1 to 18 carbon atoms, an alkoxyl group of 1 to 18 carbon atoms, a hydroxyl group, an alkyl halide group, a cyano group, nitro group, or an alkyl-substituted amino group optionally forming a ring with a nitrogen atom. The substituent in the formula ($BP_1$) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

Preferably, the biphenyl derivative is a compound selected from the group consisting of a biphenyl, o-terphenyl, m-terphenyl, p-terphenyl, p-benzylbiphenyl, and hydrogenated terphenyl.

An alkyl group, according to the present invention, may branched or straight chained.

Advantageously, at least one of the electron transport substances is selected from the acceptor compounds represented by the following general formulas (ET1) to (ET15).

(ET1)

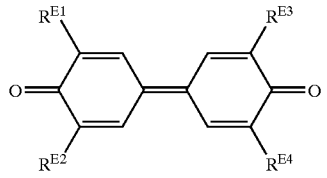

In the formula (ET1), each of $R^{E1}$ to $R^{E4}$ is independently a hydrogen atom, an alkyl group of 1 to 12 carbon atoms, an alkoxyl group of 1 to 12 carbon atoms, an optionally substituted aryl group, a cycloalkyl group, an optionally substituted aralkyl group, or an alkyl halide group. The substituent in the formula (ET1) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET2)

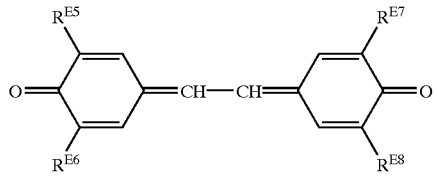

In the formula (ET2), each of $R^{E5}$ to $R^{E8}$ is independently a hydrogen atom, an alkyl group of 1 to 12 carbon atoms, an alkoxyl group of 1 to 12 carbon atoms, an optionally substituted aryl group, a cycloalkyl group, an optionally substituted aralkyl group, or an alkyl halide group. The substituent in the formula (ET2) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET3)

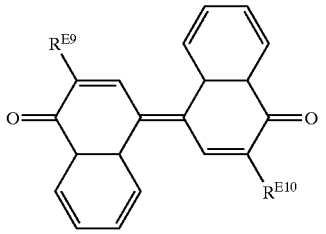

In the formula (ET3), each of $R^{E9}$ to $R^{E10}$ is independently a hydrogen atom, an alkyl group of 1 to 12 carbon atoms, an alkoxyl group of 1 to 12 carbon atoms, an optionally substituted aryl group, a cycloalkyl group, an optionally substituted aralkyl group, or an alkyl halide group. The substituent in the formula (ET3) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET4)

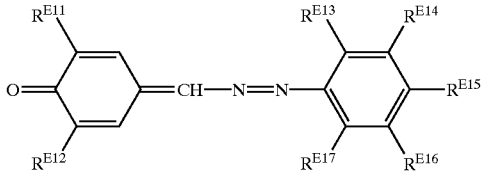

In the formula (ET4), each of $R^{E11}$ and $R^{E12}$ is independently a hydrogen atom, an alkyl group of 1 to 12 carbon atoms, an alkoxyl group of 1 to 12 carbon atoms, an optionally substituted aryl group, a cycloalkyl group, an optionally substituted aralkyl group, or an alkyl halide group. Each of $R^{E13}$ to $R^{E17}$ is independently a hydrogen atom, a halogen atom, an alkyl group of 1 to 12 carbon atoms, an alkoxyl group of 1 to 12 carbon atoms, an optionally substituted aryl group, an optionally substituted aralkyl group, an optionally substituted phenoxy group, or an alkyl halide group, wherein two or more of the groups may bond one another to for a ring. The substituent in the formula (ET4) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET5)

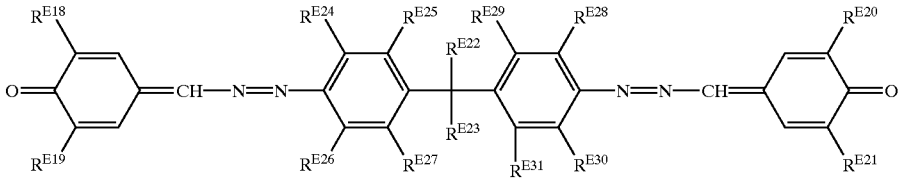

In the formula (ET5), each of $R^{E18}$ to $R^{E21}$ is independently a hydrogen atom, an alkyl group of 1 to 12 carbon atoms, an alkoxyl group of 1 to 12 carbon atoms, an optionally substituted aryl group, a cycloalkyl group, an optionally substituted aralkyl group, or an alkyl halide group. Each of $R^{E22}$ and $R^{E23}$ is independently a hydrogen atom, or an alkyl group of 1 to 12 carbon atoms. Each of $R^{E24}$ to $R^{E31}$ is independently a hydrogen atom, a halogen atom, an alkyl group of 1 to 12 carbon atoms, an alkoxyl group of 1 to 12 carbon atoms, an optionally substituted aryl group, or an alkyl halide group. The substituent in the formula (ET5) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET6)

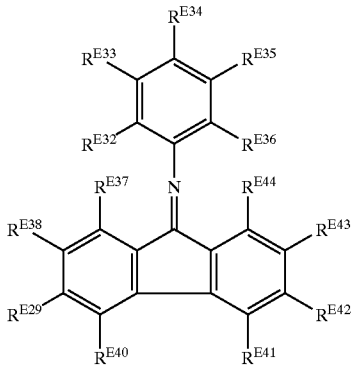

In the formula (ET6), each of $R^{E32}$ to $R^{E36}$ is independently a hydrogen atom, a halogen atom, a cyano group, a nitro group, an alkyl group of 1 to 12 carbon atoms, an alkoxyl group of 1 to 12 carbon atoms, an optionally substituted aryl group, an optionally substituted aralkyl group, an optionally substituted phenoxy group, or an alkyl halide group. Each of $R^{E37}$ to $R^{E44}$ is a hydrogen atom or a nitro group, at least three of the $R^{E37}$ to RS being nitro groups. The substituent in the formula (ET6) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET7)

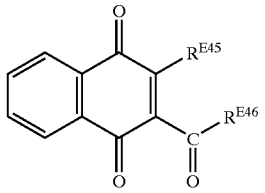

In the formula (ET7), $R^{E45}$ is an optionally substituted alkyl group or an optionally substituted aryl group. $R^{E46}$ is an optionally substituted alkyl group, an optionally substituted aryl group, or a group represented by the following formula (ET7a), in which $R^{E47}$ is an optionally substituted alkyl group or an optionally substituted aryl group.

$$—O—R^{E47} \quad \text{(ET7a)}$$

The substituent in the formula (ET7) and the formula (ET7a) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET8)

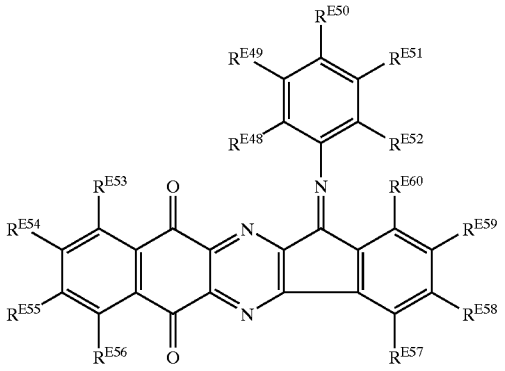

In the formula (ET8), each of $R^{E48}$ to $R^{E60}$ is independently a hydrogen atom, an alkyl group of 1 to 6 carbon atoms, an alkoxyl group of 1 to 6 carbon atoms, an aryl group, an aralkyl group, a halogen atom, or an alkyl halide group.

(ET9)

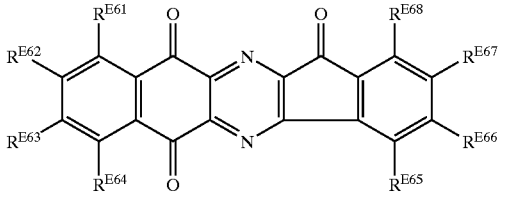

In the formula (ET9), each of $R^{E61}$ to $R^{E68}$ is independently a hydrogen atom, an alkyl group of 1 to 6 carbon atoms, an alkoxyl group of 1 to 6 carbon atoms, an aryl group, an aralkyl group, a halogen atom, or an alkyl halide group.

(ET10)

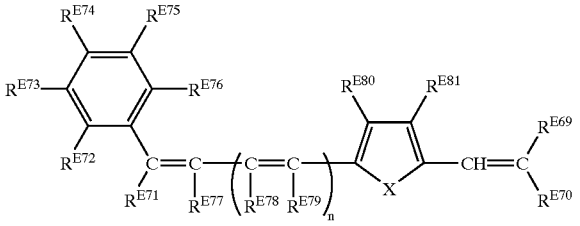

In the formula (ET10), each of $R^{E69}$ and $R^{E70}$ is independently a cyano group or an alkoxycarbonyl group. $R^{E71}$ is a hydrogen atom, an alkyl group of 1 to 12 carbon atoms, or an optionally substituted aryl group. Each of $R^{E72}$ to $R^{E76}$ is independently a hydrogen atom, a halogen atom, an alkyl group of 1 to 12 carbon atoms, an alkoxyl group, an optionally substituted aryl group, an alkyl halide group, or alkyl-substituted amino group. Each of $R^{E77}$ to $R^{E79}$ is independently a hydrogen atom or an alkyl group of 1 to 12 carbon atoms. Each of $R^{E80}$ and $R^{E81}$ is independently a hydrogen atom, halogen atom, an alkyl group of 1 to 12 carbon atoms, or an optionally substituted aryl group. X is a sulfur atom or an oxygen atom, n is 0 or 1. The substituent in the formula (ET10) is a halogen atom, an alkyl group of 1 to 6 carbon atoms, an alkoxyl group of 1 to 6 carbon atoms, a hydroxyl group, a cyano group, an amino group, a nitro group, or an alkyl halide group.

(ET11)

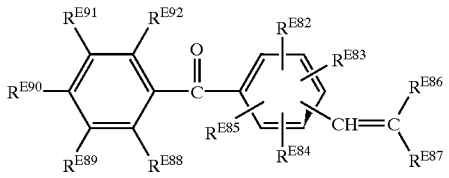

(ET12)

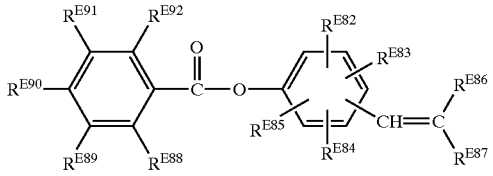

(ET13)

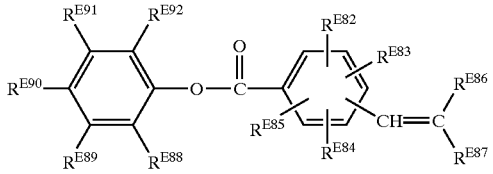

In the formulas (ET11). (ET12), and (ET13), each of $R^{E82}$ to $R^{E85}$ is independently a hydrogen atom or a halogen atom. Each of $R^{E86}$ and $R^{E87}$ is independently a cyano group or an alkoxycarbonyl group. Each of $R^{E88}$ to $R^{E92}$ is independently a hydrogen atom, a halogen atom, an alkyl group of 1 to 6 carbon atoms, a nitro group, or a cyano group.

(ET14)

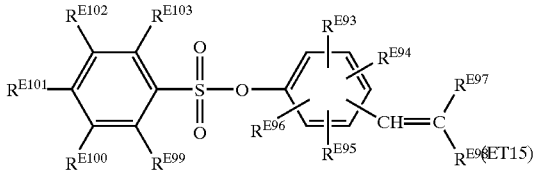

(ET15)

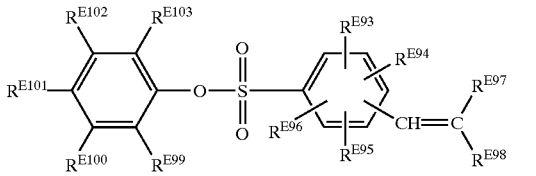

In the formulas (ET14) and (ET15), each of $R^{E93}$ to $R^{E96}$ is independently a hydrogen atom or a halogen atom. Each of $R^{E97}$ and $R^{E98}$ is independently a cyano group or an alkoxycarbonyl group. Each of $R^{E99}$ to $R^{E103}$ is independently a hydrogen atom, a halogen atom, an alkyl group of 1 to 6 carbon atoms, a nitro group, or a cyano group.

Advantageously, at least one of the hole transport substances is a compound represented by the following general formulas (HT1) to (HT5).

(HT1)

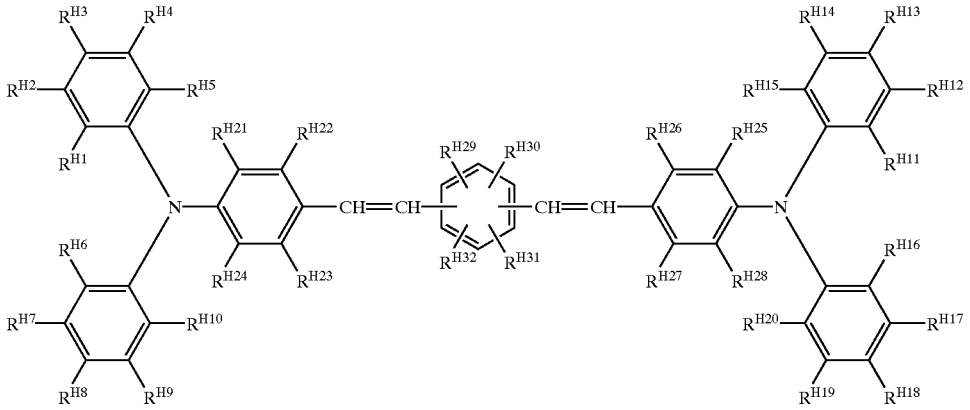

In the formula (HT1), each of $R^{H1}$–$R^{H32}$ is independently a hydrogen atom, an alkyl group of 1 to 6 carbon atoms, or an alkoxyl group of 1 to 6 carbon atoms.

(HT2)

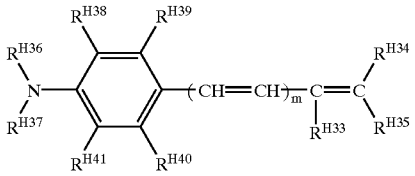

In the formula (HT2), $R^{H33}$ is a hydrogen atom or an alkyl group of 1 to 6 carbon atoms. Each of $R^{H34}$ and $R^{H35}$ is independently a hydrogen atom, an alkyl group of 1 to 6 carbon atoms, an alkoxyl group of 1 to 6 carbon atoms, or an optionally substituted aryl group, in which $R^{H34}$ and $R^{H35}$ may bond each other to form a ring, directly or through a carbon chain, an oxygen atom, or a sulfur atom. Each of $R^{H36}$ and $R^{H37}$ is independently an alkyl group of 1 to 12 carbon atoms, an optionally substituted cycloalkyl group of 3 to 12 carbon atoms, an optionally substituted aryl group, or an optionally substituted aralkyl group. Each of $R^{H38}$ to $R^{H41}$ is independently a hydrogen atom, an alkyl group of 1 to 6 carbon atoms, an alkoxyl group of 1 to 6 carbon atoms, or an optionally substituted aryl group. Two or more of the $R^{H36}$ to $R^{H41}$ may bond one another to form a ring, directly or through a carbon chain, an oxygen atom, or a sulfur atom. m is 0 or 1. The substituent in the formula (HT2) is a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, or an alkyl-substituted amino group. Two or more of these substituent groups may bond one another to form a ring, directly or through a carbon chain, an oxygen atom, or a sulfur atom.

(HT3)

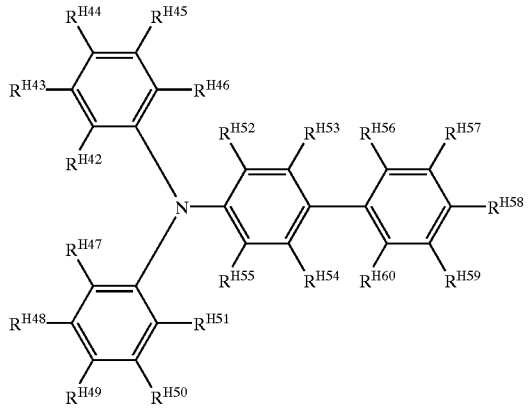

In the formula (HT3), each of $R^{H42}$ to $R^{H60}$ is independently a hydrogen atom, a halogen atom, an alkyl group of 1 to 12 carbon atoms, an alkoxyl group of 1 to 12 carbon atoms, an alkyl-substituted amino group, or an optionally substituted aryl group, in which two or more of $R^{H42}$ to $R^{H60}$ may bond one another to form a ring, directly or through a carbon chain, an oxygen atom, or a sulfur atom. The substituent in the formula (HT3) is a halogen atom, an alkyl group of 1 to 6 carbon atoms, an alkoxyl group of 1 to 6 carbon atoms, a hydroxyl group, a cyano group, an amino group, a nitro group, or an alkyl halide group, in which two or more of these substituent groups may bond one another to form a ring, directly or through a carbon chain, an oxygen atom, or a sulfur atom.

(HT4)

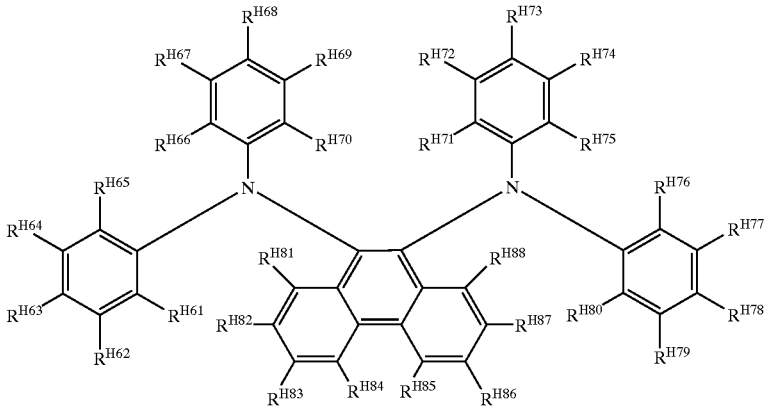

In the formula (HT4), each of $R^{H61}$ to $R^{H88}$ is independently a hydrogen atom, a halogen atom, an aryl group, an alkyl group of 1 to 12 carbon atoms, an alkoxyl group of 1 to 12 carbon atoms or an optionally substituted aryl group. The substituent in the formula (HT4) is a halogen atom, an alkyl group of 1 to 6 carbon atoms, or an alkoxyl group of 1 to 6 carbon atoms.

(HT5)

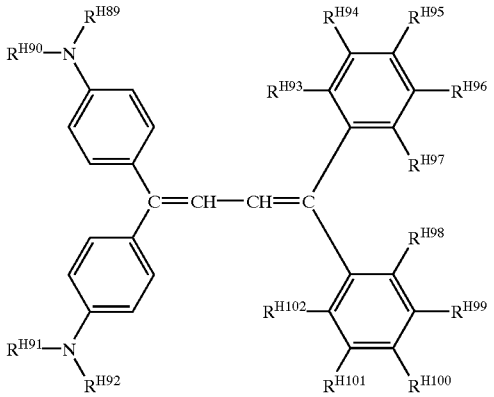

In the formula (HT5), each of $R^{H89}$ to $R^{H92}$ is independently an alkyl group of 1 to 6 carbon atoms, or an optionally substituted aralkyl group. Each of $R^{H93}$ to $R^{H102}$ is independently a hydrogen atom, a halogen atom, an alkyl group of 1 to 6 carbon atoms, or an alkoxyl group of 1 to 6 carbon atoms. The substituent in the formula (HT5) is a halogen atom, an alkyl group of 1 to 6 carbon atoms, or an alkoxyl group of 1 to 6 carbon atoms.

Advantageously, at least one of the charge generation substances is an X-type metal-free phthalocyanine.

Advantageously, at least one of the resin binder is polycarbonate having a structural unit represented by the general formula (BD1) below as a principal repeating unit.

(BD1)

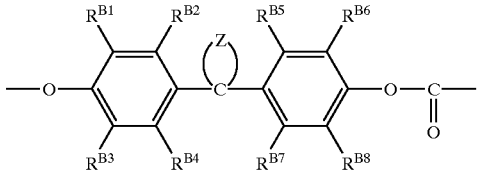

In the formula (BD1), each of $R^{B1}$ to $R^{B8}$ is independently a hydrogen atom, an alkyl group of 1 to 6 carbon atoms, an optionally substituted aryl group, a cycloalkyl group, or an halogen atom. Z is a group of atoms needed to form an optionally substituted carbon ring. The substituent in the formula (BD1) is an alkyl group of 1 to 6 carbon atoms or a halogen atom.

The electrophotographic apparatus of the present invention is provided with the above-described electrophotographic photoconductor of the present invention. The charging process of the electrophotographic apparatus of the present invention is performed by a positive-charging process.

Although a definite mechanism of how the present invention leads to excellent electrical characteristics in positive-charging process and improved stability is not thoroughly understood, it may be assumed that the favorable results are brought about by the effect of the biphenyl derivative to suppress undesirable trapping of electrons during electron transport by the electron transport substance, and are not caused by the effects as a plasticizer agent, as a deactivating agent, as an agent for increasing electrostatic force or van der Vaals' force, or resistance to NOx.

The invention will be described with reference to some preferred embodiments thereof and the accompanying drawing.

Structure of Layers

FIG. 1 is a cross sectional view showing an electrophotographic photoconductor according to the present invention. An undercoat layer 2 is coated on a conductive substrate 1. A photosensitive layer 3 and an optional protection layer 4 are then subsequently coated on conductive substrate 1. Undercoat layer 2 and protection layer 4 are provided as needed. Photosensitive layer 3 of the present invention is preferably of a single-layer type, performing both a charge generation function and a charge transport function.

Conductive Substrate

Conductive substrate 1, acting as a support for the other layers, functions as an electrode of the photoconductor. Conductive substrate 1 may have a cylindrical shape, planar shape, or film-like shape, and may be formed of a metal, such as aluminum, stainless steel or nickel, or glass or resin that has been treated to be given a certain conductivity.

Undercoat layer

Undercoat layer 2, which may be formed of a layer containing a resin as a major component, or of an oxide film such as alumite, is provided as needed for the purposes of preventing unnecessary charges from injecting from conductive substrate 1 into photosensitive layer 3. Undercoat layer 2 also acts to cover defects on the surface of conductive substrate 1, and improving the adhesivity of photosensitive layer 3.

The binder resin of undercoat layer 2 is preferably selected from polycarbonate resin, polyester resin, polyvinylacetal resin, polyvinylbutyral resin, polyvinylalcohol resin, vinylchloride resin, vinylacetate resin, polyethylene, polypropylene, acrylic resin, polyurethane resin, epoxy resin, melamine resin, silicon resin, polyamide resin, polystyrene resin, polyacetal resin, polyarylate resin, polysulfone resin, and polymer of methacrylic acid ester, and copolymers of these resins, which may be used in suitable combination. A mixture of resins of the same species but different molecular weight may also be used as a binder resin.

The binder resin may contain fine particles of a metal oxide, such as silicon oxide (silica), titanium oxide, zinc oxide, calcium oxide, aluminum oxide (alumina), or zirconium oxide, a metal sulfate, such as barium sulfate or calcium sulfate, or a metal nitride, such as silicon nitride or aluminum nitride. Alternatively, the binder resin may contain an organic metal compound, a silane coupling agent, or a material formed of an organic metal compound and a silane coupling agent. The content of these additives may be set to a desired value within a range in which an undercoat layer can be actually formed.

Undercoat layer 2, which is formed of a resin as a major component, may contain a charge transport substance for the purpose to give charge transport ability or to suppress charge trapping. The content of such charge transport substance is from about 0.1 to about 60 wt. %, preferably from about 5 to about 40 wt. % with respect to a solid component of undercoat layer 2. Undercoat layer 2 may further contain other known additives as needed, so far as the additives don't much deteriorate electrophotographic characteristics.

Although undercoat layer 2 may be used in the form of a single-layer, undercoat layer 2 may also be used in a form of a laminate, consisting of two or more different layers. While the film thickness of undercoat layer 2 depends on the composition of the materials used in the layer, the film thickness may be set to a desired value within a range in which the photoconductor does not suffer from adverse influences, such as an increase in the residual potential, when it is repeatedly and continuously used. The film thickness of undercoat layer 2 is preferably from about 0.1 $\mu$m to about 10 $\mu$m.

Photosensitive Layer

Photosensitive layer 3 is principally formed of a resin binder, a charge generation substance, a hole transport substance, and an electron transport substance. Photosensitive layer 3, according to the present invention, is a single-layer containing a biphenyl derivative.

The biphenyl derivatives used in the present invention preferably have the structural formula represented by the general formula(BP1). More preferably, the biphenyl derivative is a compound selected from the group consisting of the biphenyl represented by the formula (BP1-1), o-terphenyl represented by the formula (BP1-4), m-terphenyl represented by the formula (BP1-3), p-terphenyl represented by the formula (BP1-2), p-benzylbiphenyl represented by formula (BP1-5), and hydrogenated terphenyl represented by the formulas (BP1-6)–(BP1-8). A mixture of two or more of the compounds of the formula (BP1) may also be used in the invention. Specific examples of such biphenyl derivatives include the compounds represented by the structural formulas (BP1-1)–(BP1-78), but are not limited to those compounds. The content of the biphenyl derivative is in the range from about 0.1 to about 20 wt. %, preferably from about 0.5 to about 10 wt. % with respect to a solid component of photosensitive layer 3.

(BP1-1)

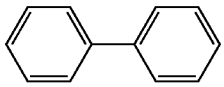

(BP1-2)

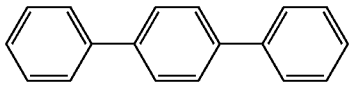

(BP1-3)

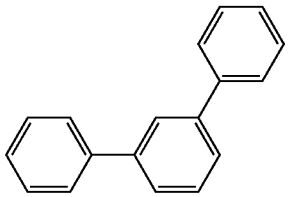

(BP1-4)

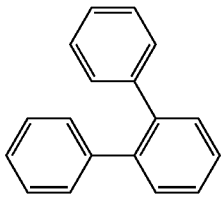

(BP1-5)

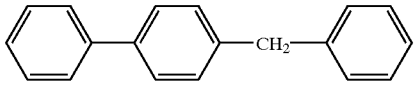

(BP1-6)

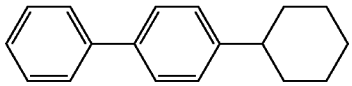

(BP1-7)

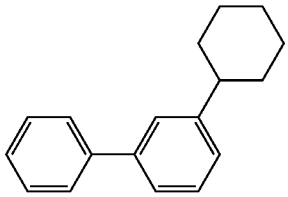

-continued
(BP1-8)
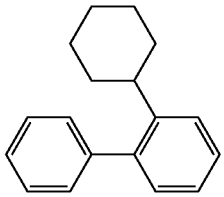
(BP1-9)
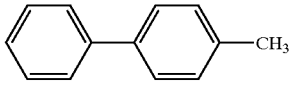
(BP1-10)
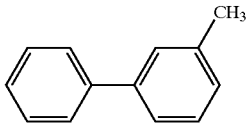
(BP1-11)
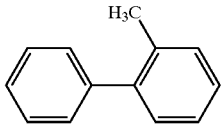
(BP1-12)
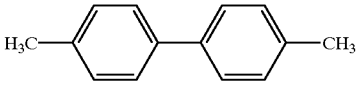
(BP1-13)
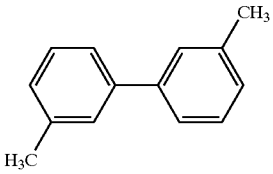
(BP1-14)
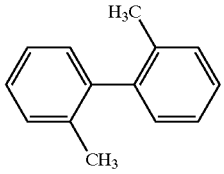
(BP1-15)
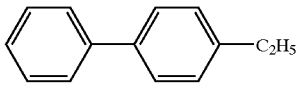
(BP1-16)
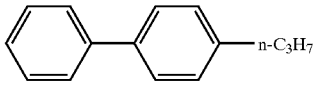
(BP1-17)
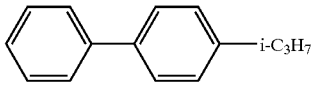
(BP1-18)
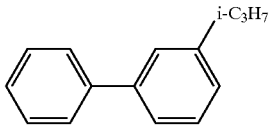
(BP1-19)
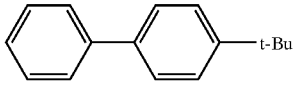
-continued
(BP1-20)
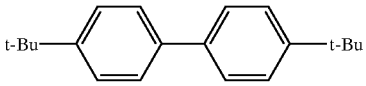
(BP1-21)
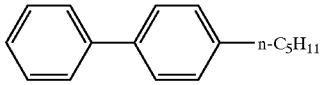
(BP1-22)
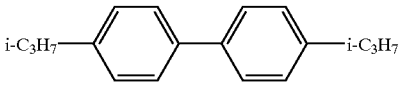
(BP1-23)
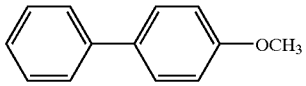
(BP1-24)
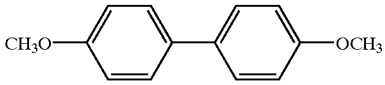
(BP1-25)
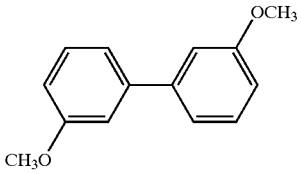
(BP1-26)
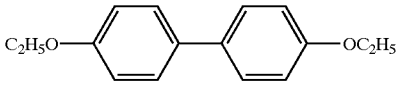
(BP1-27)
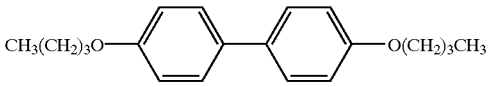
(BP1-28)
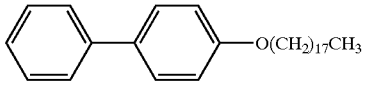
(BP1-29)
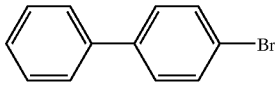
(BP1-30)
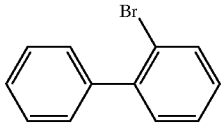
(BP1-31)
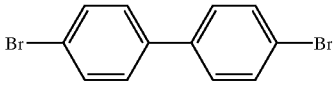
(BP1-32)
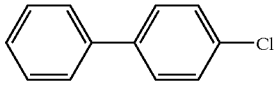
(BP1-33)
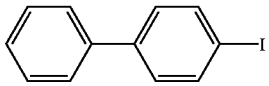
(BP1-34)
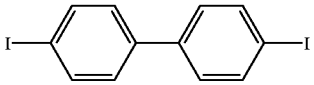

-continued
(BP1-35)
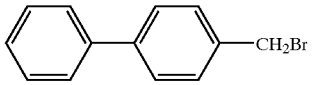
(BP1-36)
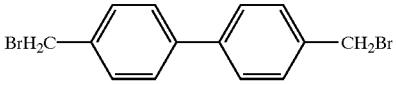
(BP1-37)
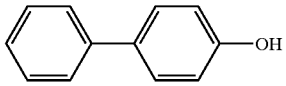
(BP1-38)
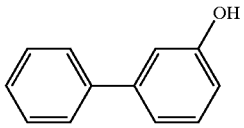
(BP1-39)
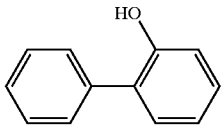
(BP1-40)
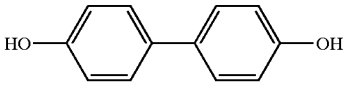
(BP1-41)
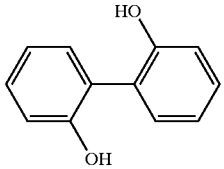
(BP1-42)
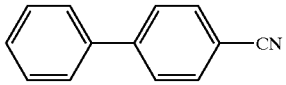
(BP1-43)
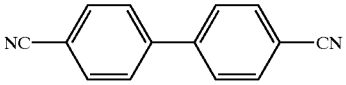
(BP1-44)
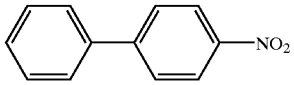
(BP1-45)
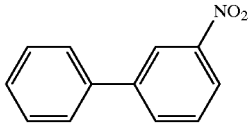
(BP1-46)
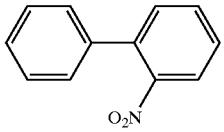
(BP1-47)
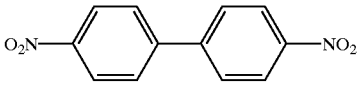
-continued
(BP1-48)
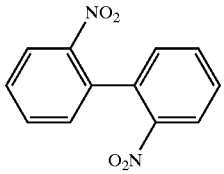
(BP1-49)
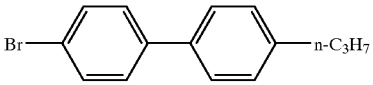
(BP1-50)
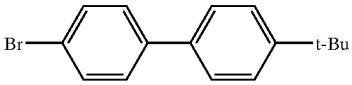
(BP1-51)
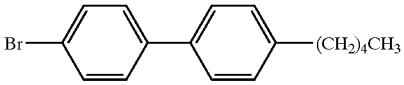
(BP1-52)
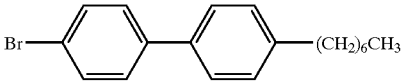
(BP1-53)
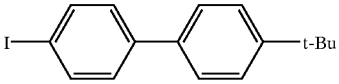
(BP1-54)
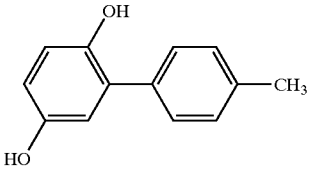
(BP1-55)
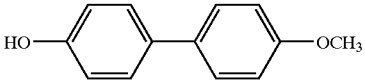
(BP1-56)
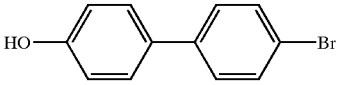
(BP1-57)
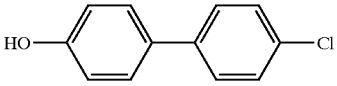
(BP1-58)
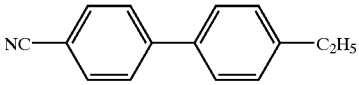
(BP1-59)
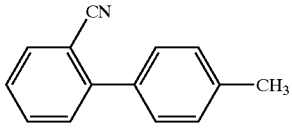
(BP1-60)
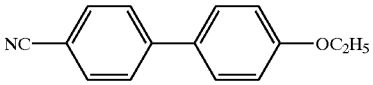
(BP1-61)
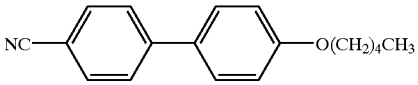

-continued (BP1-62)

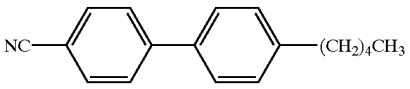

(BP1-63)

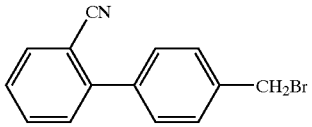

(BP1-64)

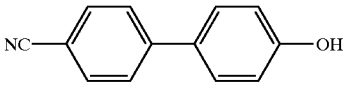

(BP1-65)

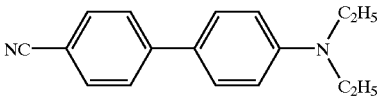

(BP1-66)

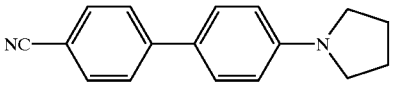

(BP1-67)

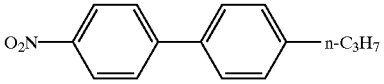

(BP1-68)

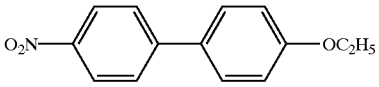

(BP1-69)

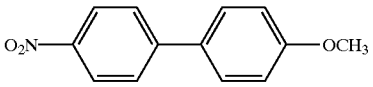

(BP1-70)

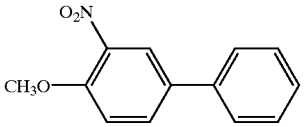

(BP1-71)

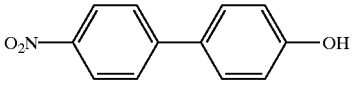

(BP1-72)

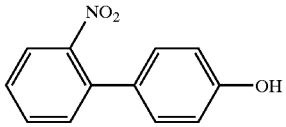

(BP1-73)

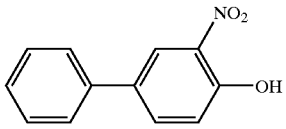

(BP1-74)

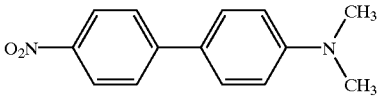

(BP1-75)

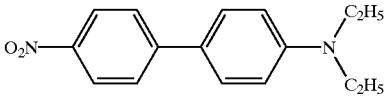

-continued (BP1-76)

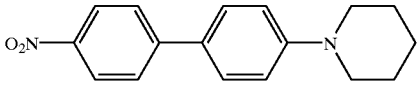

(BP1-77)

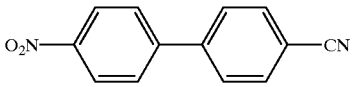

(BP1-78)

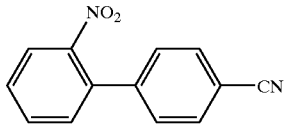

The charge generation substance in the present invention is preferably a phthalocyanine pigment, a naphthalocyanine pigment, an azo pigment, a polycyclic quinone pigment such as anthraquinone and anthanthrone, a perylene pigment, a perynone pigment, a squarylium dye, an azulenium dye, a thiapyrylium dye, a cyanine dye, a quinacridone dye, and any combination of these pigments and dyes may be used. More preferably, the charge generation substance are pigments including disazo pigments and trisazo pigments as azo pigments, 3,9-dibromo anthanthrone as an anthanthrone pigment, N-N'-bis(3,5dimethylphenyl)-3,4:9,10-perylene bis(carboxyimide) as a perylene pigment, metal-free phthalocyanine, copper phthalocyanine, and titanylphthalocyanine as phthalocyanines, in particular, X-type metal-free phthalocyanine, τ-type metal-free phthalocyanine, ϵ-type copper phthalocyanine, α-type titanylphthalocyanine, β-type titanylphthalocyanine, amorphous titanylphthalocyanine, Y-type titanylphthalocyanine, I-type titanylphthalocyanine, and the titanylphthalocyanine disclosed in Japanese unexamined patent application publication No. H8-209023, exhibiting a maximum peak at 9.6° of Bragg angle 2θ in an X-ray diffraction spectrum observed with Cu Kα radiation. The content of such charge generation substance is in the range from about 0.1 to about 20 wt. %, preferably from about 0.5 to about 10 wt. %.

The electron transport substance is preferaby selected from the compounds represented by the above-described general formulas (ET1) to (ET15). Other electron transport substances which may be suitably used include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitro phthalimide, tetracyanoethylene, tetracyanoquinodimethane, chloranil, bromanil, o-nitro benzoic acid, malononitrile, trinitrofluorenone, trinitrothioxanthone, dinitrobenzene, dinitroanthracene, dinitroacridine, nitroanthraquinone, dinitroanthraquinon, thiopyran compounds, quinone compounds, benzoquinone compounds, diphenoquinone compounds, naphthoquinone compounds, anthraquinone compounds, stilbenequinone compounds, and any appropriate combination of these compounds. The specific examples of the compounds represented by the general formulas (ET1) to (ET15) include the compounds represented by the following structural formulas (ET1-1)–(ET15-16). The specific examples of the other electron transport substances include the compounds represented by the structural formulas (ET-1)–(ET-42), but are not limited to those compounds.

The content of the electron transport substance is in the range from about 1 to about 50 wt. %, preferably from about 5 to about 40 wt. % with respect to the solid component of the photosensitive layer.

(ET1-1)
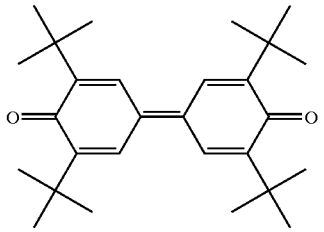
(ET1-2)
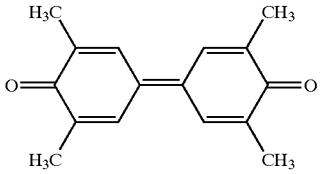
(ET1-3)
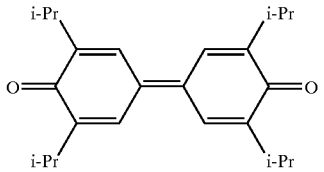
(ET1-4)
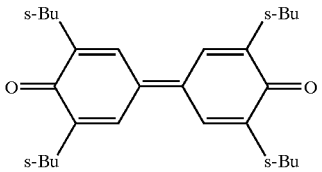
(ET1-5)
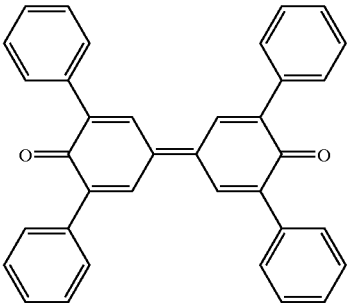
(ET1-6)
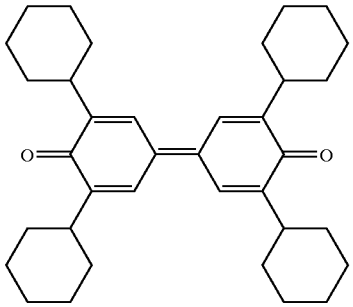
(ET1-7)
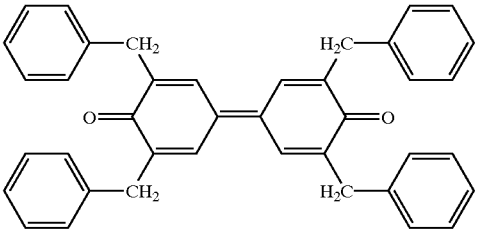
(ET1-8)
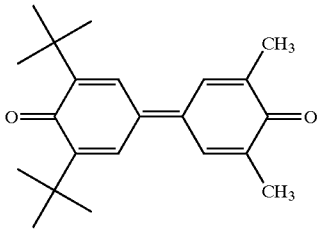
(ET1-9)
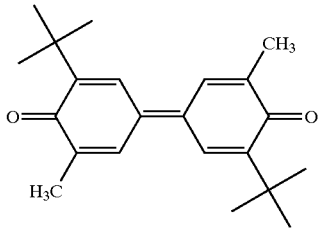
(ET1-10)
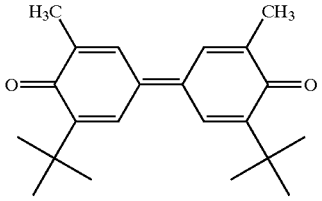
(ET1-11)
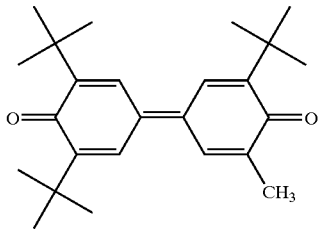
(ET1-12)
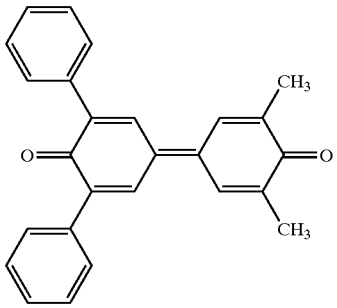

-continued
(ET1-13)
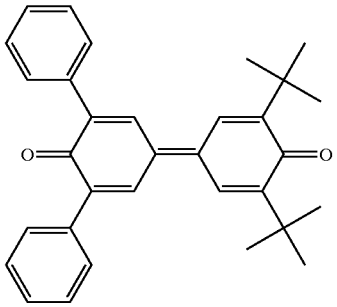
(ET1-14)
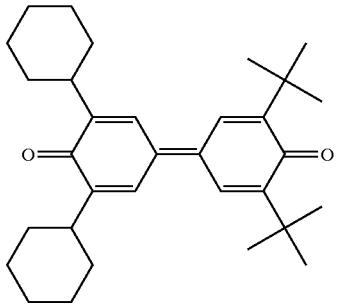
(ET1-15)
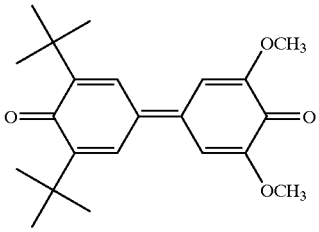
(ET1-16)
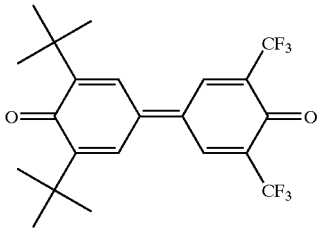
(ET2-1)
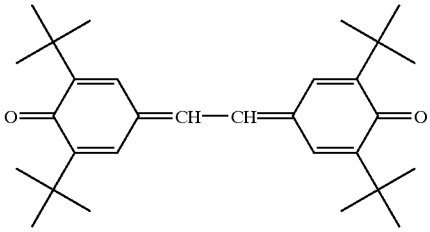
(ET2-2)
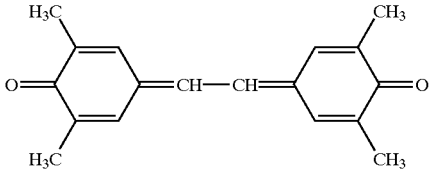
(ET2-3)
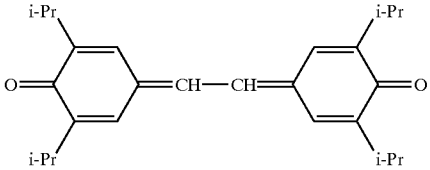
(ET2-4)
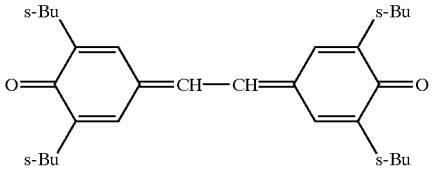
(ET2-5)
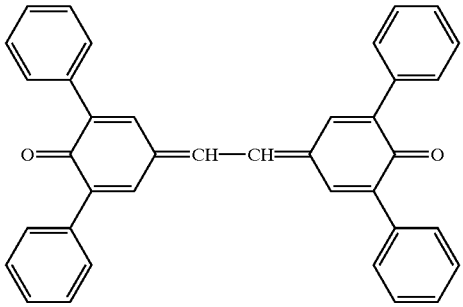
(ET2-6)
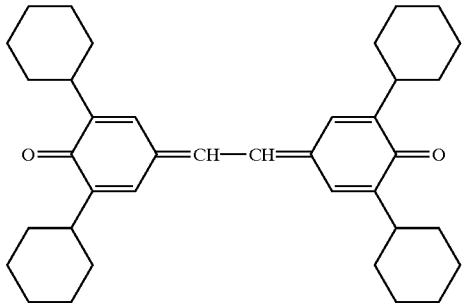
(ET2-7)
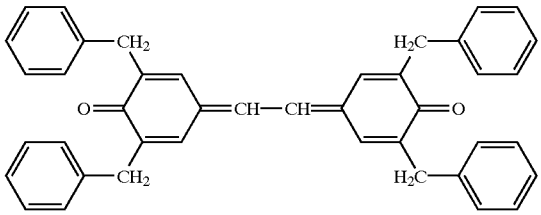
(ET2-8)
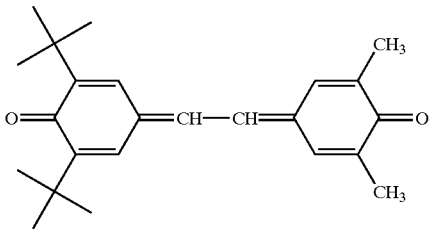

-continued
(ET2-9)
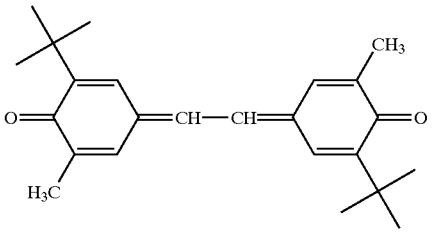
(ET2-10)
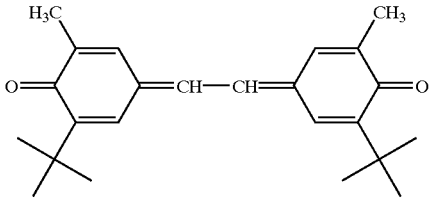
(ET2-11)
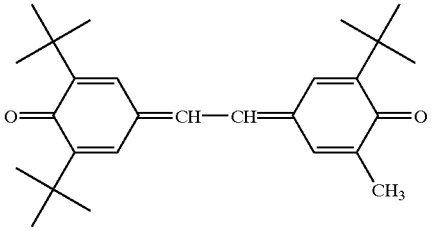
(ET2-12)
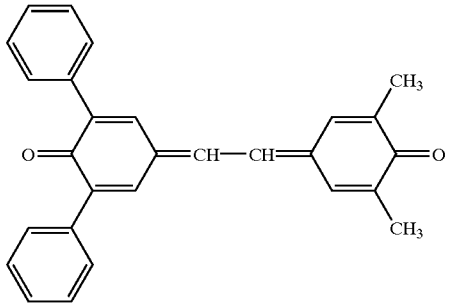
(ET2-13)
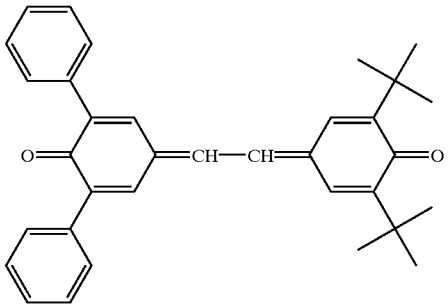
(ET2-14)
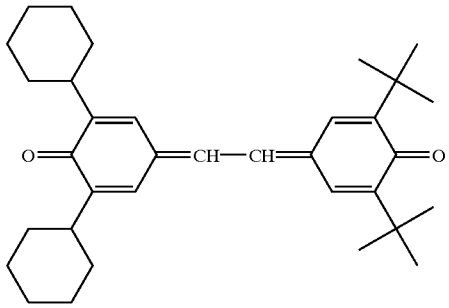
(ET2-15)
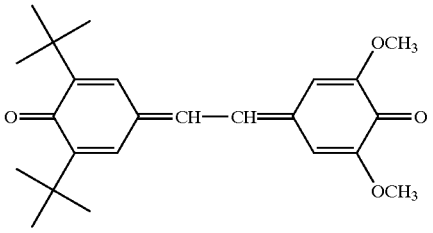
(ET2-16)
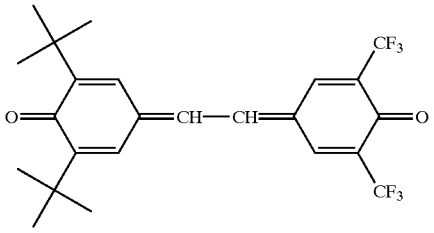
(ET3-1)
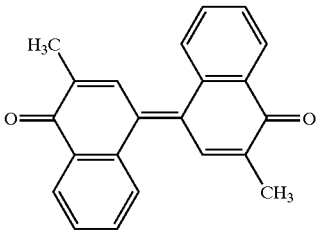
(ET3-2)
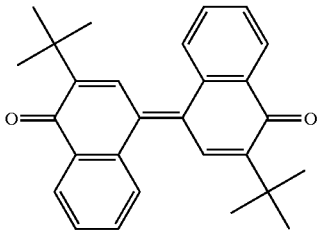
(ET3-3)
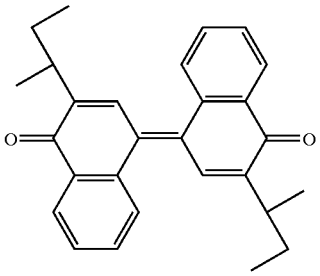
(ET3-4)
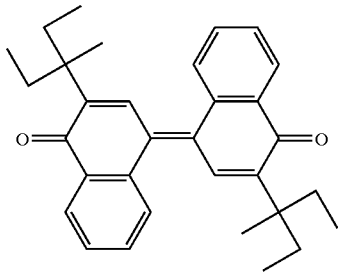

-continued
(ET3-5)
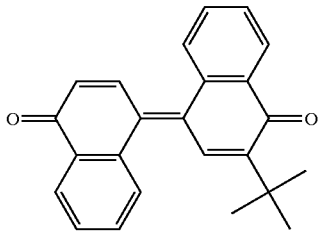
(ET3-6)
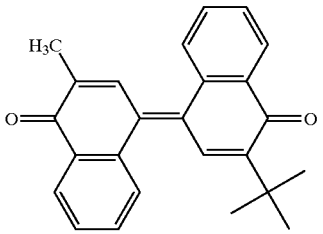
(ET3-7)
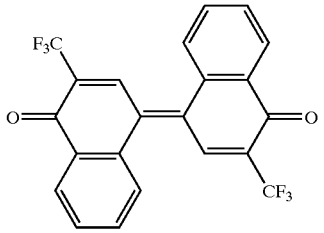
(ET3-8)
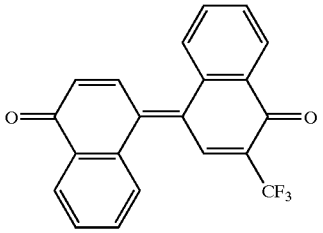
(ET3-9)
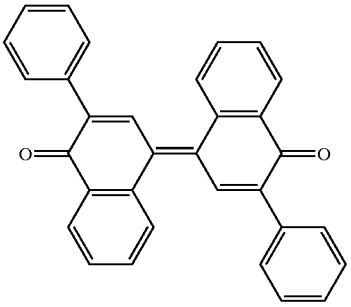
(ET3-10)
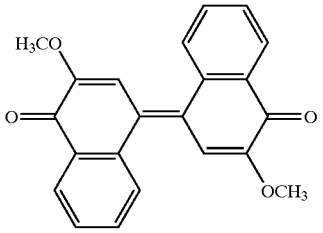
(ET3-11)
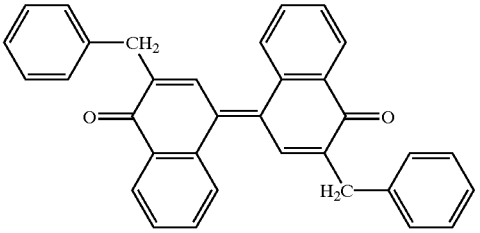
(ET3-12)
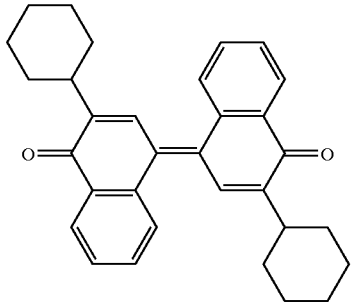
(ET4-1)
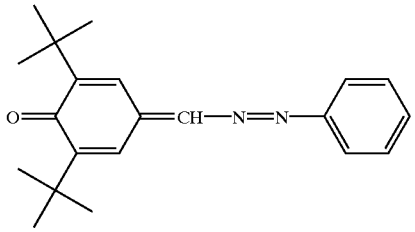
(ET4-2)
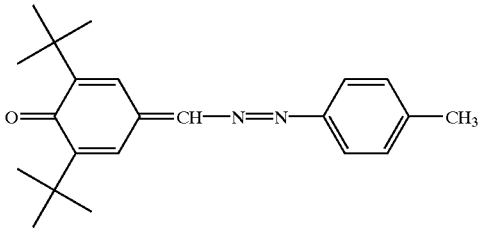
(ET4-3)
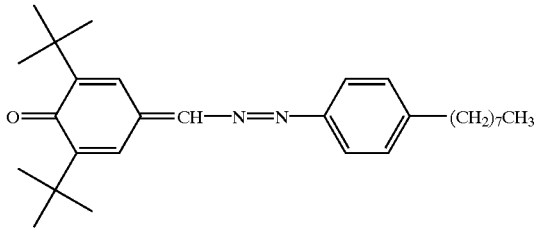
(ET4-4)
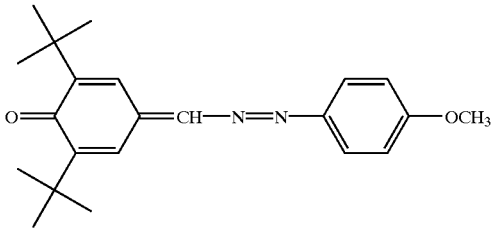

-continued
(ET4-5)
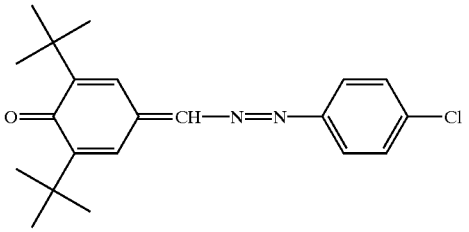
(ET4-6)
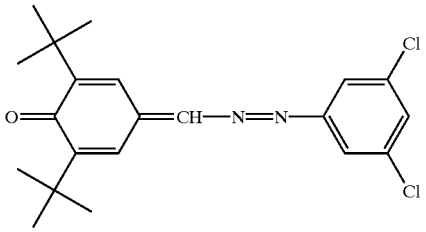
(ET4-7)
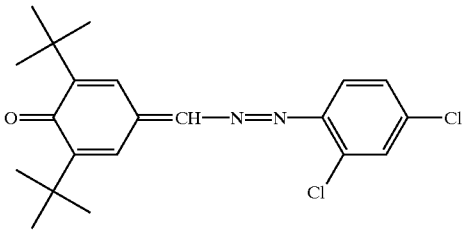
(ET4-8)
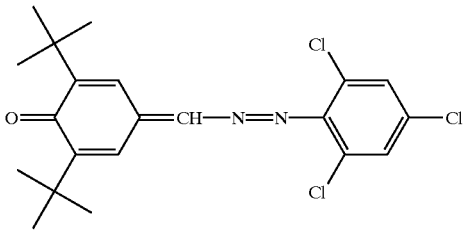
(ET4-9)
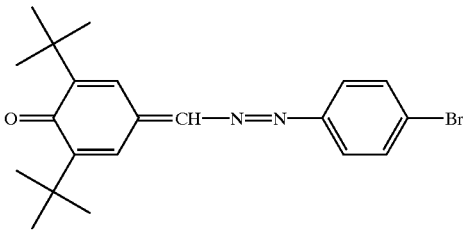
(ET4-10)
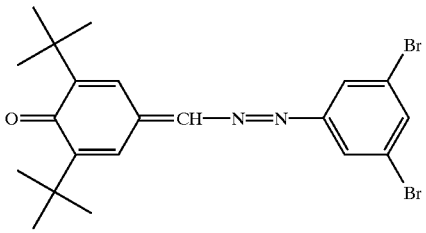
(ET4-11)
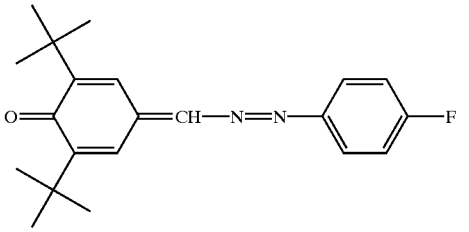
(ET4-12)
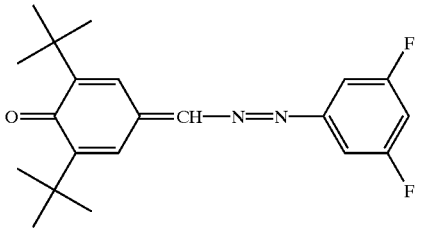
(ET4-13)
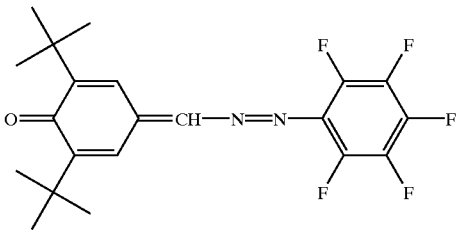
(ET4-14)
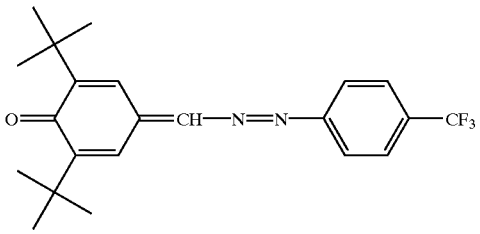
(ET4-15)
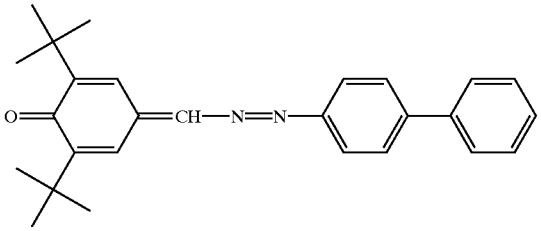
(ET4-16)
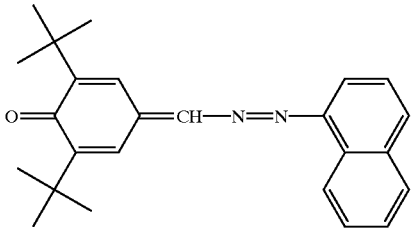
(ET4-17)
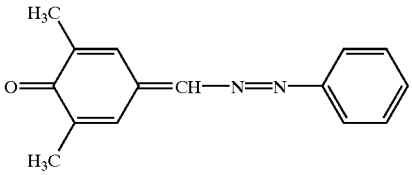
(ET4-18)
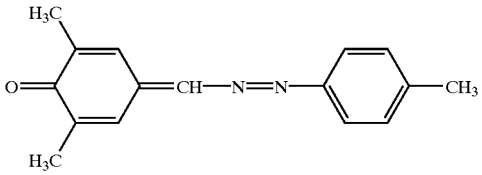

-continued
(ET4-19)
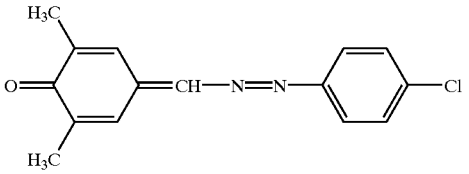
(ET4-20)
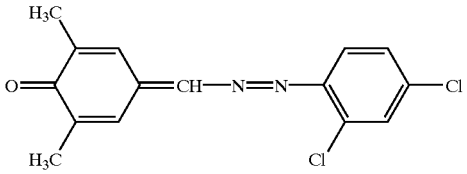
(ET4-21)
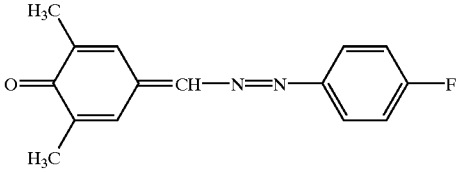
(ET4-22)
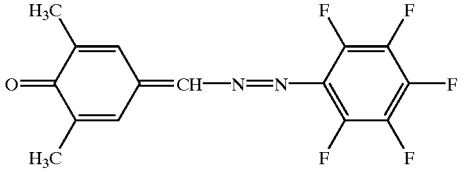
(ET4-23)
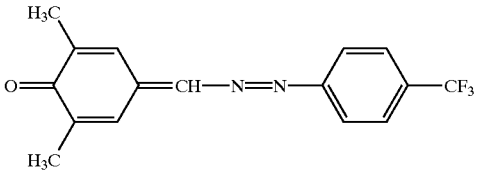
(ET4-24)
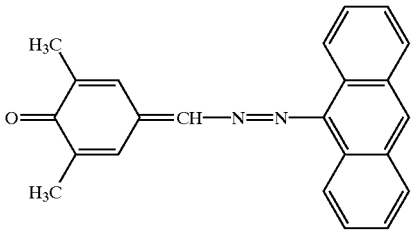
(ET4-25)
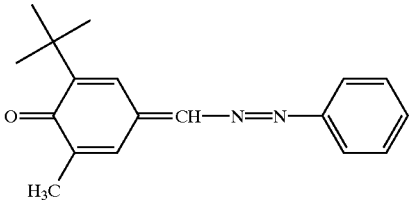
(ET4-26)
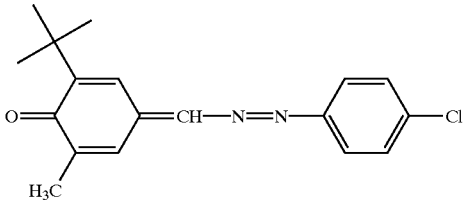
(ET4-27)
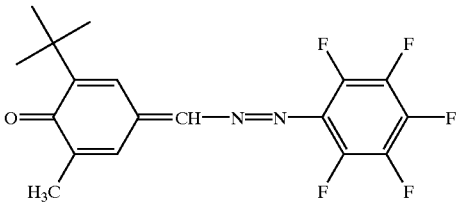
(ET4-28)
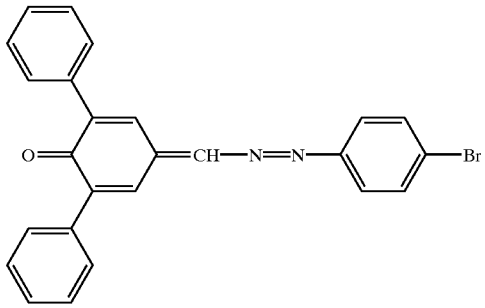
(ET4-29)
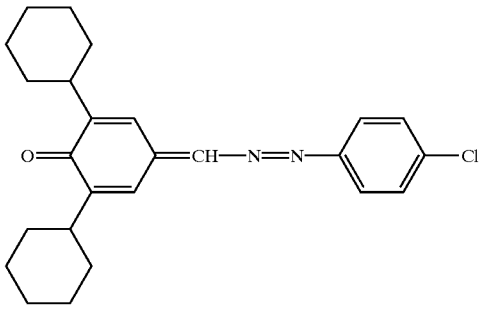
(ET4-30)
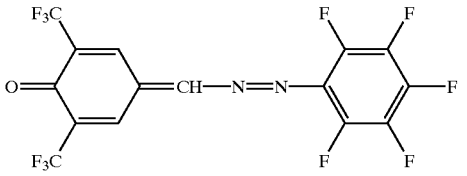
(ET4-31)
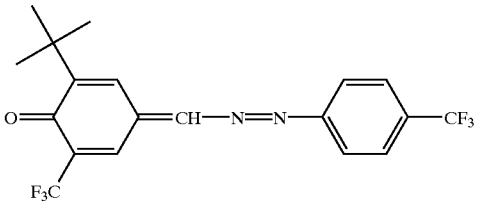
(ET4-32)
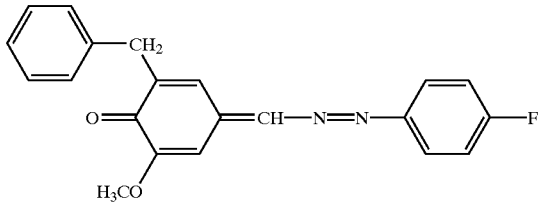

-continued
(ET5-1)
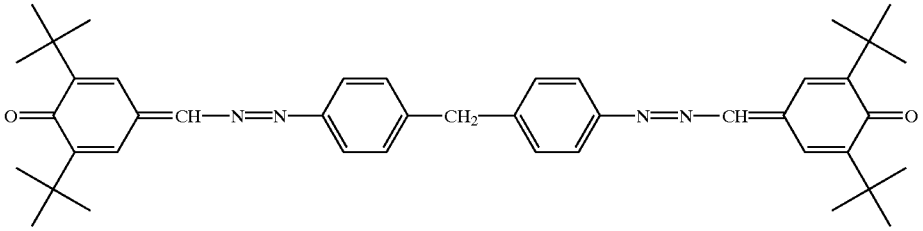
(ET5-2)
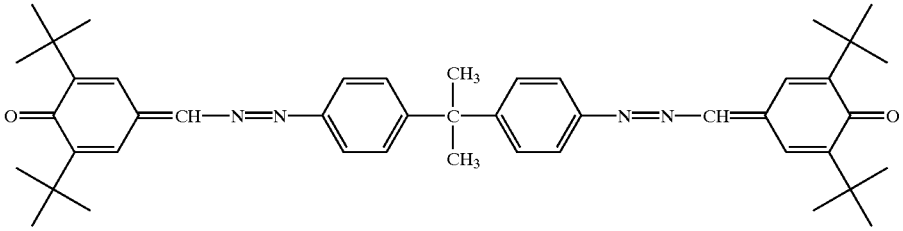
(ET5-3)
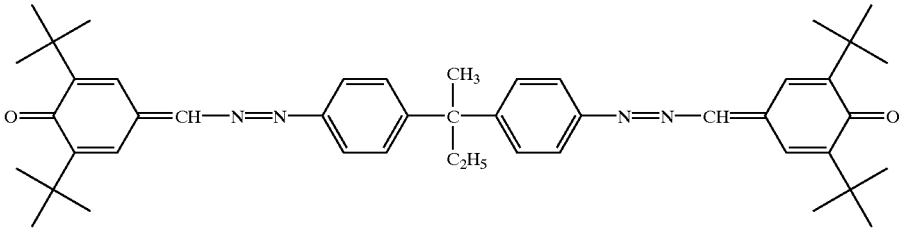
(ET5-4)
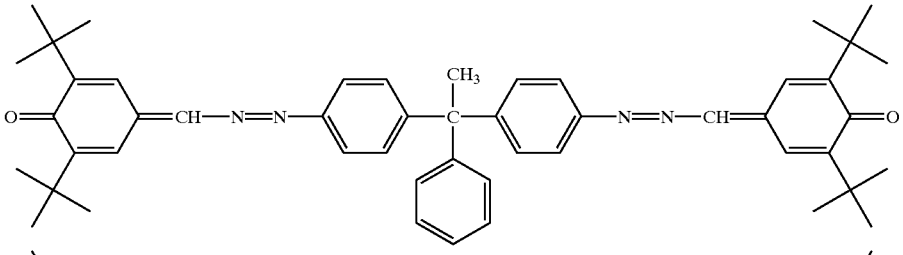
(ET5-5)
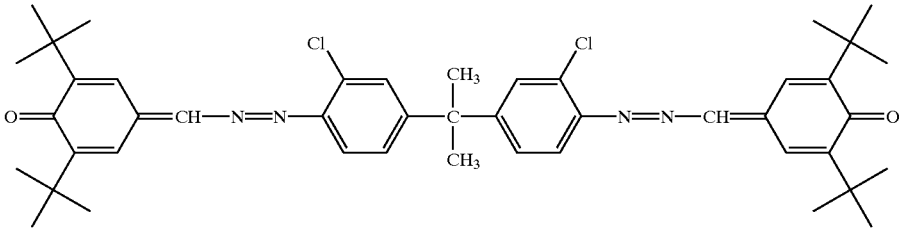
(ET5-6)
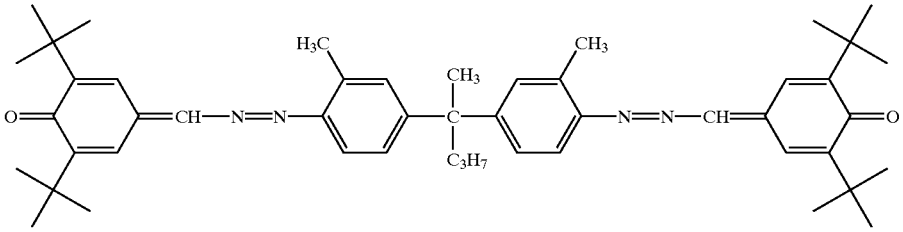
(ET5-7)
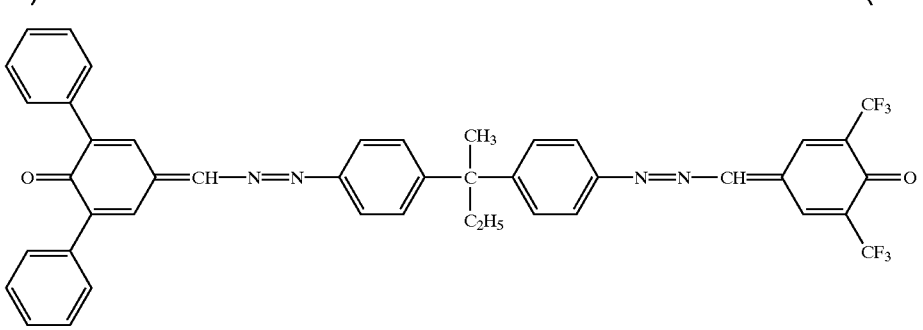

-continued
(ET5-8)
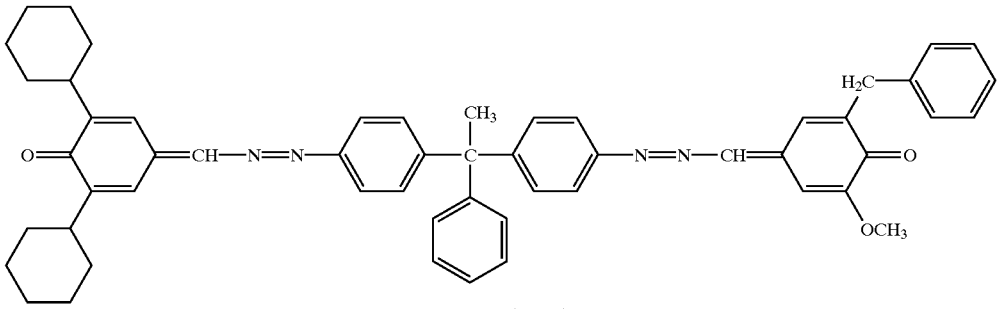
(ET6-1)
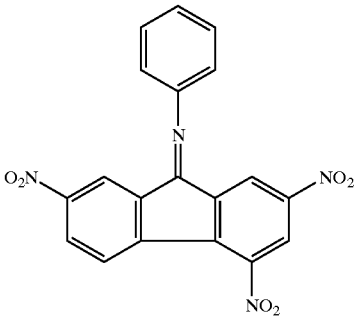
(ET6-2)
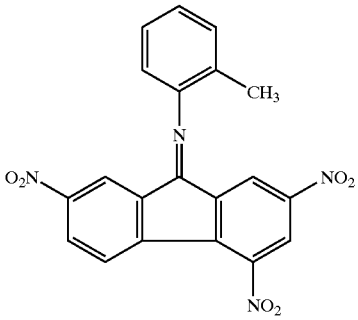
(ET6-3)
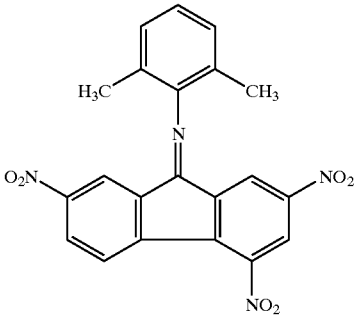
(ET6-4)
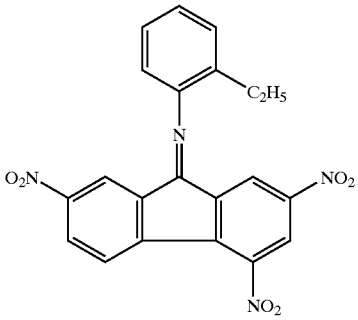
(ET6-5)
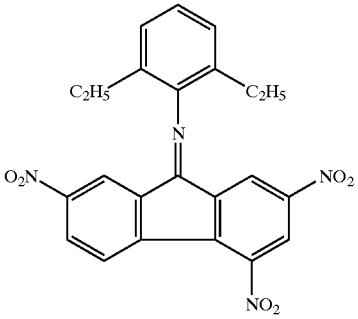
(ET6-6)
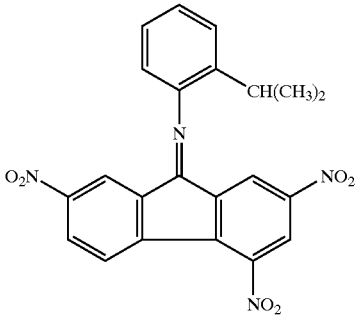
(ET6-7)
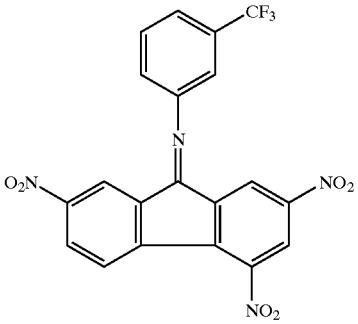
(ET6-8)
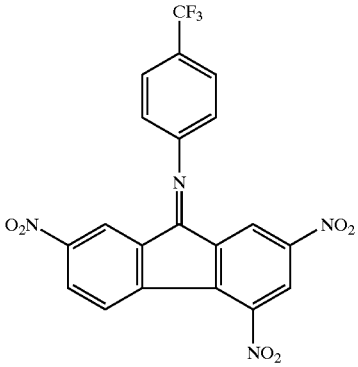

-continued
(ET6-9)
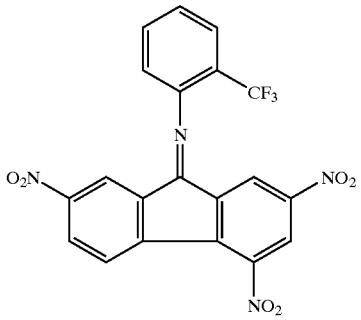
(ET6-10)
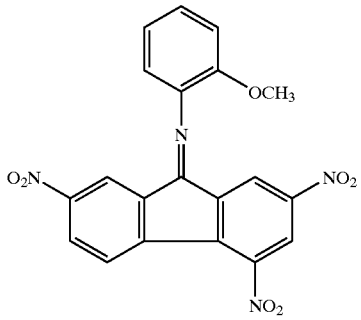
(ET6-11)
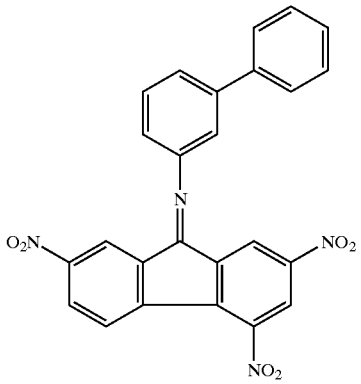
(ET6-12)
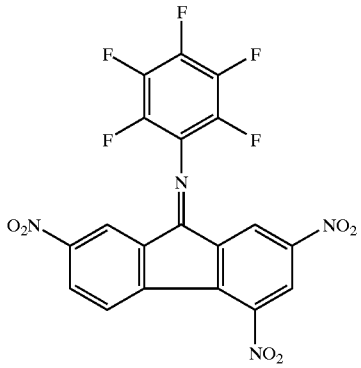
(ET6-13)
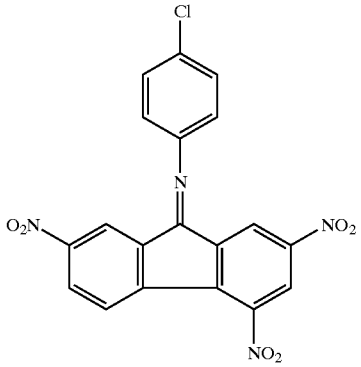
(ET6-14)
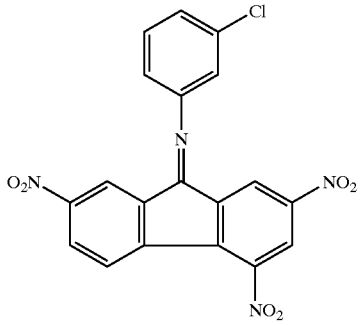
(ET6-15)
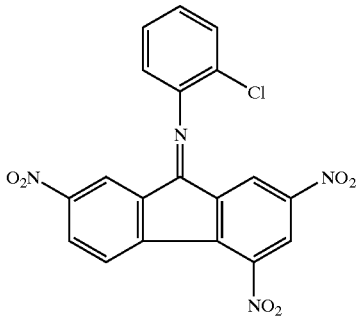
(ET6-16)
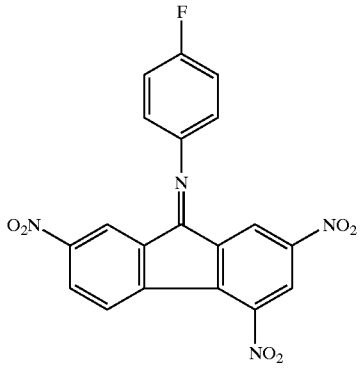

-continued
(ET6-17)
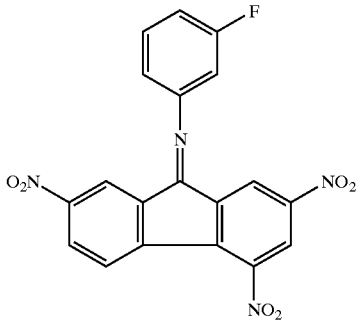
(ET6-18)
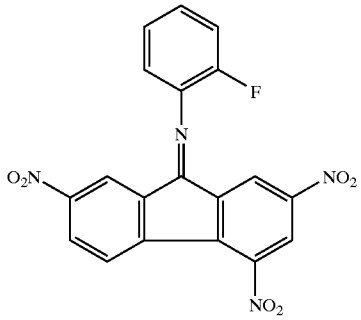
(ET6-19)
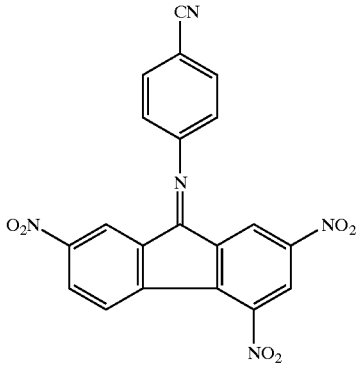
(ET6-20)
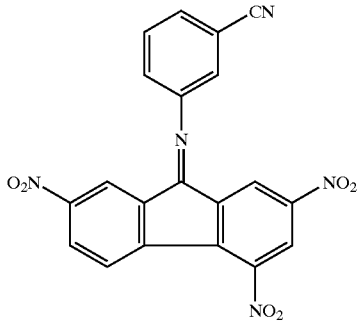
(ET6-21)
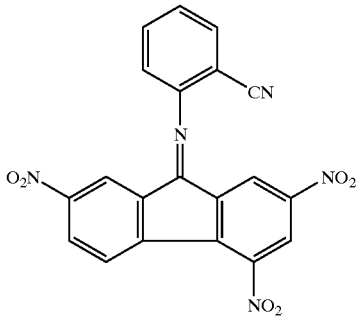
(ET6-22)
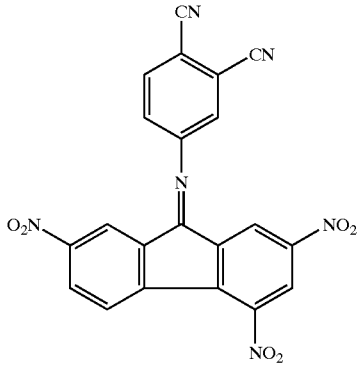
(ET6-23)
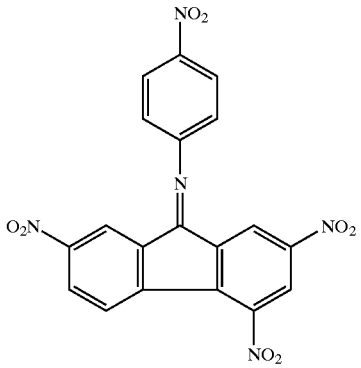
(ET6-24)
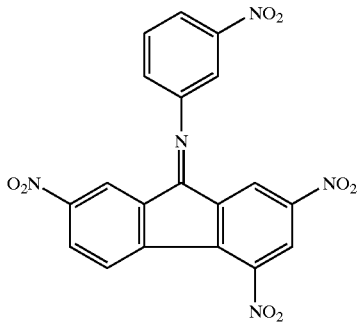

-continued
(ET6-25)
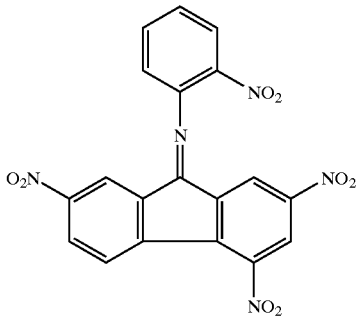
(ET6-26)
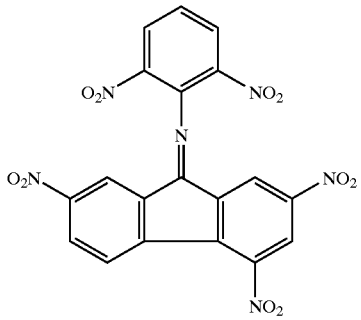
(ET6-27)
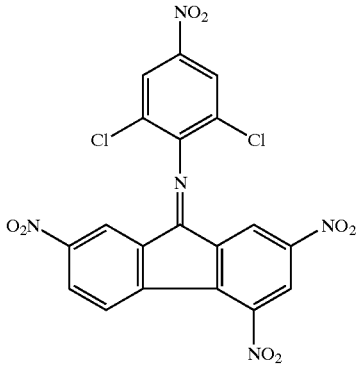
(ET6-28)
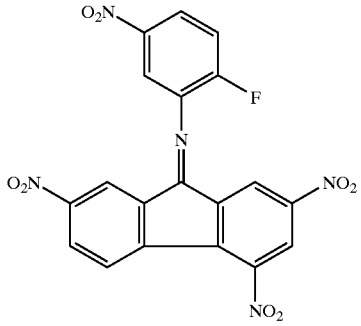
(ET6-29)
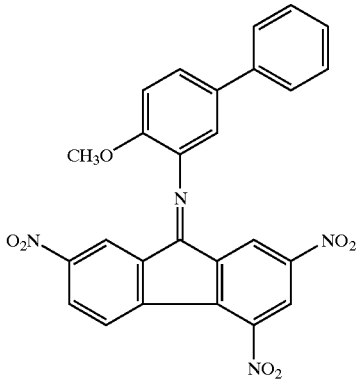
(ET6-30)
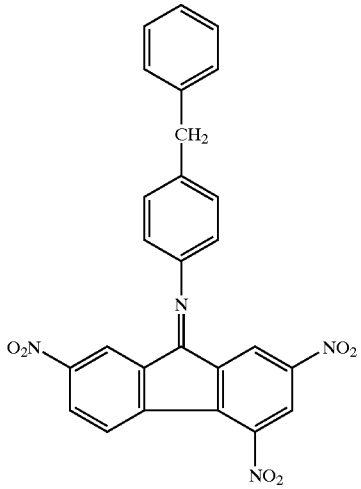
(ET6-31)
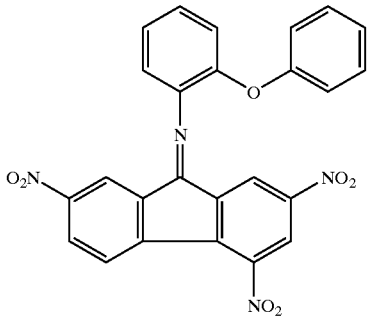
(ET6-32)
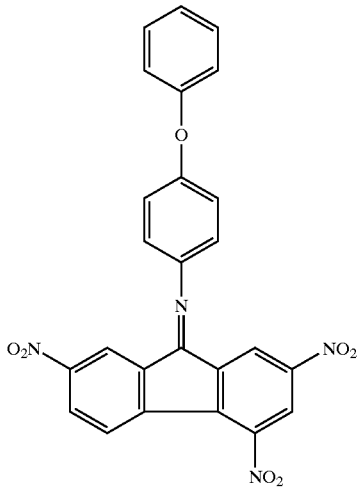

-continued
(ET6-33)
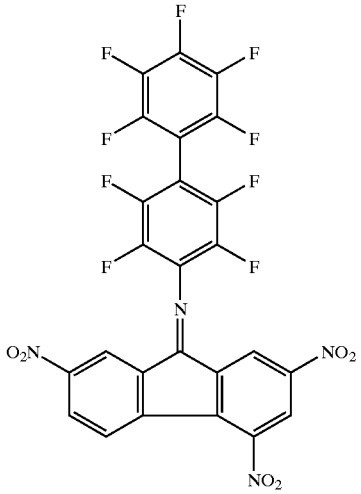
(ET6-34)
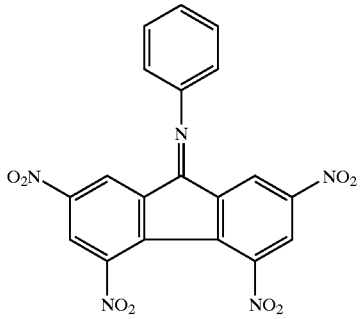
(ET6-35)
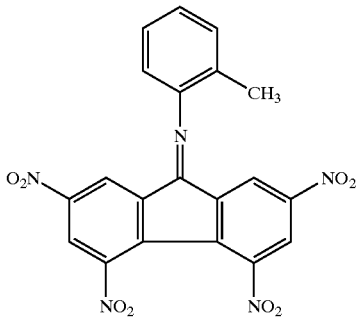
(ET6-36)
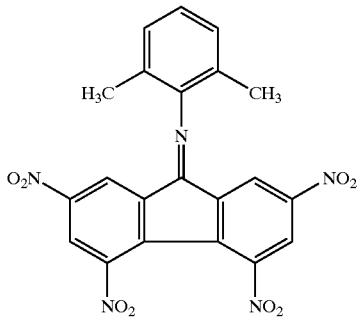
(ET6-37)
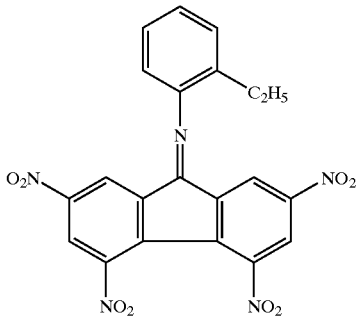
(ET6-38)
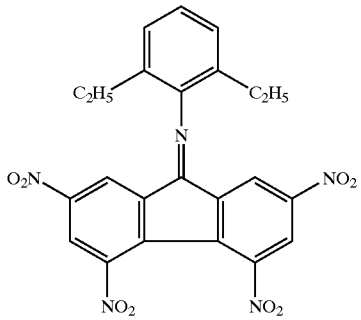
(ET6-39)
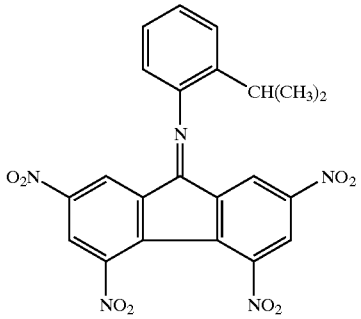
(ET6-40)
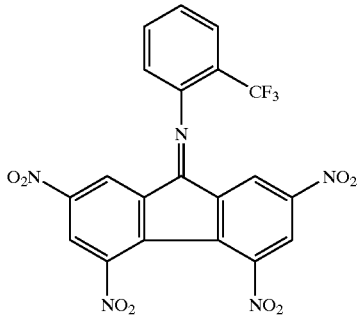

-continued
(ET6-41)
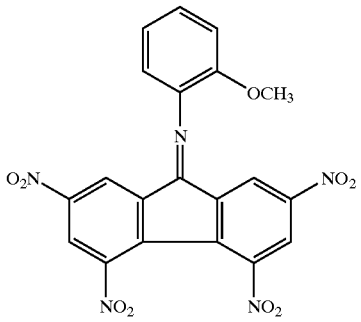
(ET6-42)
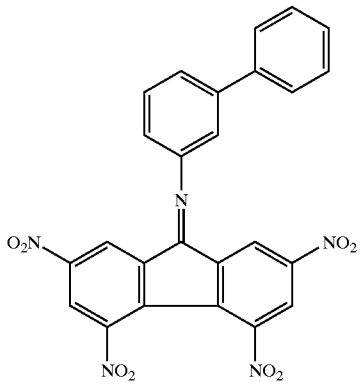
(ET6-43)
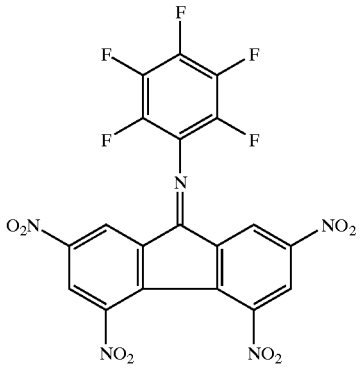
(ET6-44)
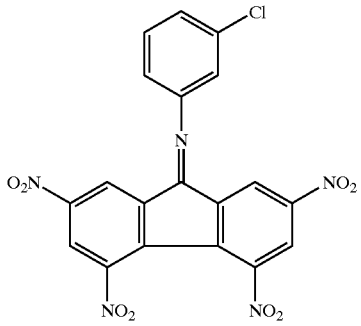
(ET6-45)
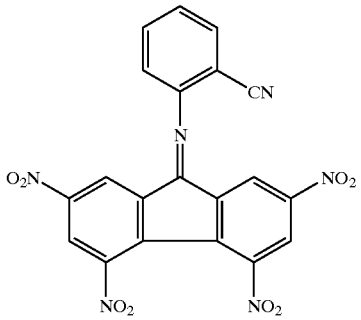
(ET6-46)
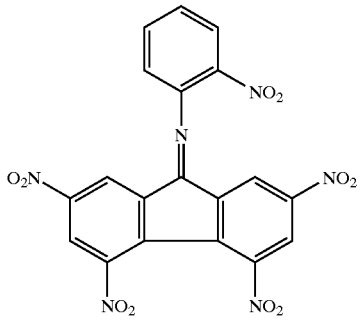
(ET6-47)
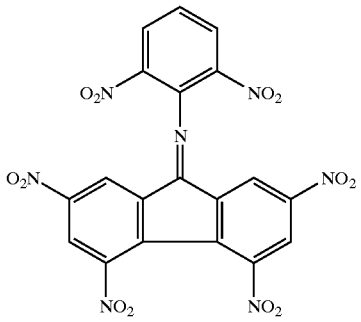
(ET6-48)
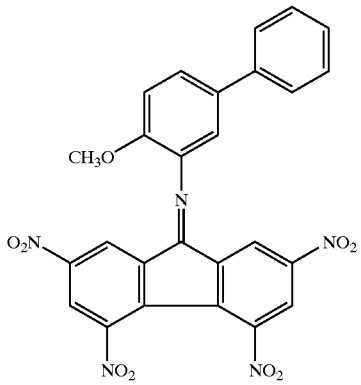

-continued
(ET6-49)
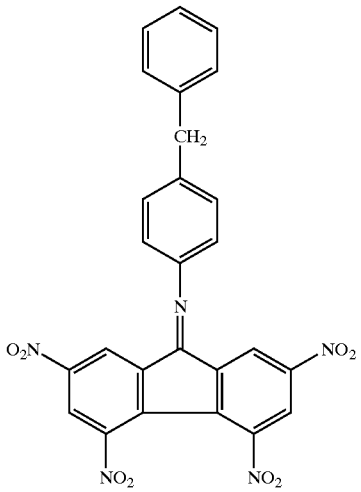
(ET6-50)
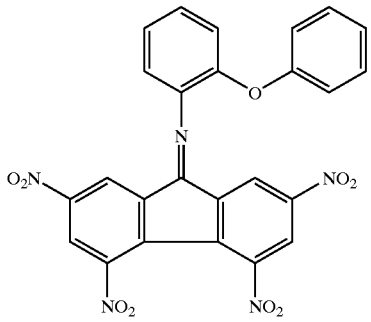
(ET7-1)
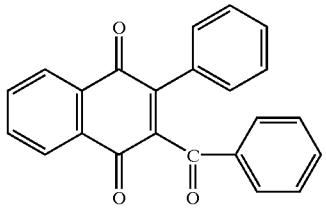
(ET7-2)
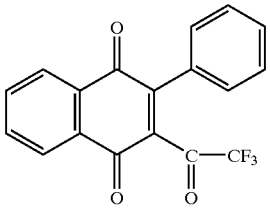
(ET7-3)
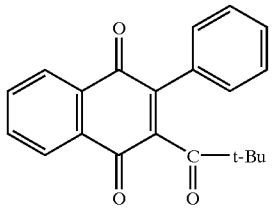
(ET7-4)
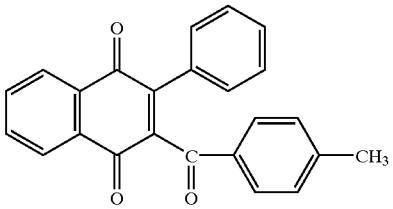
(ET7-5)
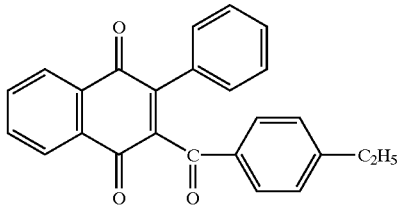
(ET7-6)
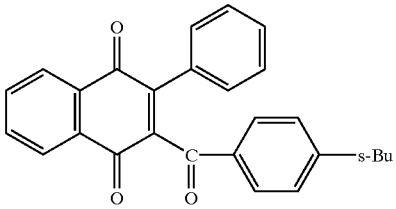
(ET7-7)
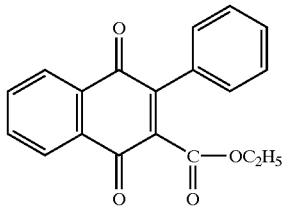
(ET7-8)
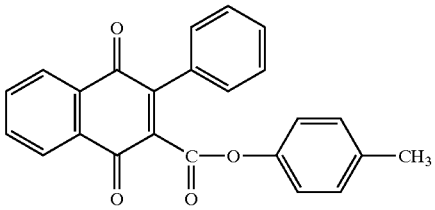
(ET7-9)
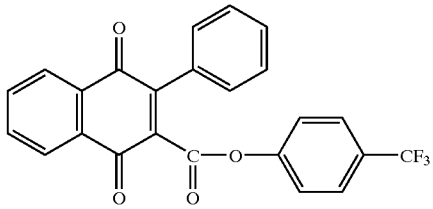
(ET7-10)
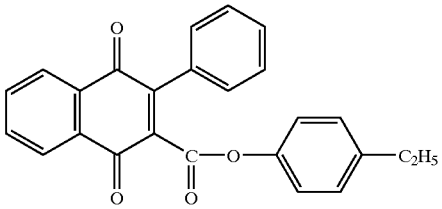

-continued
(ET7-11)
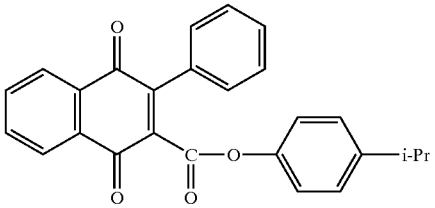
(ET7-12)
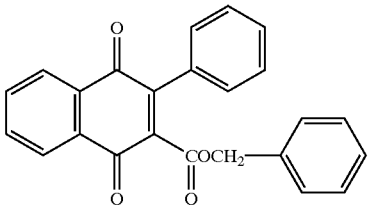
(ET7-13)
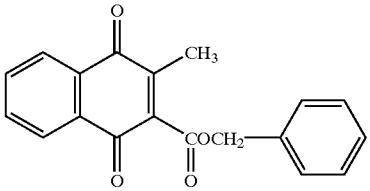
(ET7-14)
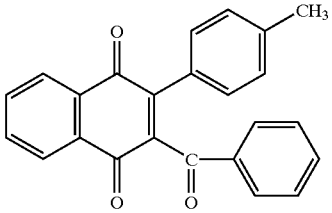
(ET8-1)
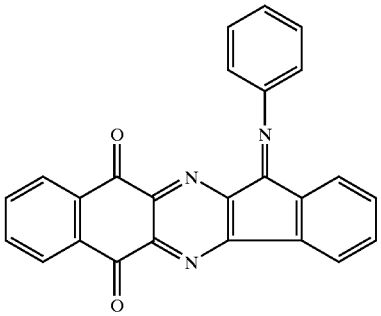
(ET8-2)
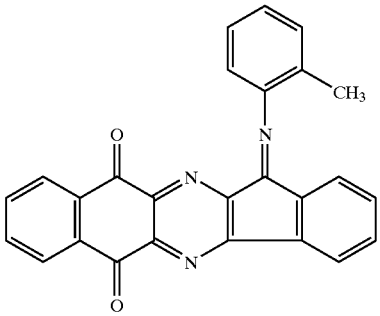
(ET8-3)
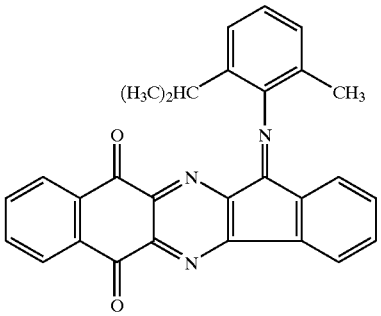
(ET8-4)
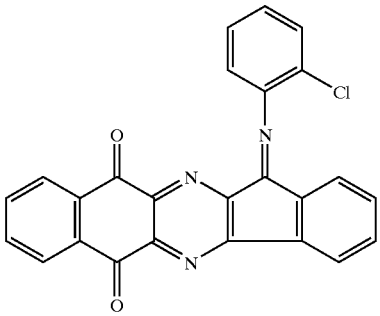
(ET8-5)
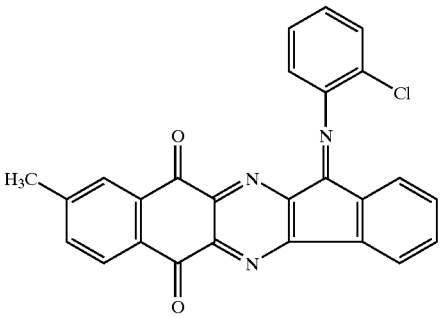
(ET8-6)
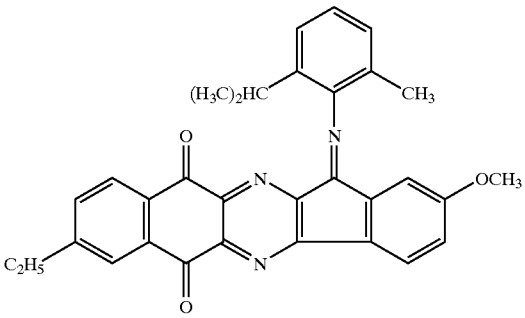
(ET9-1)
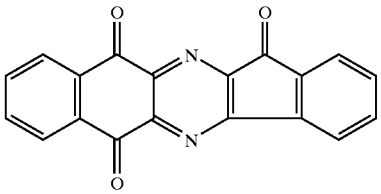
(ET9-2)
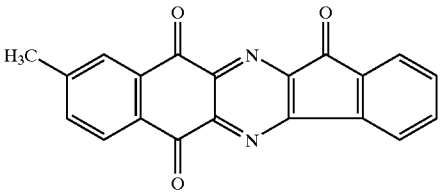

-continued
(ET9-3)
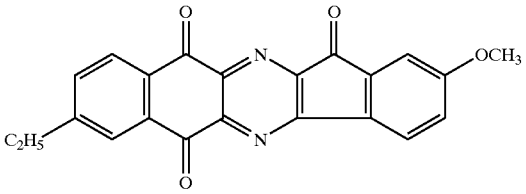
(ET9-4)
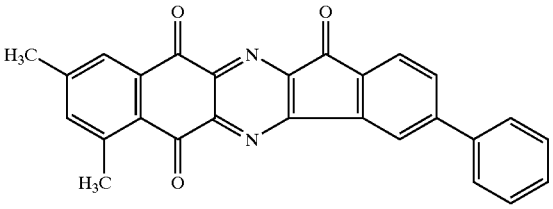
(ET10-1)
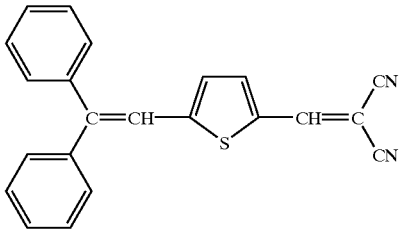
(ET10-2)
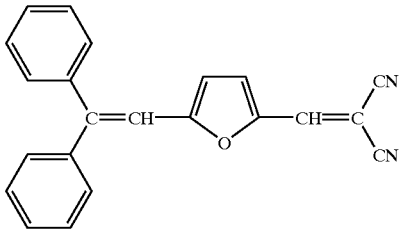
(ET10-3)
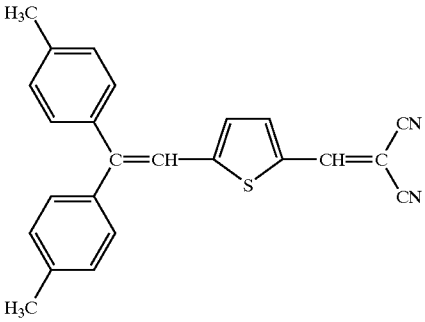
(ET10-4)
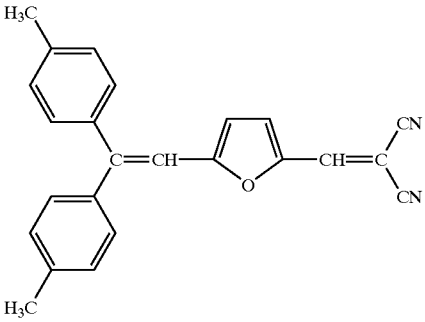
(ET10-5)
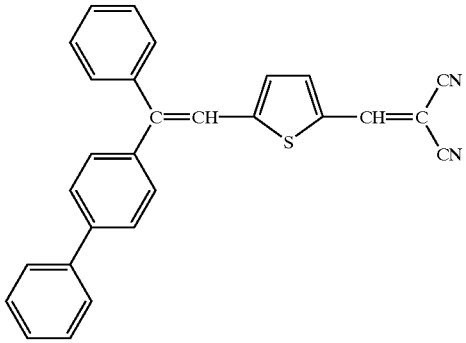
(ET10-6)
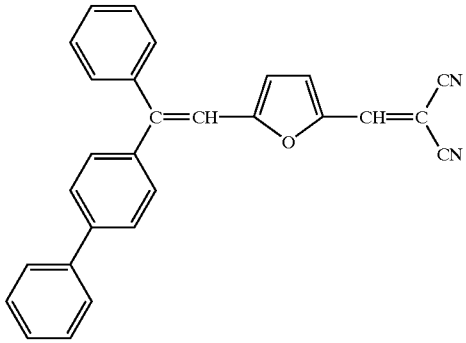
(ET10-7)
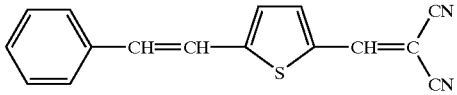
(ET10-8)
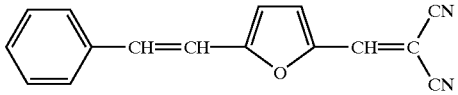
(ET10-9)
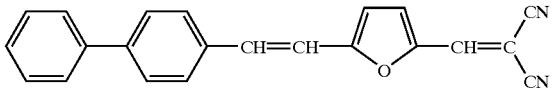
(ET10-10)
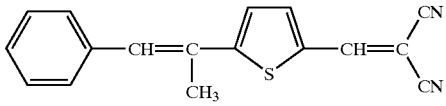
(ET10-11)
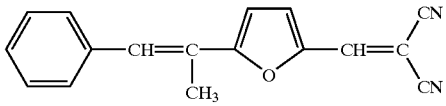
(ET10-12)
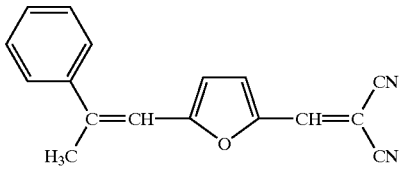

-continued
(ET10-13)
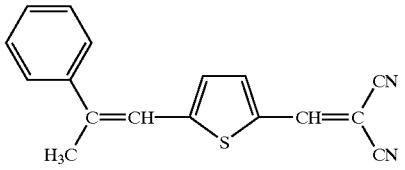
(ET10-14)
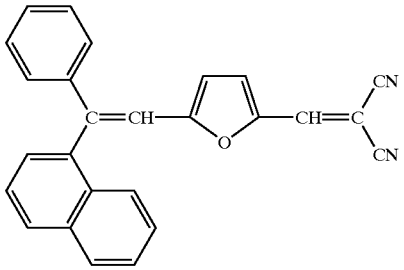
(ET10-15)
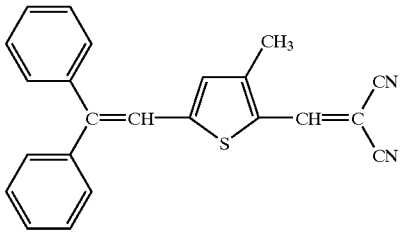
(ET10-16)
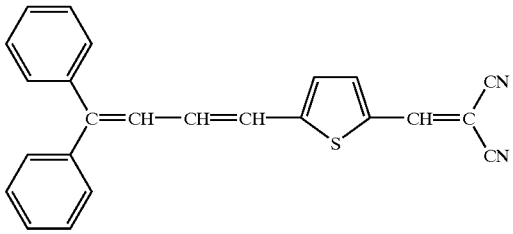
(ET10-17)
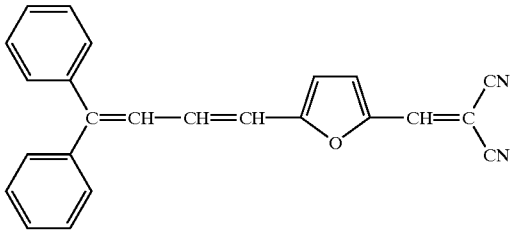
(ET10-18)
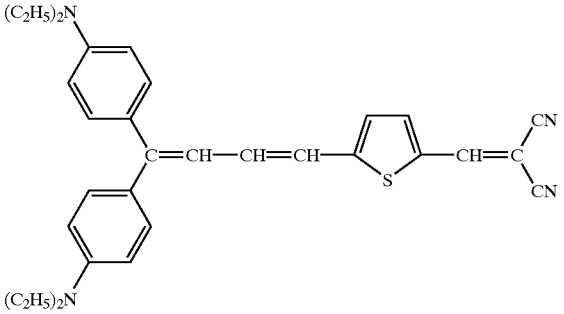
(ET10-19)
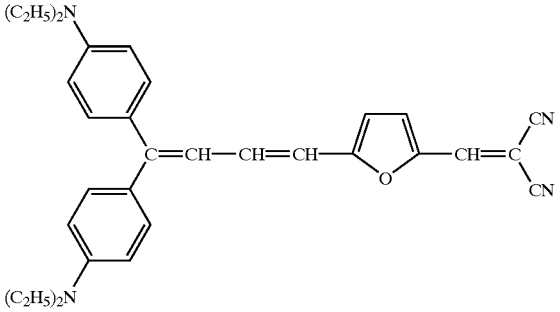
(ET10-20)
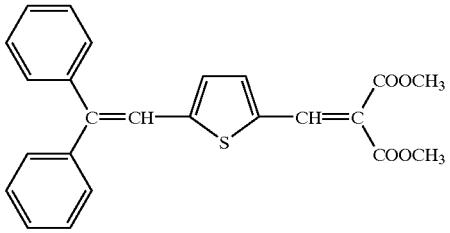
(ET10-21)
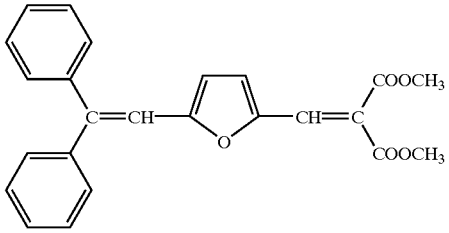
(ET10-22)
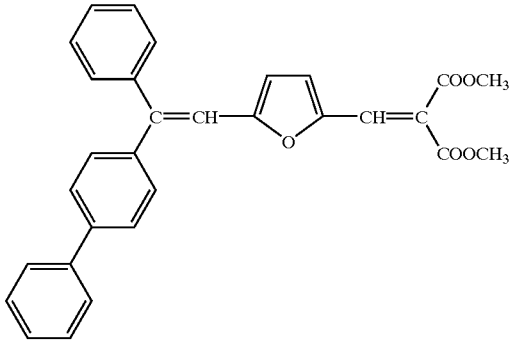

-continued
(ET10-23)
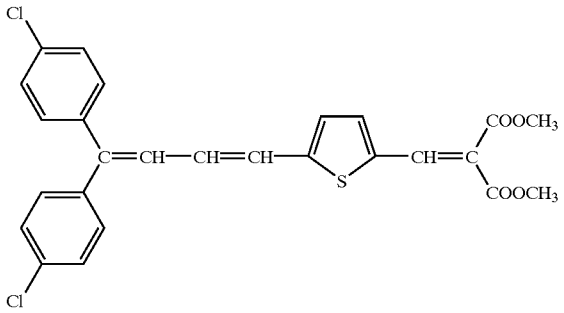
(ET10-24)
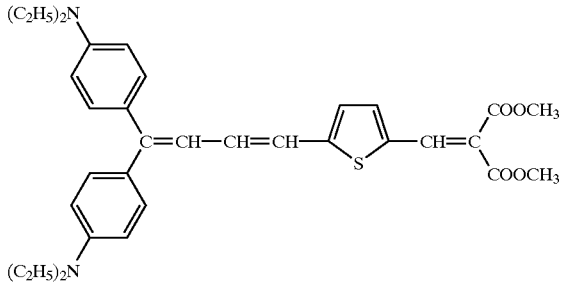
(ET10-25)
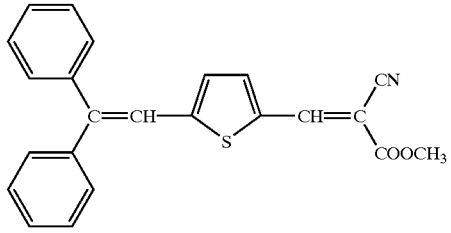
(ET10-26)
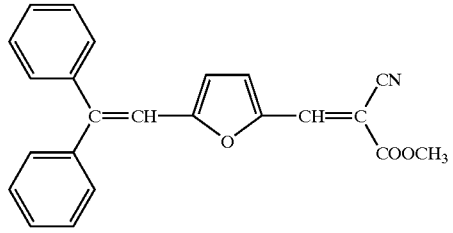
(ET10-27)
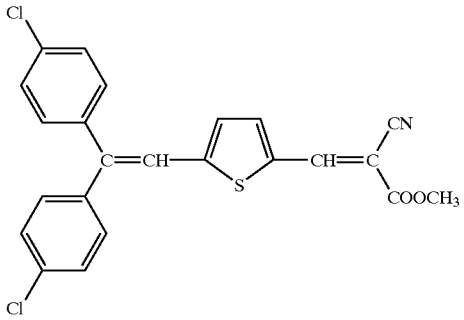
(ET10-28)
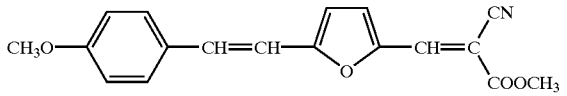
(ET10-29)
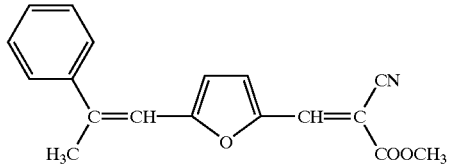
(ET10-30)
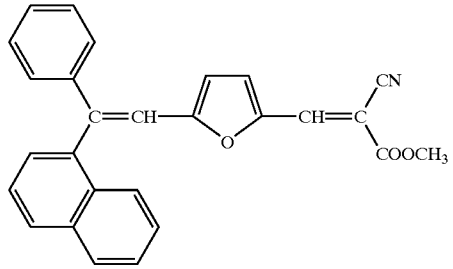
(ET10-31)
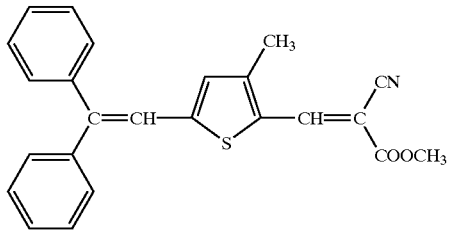
(ET10-32)
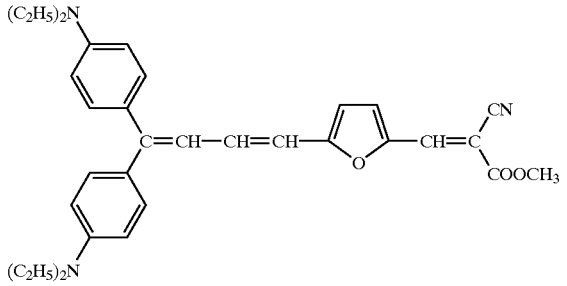

-continued
(ET11-1)
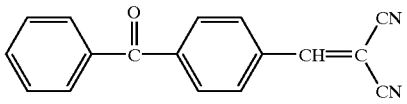
(ET11-2)
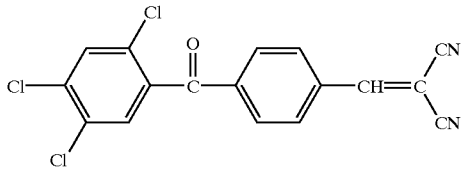
(ET11-3)
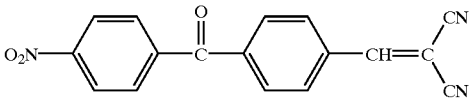
(ET11-4)
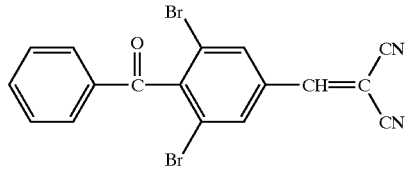
(ET11-5)
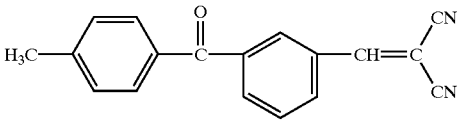
(ET11-6)
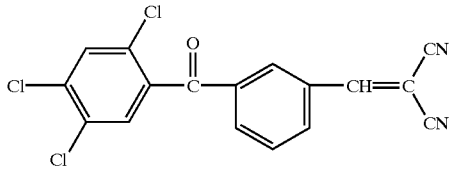
(ET11-7)
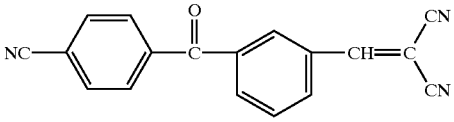
(ET11-8)
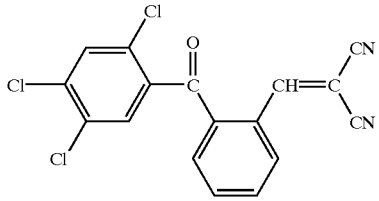
(ET11-9)
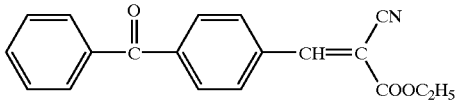
(ET11-10)
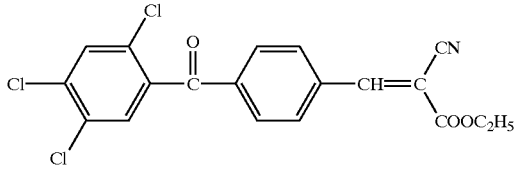
(ET11-11)
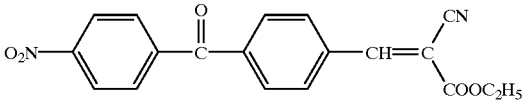
(ET11-12)
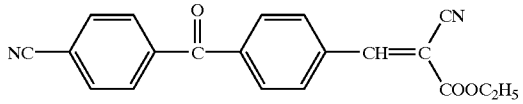
(ET11-13)
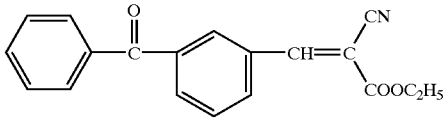
(ET11-14)
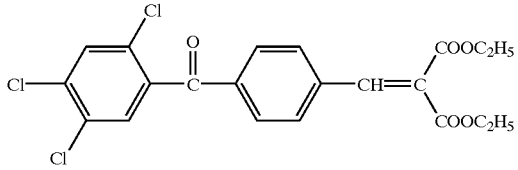
(ET11-15)
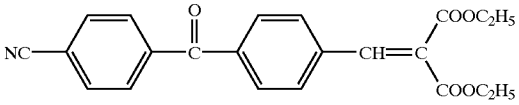
(ET11-16)
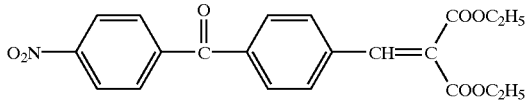
(ET12-1)
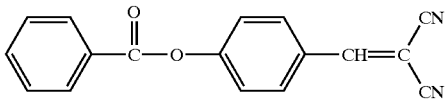
(ET12-2)
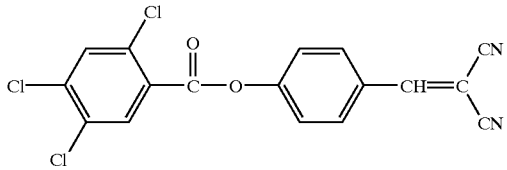

-continued
(ET12-3)
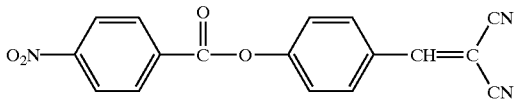
(ET12-4)
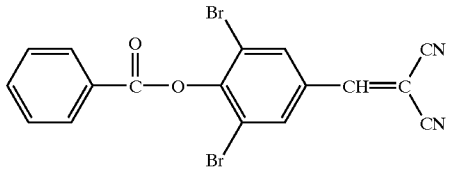
(ET12-5)
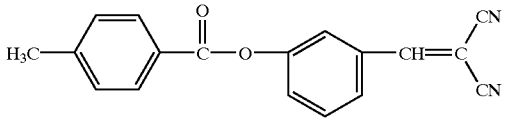
(ET12-6)
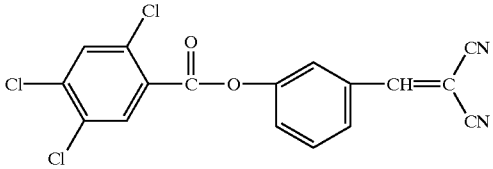
(ET12-7)
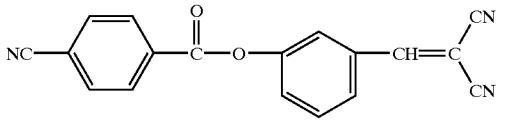
(ET12-8)
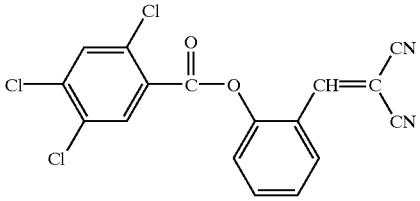
(ET12-9)
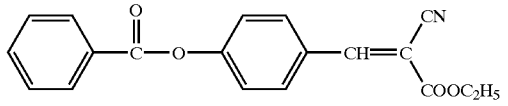
(ET12-10)
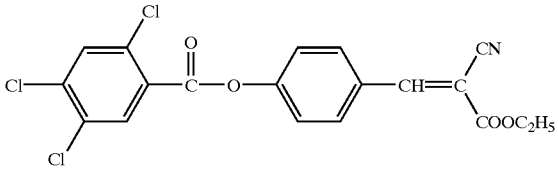
(ET12-11)
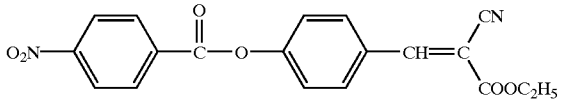
(ET12-12)
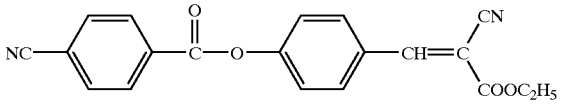
(ET12-13)
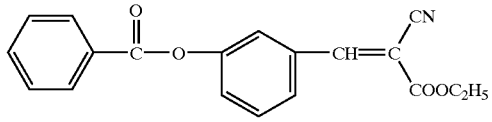
(ET12-14)
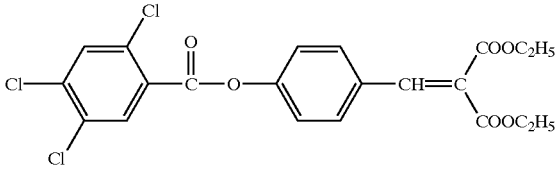
(ET12-15)
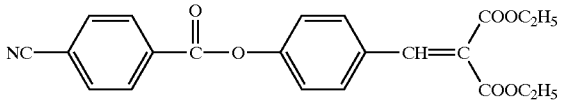
(ET12-16)
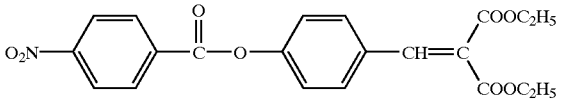
(ET13-1)
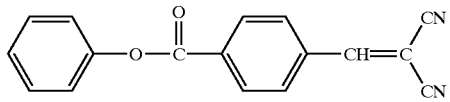
(ET13-2)
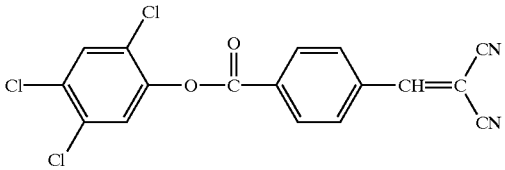

-continued
(ET13-3)
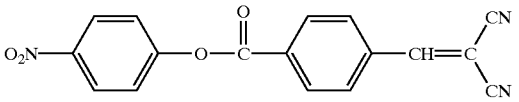
(ET13-4)
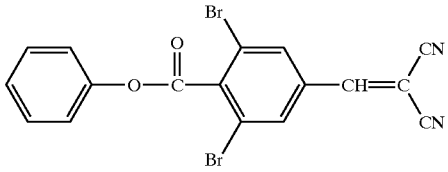
(ET13-5)
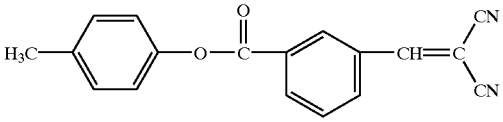
(ET13-6)
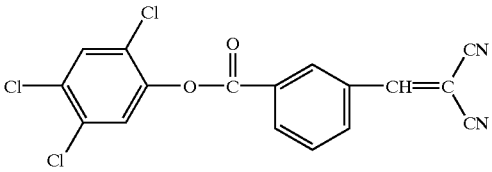
(ET13-7)
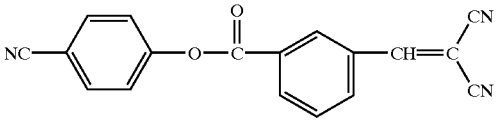
(ET13-8)
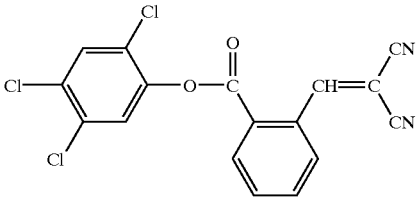
(ET13-9)
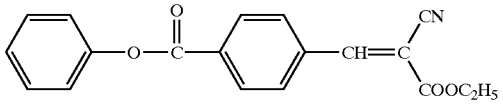
(ET13-10)
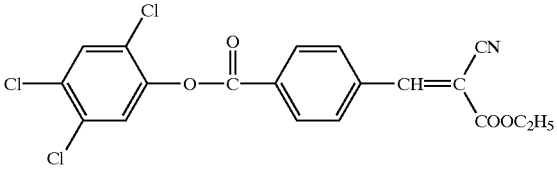
(ET13-11)
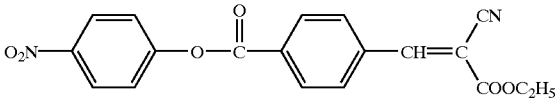
(ET13-12)
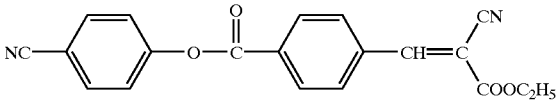
(ET13-13)
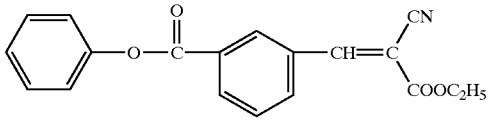
(ET13-14)
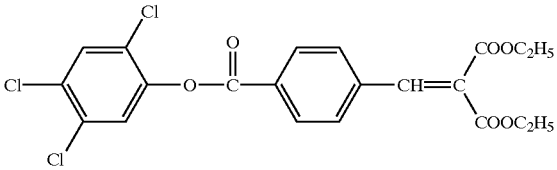
(ET13-15)
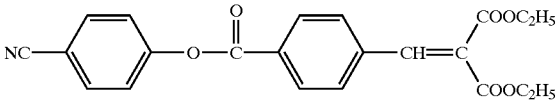
(ET13-16)
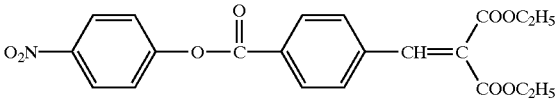
(ET14-1)
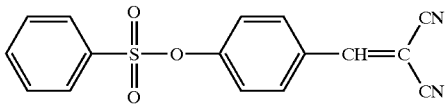
(ET14-2)
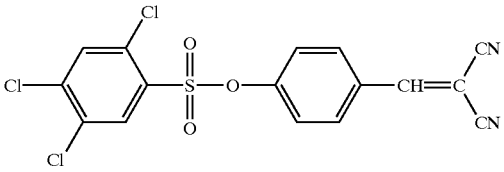

-continued
(ET14-3)
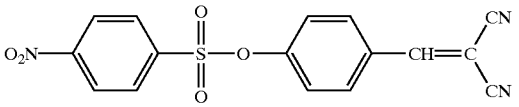
(ET14-4)
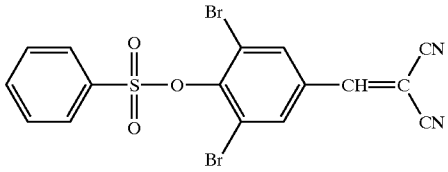
(ET14-5)
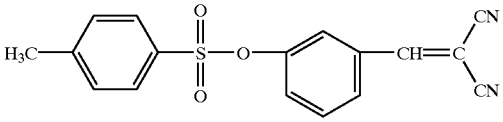
(ET14-6)
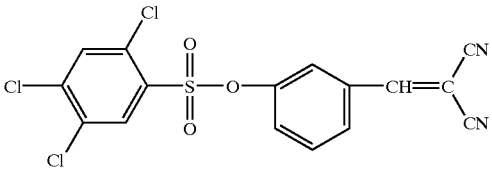
(ET14-7)
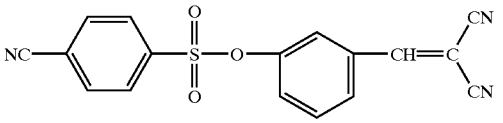
(ET14-8)
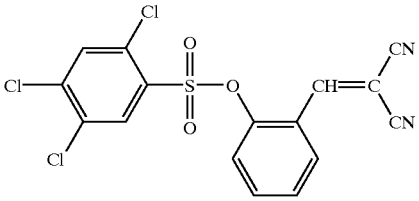
(ET14-9)
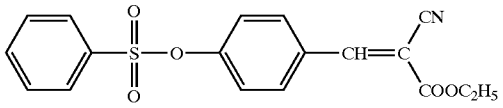
(ET14-10)
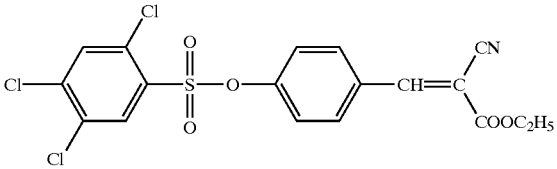
(ET14-11)
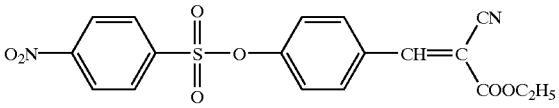
(ET14-12)
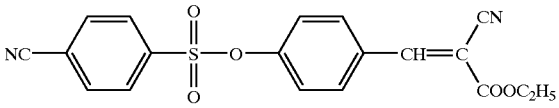
(ET14-13)
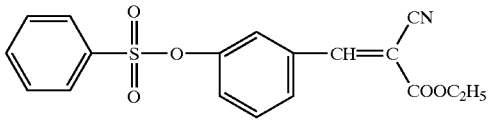
(ET14-14)
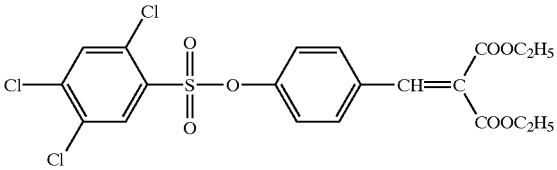
(ET14-15)
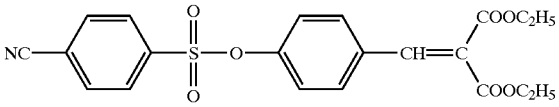
(ET14-16)
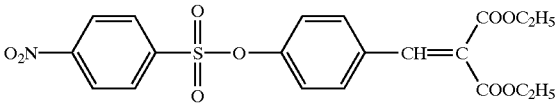
(ET15-1)
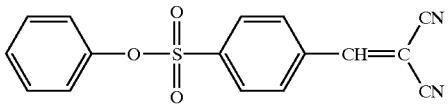
(ET15-2)
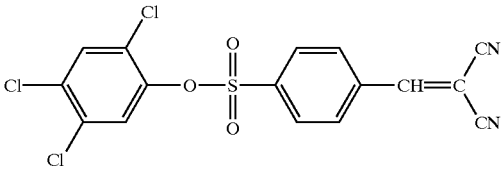

-continued
(ET15-3)
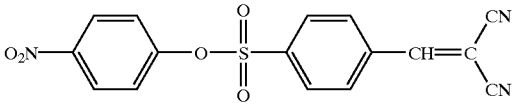
(ET15-4)
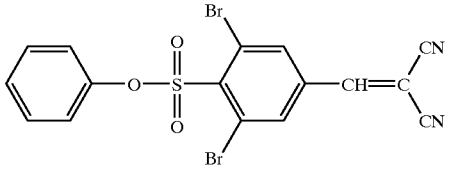
(ET15-5)
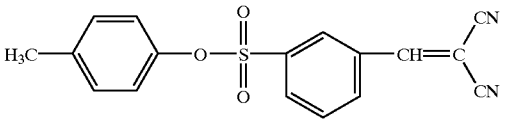
(ET15-6)
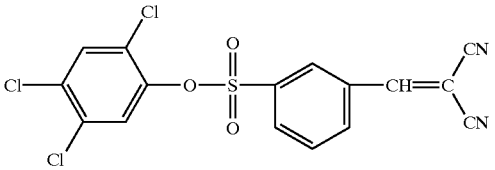
(ET15-7)
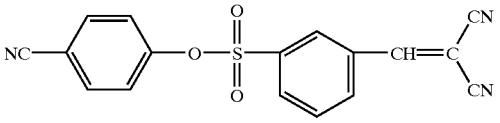
(ET15-8)
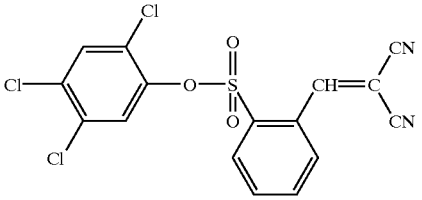
(ET15-9)
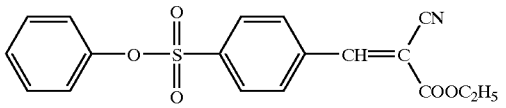
(ET15-10)
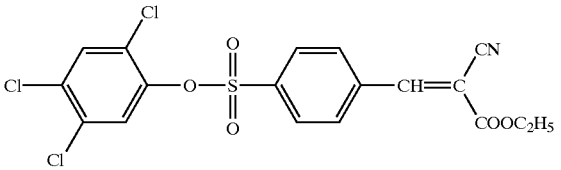
(ET15-11)
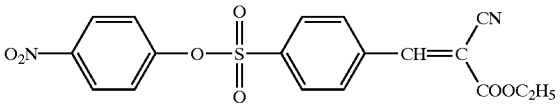
(ET15-12)
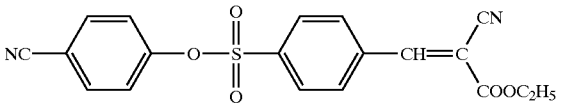
(ET15-13)
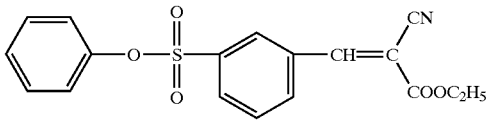
(ET15-14)
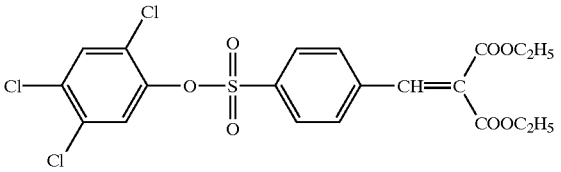
(ET15-15)
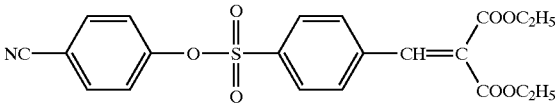
(ET15-16)
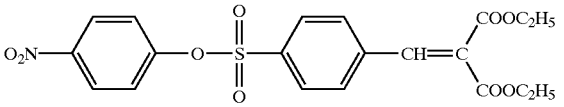
(ET-1)
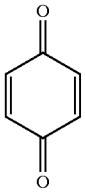
(ET-2)
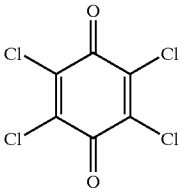

-continued
(ET-3)
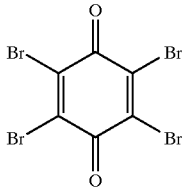
(ET-4)
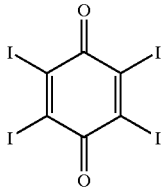
(ET-5)
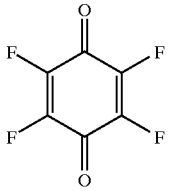
(ET-6)
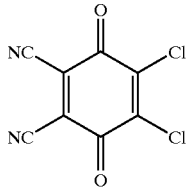
(ET-7)
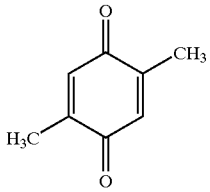
(ET-8)
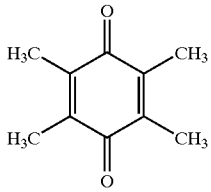
(ET-9)
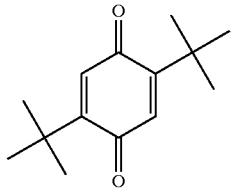
(ET-10)
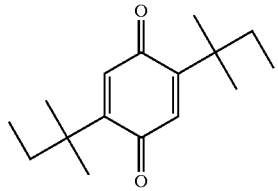
(ET-11)
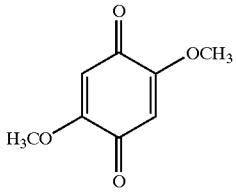
(ET-12)
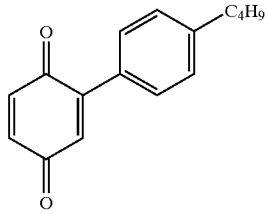
(ET-13)
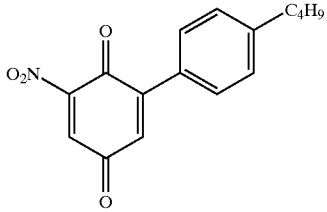
(ET-14)
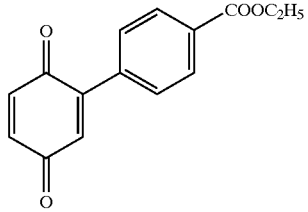
(ET-15)
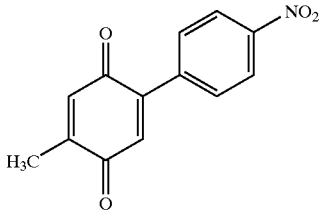
(ET-16)
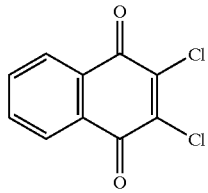

-continued
(ET-17)
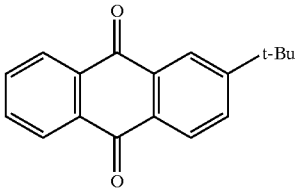
(ET-18)
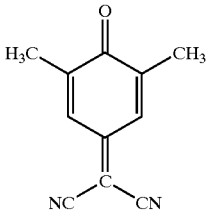
(ET-19)
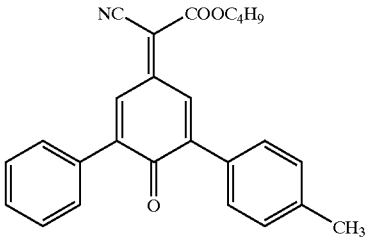
(ET-20)
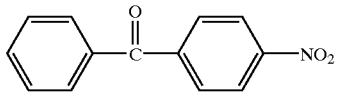
(ET-21)
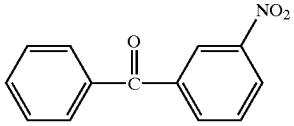
(ET-22)
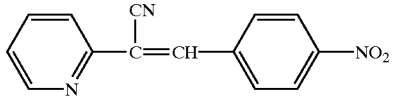
(ET-23)
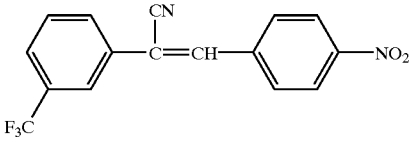
(ET-24)
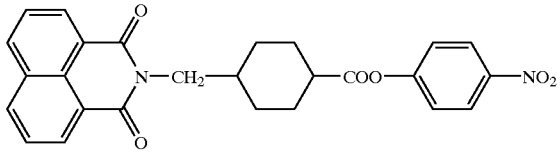
(ET-25)
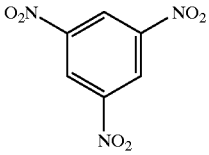
(ET-26)
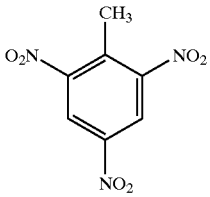
(ET-27)
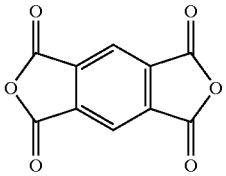
(ET-28)
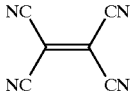
(ET-29)
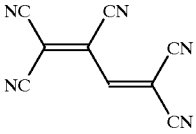
(ET-30)
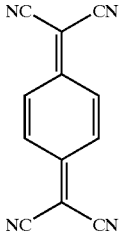

-continued (ET-31)

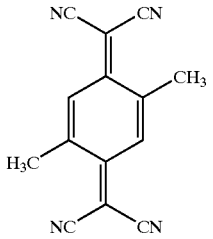

(ET-32)

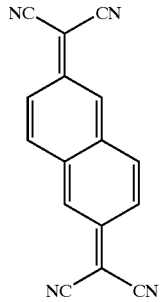

(ET-33)

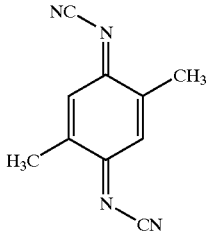

(ET-34)

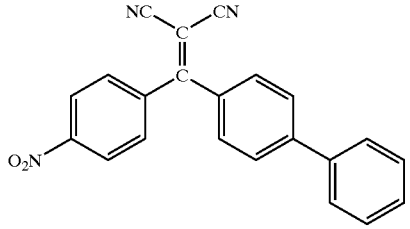

(ET-35)

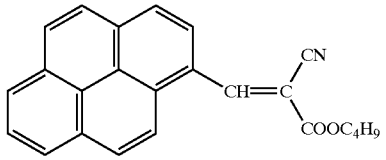

(ET-36)

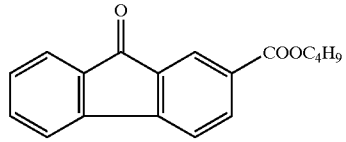

(ET-37)

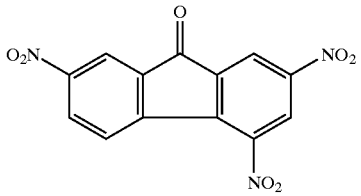

(ET-38)

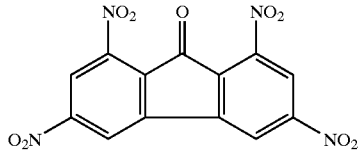

(ET-39)

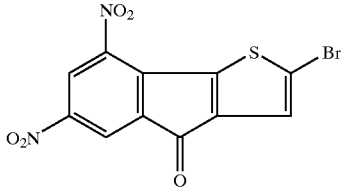

(ET-40)

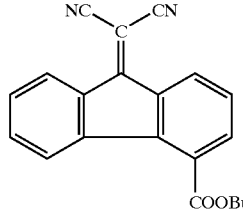

(ET-41)

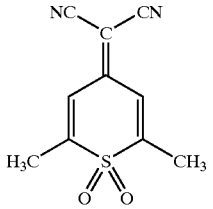

(ET-42)

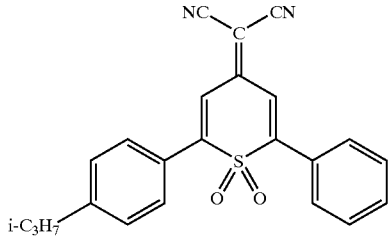

The hole transport substance is preferably selected from the compounds represented by the general formulas (HT1) to (HT5). Other hole transport substances which may be used include a hydrazone compound, a pyrazoline compound, a pyrazolone compound, an oxadiazole compound, an oxazole compound, an arylamine compound, a benzidine compound, a stilbene compound, a styryl compound, polyvinylcarbazole, polysilane, and an appropriate combination of these hole transport substances. The specific compounds represented by the general formulas (HT1) to (HT5) include the compounds represented by the following structural formulas (HT1-1) to (HT5-10). The specific examples of the other hole transport substance include the compounds represented by the following structural formulas (HT-1) to (HT-37), but are not limited to those compounds.

The content of the hole transport substance is in the range from about 5 to about 80 wt. %, preferably from about 10 to about 60 wt. % with respect to the solid component of the photosensitive layer.

(HT1-1)
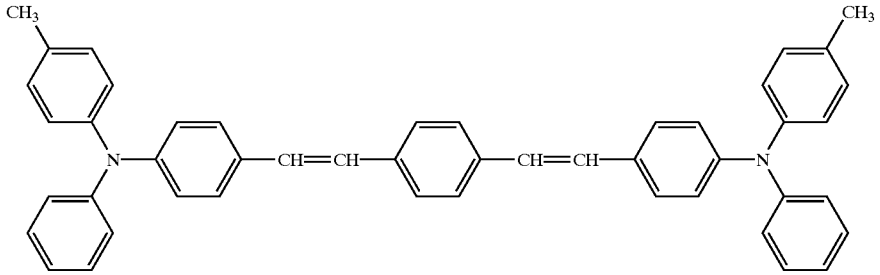
(HT1-2)
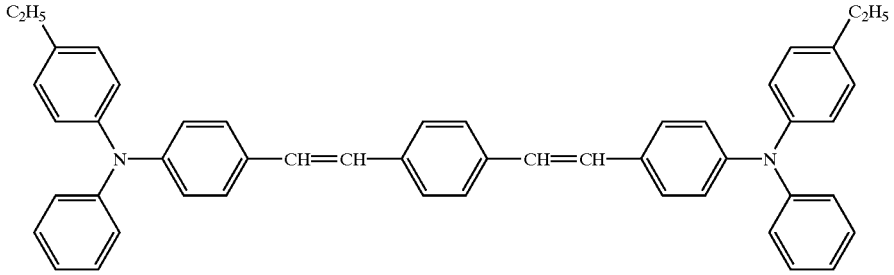
(HT1-3)
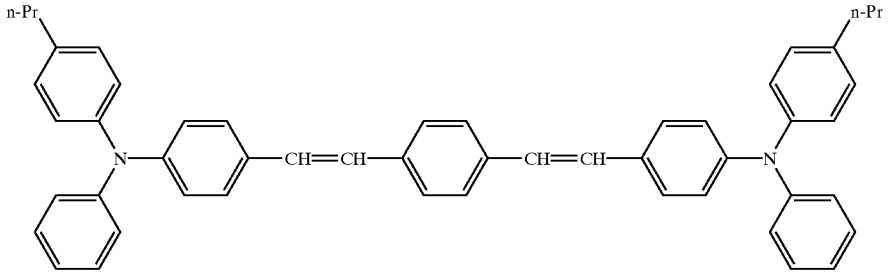
(HT1-4)
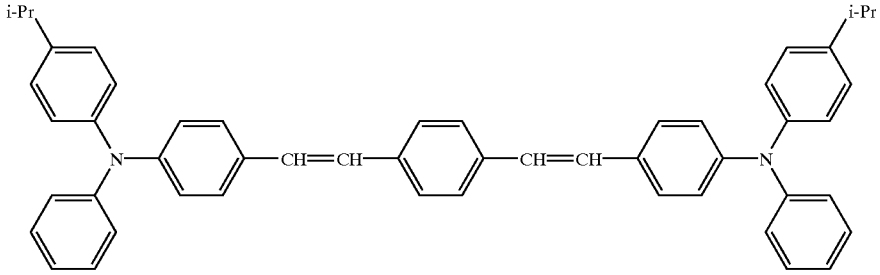
(HT1-5)
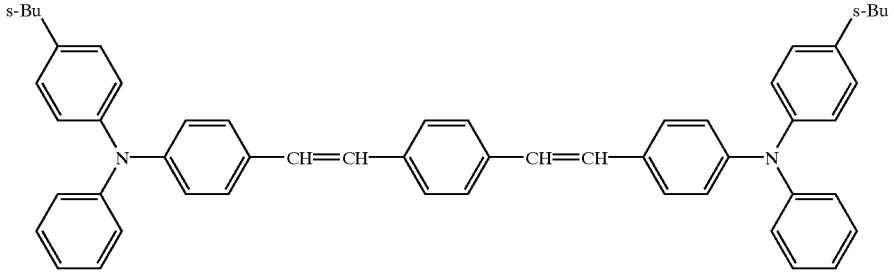

-continued
(HT1-6)
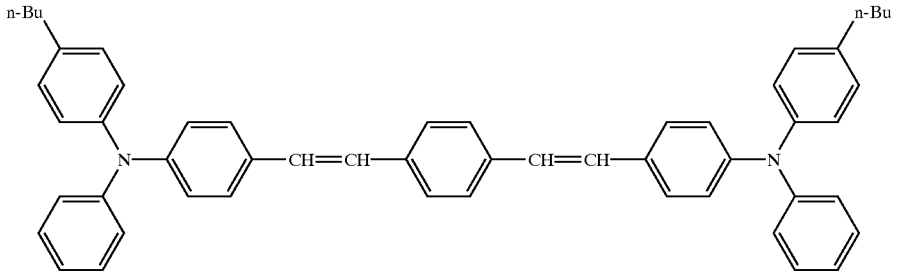
(HT1-7)
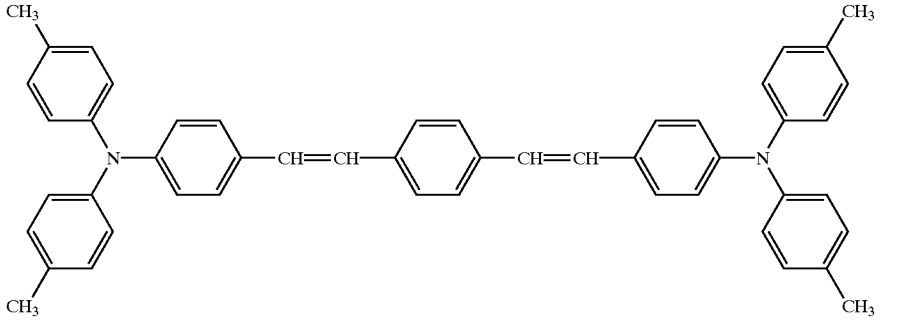
(HT1-8)
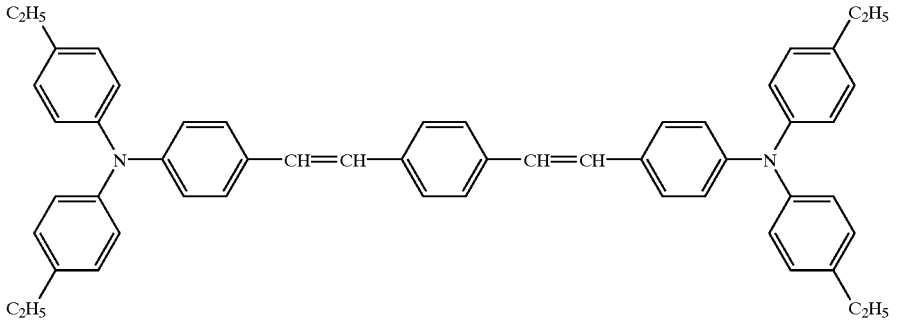
(HT1-9)
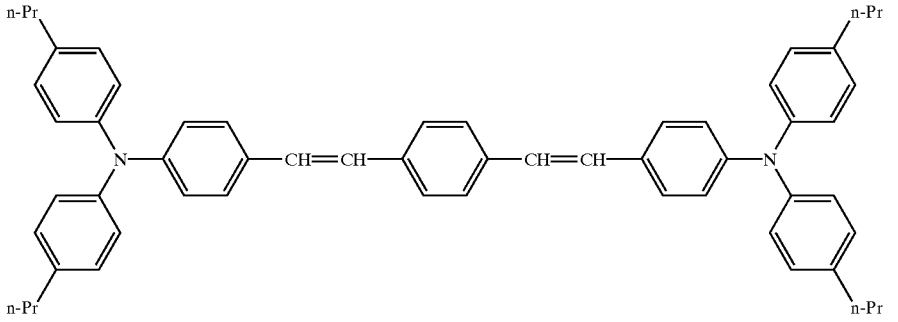
(HT1-10)
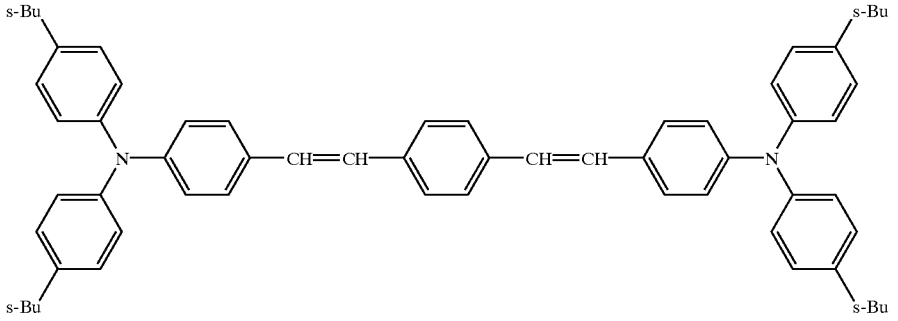

-continued
(HT1-11)
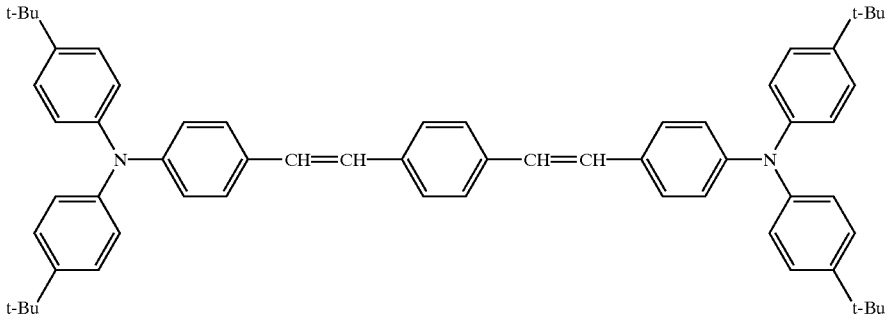
(HT1-12)
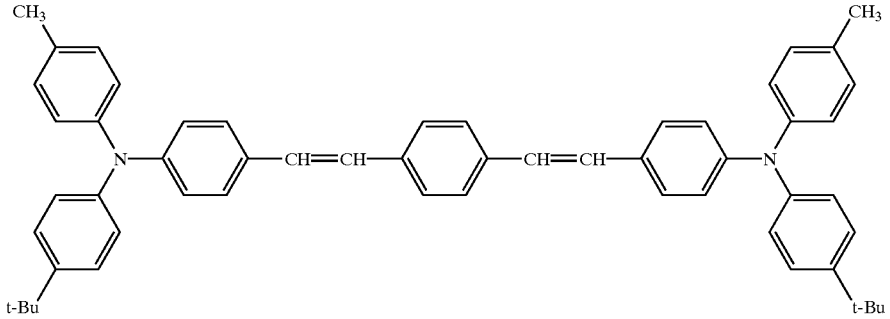
(HT1-13)
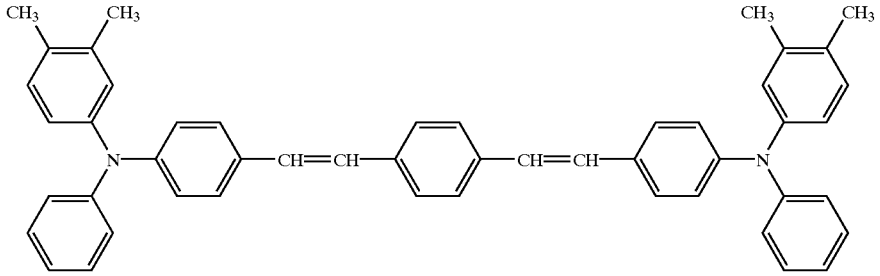
(HT1-14)
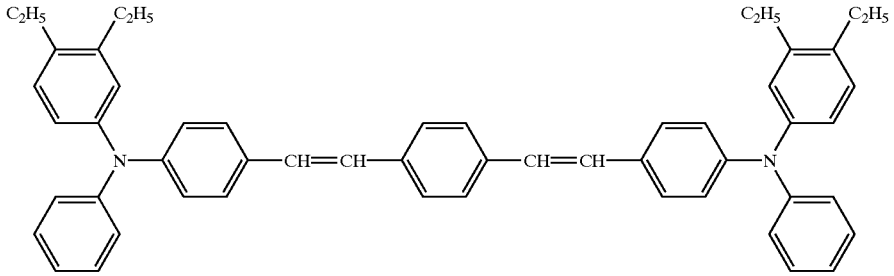
(HT1-15)
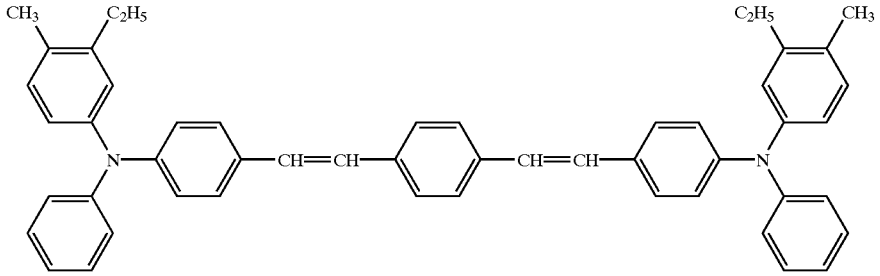

-continued
(HT1-16)
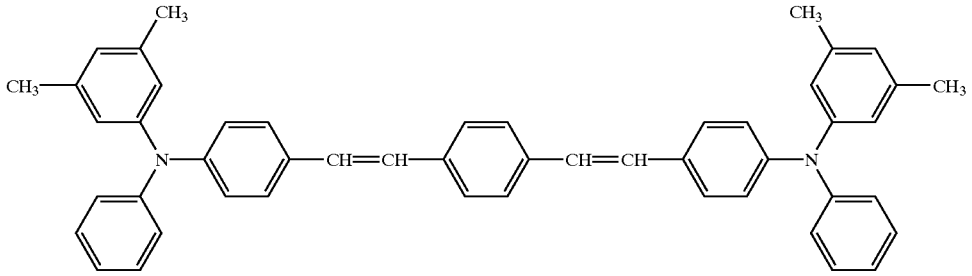
(HT1-17)
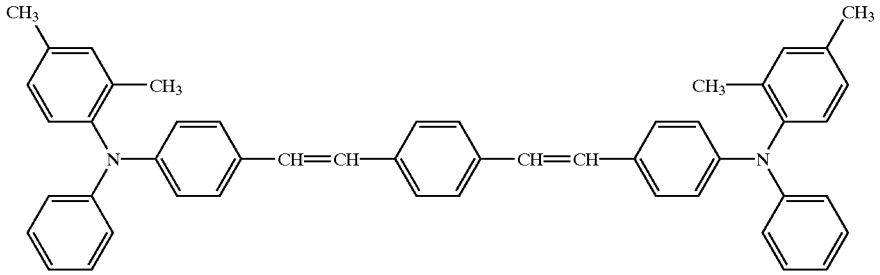
(HT1-18)
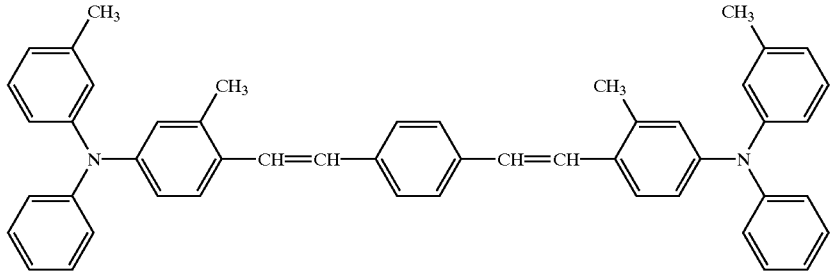
(HT1-19)
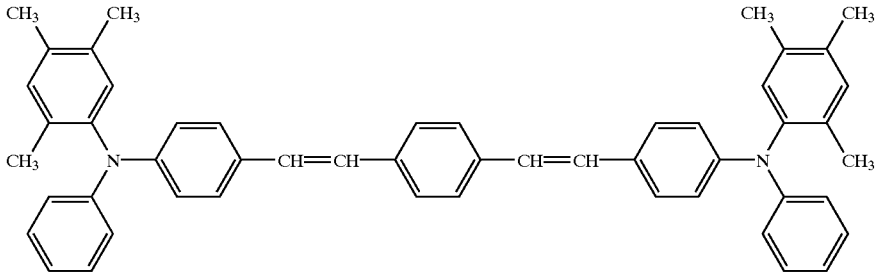
(HT1-20)
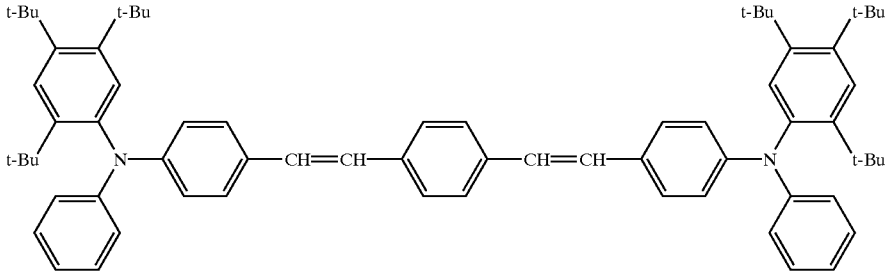

-continued
(HT1-21)
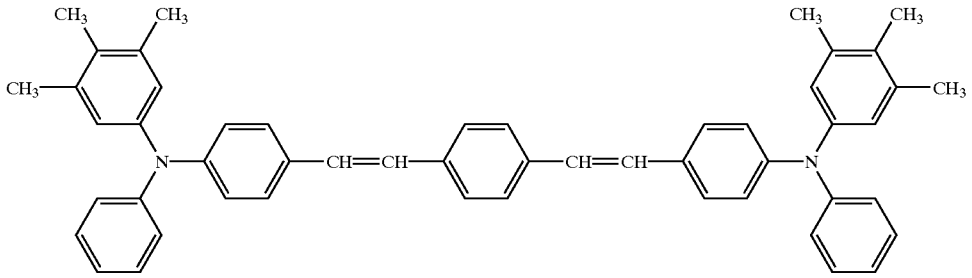
(HT1-22)
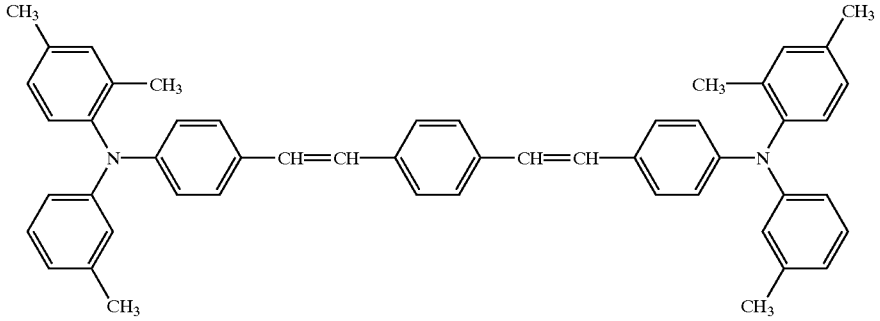
(HT1-23)
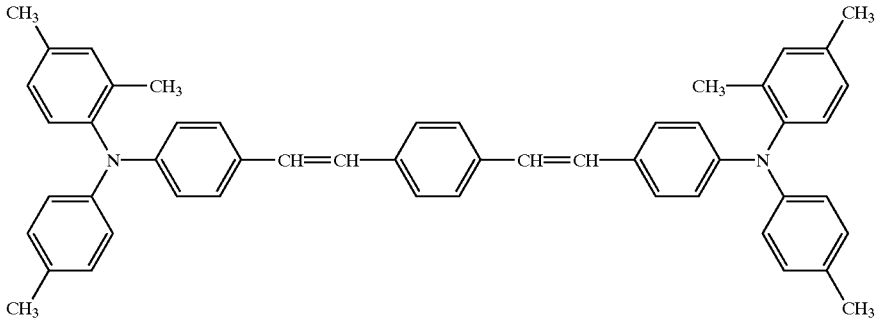
(HT1-24)
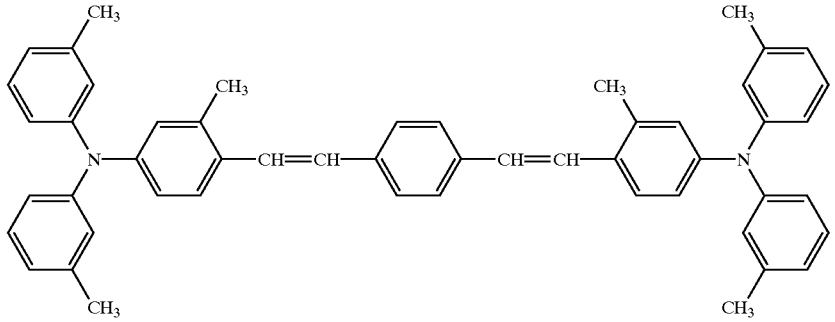
(HT1-25)
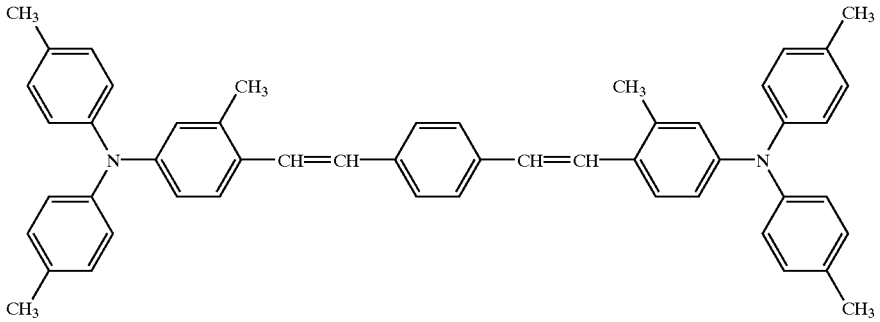

-continued
(HT1-26)
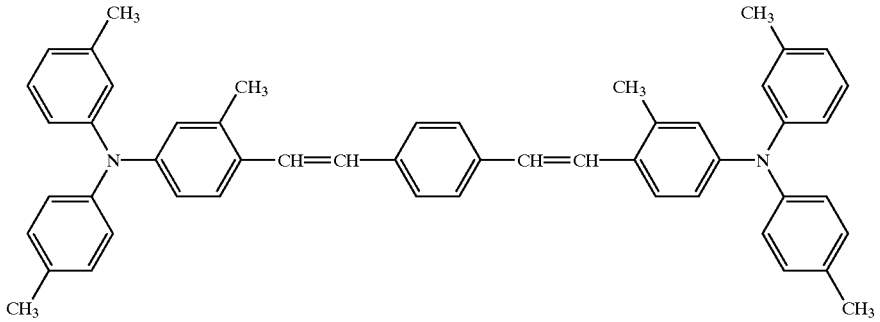
(HT1-27)
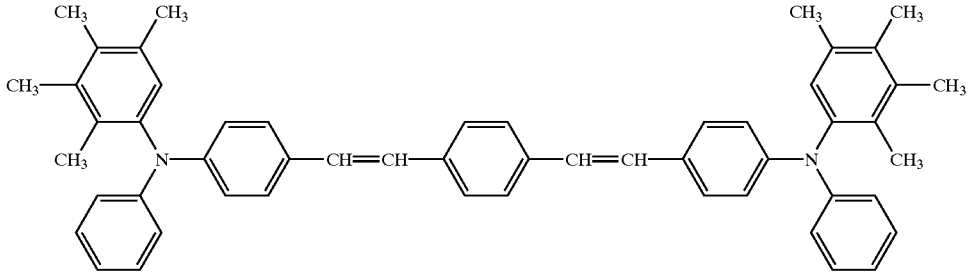
(HT1-28)
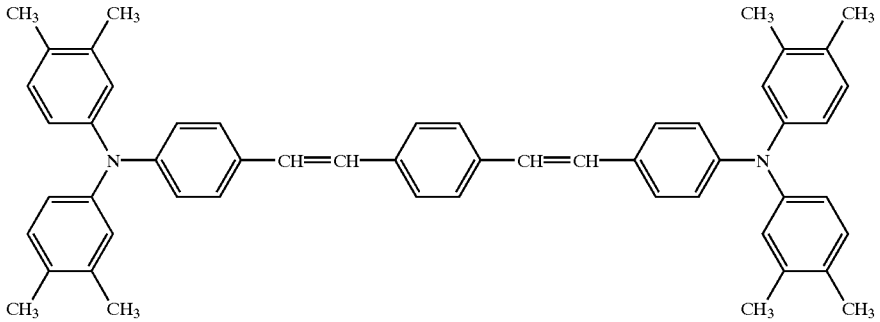
(HT1-29)
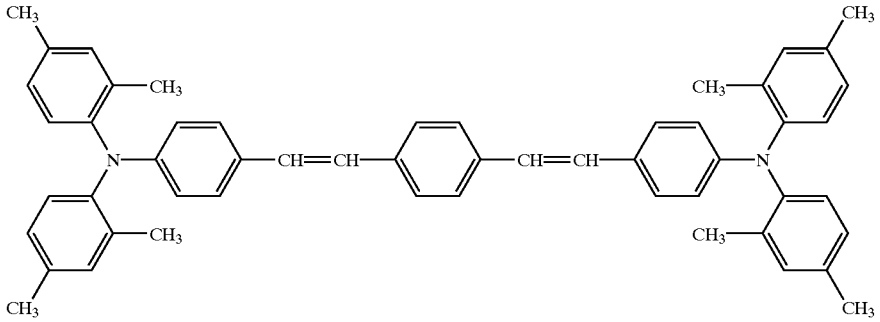
(HT1-30)
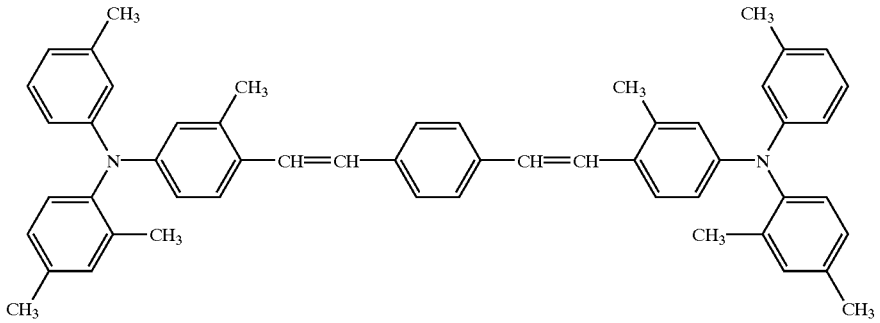

-continued
(HT1-31)
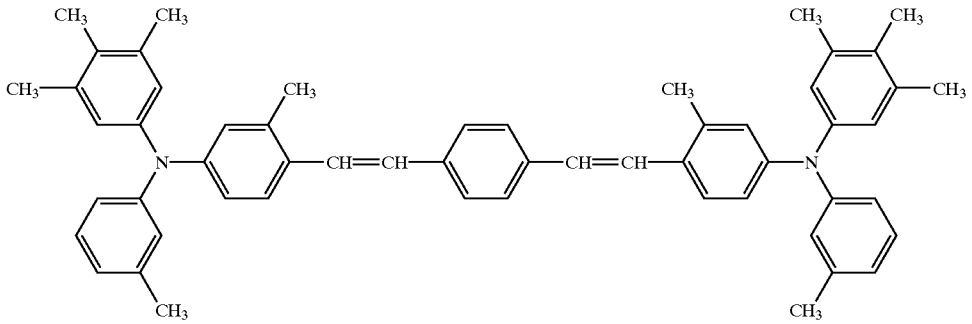
(HT1-32)
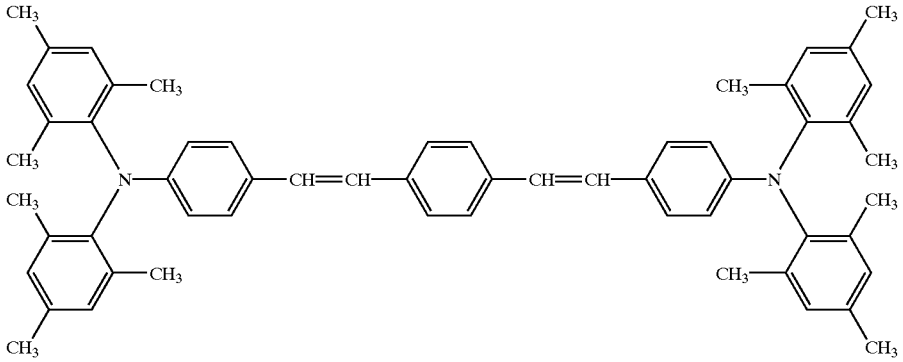
(HT1-33)
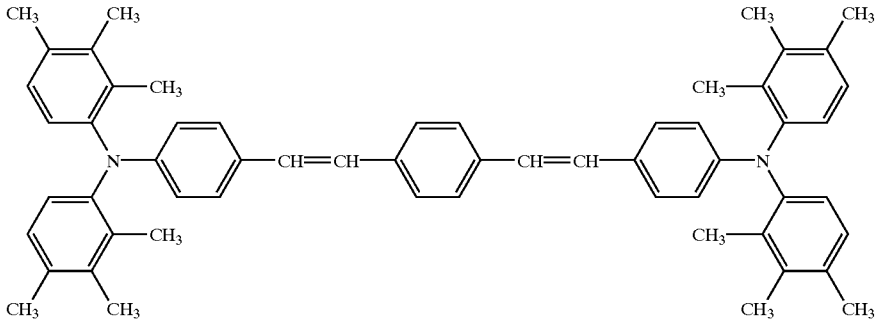
(HT1-34)
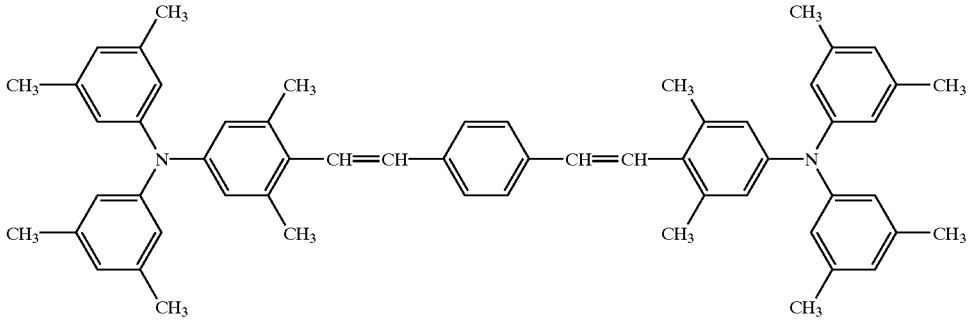

-continued
(HT1-35)
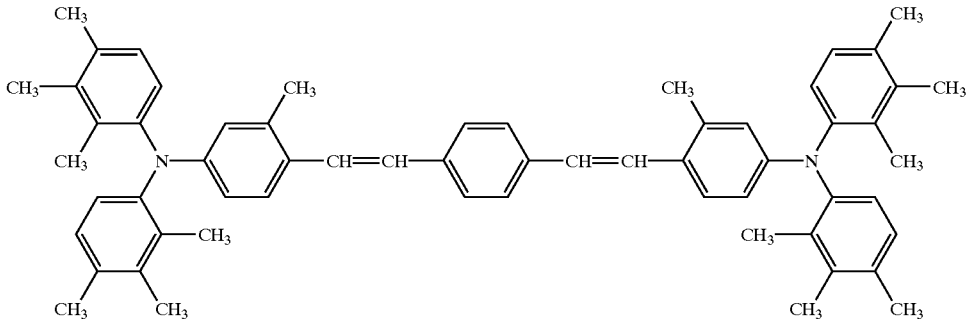
(HT1-36)
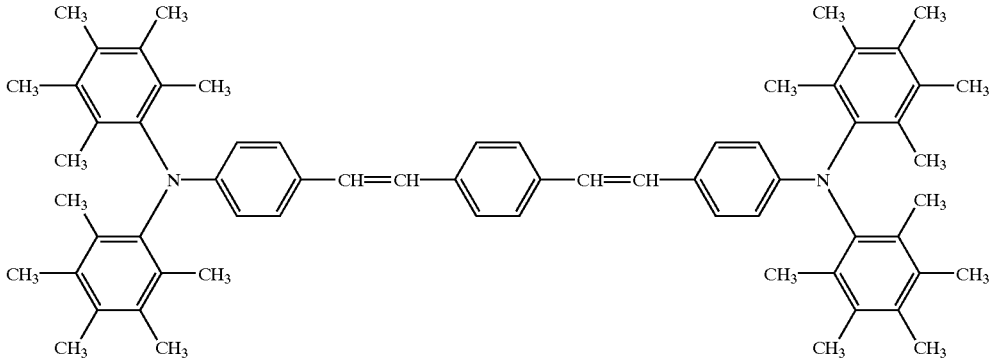
(HT1-37)
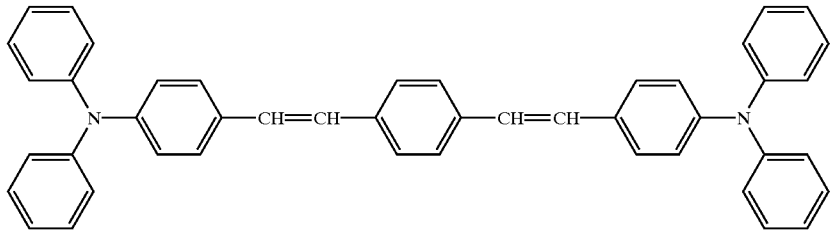
(HT1-38)
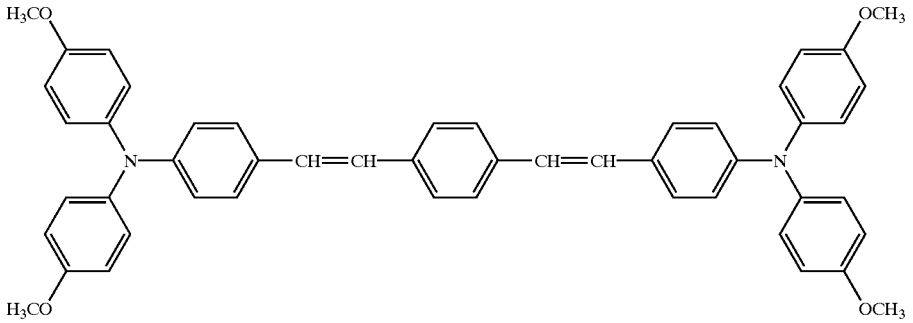
(HT1-39)
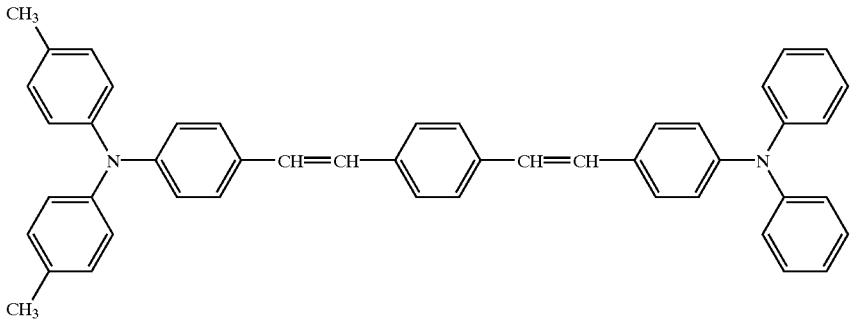

-continued
(HT1-40)
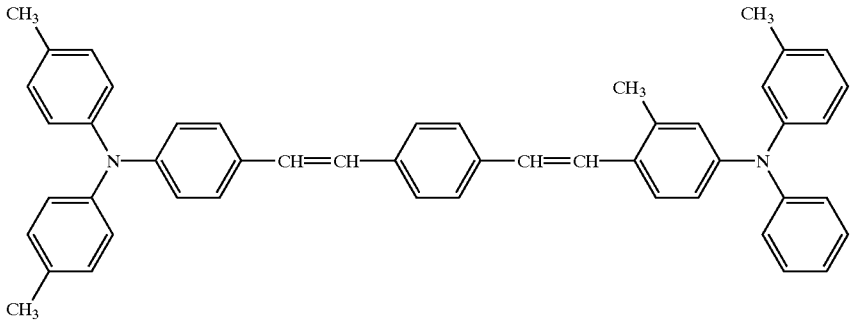
(HT1-41)
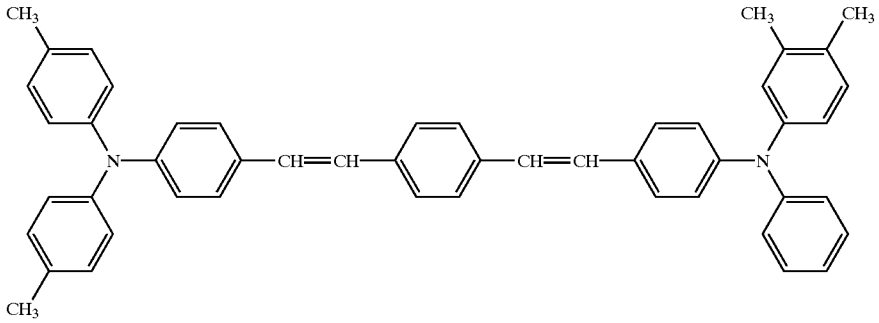
(HT1-42)
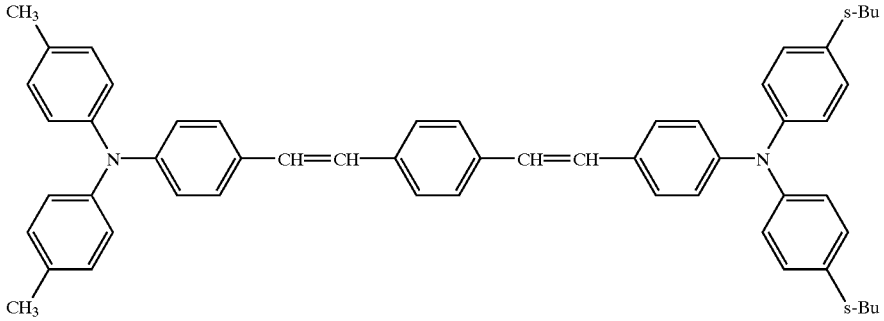
(HT1-43)
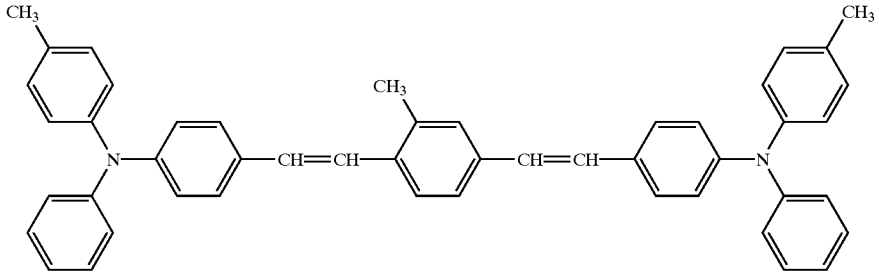
(HT1-44)
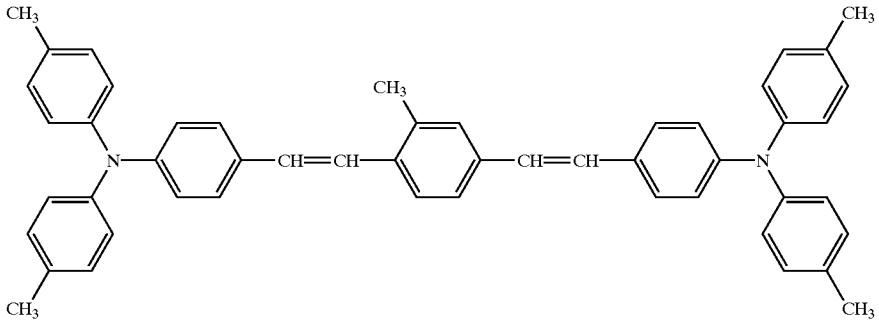

-continued
(HT1-45)
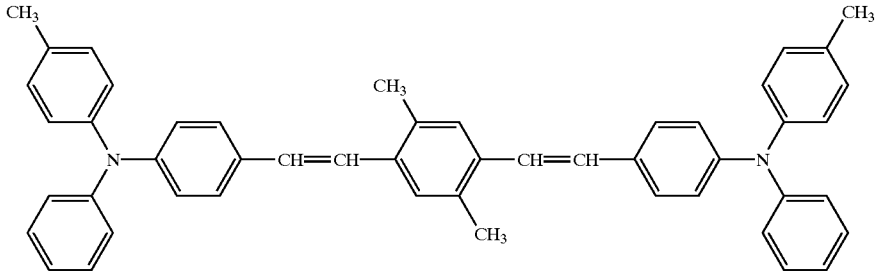
(HT1-46)
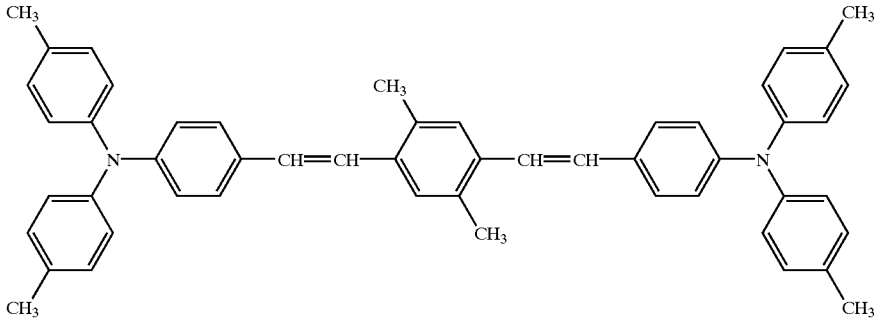
(HT1-47)
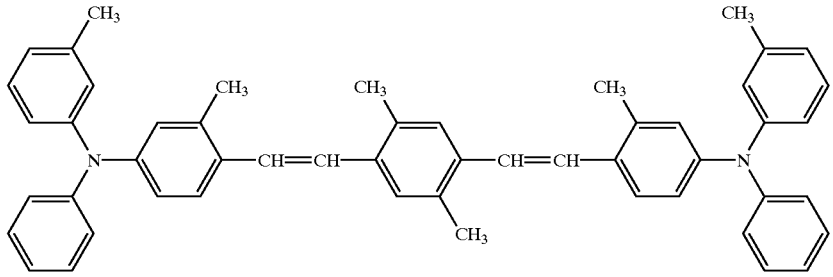
(HT1-48)
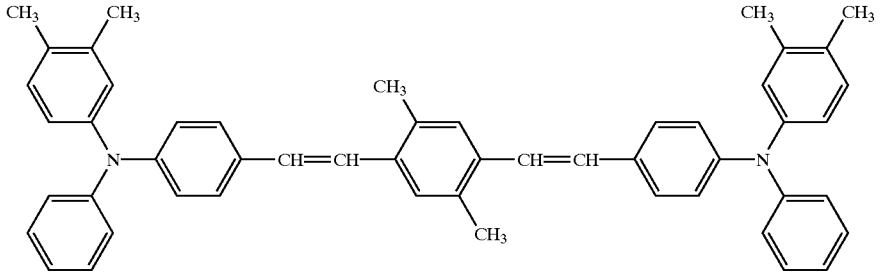
(HT1-49)
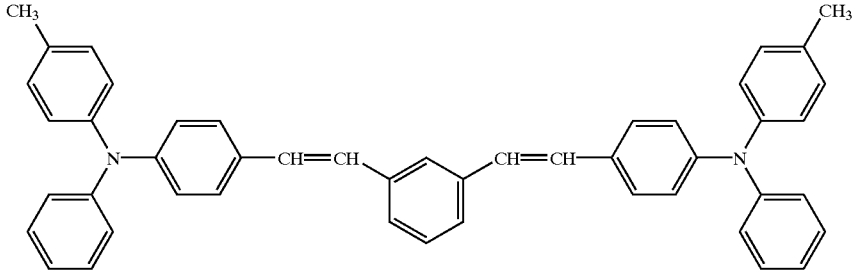

-continued
(HT1-50)
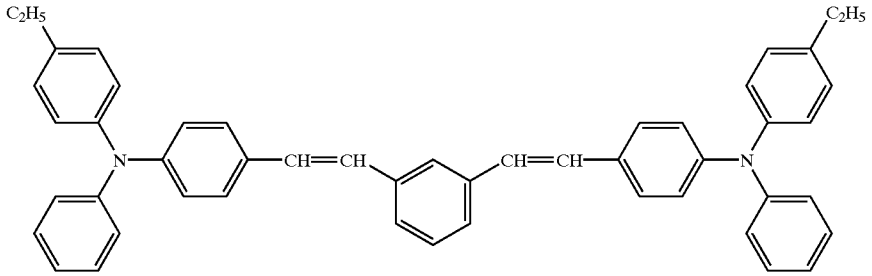
(HT1-51)
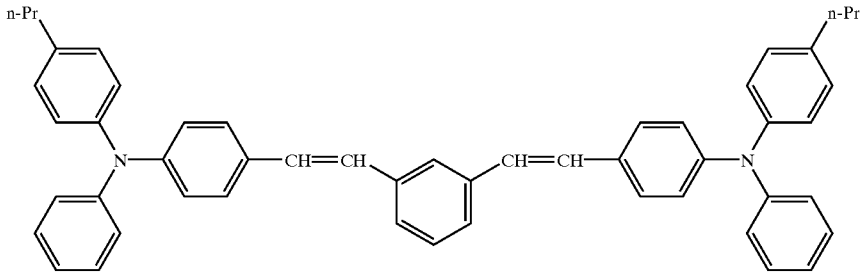
(HT1-52)
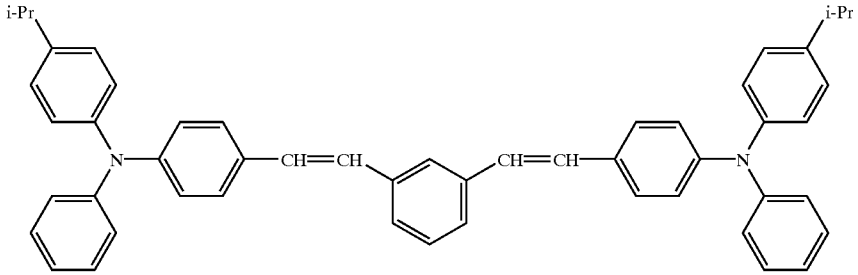
(HT1-53)
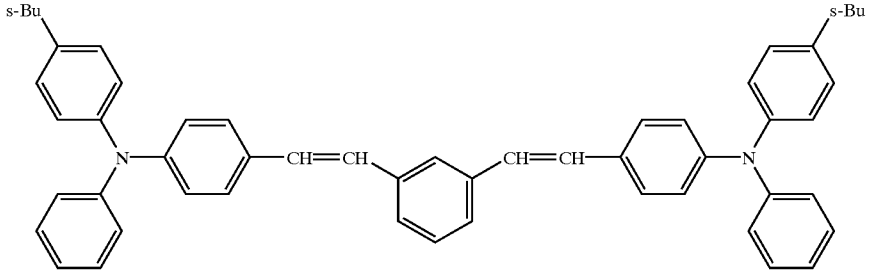
(HT1-54)
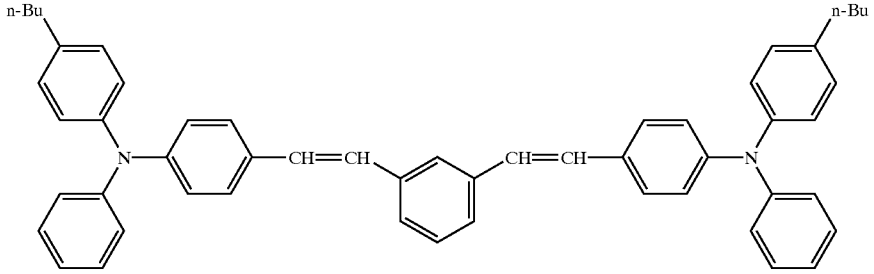

-continued
(HT1-55)
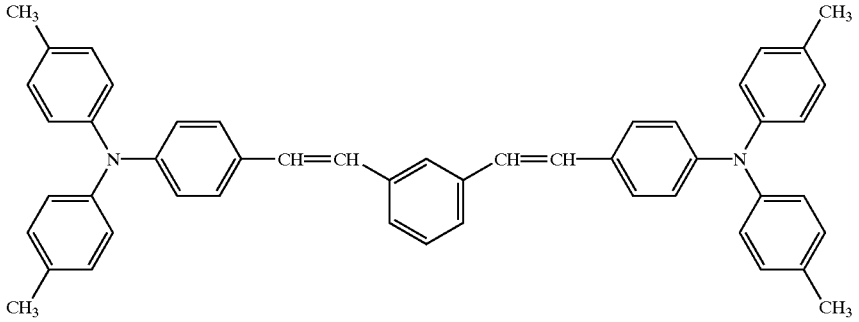
(HT1-56)
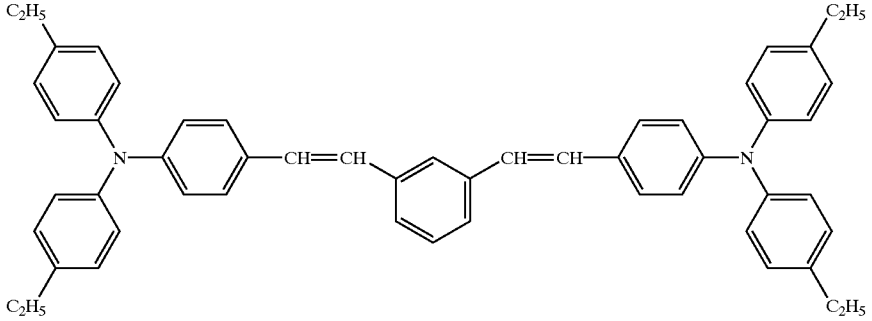
(HT1-57)
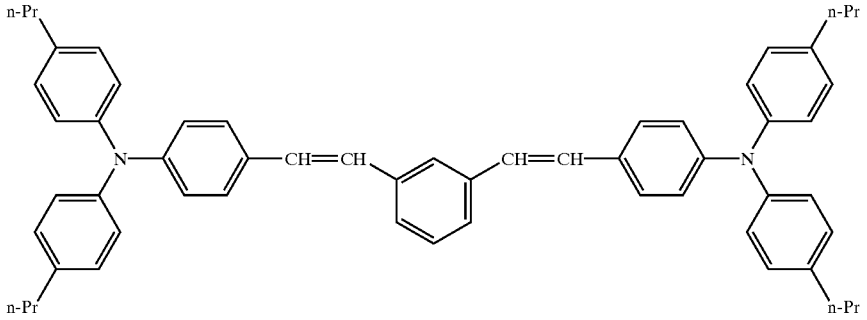
(HT1-58)
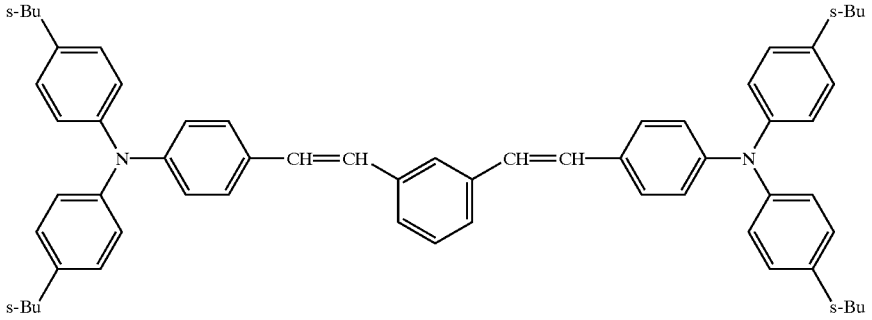
(HT1-59)
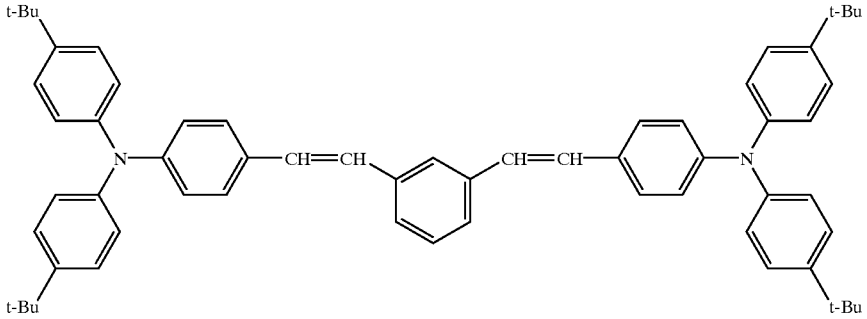

-continued
(HT1-60)
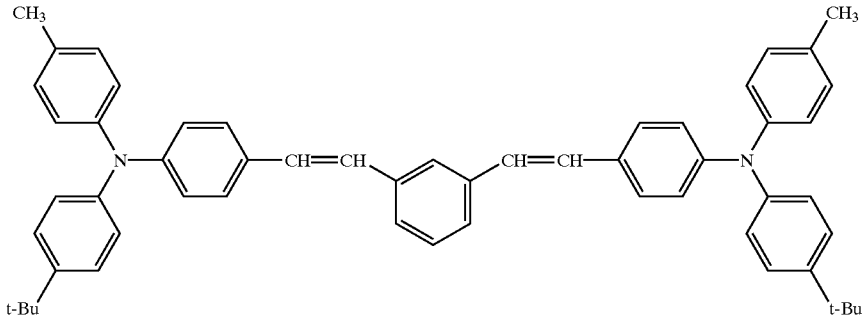
(HT1-61)
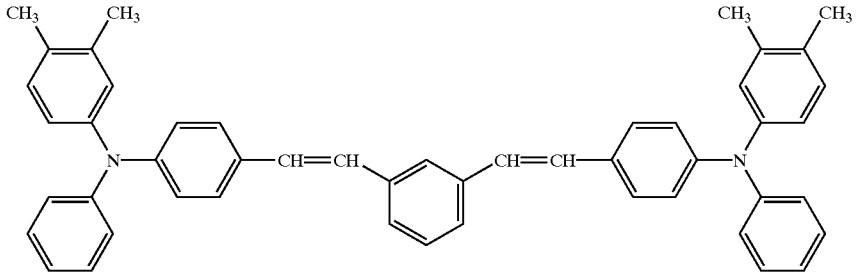
(HT1-62)
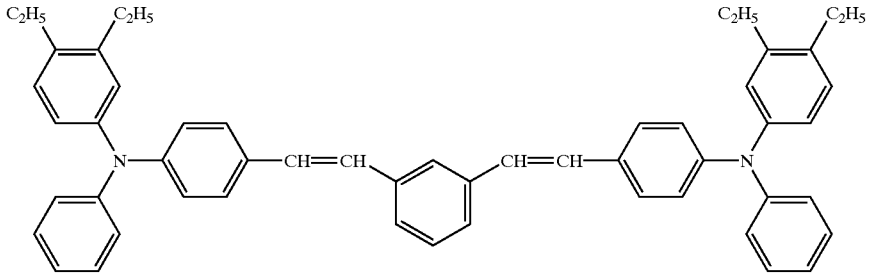
(HT1-63)
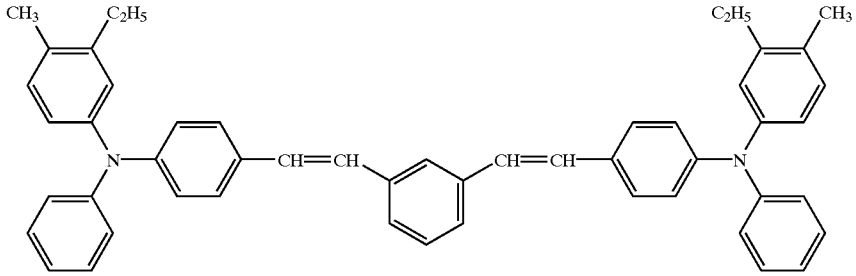
(HT1-64)
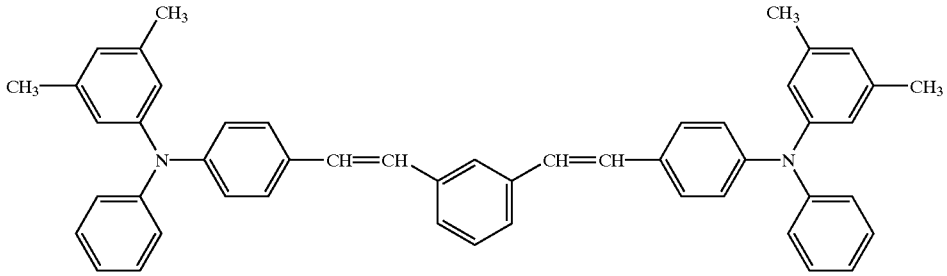

-continued
(HT1-65)
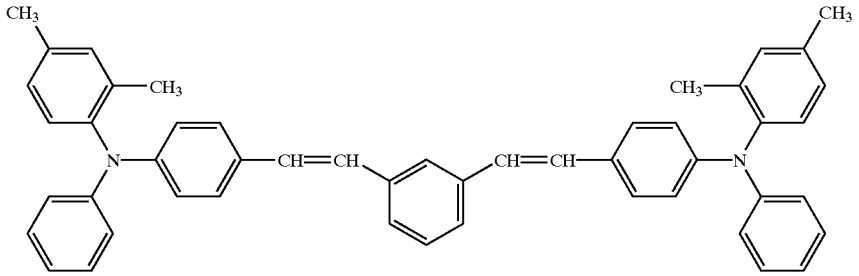
(ET1-66)
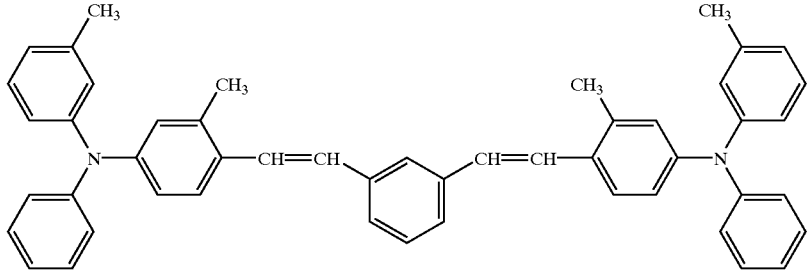
(ET1-67)
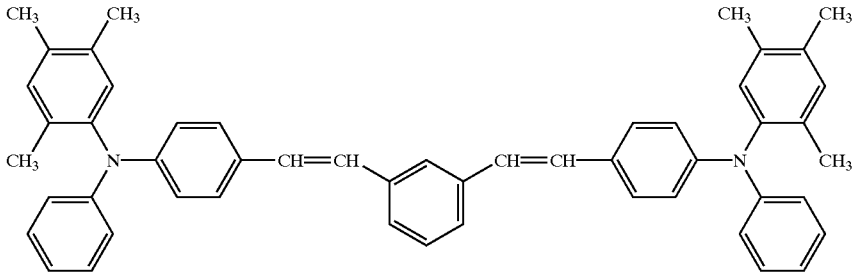
(ET1-68)
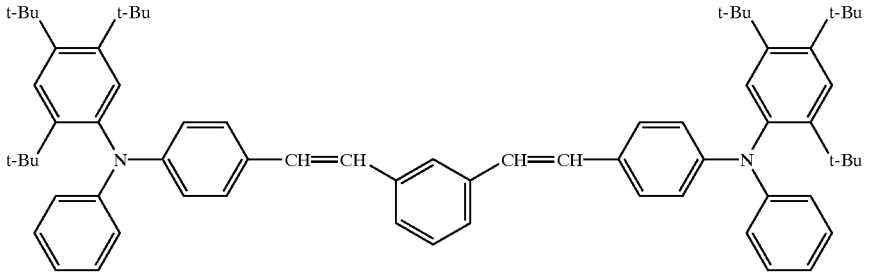
(ET1-69)
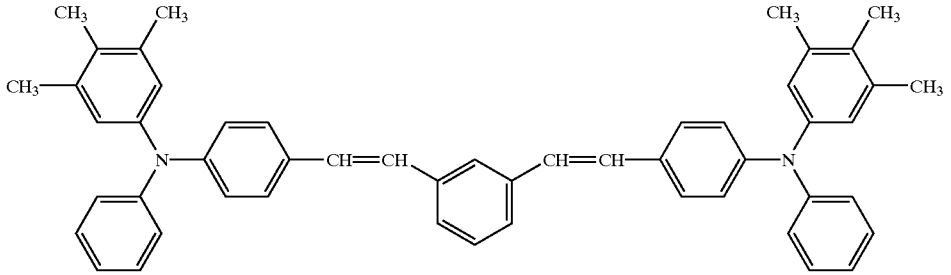

-continued
(ET1-70)
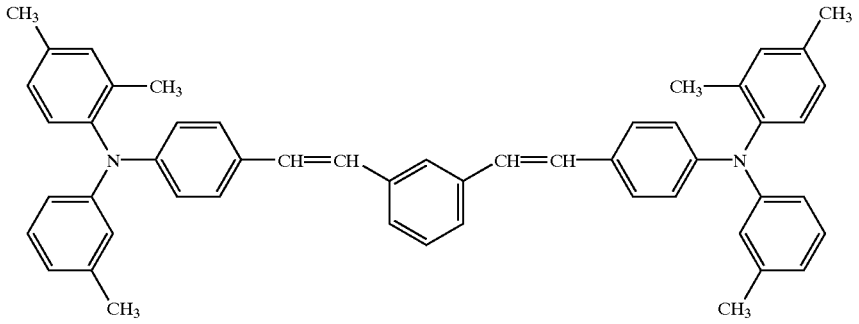
(HT1-71)
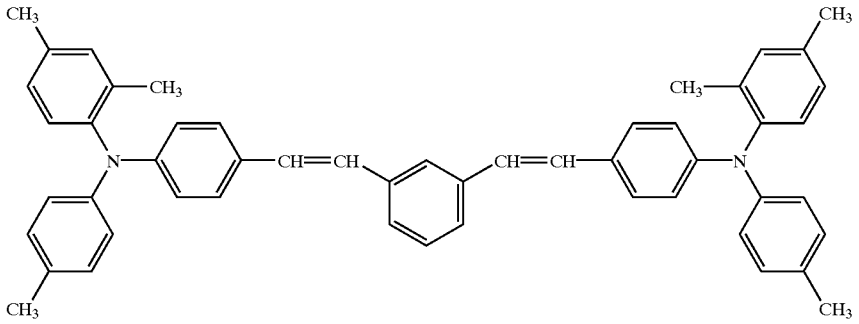
(HT1-72)
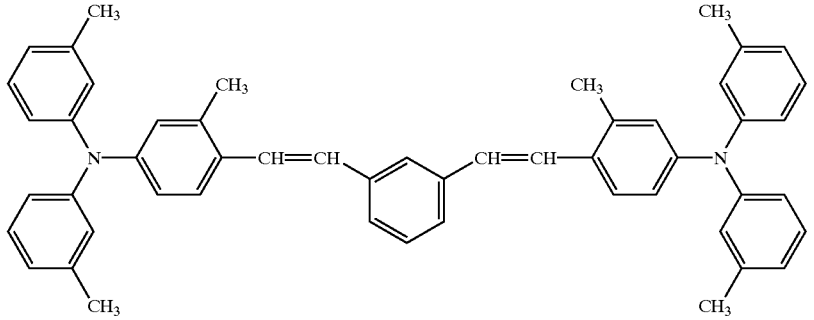
(HT1-73)
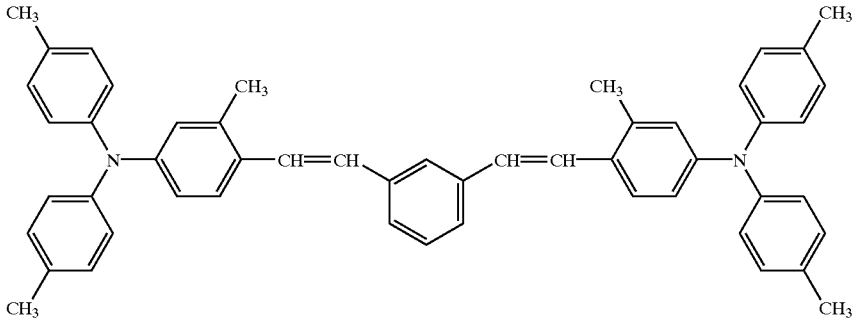
(HT1-74)
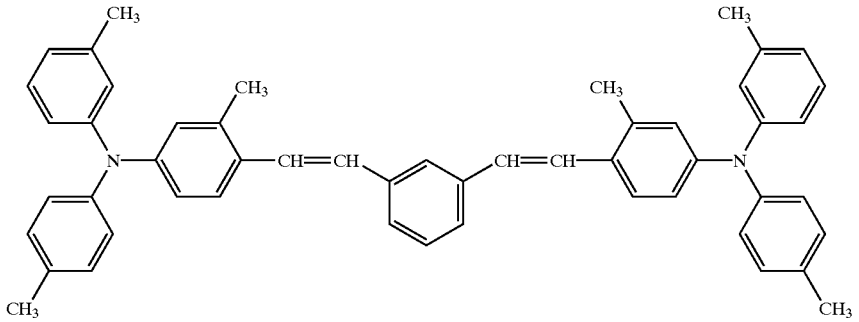

-continued
(HT1-75)
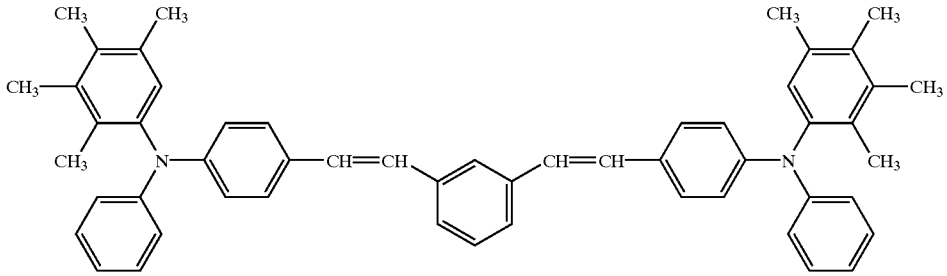
(HT1-76)
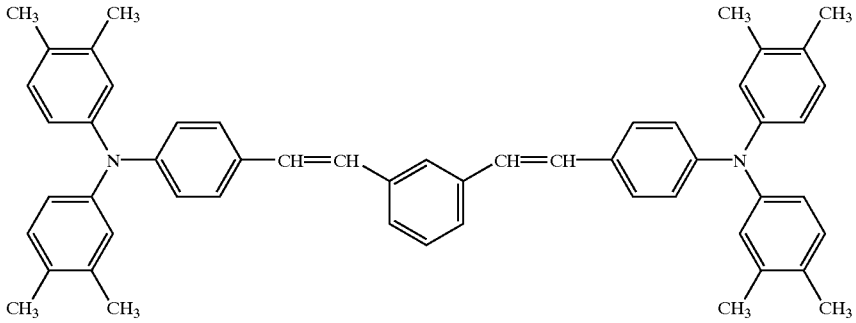
(HT1-77)
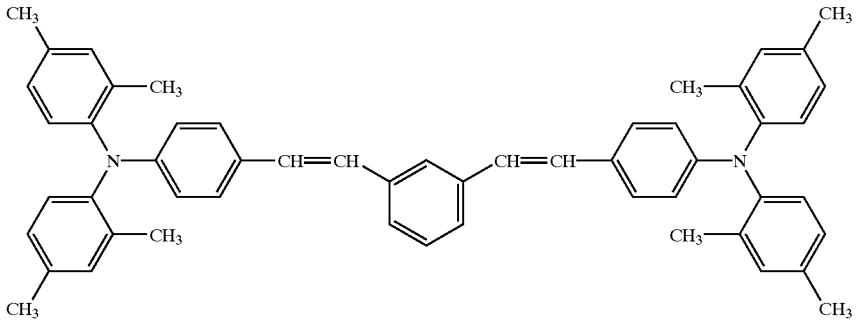
(HT1-78)
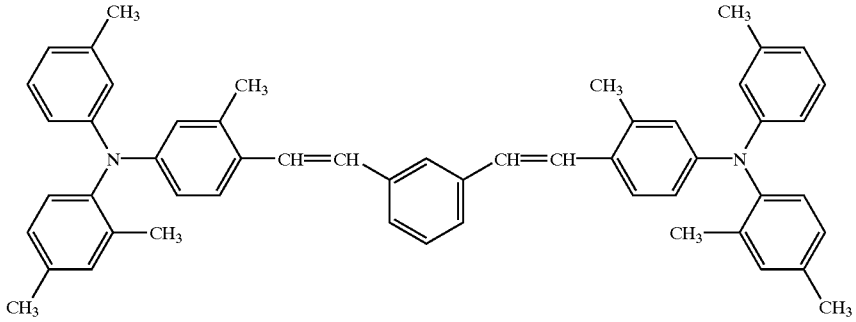
(HT1-79)
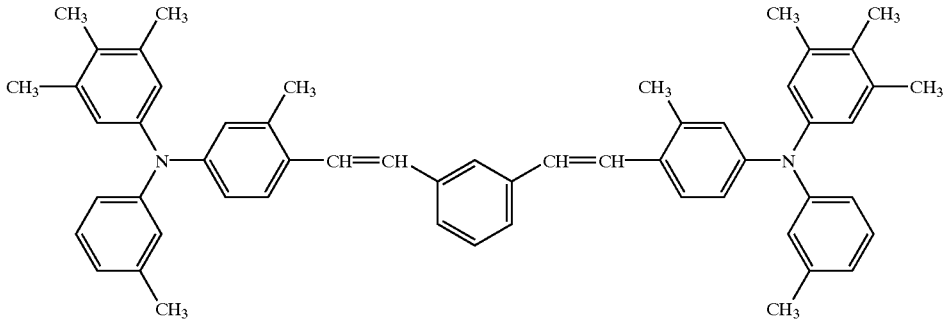

-continued
(HT1-80)
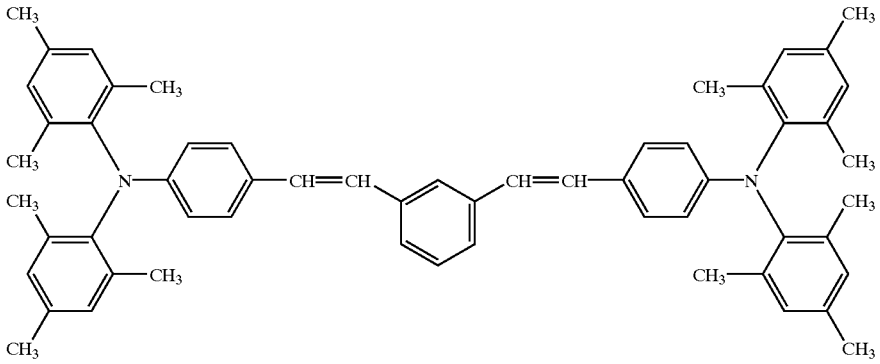
(HT1-81)
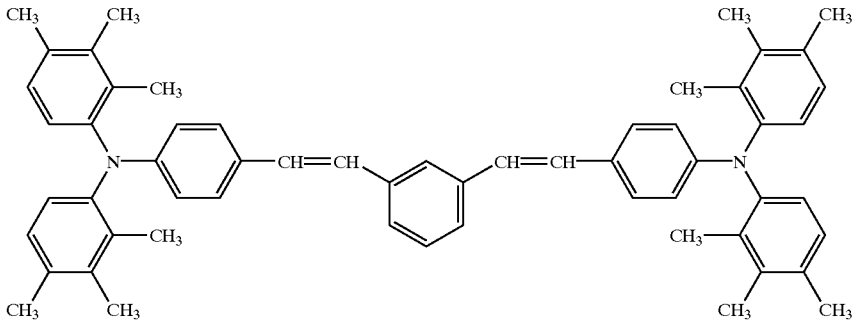
(HT1-82)
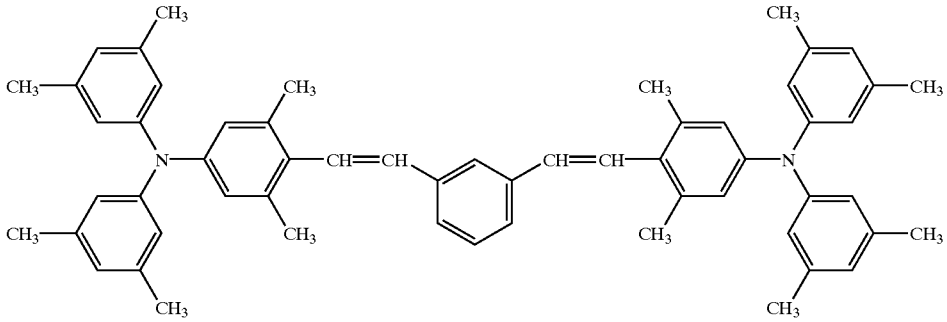
(HT1-83)
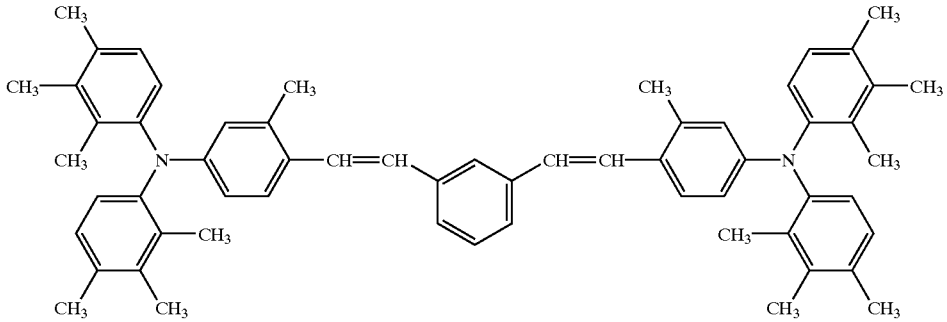

-continued
(HT1-84)
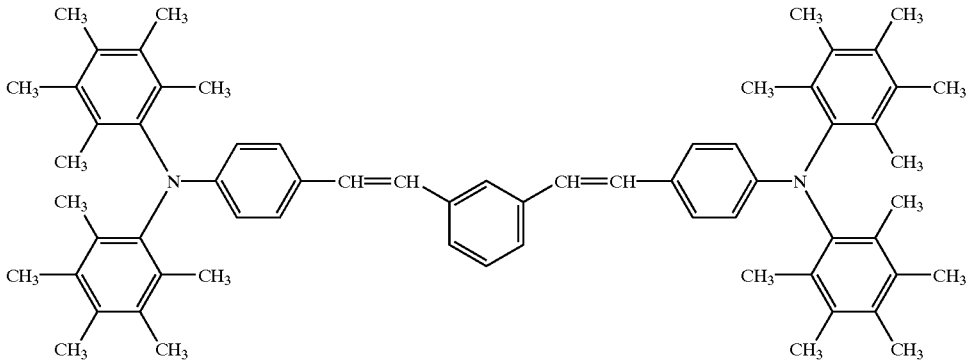
(HT1-85)
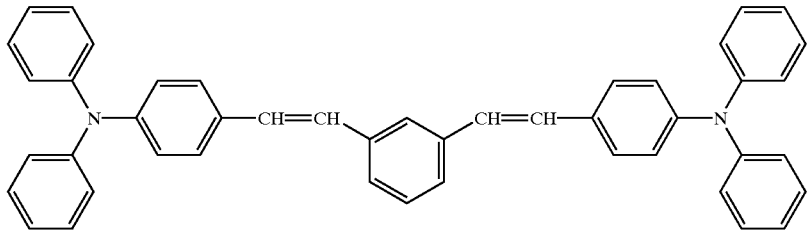
(HT1-86)
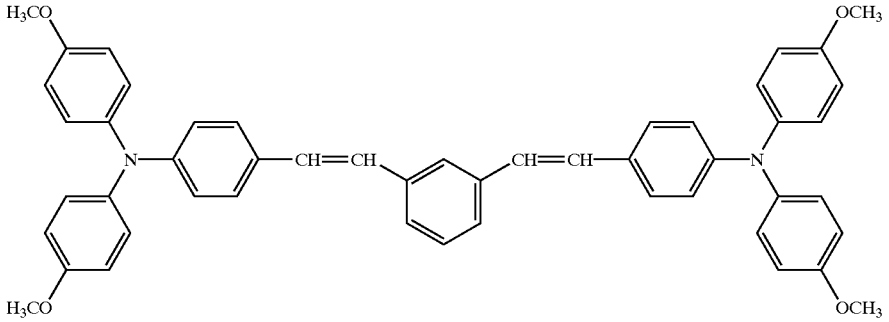
(HT1-87)
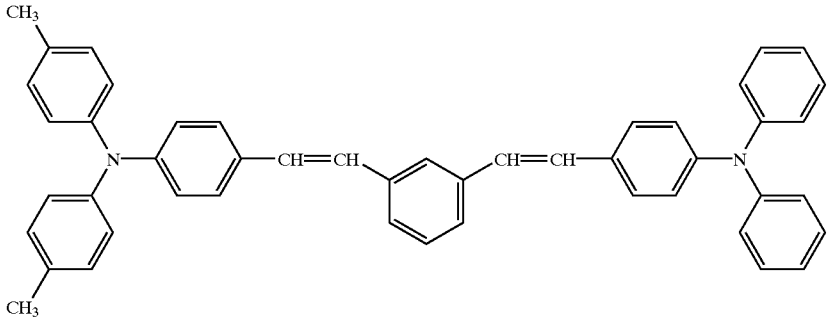
(HT1-88)
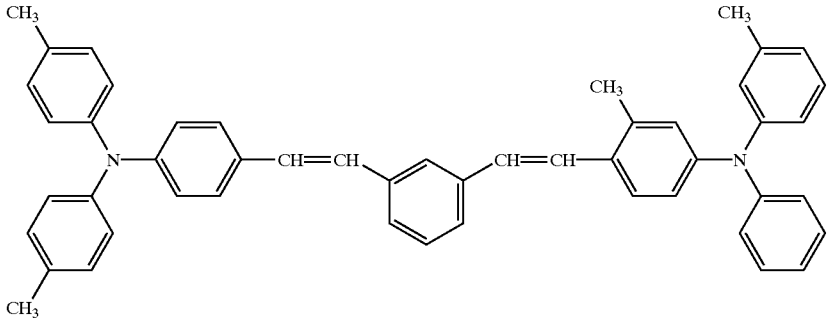

-continued
(HT1-89)
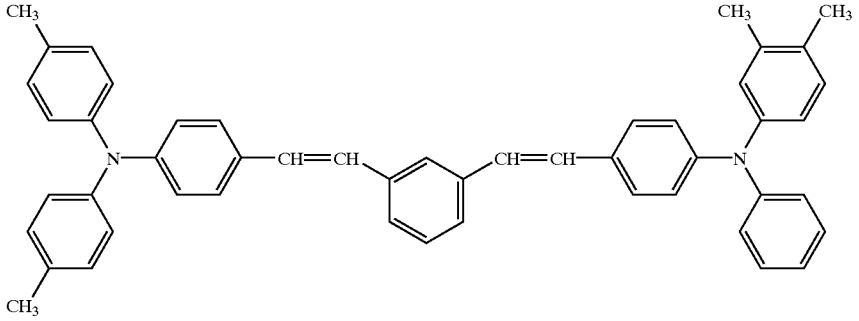
(HT1-90)
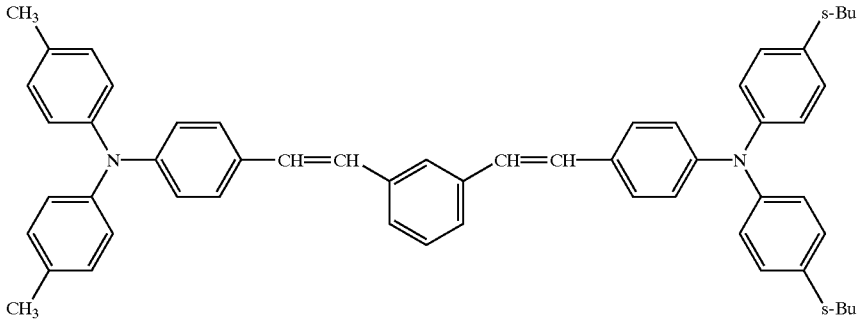
(HT1-91)
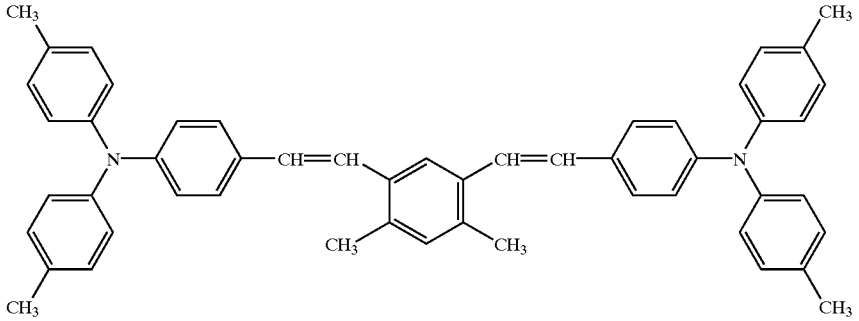
(HT1-92)
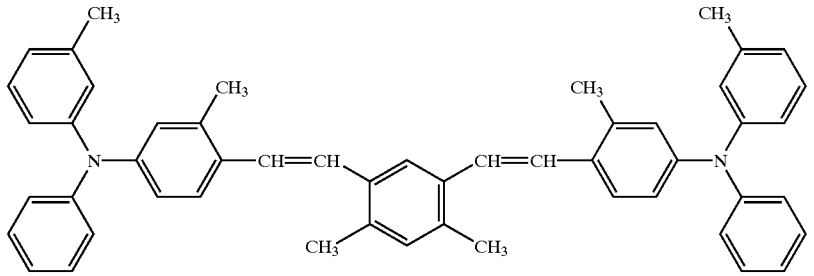
(HT1-93)
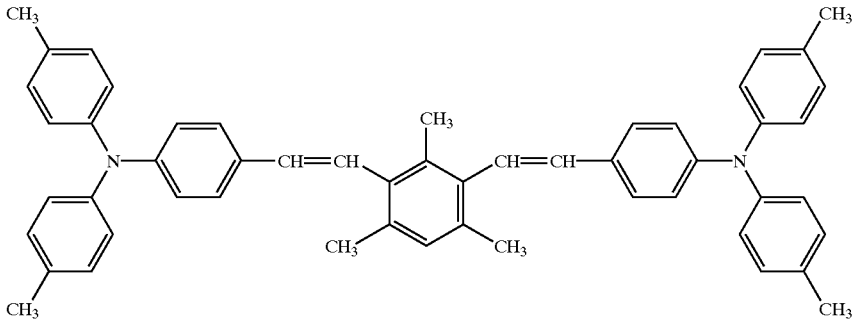

-continued
(HT1-94)
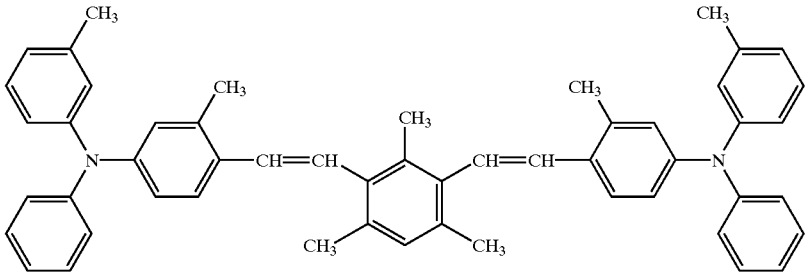
(HT1-95)
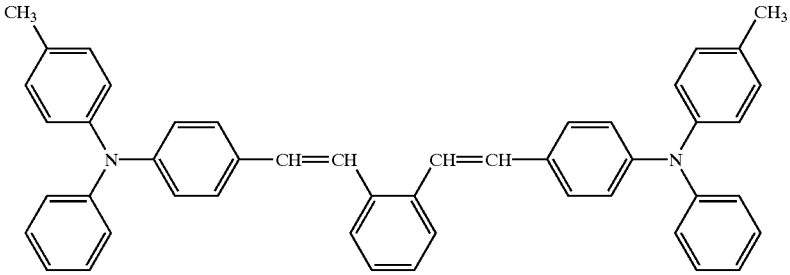
(HT1-96)
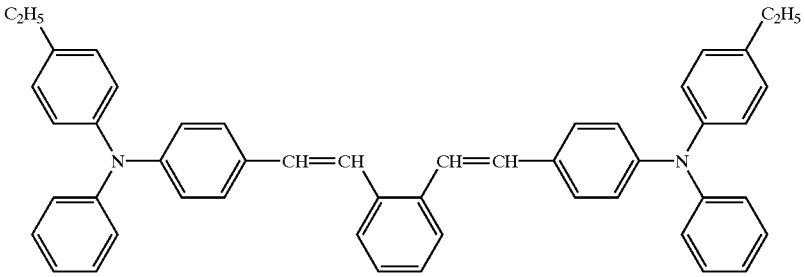
(HT1-97)
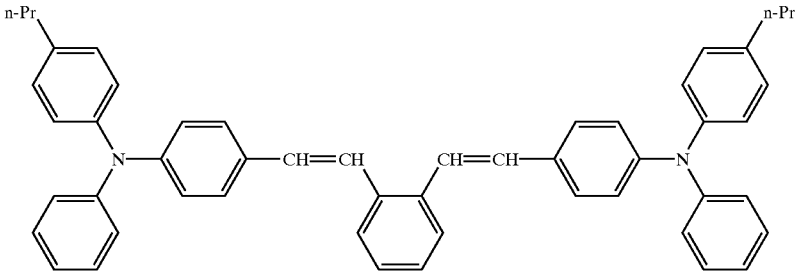
(HT1-98)
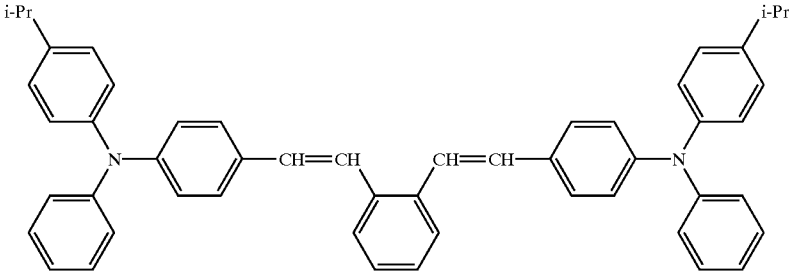

-continued
(HT1-99)
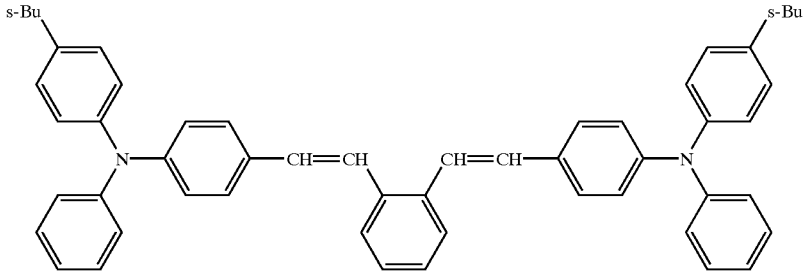
(HT1-100)
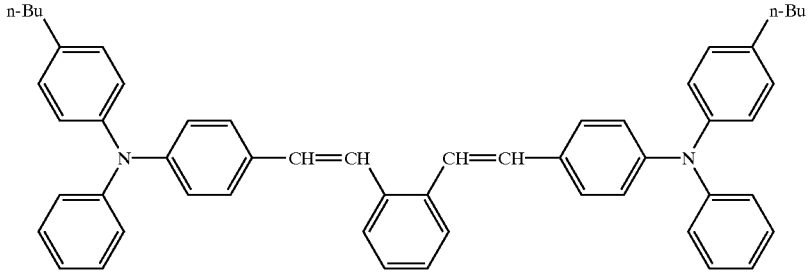
(HT1-101)
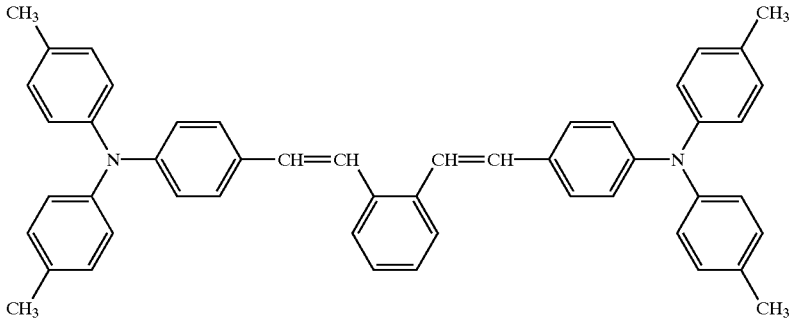
(HT1-102)
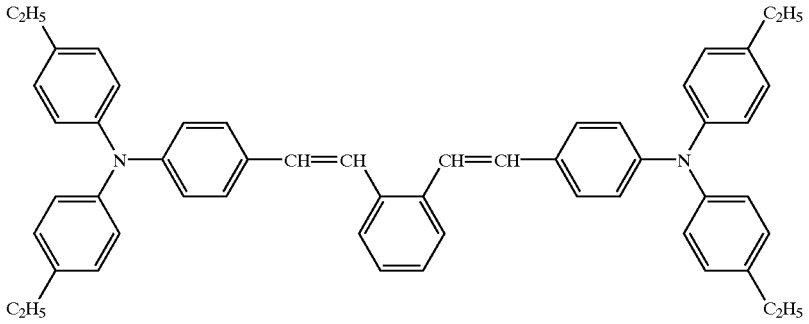
(HT1-103)
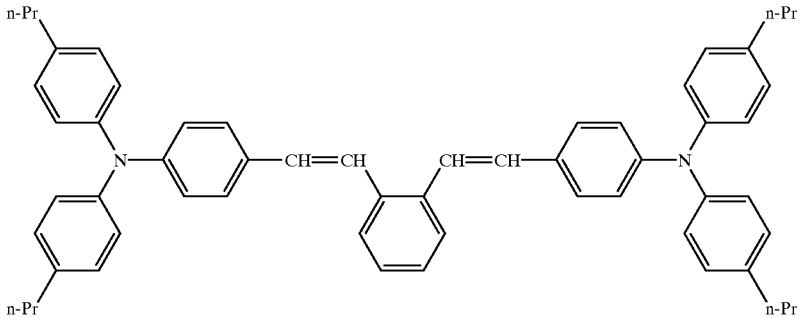

-continued
(HT1-104)
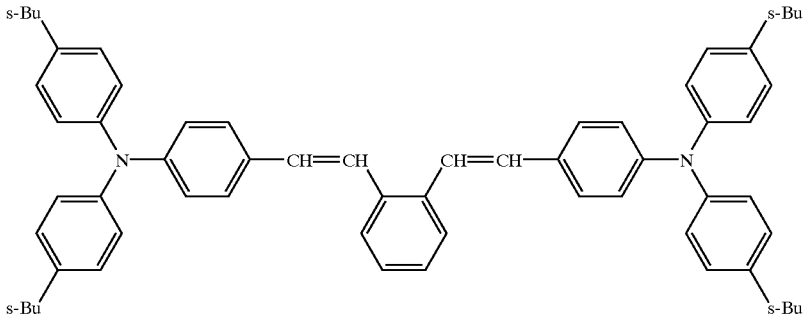
(HT1-105)
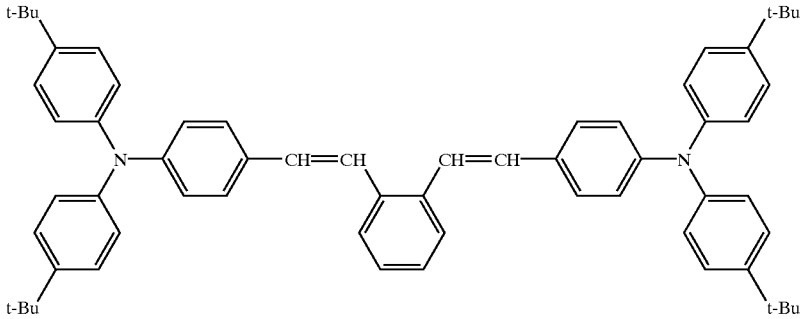
(HT1-106)
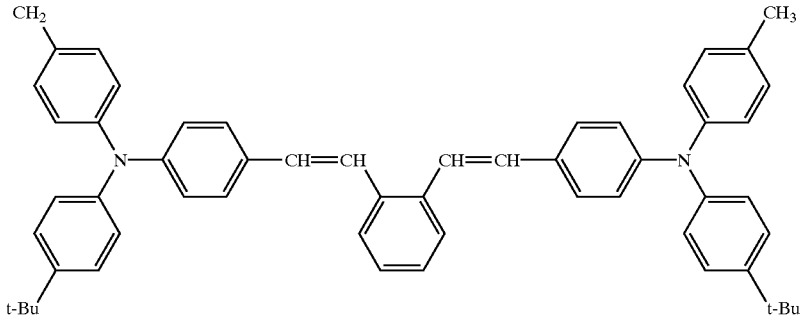
(HT1-107)
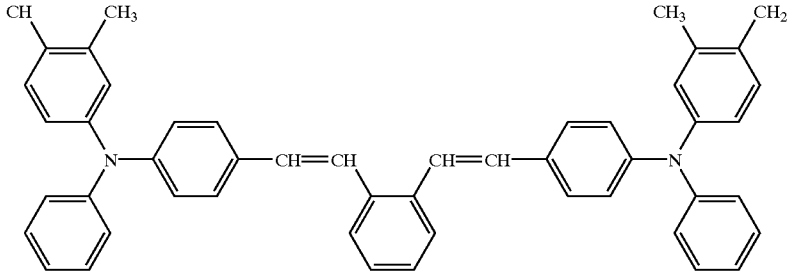
(HT1-108)
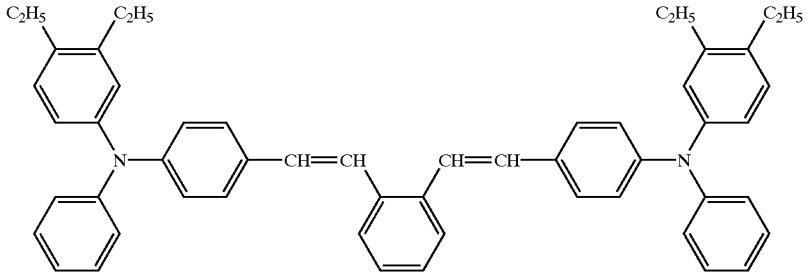

-continued
(HT1-109)
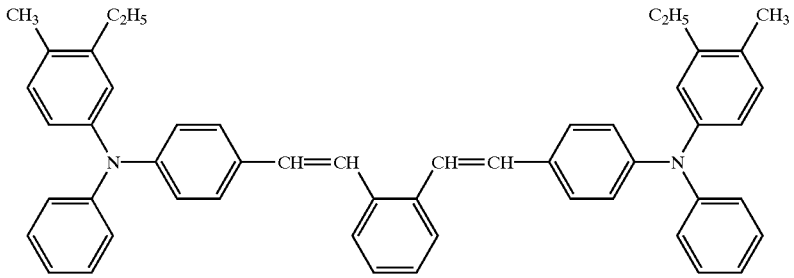
(HT1-110)
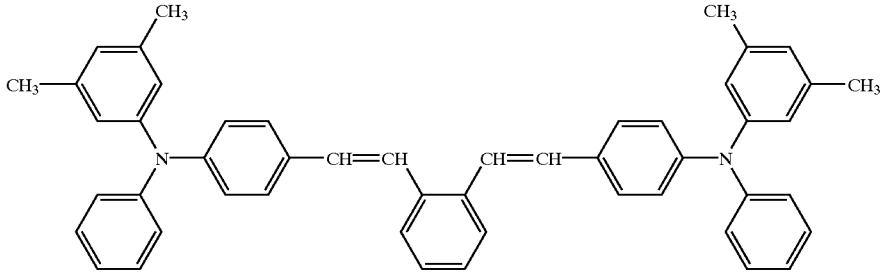
(HT1-111)
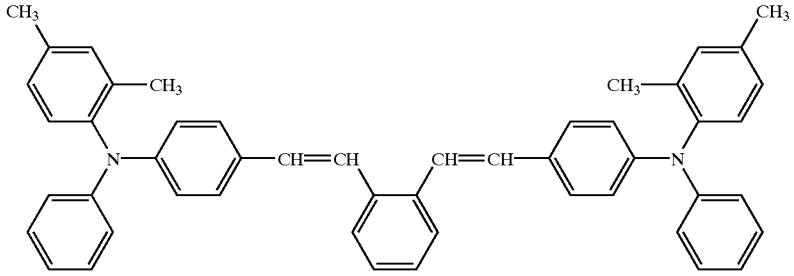
(HT1-112)
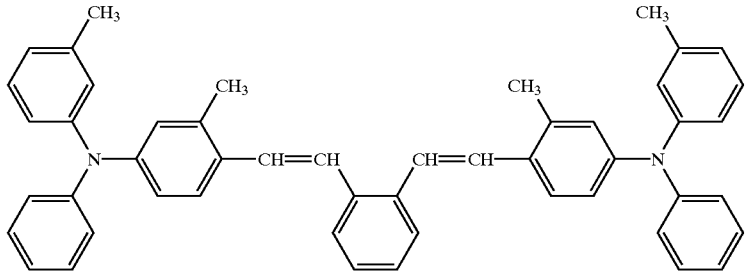
(HT1-113)
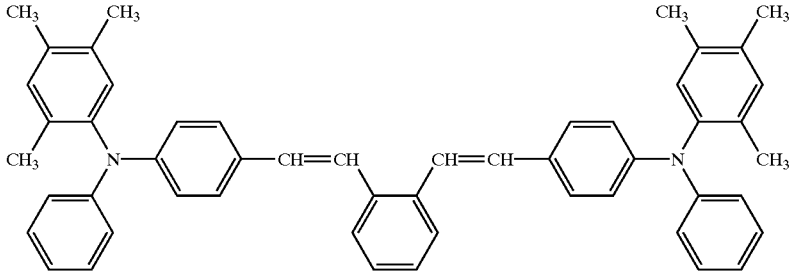

-continued
(HT1-114)
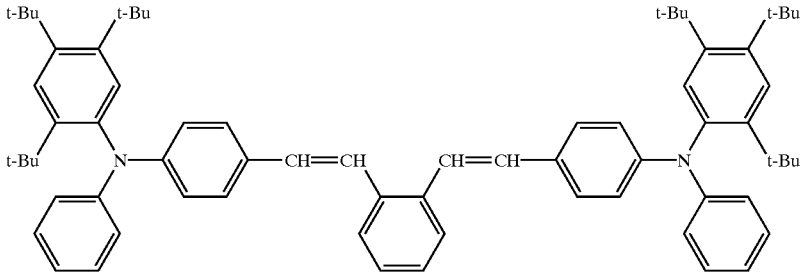
(HT1-115)
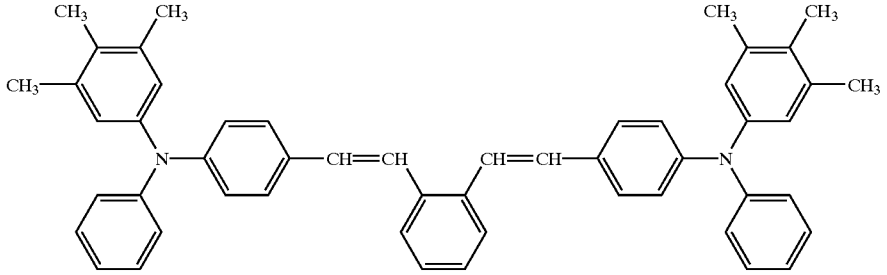
(HT1-116)
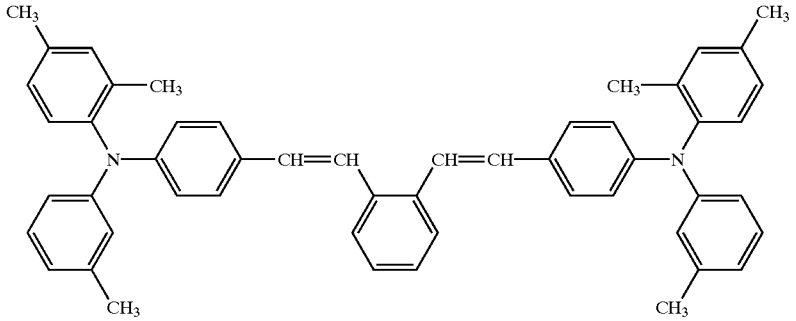
(HT1-117)
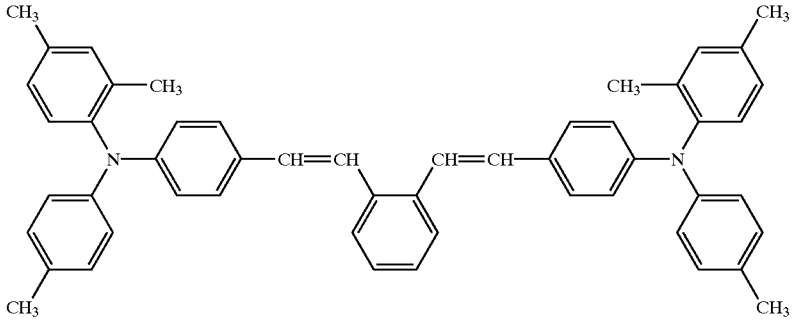
(HT1-118)
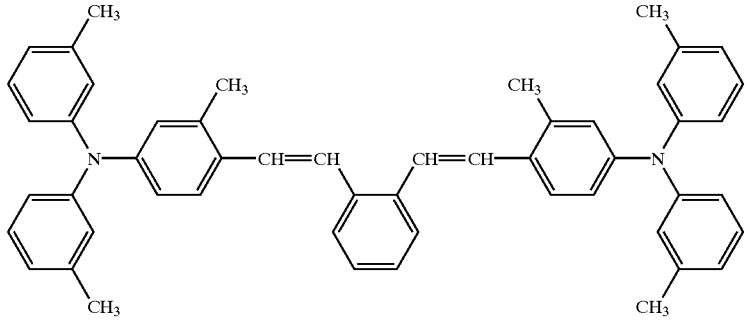

-continued
(HT1-119)
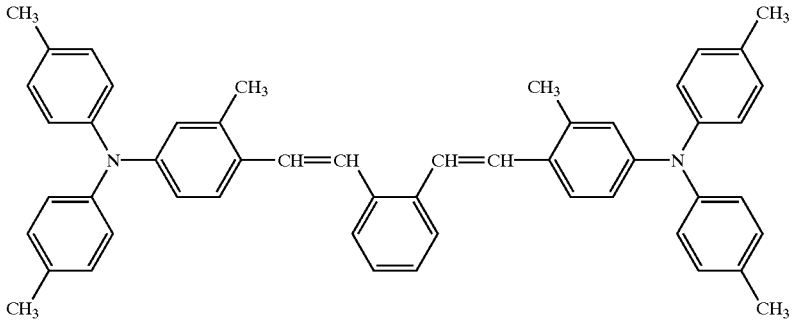
(HT1-120)
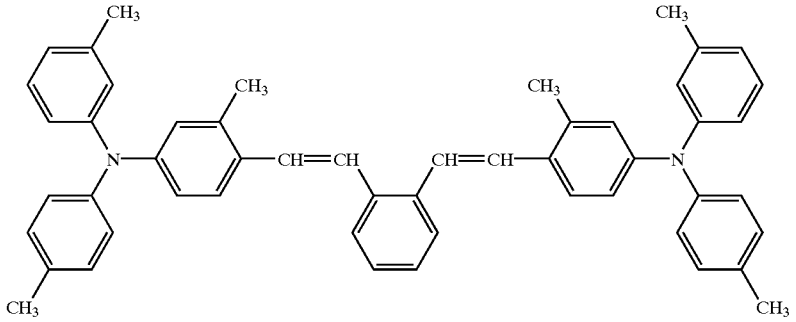
(HT1-121)
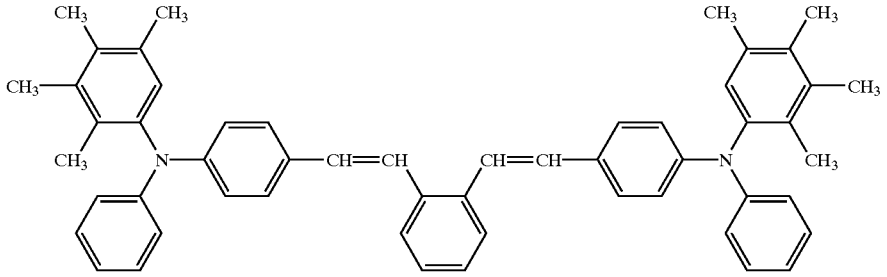
(HT1-122)
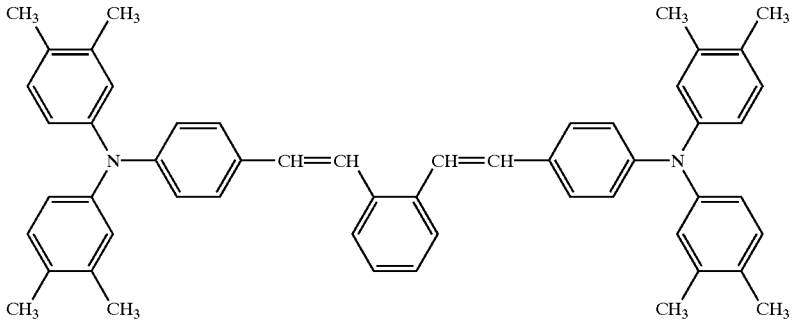
(HT1-123)
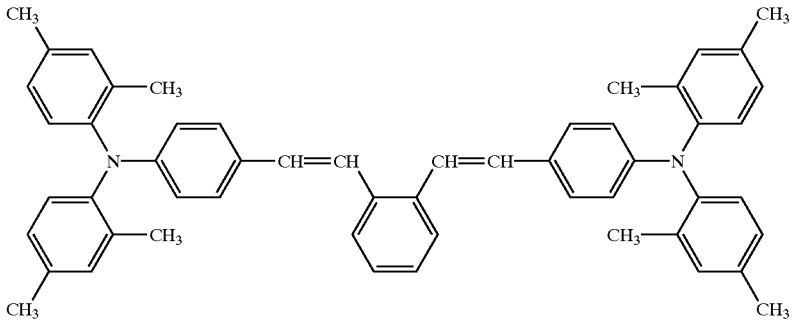

-continued
(HT1-124)
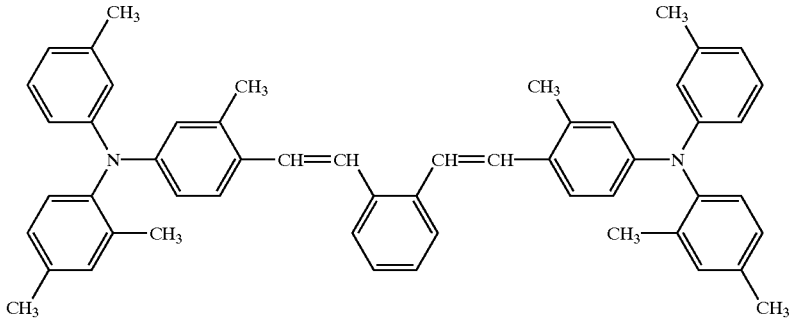
(HT1-125)
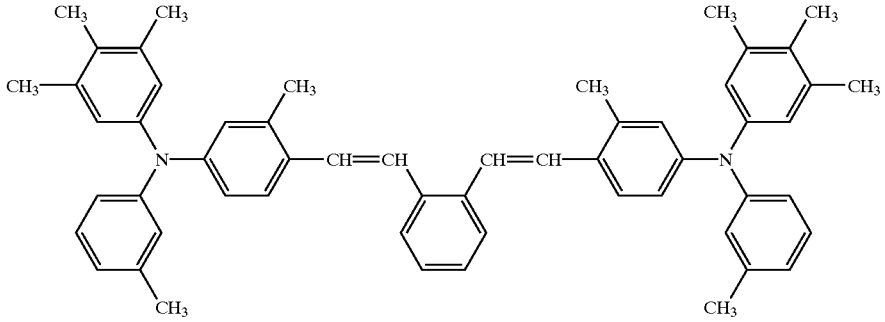
(HT1-126)
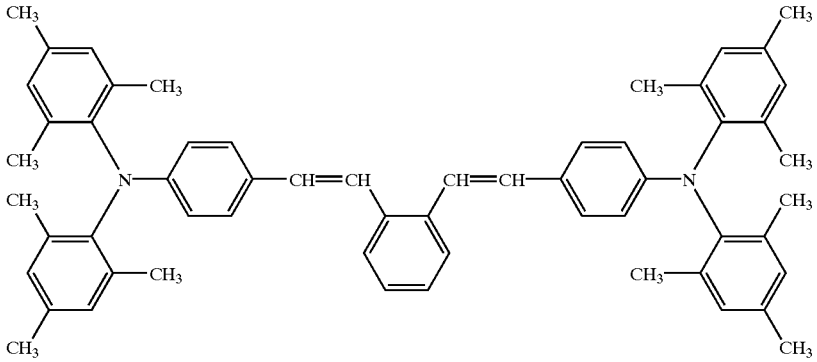
(HT1-127)
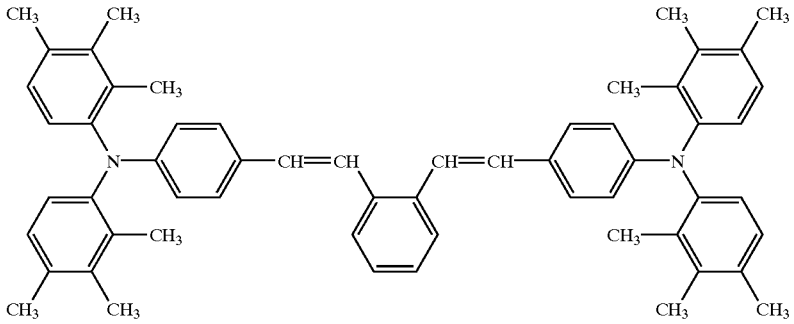

-continued
(HT1-128)
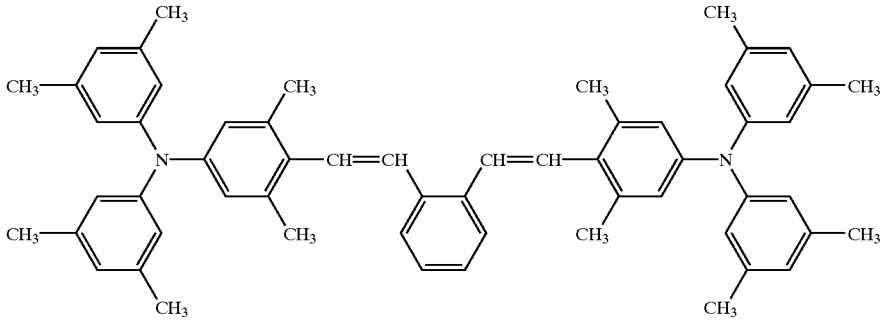
(HT1-129)
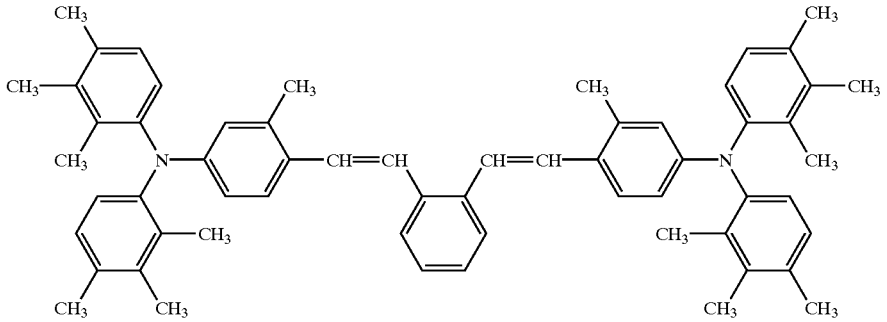
(HT1-130)
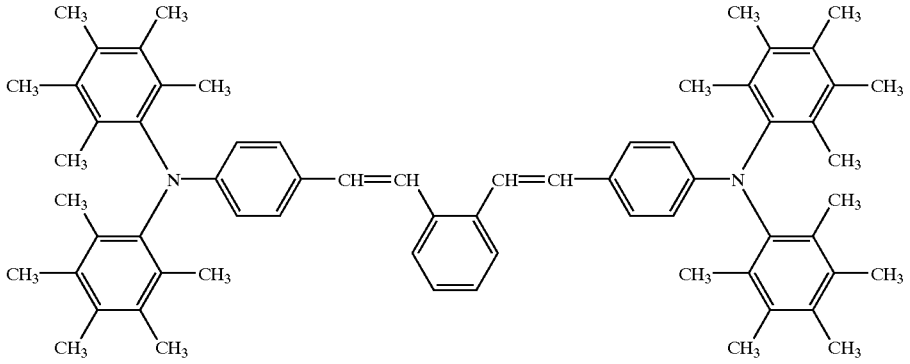
(HT1-131)
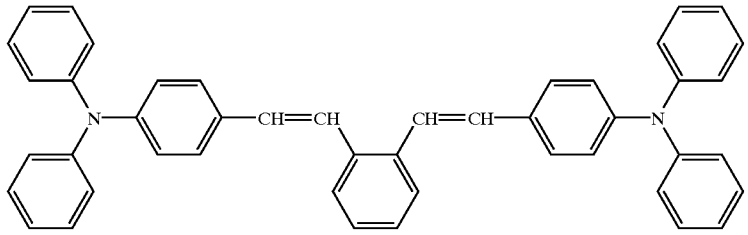
(HT1-132)
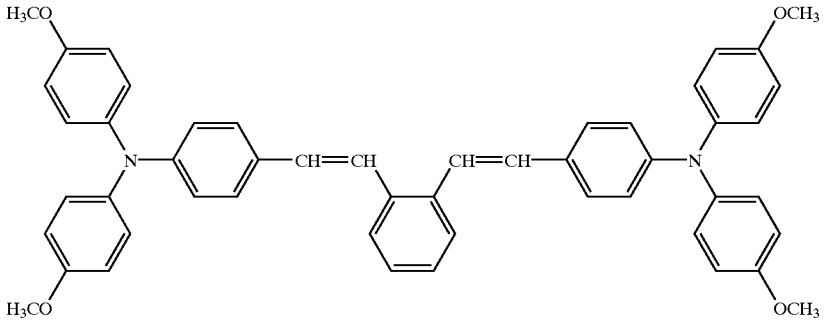

-continued
(HT1-133)
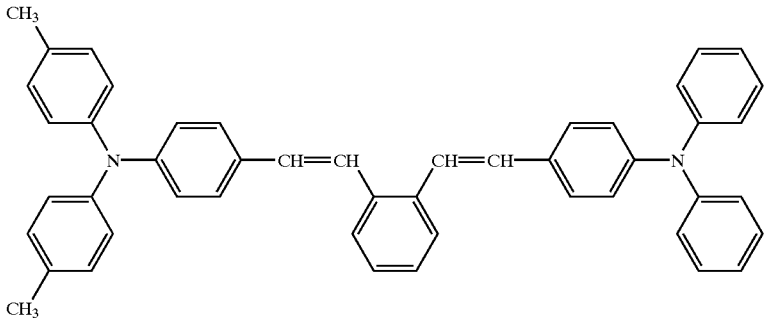
(HT1-134)
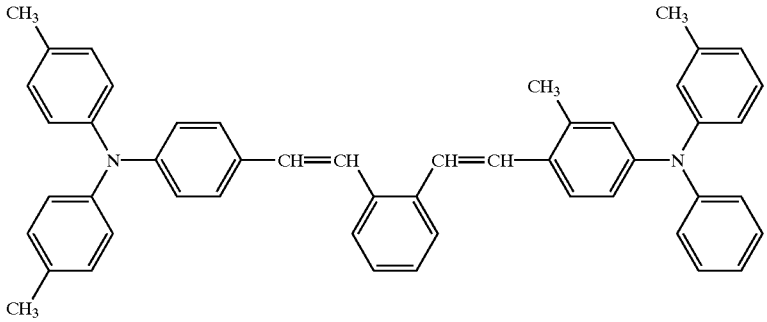
(HT1-135)
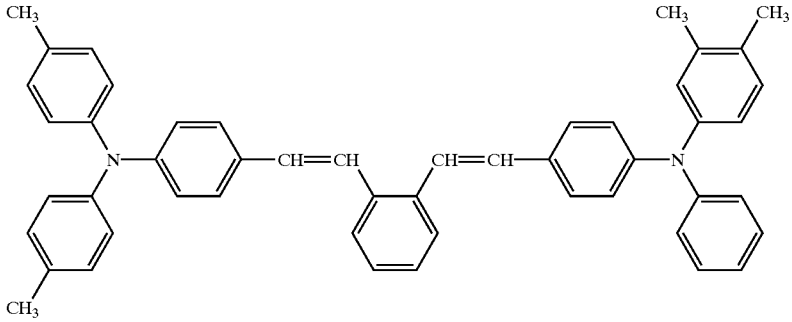
(HT1-136)
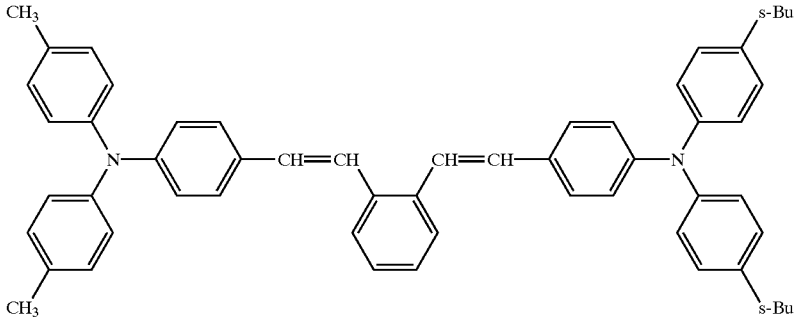
(HT2-1)
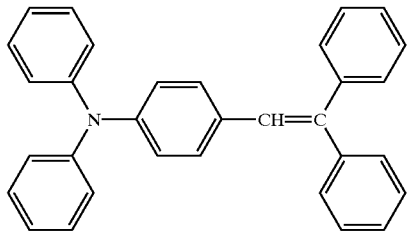
(HT2-2)
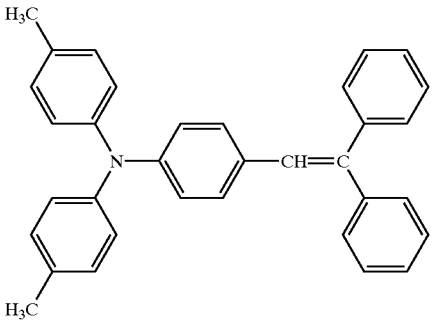

-continued
(HT2-3)
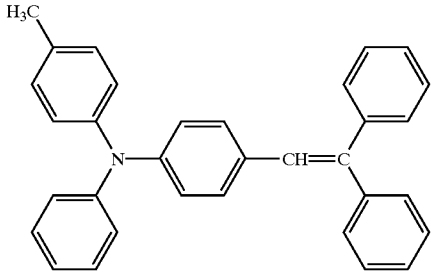
(HT2-4)
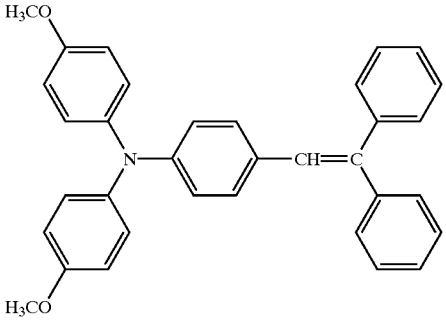
(HT2-5)
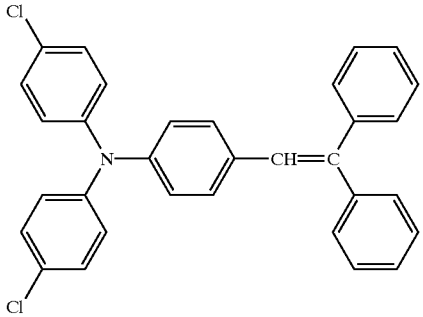
(HT2-6)
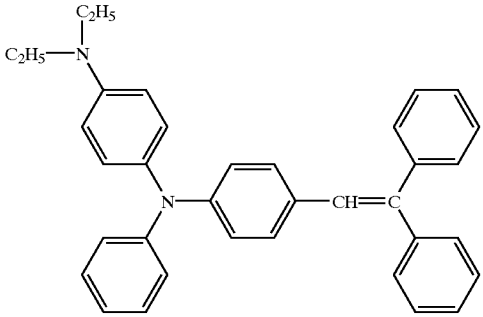
(HT2-7)
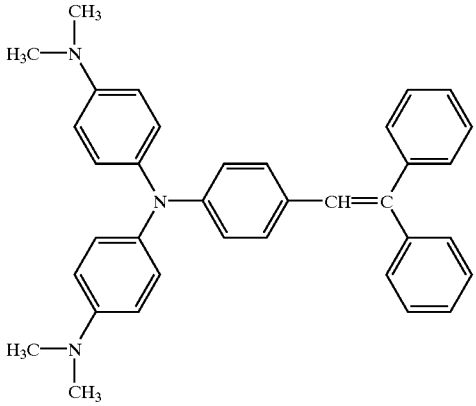
(HT2-8)
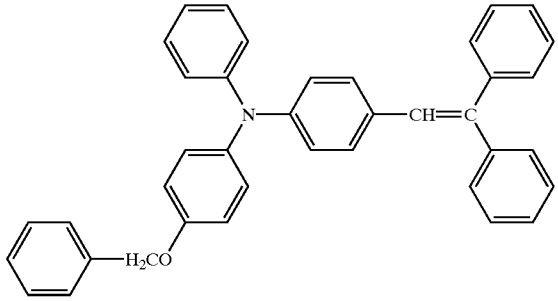
(HT2-9)
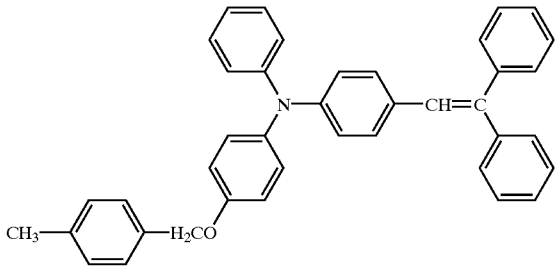
(HT2-10)
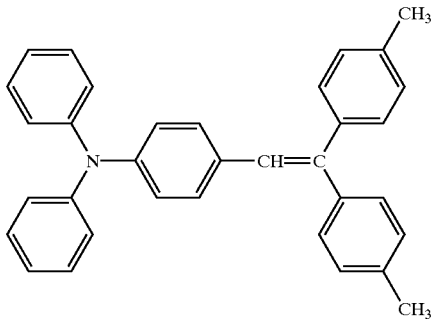

-continued
(HT2-11)
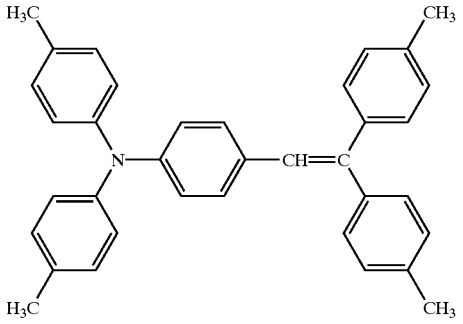
(HT2-12)
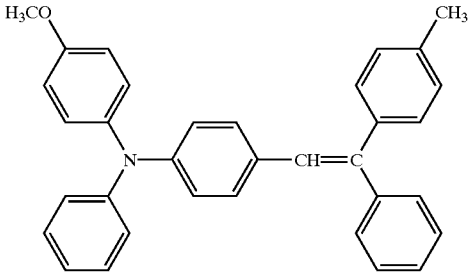
(HT2-13)
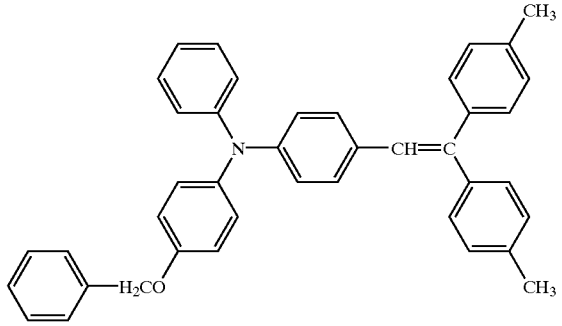
(HT2-14)
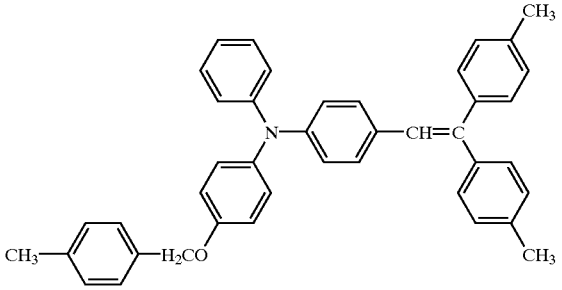
(HT2-15)
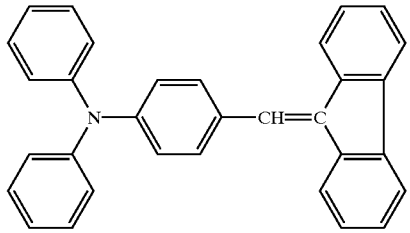
(HT2-16)
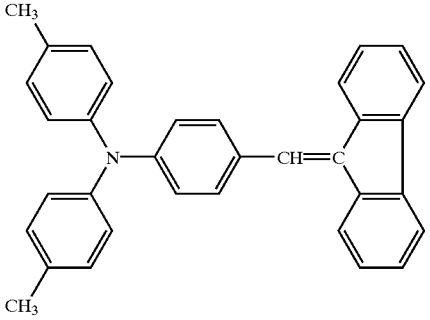
(HT2-17)
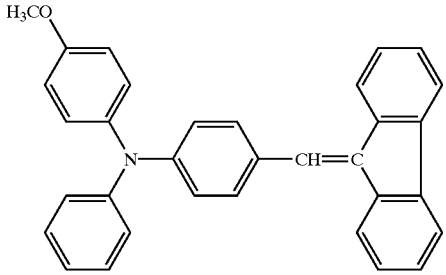
(HT2-18)
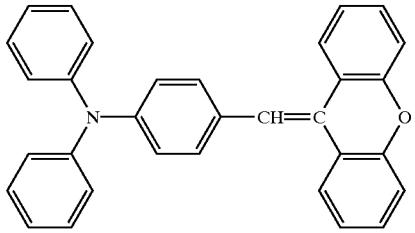
(HT2-19)
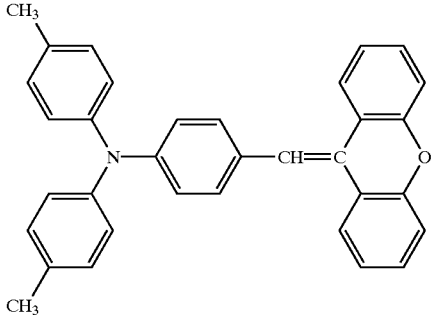
(HT2-20)
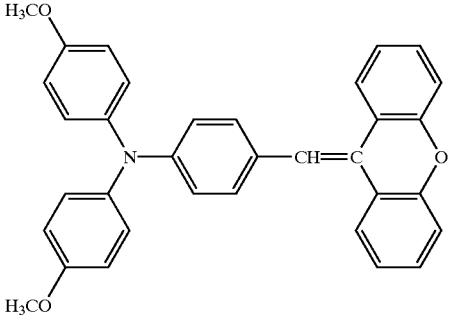

-continued
(HT2-21)
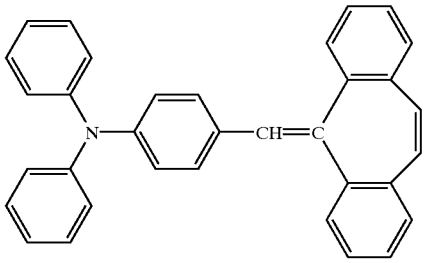
(HT2-22)
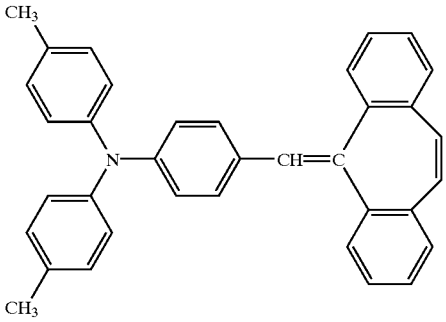
(HT2-23)
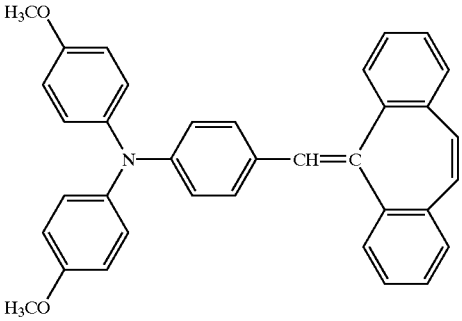
(HT2-24)
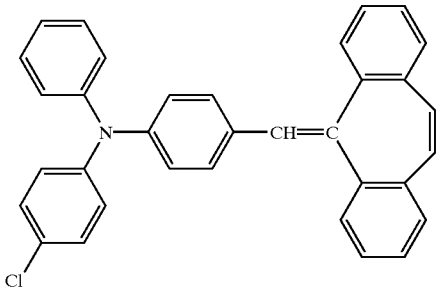
(HT2-25)
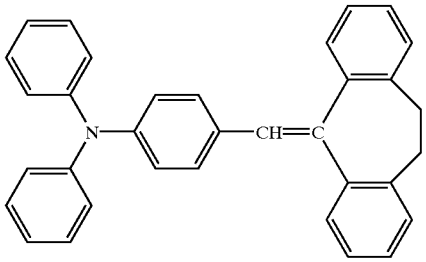
(HT2-26)
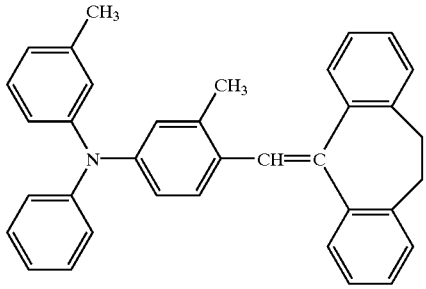
(HT2-27)
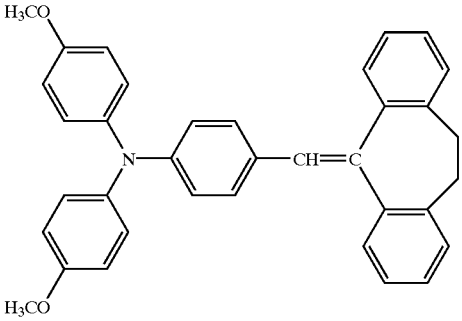
(HT2-28)
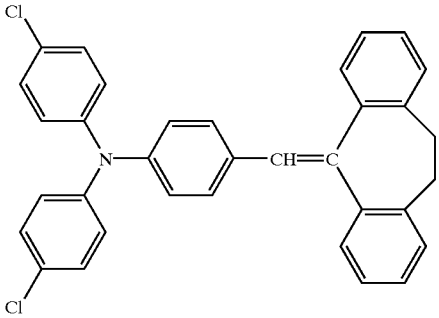
(HT2-29)
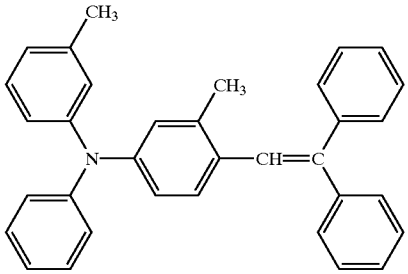
(HT2-30)
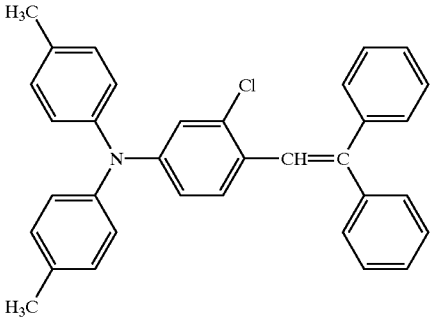

-continued
(HT2-31)
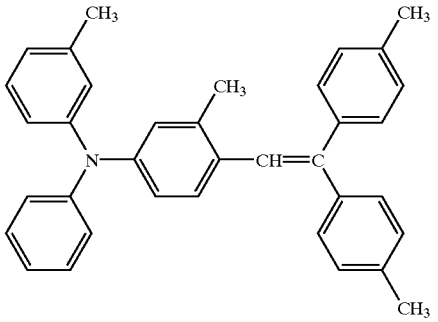
(HT2-32)
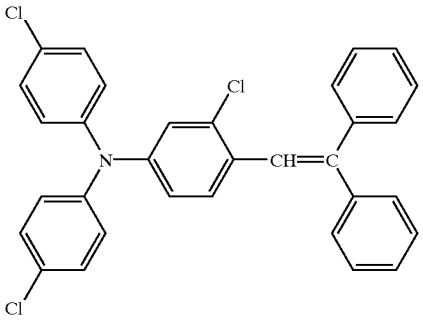
(HT2-33)
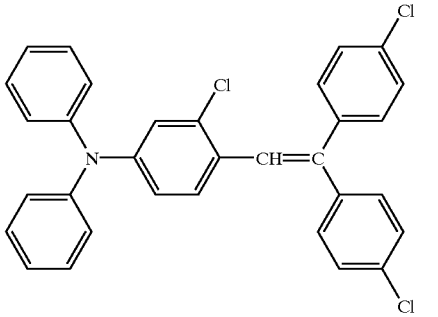
(HT2-34)
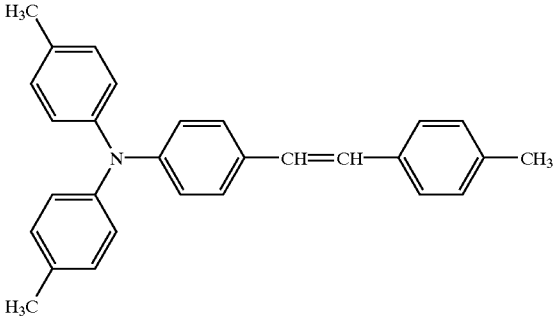
(HT2-35)
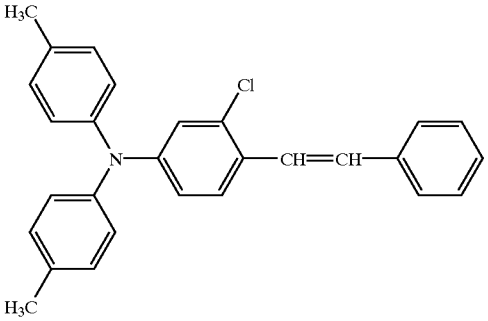
(HT2-36)
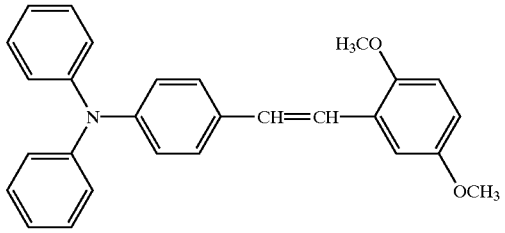
(HT2-37)
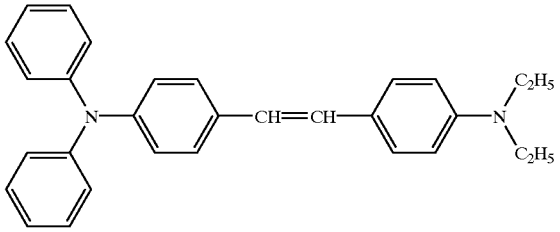
(HT2-38)
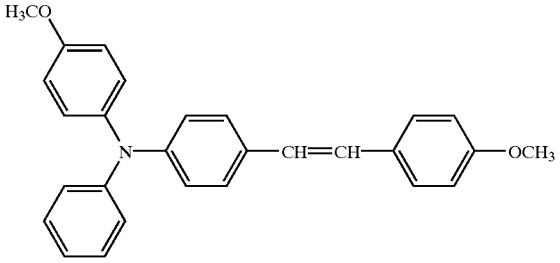
(HT2-39)
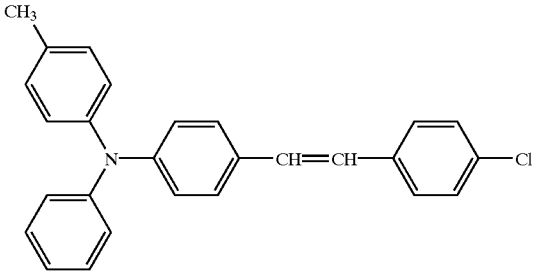
(HT2-40)
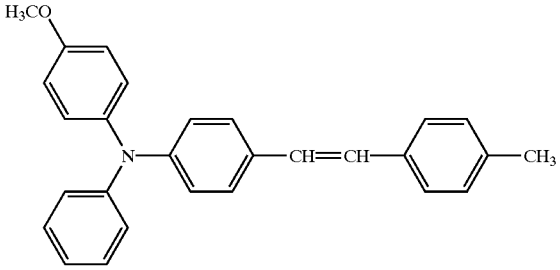

-continued
(HT2-41)
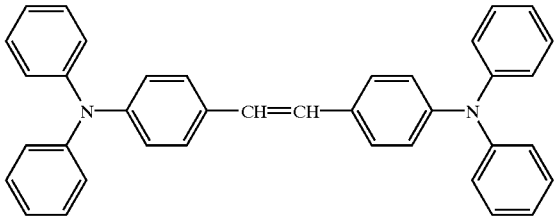
(HT2-42)
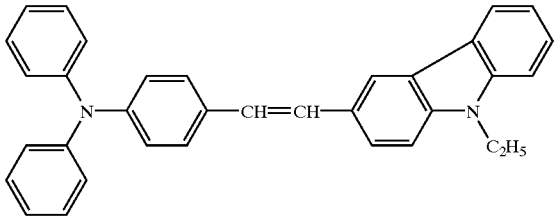
(HT2-43)
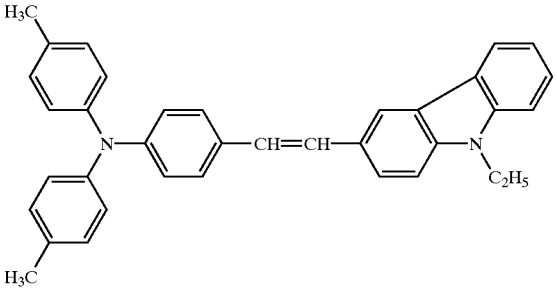
(HT2-44)
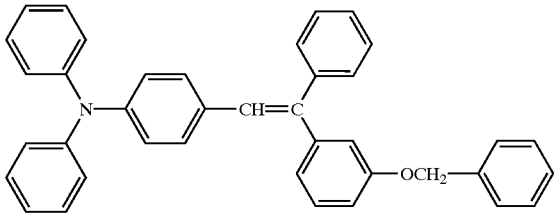
(HT2-45)
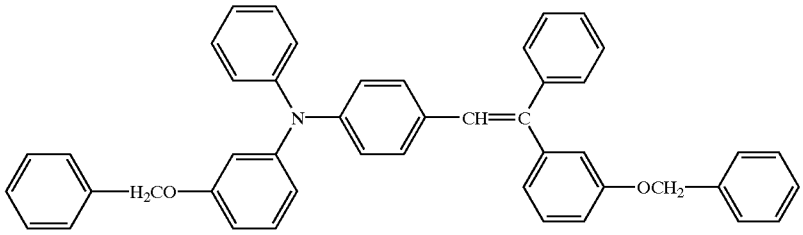
(HT2-46)
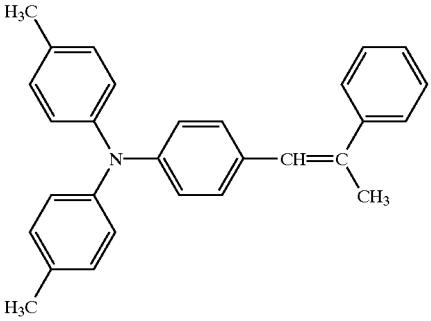
(HT2-47)
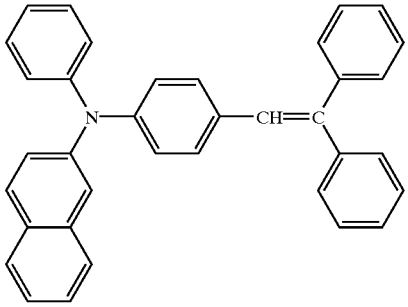
(HT2-48)
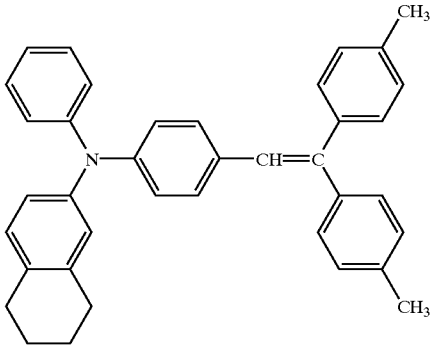
(HT2-49)
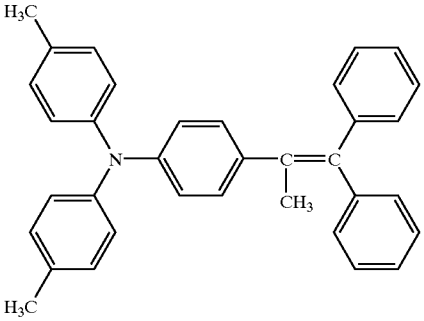

-continued
(HT2-50)
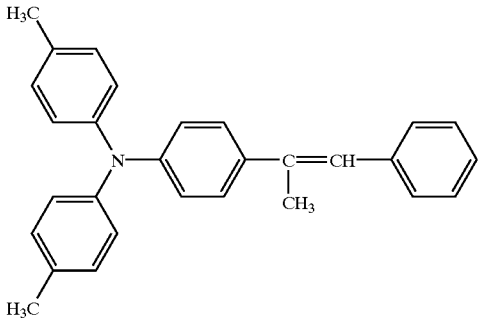
(HT2-51)
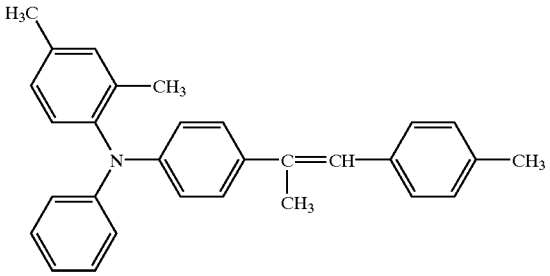
(HT2-52)
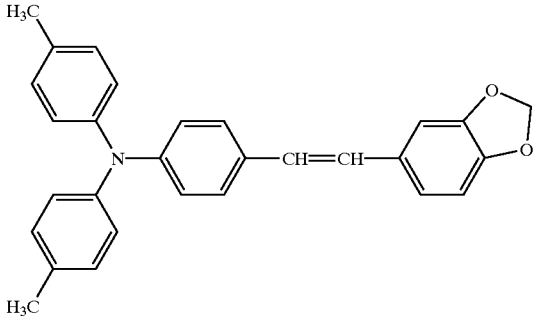
(HT2-53)
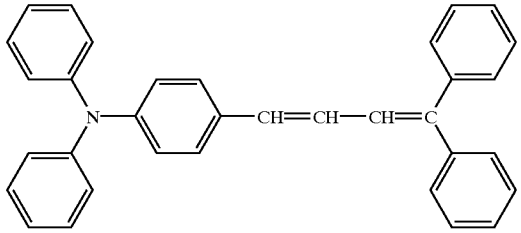
(HT2-54)
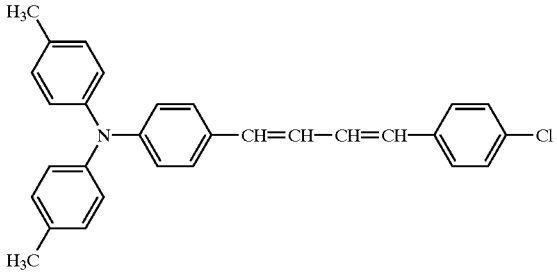
(HT2-55)
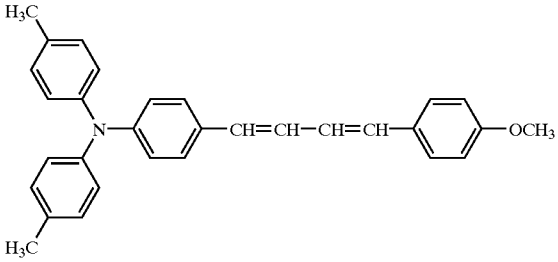
(HT2-56)
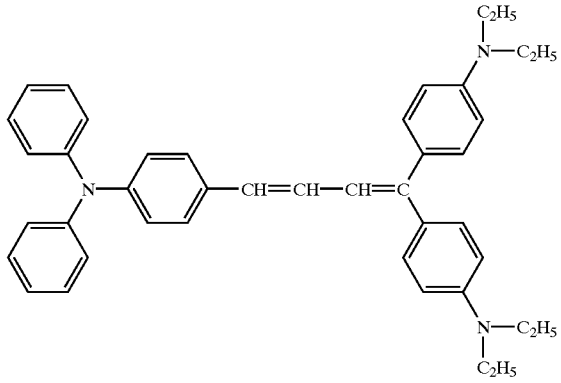
(HT2-57)
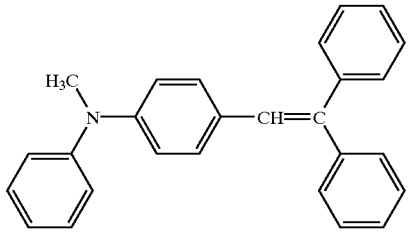

-continued
(HT2-58)
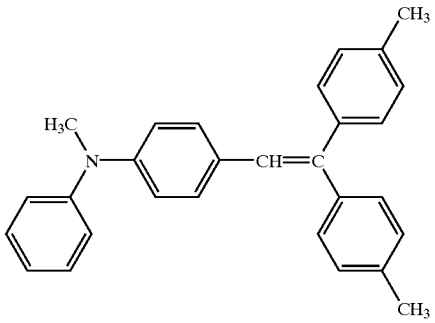
(HT2-59)
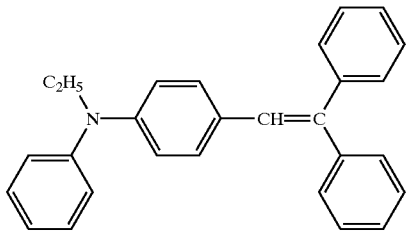
(HT2-60)
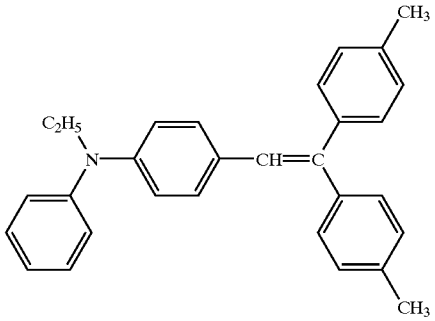
(HT2-61)
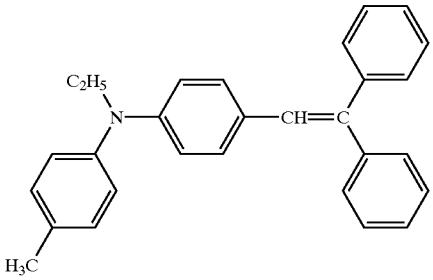
(HT2-62)
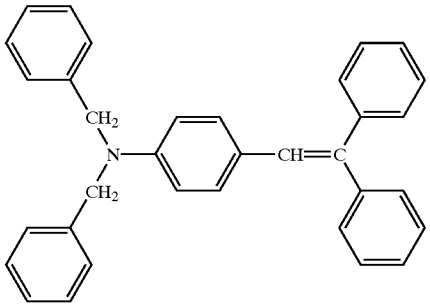
(HT2-63)
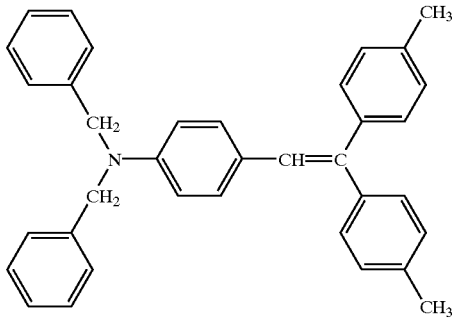
(HT2-64)
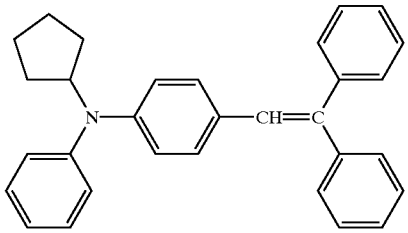
(HT2-65)
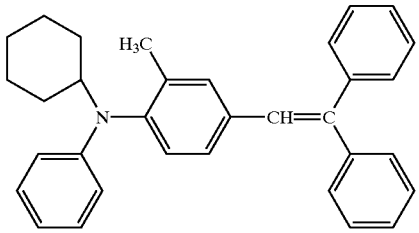
(HT2-66)
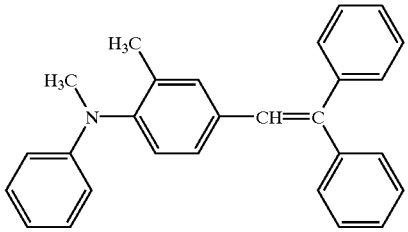
(HT2-67)
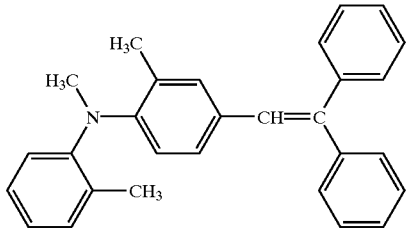

-continued
(HT2-68)
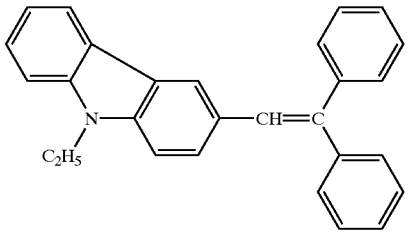
(HT2-69)
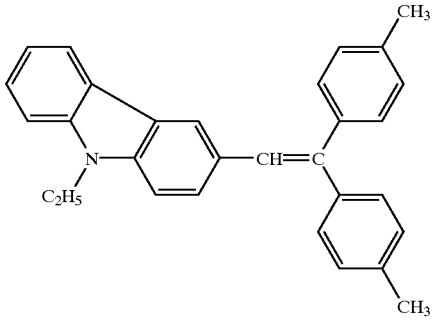
(HT2-70)
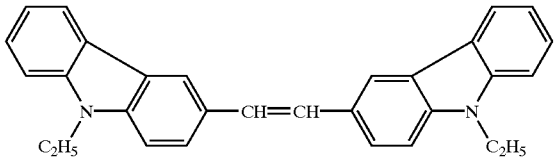
(HT3-1)
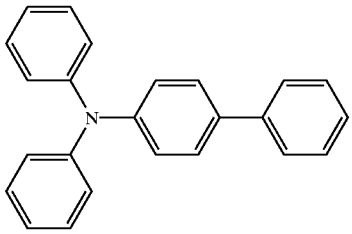
(HT3-2)
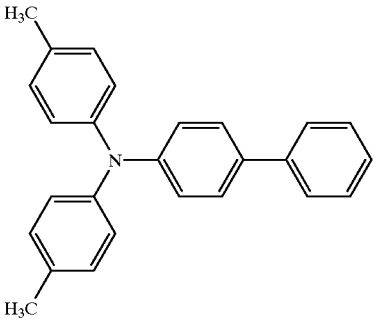
(HT3-3)
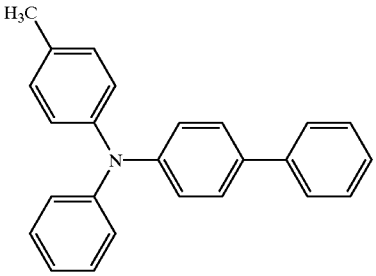
(HT3-4)
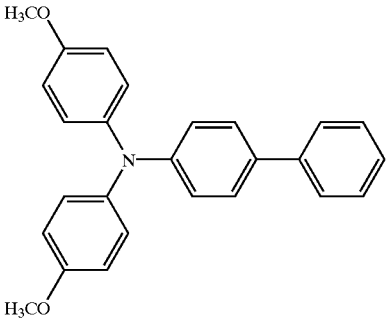
(HT3-5)
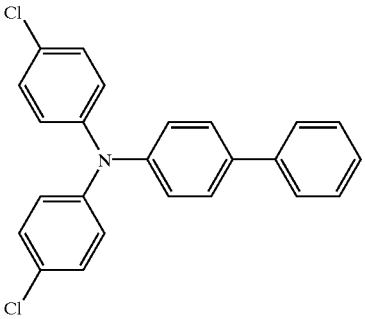
(HT3-6)
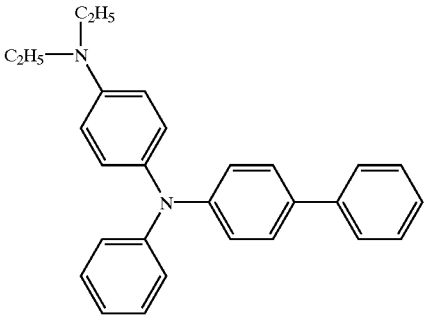
(HT3-7)
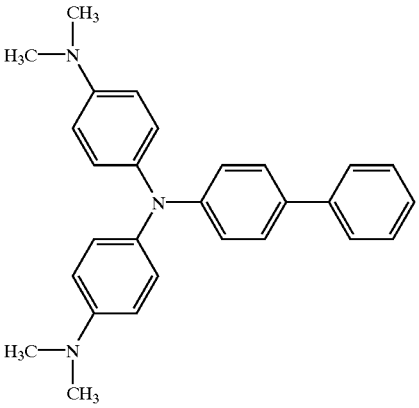

-continued
(HT3-8)
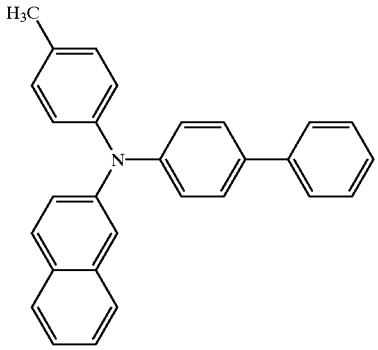
(HT3-9)
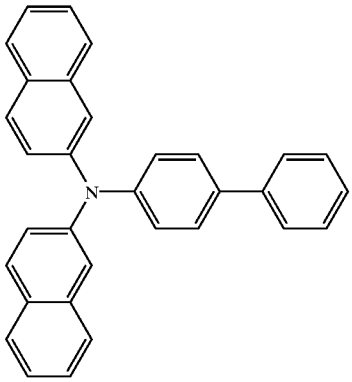
(HT3-10)
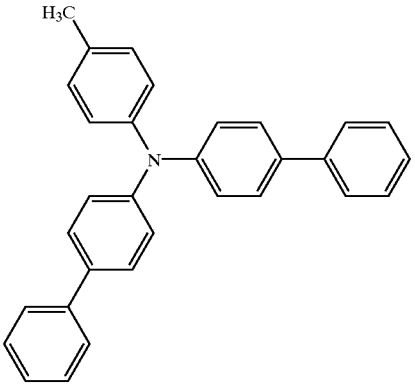
(HT3-11)
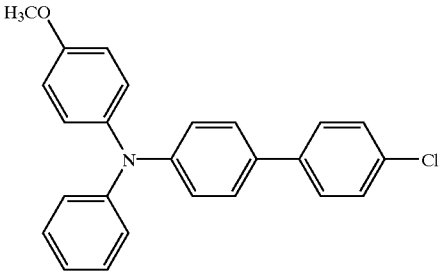
(HT3-12)
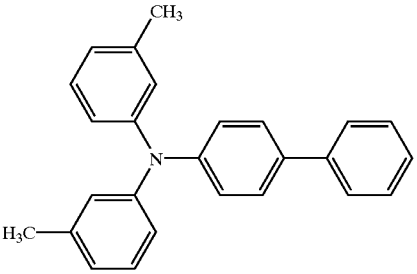
(HT3-13)
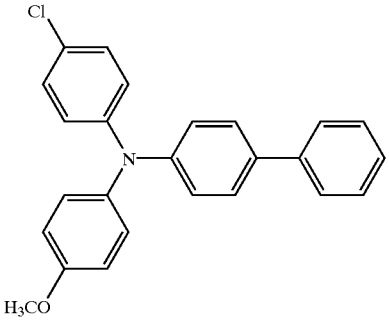
(HT3-14)
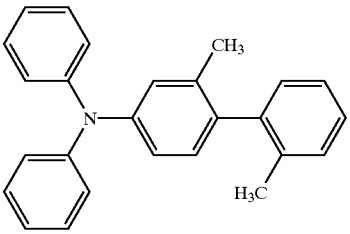
(HT3-15)
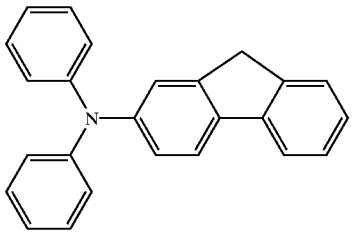

-continued
(HT3-16)
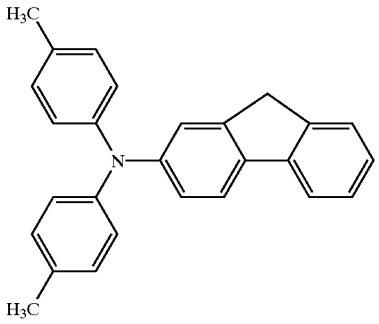
(HT3-17)
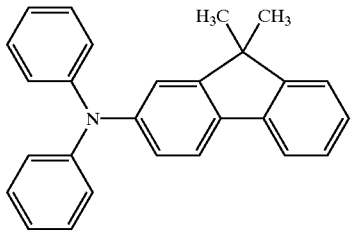
(HT3-18)
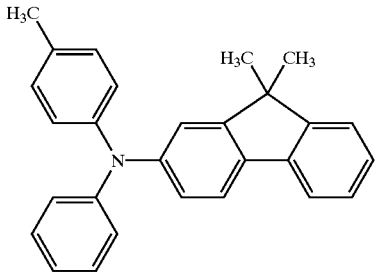
(HT3-19)
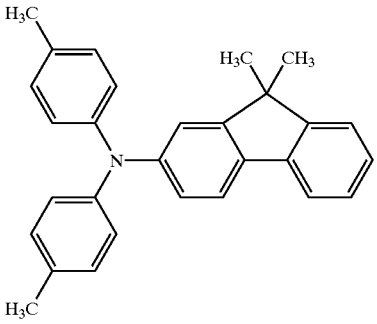
(HT3-20)
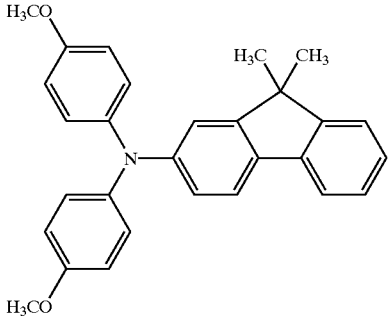
(HT3-21)
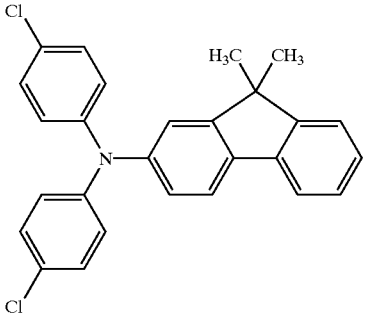
(HT3-22)
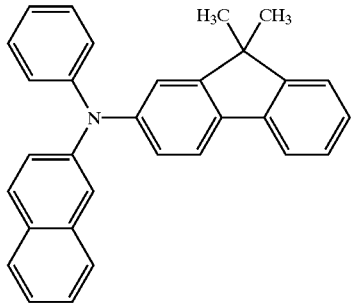
(HT3-23)
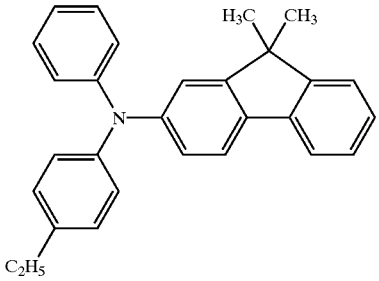

-continued
(HT3-24)
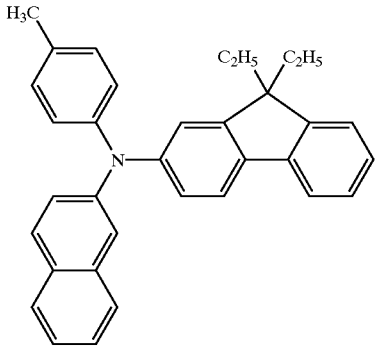
(HT3-25)
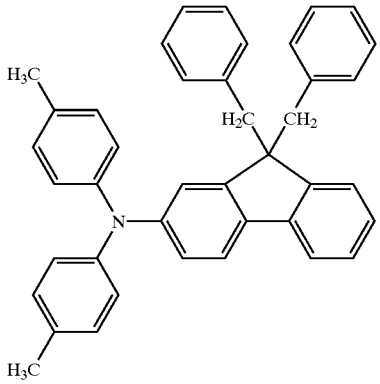
(HT3-26)
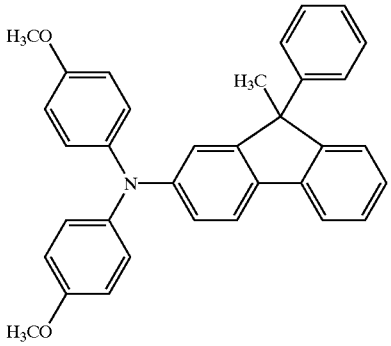
(HT3-27)
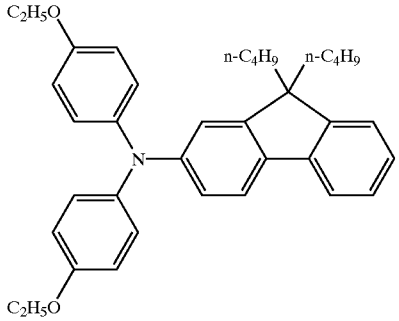
(HT3-28)
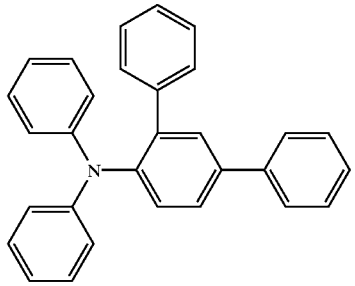
(HT3-29)
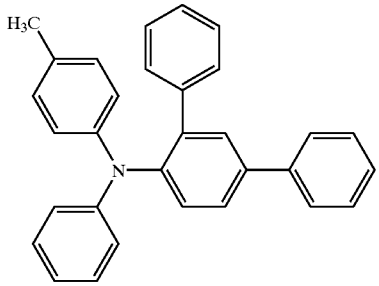
(HT3-30)
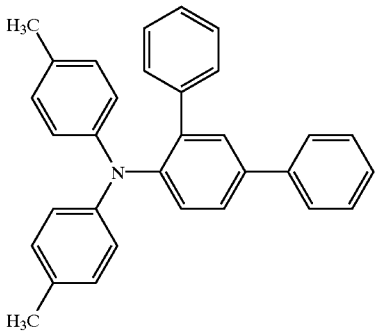
(HT3-31)
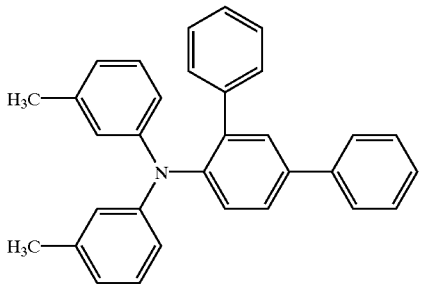

-continued
(HT3-32)
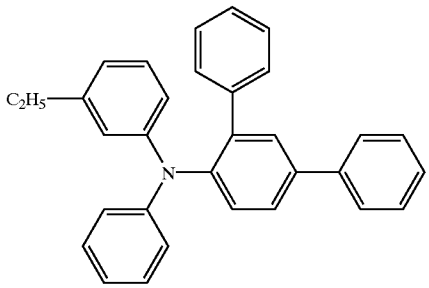
(HT3-33)
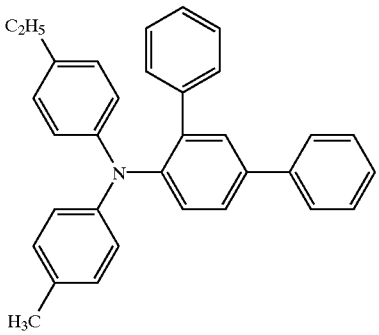
(HT3-34)
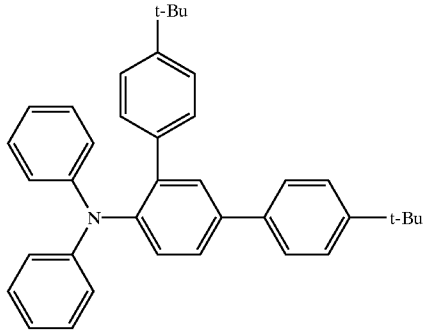
(HT3-35)
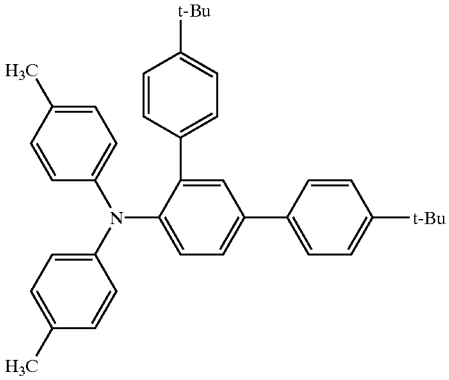
(HT3-36)
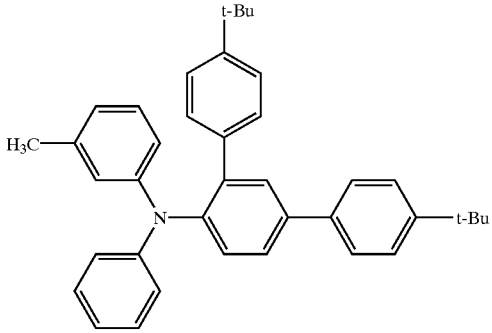
(HT3-37)
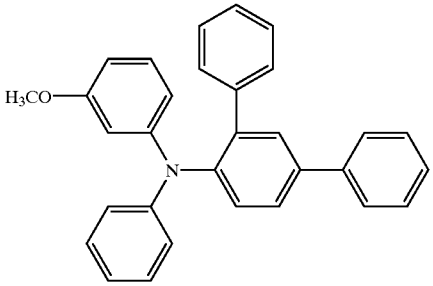
(HT3-38)
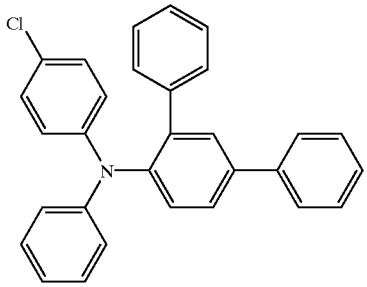
(HT3-39)
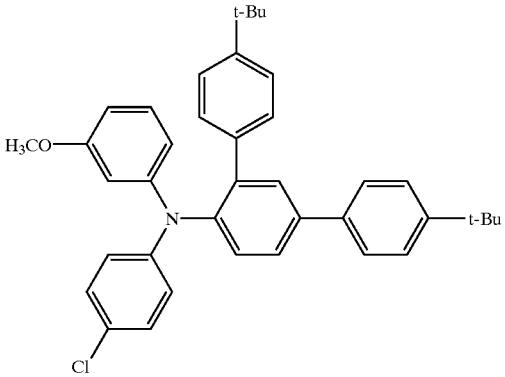

-continued
(HT4-1)
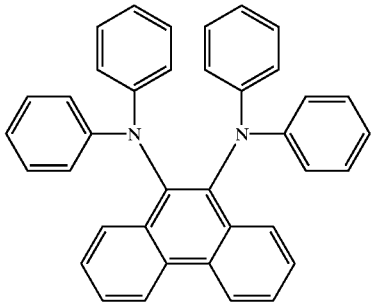
(HT4-2)
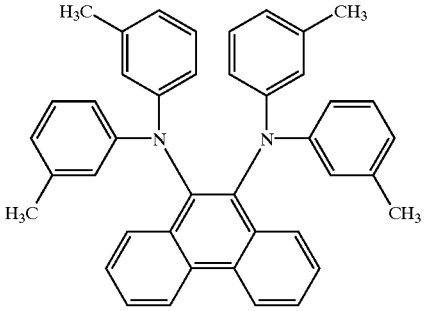
(HT4-3)
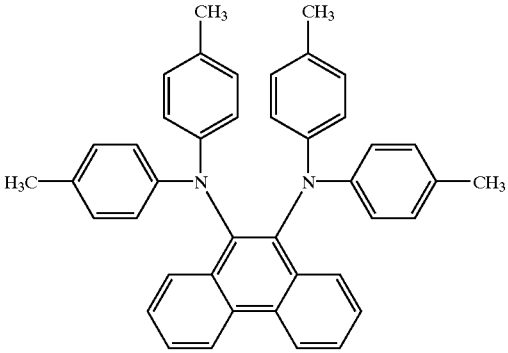
(HT4-4)
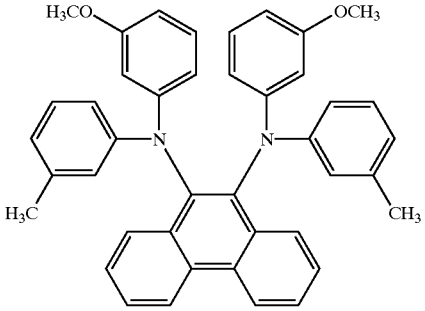
(HT4-5)
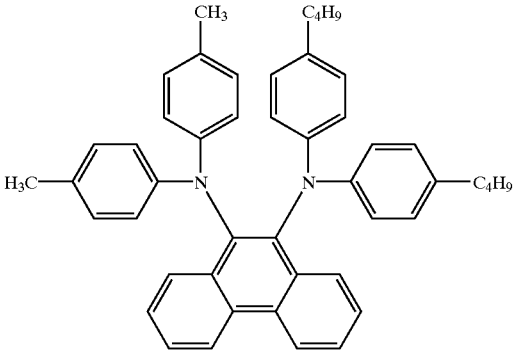
(HT4-6)
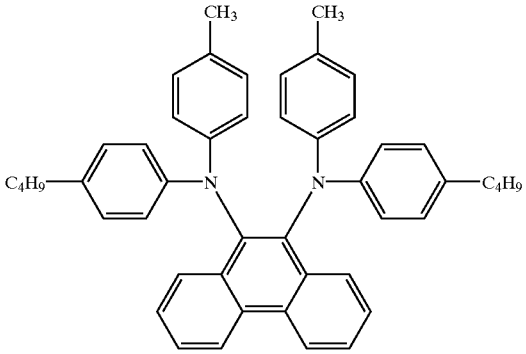
(HT4-7)
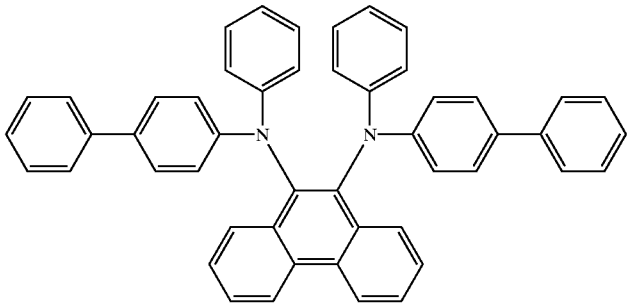

-continued
(HT4-8)
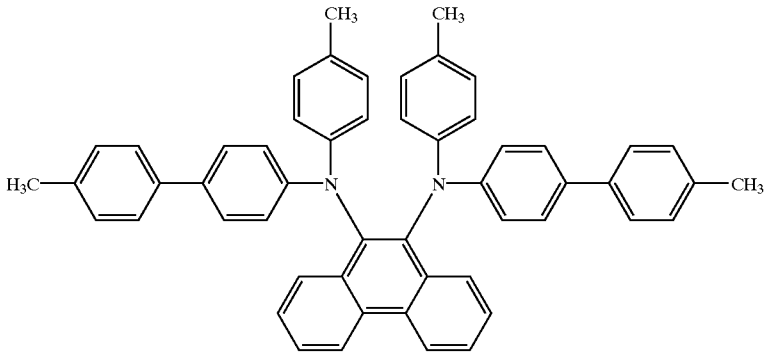
(HT4-9)
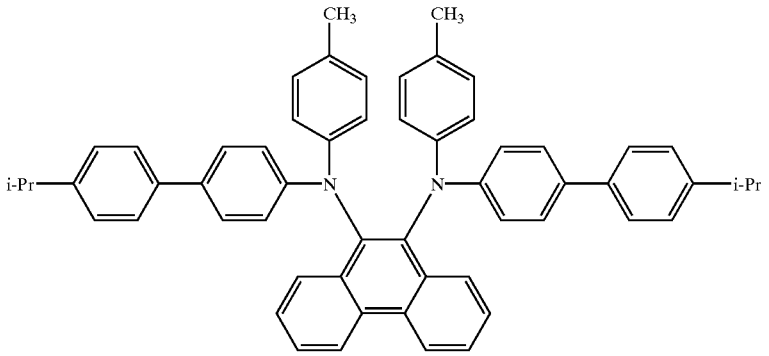
(HT4-10)
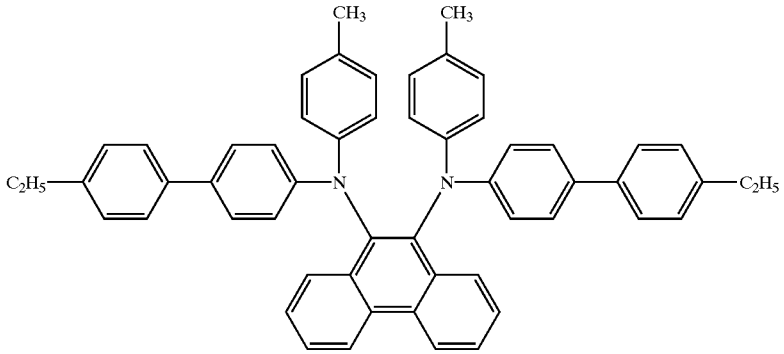
(HT4-11)
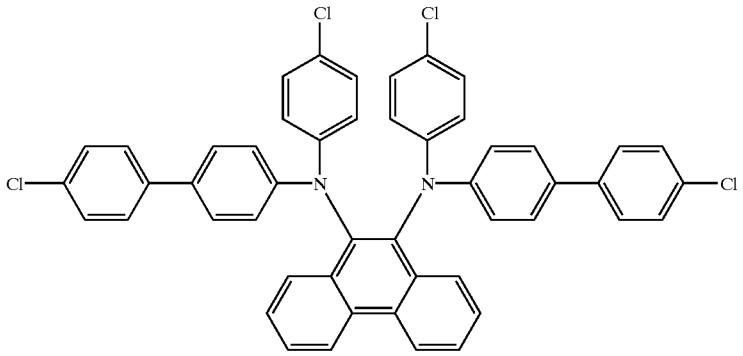

-continued
(HT4-12)
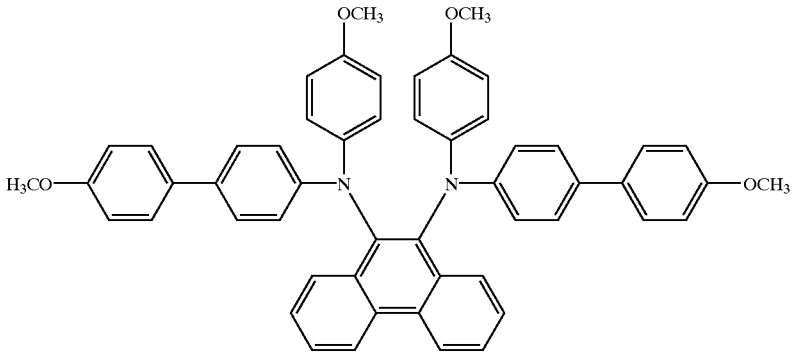
(HT4-13)
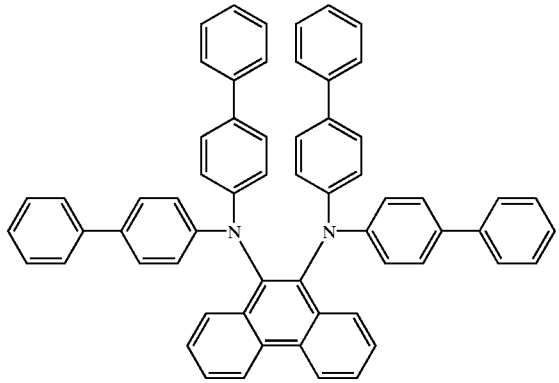
(HT4-14)
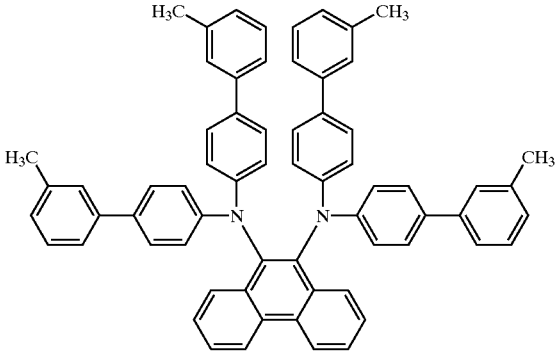
(HT4-15)
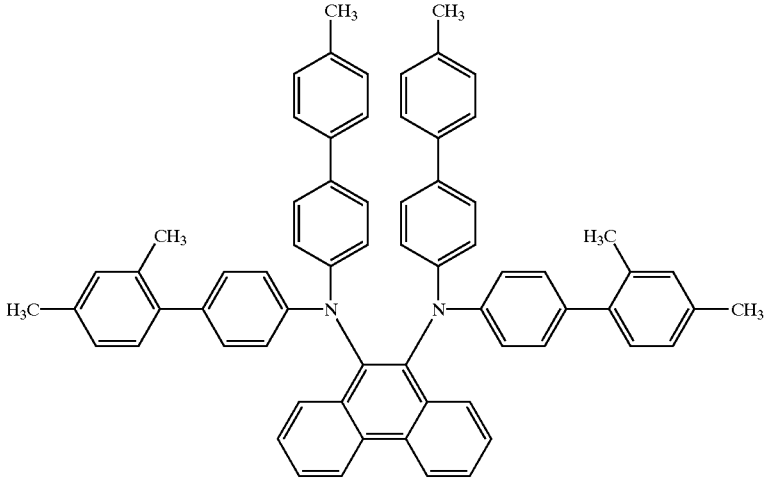

-continued
(HT4-16)
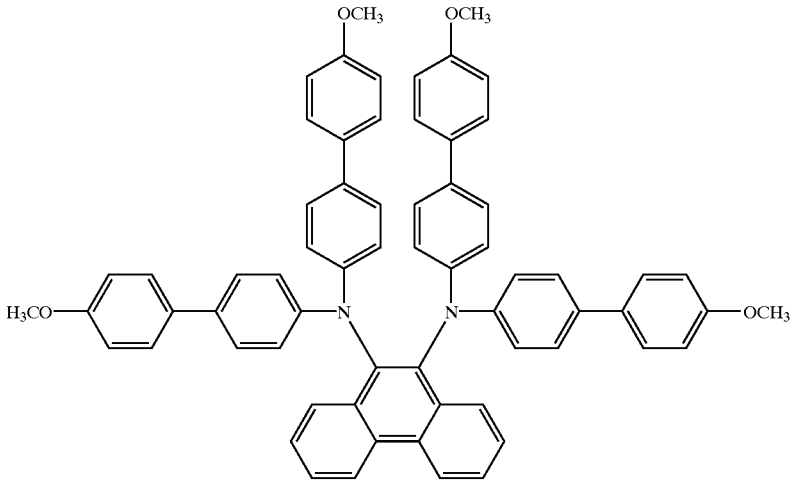
(HT4-17)
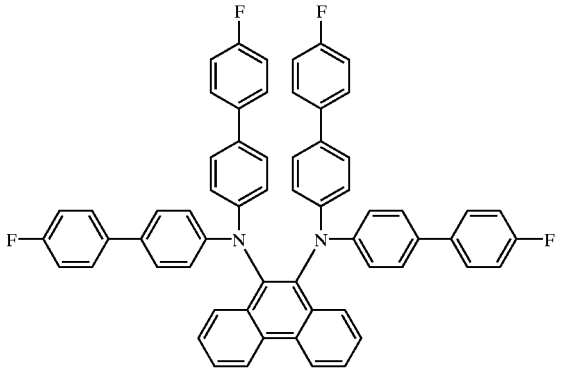
(HT4-18)
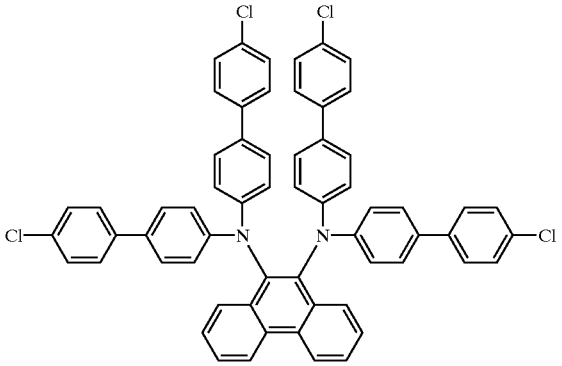
(HT4-19)
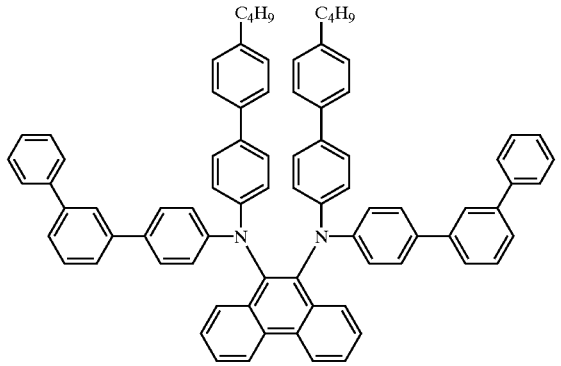
(HT4-20)
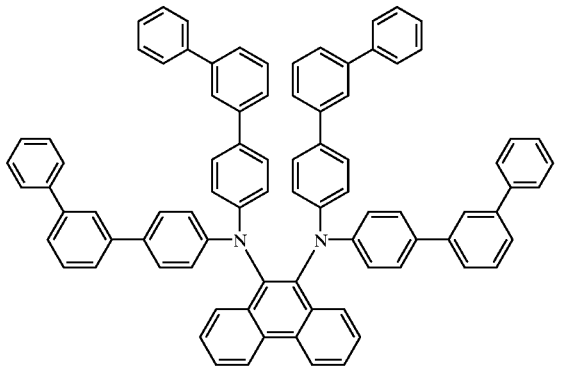

-continued
(HT5-1)
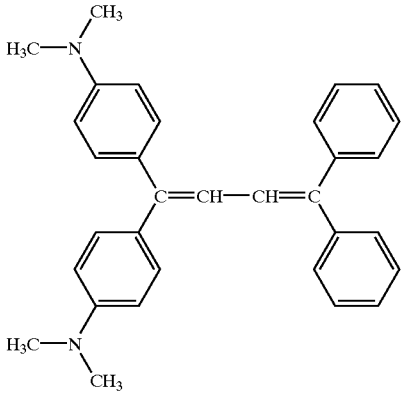
(HT5-2)
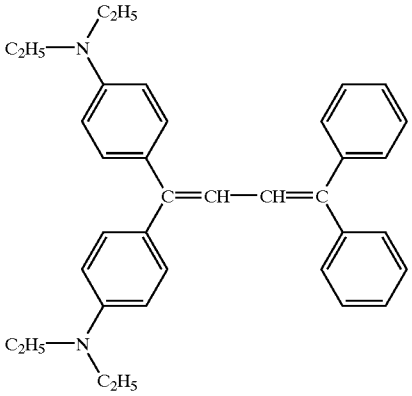
(HT5-3)
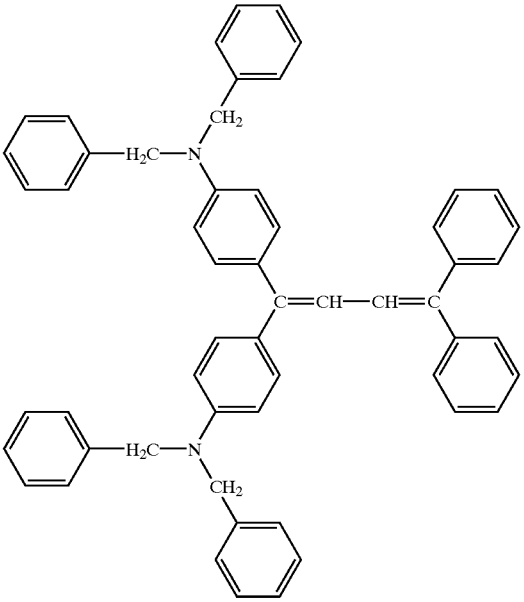
(HT5-4)
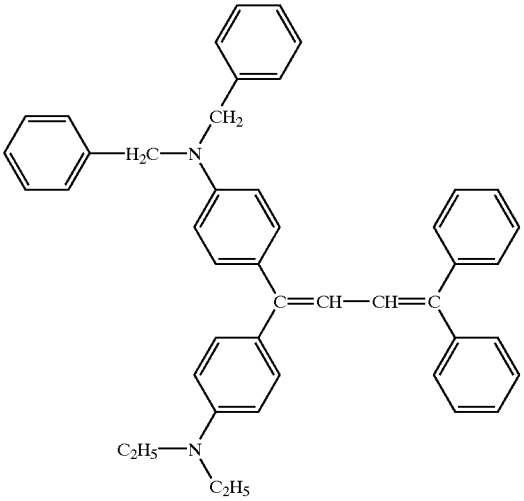
(HT5-5)
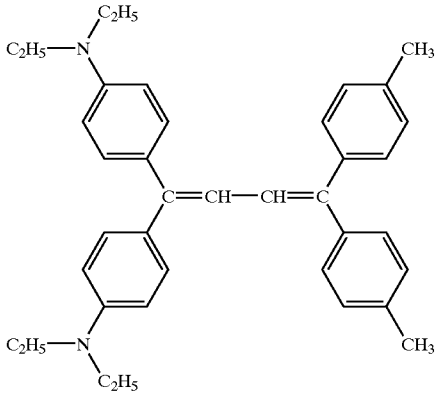
(HT5-6)
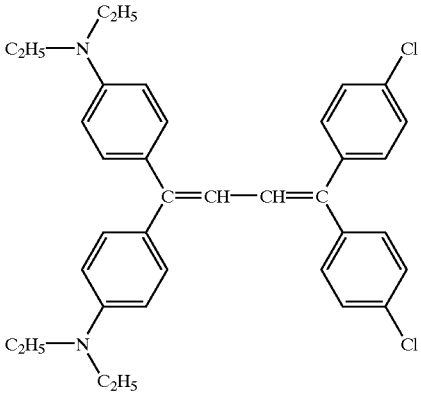

-continued
(HT5-7)
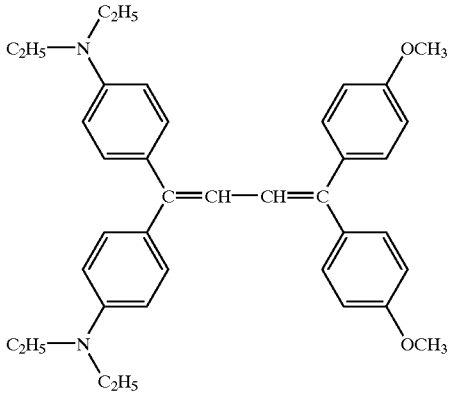
(HT5-8)
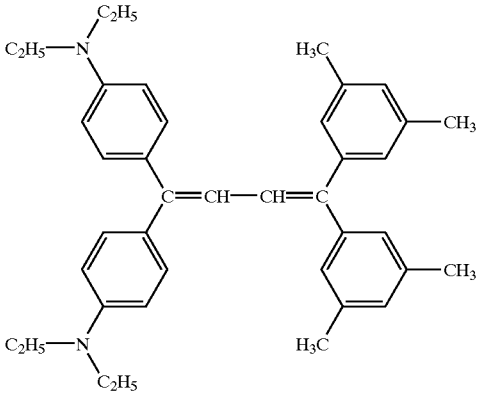
(HT5-9)
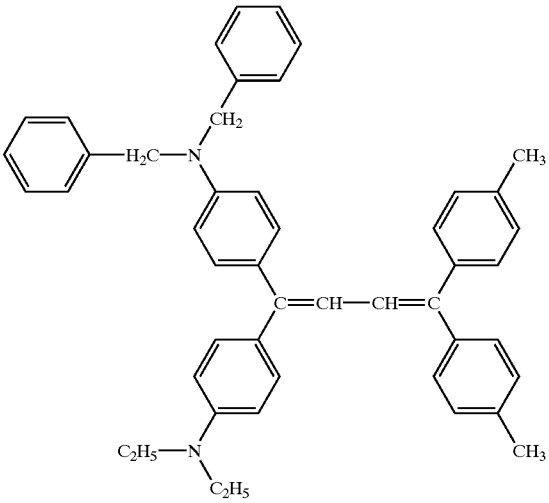
(HT5-10)
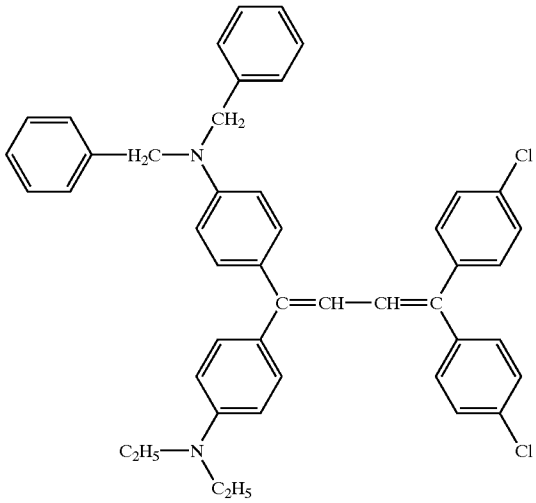
(HT-1)
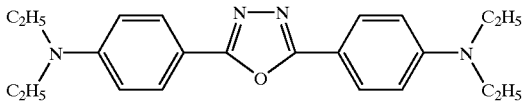
(HT-2)
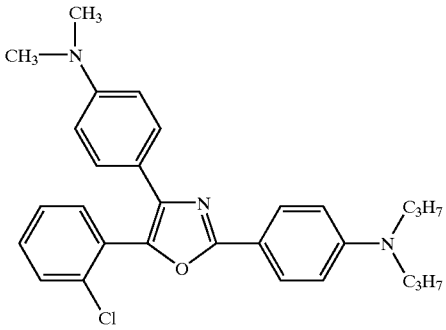
(HT-3)
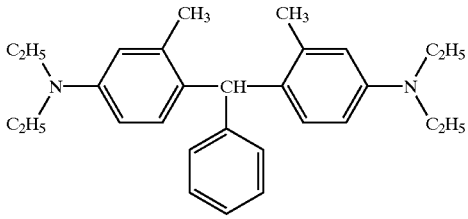
(HT-4)
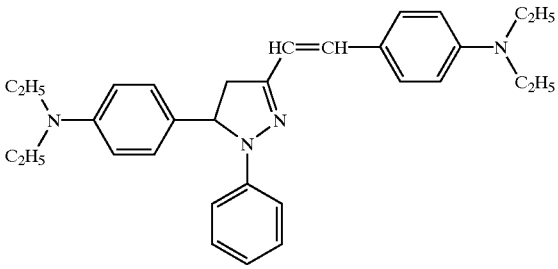

-continued
(HT-5)
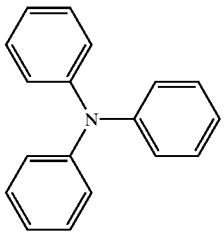
(HT-6)
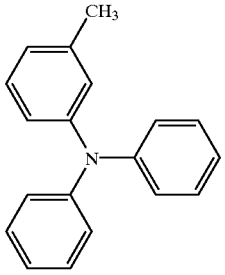
(HT-7)
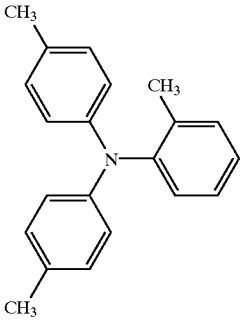
(HT-8)
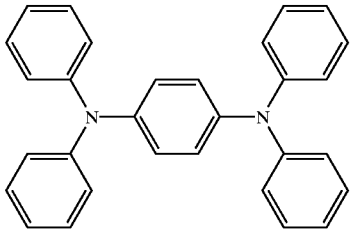
(HT-9)
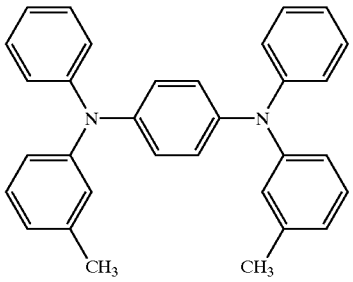
(HT-10)
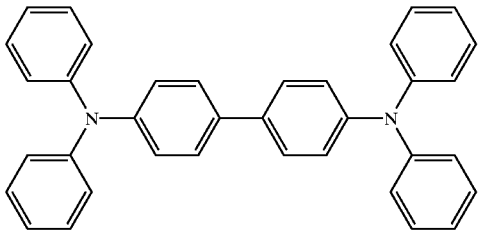
(HT-11)
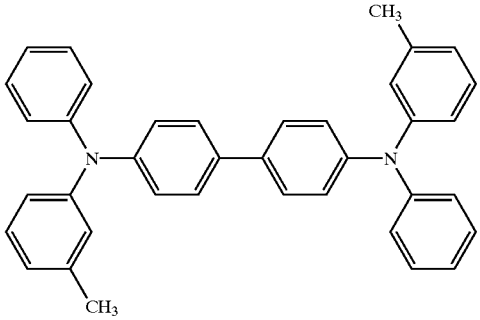
(HT-12)
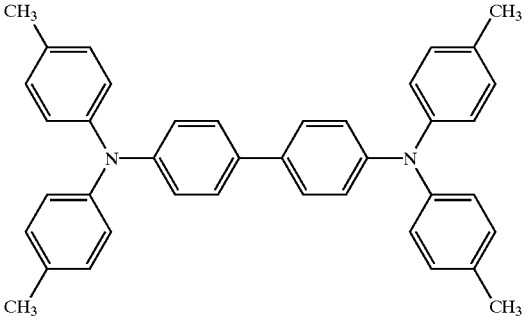
(HT-13)
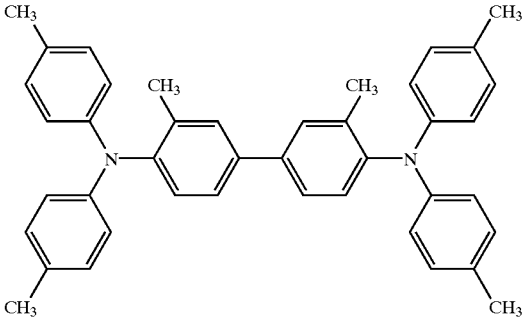
(HT-14)
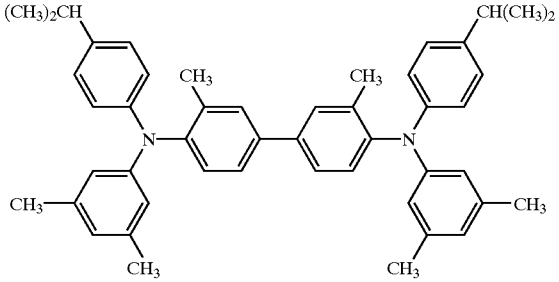

-continued
(HT-15)
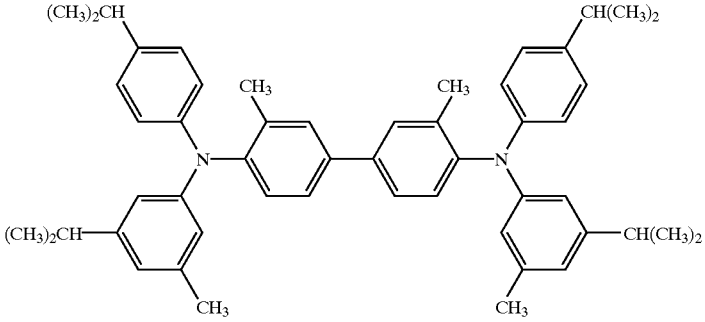
(HT-16)
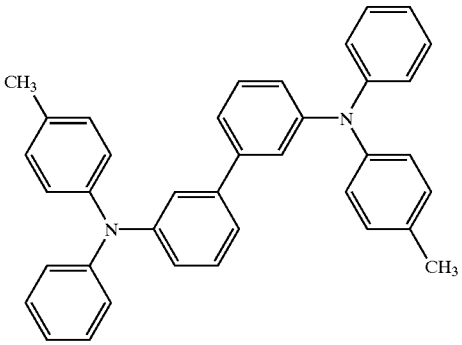
(HT-17)
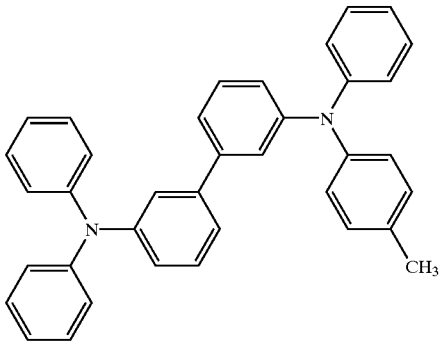
(HT-18)
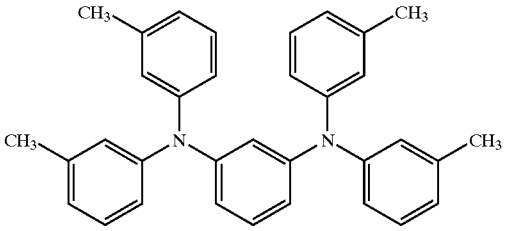
(HT-19)
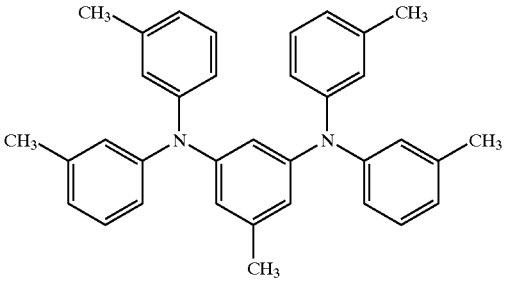
(HT-20)
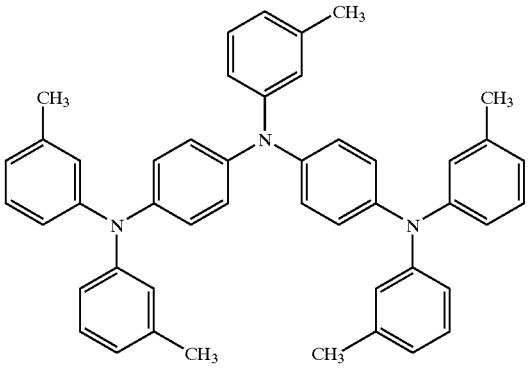
(HT-21)
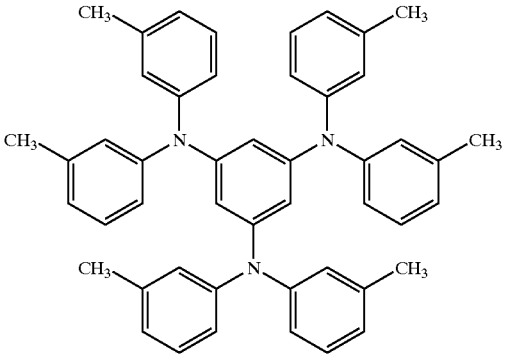
(HT-22)
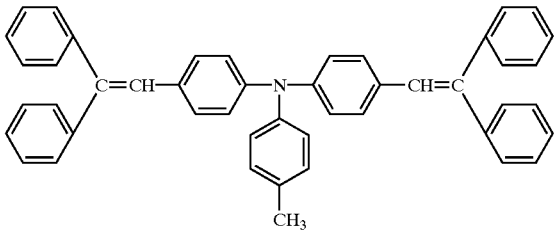
(HT-23)
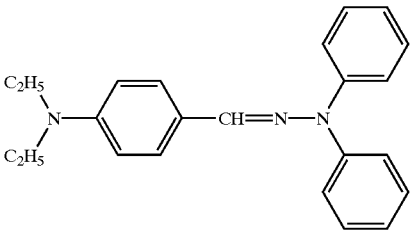

-continued
(HT-24)
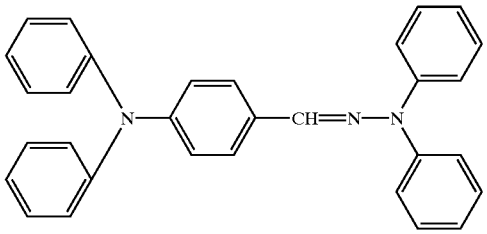
(HT-25)
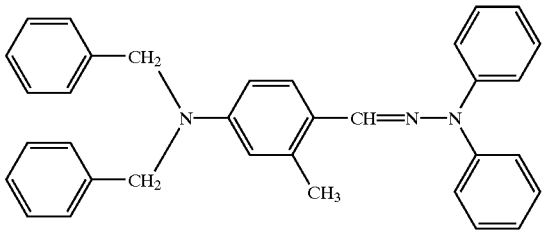
(HT-26)
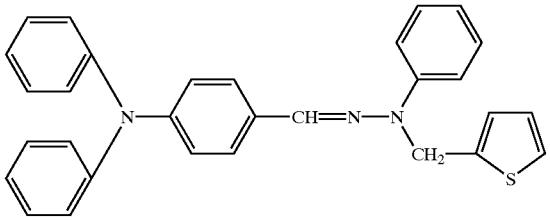
(HT-27)
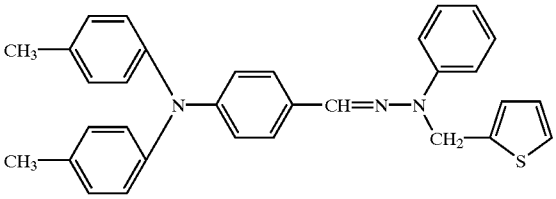
(HT-28)
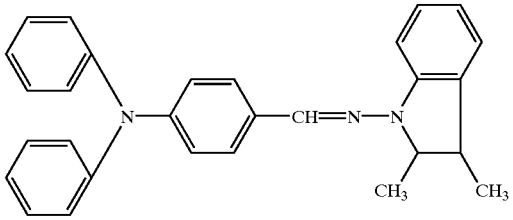
(HT-29)
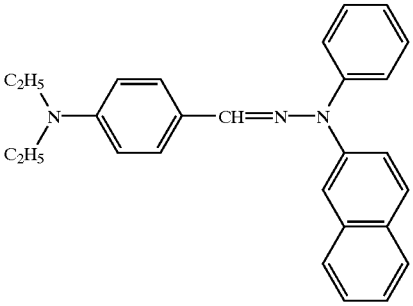
(HT-30)
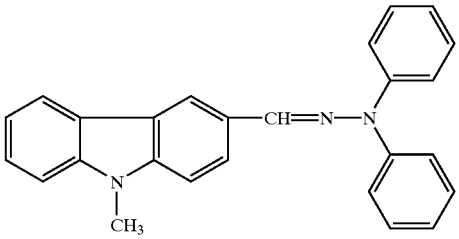
(HT-31)
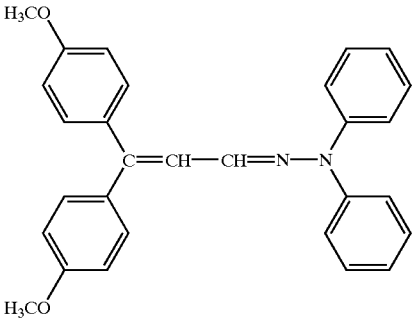
(HT-32)
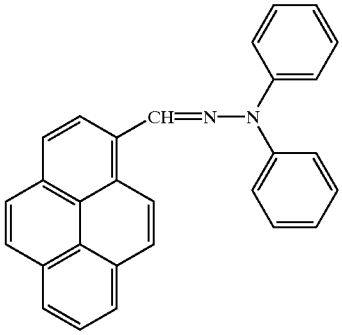

-continued (HT-33)

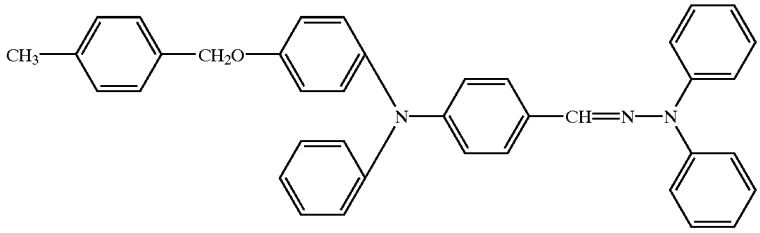

(HT-34)

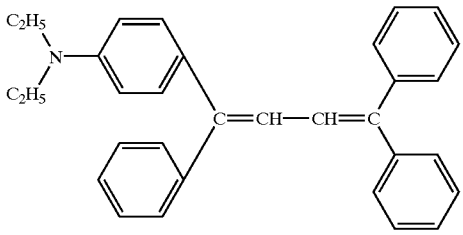

(HT-35)

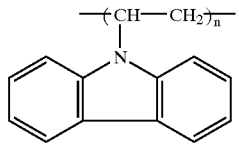

$n$ = 10–10,000

(HT-36)

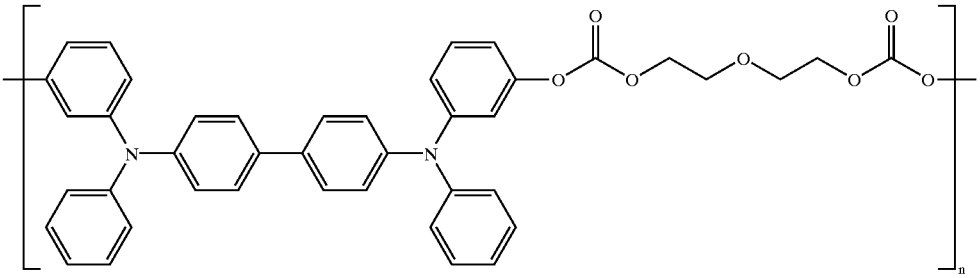

$n$ = 10–10,000

(HT-37)

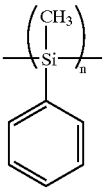

$n$ = 10–10,000

The resin binder of photosensitive layer 3 may be selected from polycarbonate resin, polyester resin, polyvinylacetal resin, polyvinylbutyral resin, polyvinylalcohol resin, vinylchloride resin, vinylacetate resin, polyethylene, polypropylene, acrylic resin, polyurethane resin, epoxy resin, melamine resin, silicone resin, polyamide resin, polystylene resin, polyacetal resin, polyarylate resin, polysulfone resin, and polymer of methacrylic acid ester, and copolymers of these resins, which may be used in suitable combination. In particular, polycarbonates, in which bisphenol Z type polycarbonate is a typical one, having the principal repeating unit represented by the general formula (BD1) may be suitably used. The specific examples of the polycarbonates include the polycarbonates having the repeating unit represented by the following structural formulas (BD1-1) to (BD1-16). Alternatively, any polycarbonate resin, having one or more repeating units represented by the following structural units (BD-1)–(BD7), as well as any polyester resin, may be used, but are not limited to those resins. A mixture of resins of the same species, but different molecular weight, may also be used as a binder resin.

The content of the binder resin is in the range from about 10 to about 90 wt. %, preferably from about 20 to about 80 wt. % with respect to the solid component of the photosensitive layer.

(BD1-1)

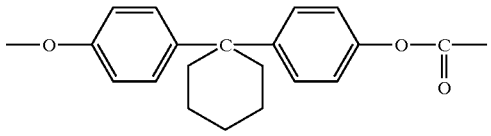

-continued
(BD1-2)
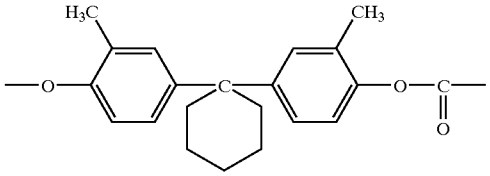
(BD1-3)
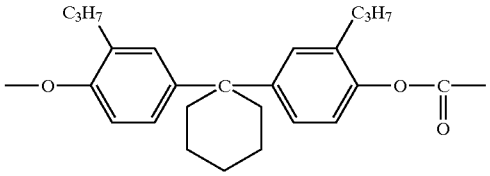
(BD1-4)
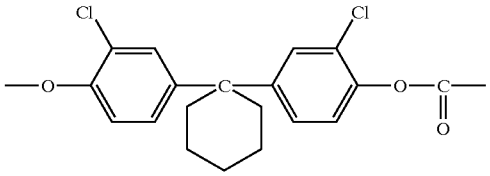
(BD1-5)
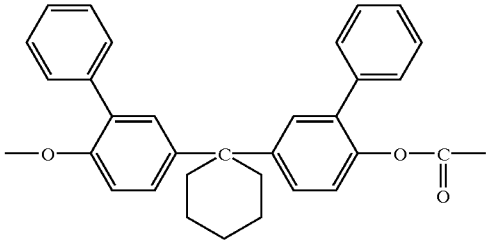
(BD1-6)
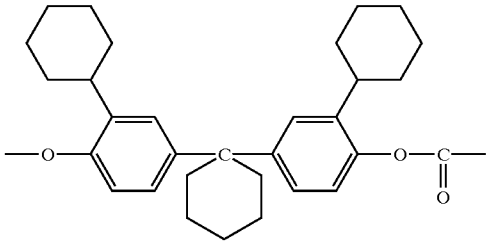
(BD1-7)
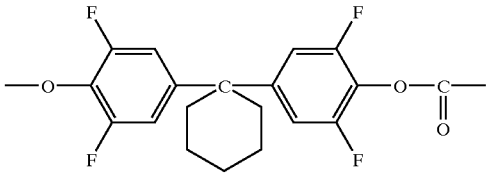
(BD1-8)
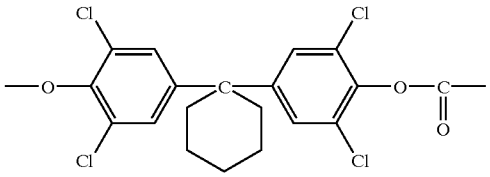
-continued
(BD1-9)
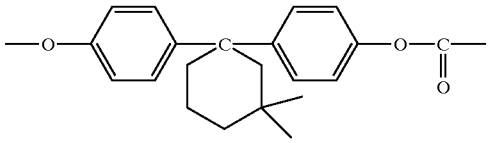
(BD1-10)
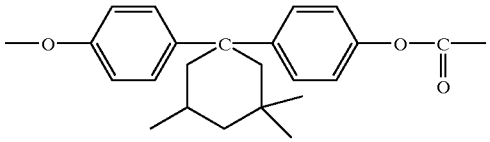
(BD1-11)
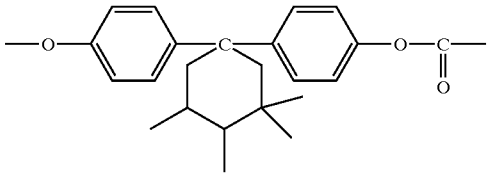
(BD1-12)
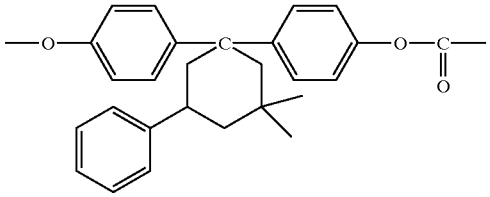
(BD1-13)
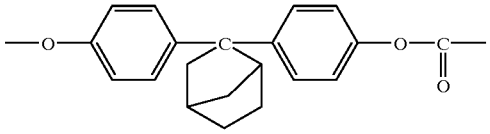
(BD1-14)
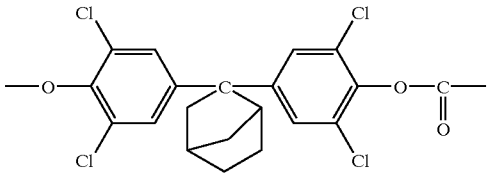
(BD1-15)
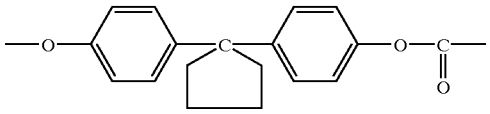
(BD1-16)
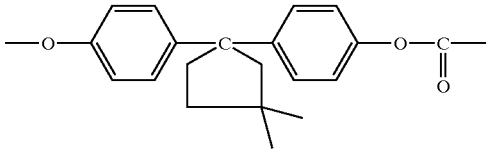
(BD-1)
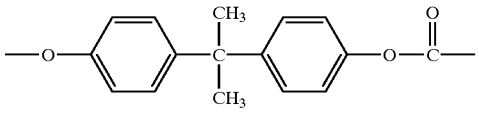

-continued (BD-2)

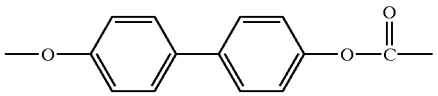

(BD-3)

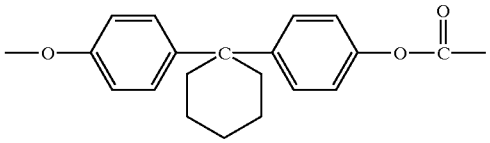

(BD-4)

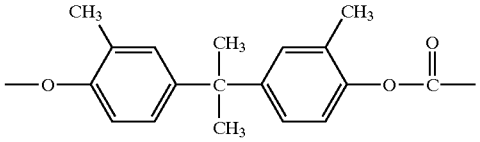

(BD-5)

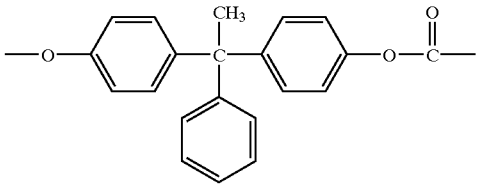

(BD-6)

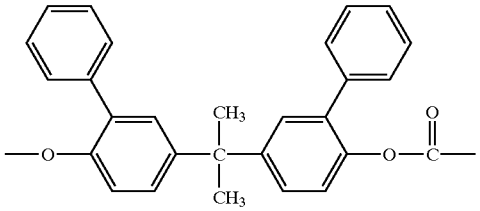

(BD-7)

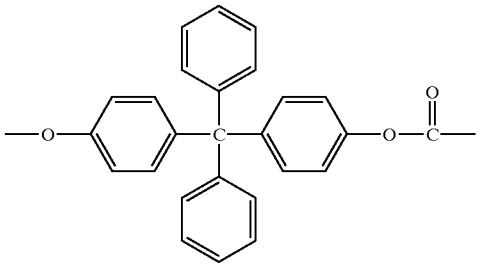

The film thickness of the photosensitive layer is preferably in a range from about 3 to about 100 $\mu$m, more preferably from about 10 to about 50 $\mu$m, so as to maintain a practically effective surface potential.

Photosensitive layer 3 may contain an antioxidant or a photo-stabilizing agent to enable photosensitive layer 3 to withstand hazardous environment or improve stability against hazardous light. The compound used for these purposes may be selected from chromanol derivatives such as tocopherol, polyarylalkane compounds, hydroquinone derivatives, benzophenone derivatives, benzotriazole derivatives, thioether compounds, phenylene diamine derivatives, phosphonic ester, phosphorous ester, phenol compounds, hindered phenol compounds, straight chain amine compounds, cyclic amine compounds, and hindered amine compounds.

Photosensitive layer 3 may contain a leveling agent such as silicone oil or fluoro oil for improving flatness and lubrication performance of the formed film.

Photosensitive layer 3 may further contain, for the purposes of reducing friction coefficient and providing lubrication, fine particles of a metal oxide, such as silicon oxide (silica), titanium oxide, zinc oxide, calcium oxide, aluminum oxide (alumina), or zirconium oxide, a metal sulfate such as barium sulfate or calcium sulfate, a metal nitride such as silicon nitride or aluminum nitride, particles of fluororesin, such as tetrafluoroethylene resin, or comb-type graft polymerized fluororesin.

Further, photosensitive layer 3 may contain other known additives as needed, in the range in which electrophotographic characteristics are not much deteriorated.

Protection Layer

Protection layer 4 may be provided, as needed, to improve durability in repeated printings. Protection layer 4 is preferably formed from a layer of a resin binder as a major component, or a thin film of inorganic material, such as amorphous carbon. The binder resin of protection layer 4 may contain, to improve electrical conductivity, reduce friction coefficient, or provide lubrication, fine particles of a metal oxide, such as silicon oxide (silica), titanium oxide, zinc oxide, calcium oxide, aluminum oxide (alumina), or zirconium oxide, a metal sulfate such as barium sulfate or calcium sulfate, a metal nitride such as silicon nitride or aluminum nitride, particles of fluororesin such as tetrafluoroethylene resin, or comb-type graft polymerized fluororesin.

Protection layer 4 may further contain a hole transport substance or an electron transport substance used in photosensitive layer 3, to provide charge transport capability. Protection layer 4 may also contain a leveling agent, such as silicone oil or fluoro oil, to improve flatness or provide lubrication of the formed film. Other known additives may be contained, as needed, in a range in which electrophotographic characteristics are not significantly deteriorated.

Method for Forming Layers

A preferred processes is described for forming undercoat layer 2, photosensitive layer 3, and protection layer 4. A coating liquid for each of the layers is prepared by dissolving and dispersing the materials described above in an appropriate solvent. The coating liquid is then coated by an appropriate coating method and dried.

The solvent is preferably selected from alcohols such as methanol, ethanol, n-propanol, i-propanol, n-butanol, and benzylalcohol, ketons such as acetone, MEK (methyl ethyl keton), methylisobutyl keton, and cyclohexanone, amides such as DMF (dimethy folmaldehyde) and dimethy acetoamide, sulfoxide such as dimethysulfoxide, cyclic and straight chain ethers such as THF (tetrahydrofuran), dioxane, dioxolane, diethylether, methyl cellosolve, and ethyl cellosolve, esters such as methyl acetate, ethyl acetate, and n-butyl acetate, aliphatic hydrocarbon halides such as methylene chloride, chloroform, carbon tetrachloride, dichloroethylene, trichloroethylene, mineral oils such as ligroin, aromatic hydrocarbons such as benzene, toluene, and xylene, aromatic hydrocarbon halides such as chlorobenzene and dichlorobenzene, and any mixture thereof.

The method for dissolving and dispersing the coating liquid is preferably selected from known methods including beads mill such as paint shaker, ball mill and DYNO-MIL® (manufactured by Wab Co.), and ultrasonic dispersion. The coating method is preferably selected from known methods including dip-coating, seal-coating, spray-coating, bar-coating and blade-coating.

Temperature and time of the drying process is decided in view of the solvent used and a manufacturing cost. Preferably, drying temperature is in the range from room temperature to 200° C., and the drying time is from 10 minutes to 2 hours. More preferably, drying temperature is from a boiling point of the solvent to a temperature 80° C. higher than the boiling point. The drying process is usually conducted under the atmospheric pressure or lower pressure, and in a static or ventilated place.

EXAMPLES

The present invention will be described in greater detail referring to some preferred embodiment examples.

Photoconductor Example 1 (E1)

A plate shape photoconductor was fabricated for evaluating electrical characteristics. A drum shape photoconductor (30 mm diameter) was fabricated for evaluating printing performances. Each of an aluminum plate and an aluminum blank tube was dipped in a coating solution for forming an undercoat layer, and dried at 100° C. for 60 minutes to obtain an undercoat layer having a film thickness of 0.3 μm. The coating solution for the undercoat layer had a composition as follows:

3 parts soluble nylon (AMILAN CM8000 available from Toray Industries, Inc.), and 97 parts mixed solvent of methanol and methylene chloride with weight ratio 5/5.

Dispersion liquid for a photosensitive layer was prepared by dispersing a mixture of the materials listed below in a DYNO-MIL® (manufactured by Wab Co.). Each of the aluminum plate and the aluminum tube coated with the undercoat layer was dipped in the dispersion liquid for forming a single-layer photosensitive layer, and dried at 100° C. for 60 minutes to obtain a single-layer photosensitive layer having a film thickness of 25 μm. The mixture for preparing the dispersion liquid had a composition as follows:

0.2 parts charge transport substance: X-type metal-free phthalocyanine, 0.5 parts biphenyl derivative: the compound of formula (BP1-1), 3 parts electron transport substance: the compound of formula (ET1-8), 5 parts hole transport substance: the compound of formula (HT1-66), 0.5 parts antioxidant agent: BHT (2,6-di-t-butyl-4-methylphenol), 0.01 part silicone oil: KF-50 available from Shin'etsu Chemical Industries Co., Ltd.

11 parts binder resin: bisphenol Z polycarbonate resin, a resin having the structural unit of formula (BD1-1): PANLITE TS2020 available from Teijin Chemicals Ltd., and 100 parts methylene chloride.

Thus, the electrophotographic photoconductor of Example 1 was fabricated.

Photoconductor Examples 2 to 44 (E2 to E44) and Comparative Examples 1 to 21 (C1 to C21)

Photoconductor Examples 2 to 44 and Comparative Examples 1 to 21 were fabricated in the same manner as in Example 1 except that biphenyl derivative, electron transport substance, and hole transport substance were replaced by those indicated in Tables 1, 2 and 3.

TABLE 1

| specimen | biphenyl derivative | electron transport substance | hole transport substance |
|---|---|---|---|
| E1 | (BP1-1) | (ET1-8) | (HT1-66) |
| E2 | (BP1-2) | (ET1-8) | (HT1-66) |
| E3 | (BP1-3) | (ET1-8) | (HT1-66) |
| E4 | (BP1-4) | (ET1-8) | (HT1-66) |
| E5 | (BP1-5) | (ET1-8) | (HT1-66) |
| E6 | (BP1-6) | (ET1-8) | (HT1-66) |
| E7 | (BP1-1) | (ET2-11) | (HT2-22) |
| E8 | (BP1-2) | (ET2-11) | (HT2-22) |
| E9 | (BP1-3) | (ET2-11) | (HT2-22) |
| E10 | (BP1-4) | (ET2-11) | (HT2-22) |
| E11 | (BP1-5) | (ET2-11) | (HT2-22) |
| E12 | (BP1-6) | (ET2-11) | (HT2-22) |
| E13 | (BP1-1) | (ET3-2) | (HT3-30) |
| E14 | (BP1-2) | (ET3-2) | (HT3-30) |
| E15 | (BP1-3) | (ET3-2) | (HT3-30) |
| E16 | (BP1-4) | (ET3-2) | (HT3-30) |
| E17 | (BP1-5) | (ET3-2) | (HT3-30) |
| E18 | (BP1-6) | (ET3-2) | (HT3-30) |
| E19 | (BP1-1) | (ET4-5) | (HT1-101) |
| E20 | (BP1-2) | (ET4-5) | (HT1-101) |
| E21 | (BP1-3) | (ET4-5) | (HT1-101) |
| E22 | (BP1-4) | (ET4-5) | (HT1-101) |
| E23 | (BP1-5) | (ET4-5) | (HT1-101) |
| E24 | (BP1-6) | (ET4-5) | (HT1-101) |

TABLE 2

| specimen | biphenyl derivative | electron transport substance | hole transport substance |
|---|---|---|---|
| E25 | (BP1-1) | (ET4-5) | (HT2-34) |
| E26 | (BP1-2) | (ET4-5) | (HT2-34) |
| E27 | (BP1-3) | (ET4-5) | (HT2-34) |
| E28 | (BP1-4) | (ET4-5) | (HT2-34) |
| E29 | (BP1-5) | (ET4-5) | (HT2-34) |
| E30 | (BP1-6) | (ET4-5) | (HT2-34) |
| E31 | (BP1-3) | (ET4-5) | (HT3-3) |
| E32 | (BP1-3) | (ET4-5) | (HT4-2) |
| E33 | (BP1-3) | (ET4-5) | (HT5-4) |
| E34 | (BP1-3) | (ET4-5) | (HT-11) |
| E35 | (BP1-3) | (ET4-5) | (HT-25) |
| E36 | (BP1-3) | (ET5-1) | (HT3-19) |
| E37 | (BP1-3) | (ET6-6) | (HT2-12) |
| E38 | (BP1-3) | (ET7-12) | (ET4-2) |
| E39 | (BP1-3) | (ET8-2) | (HT1-4) |
| E40 | (BP1-3) | (ET9-1) | (HT1-4) |
| E41 | (BP1-3) | (ET10-2) | (HT3-3) |
| E42 | (BP1-3) | (ET12-3) | (HT2-9) |
| E43 | (BP1-3) | (ET14-2) | (HT2-9) |
| E44 | (BP1-3) | (ET-10) | (HT1-101) |

TABLE 3

| specimen | biphenyl derivative | electron transport substance | hole transport substance |
|---|---|---|---|
| C1 | none | (ET1-8) | (HT1-66) |
| C2 | none | (ET2-11) | (HT2-22) |
| C3 | none | (ET3-2) | (HT3-30) |
| C4 | none | (ET4-5) | (HT1-101) |
| C5 | none | (ET4-5) | (HT2-34) |
| C6 | none | (ET5-1) | (HT3-19) |
| C7 | none | (ET6-6) | (HT2-12) |
| C8 | none | (ET7-12) | (HT4-2) |
| C9 | none | (ET8-2) | (HT1-4) |
| C10 | none | (ET9-1) | (HT1-4) |
| C11 | none | (ET10-2) | (HT3-3) |
| C12 | none | (ET12-3) | (HT2-9) |

TABLE 3-continued

| specimen | biphenyl derivative | electron transport substance | hole transport substance |
|---|---|---|---|
| C13 | none | (ET14-2) | (HT2-9) |
| C14 | none | (ET-10) | (HT1-101) |
| C15 | BP1-1 | none | (HT1-101) |
| C16 | BP1-2 | none | (HT1-101) |
| C17 | BP1-3 | none | (HT1-101) |

TABLE 3-continued

| specimen | biphenyl derivative | electron transport substance | hole transport substance |
|---|---|---|---|
| C18 | BP1-4 | none | (HT1-101) |
| C19 | BP1-5 | none | (HT1-101) |
| C20 | BP1-6 | none | (HT1-101) |
| C21 | none | none | (HT1-101) |

TABLE 4

| | electrical characteristics by EPA-800 | | | image quality (under high temp & humidity) by HL-730 | | | |
|---|---|---|---|---|---|---|---|
| | retention | sensitivity | residual | initial image | | after 5,000 printings | |
| specimen | rate Vk5 (%) | E1/2 $\mu J/cm^2$ | potential Vr(V) | entirely black image | entirely white image | entirely black image | entirely white image |
| E1 | 84.4 | 0.54 | 73 | good(1.44) | good(0.05) | good(1.38) | good(0.04) |
| E2 | 83.2 | 0.57 | 70 | good(1.44) | good(0.04) | good(1.32) | good(0.04) |
| E3 | 80.3 | 0.55 | 72 | good(1.43) | good(0.05) | good(1.37) | good(0.08) |
| E4 | 85.2 | 0.54 | 77 | good(1.44) | good(0.05) | good(1.34) | good(0.05) |
| E5 | 83.0 | 0.60 | 80 | good(1.42) | good(0.05) | good(1.34) | good(0.07) |
| E6 | 82.8 | 0.57 | 77 | good(1.42) | good(0.05) | good(1.36) | good(0.05) |
| E7 | 83.5 | 0.60 | 80 | good(1.41) | good(0.05) | good(1.38) | good(0.06) |
| E8 | 84.2 | 0.57 | 76 | good(1.43) | good(0.05) | good(1.35) | good(0.05) |
| E9 | 85.0 | 0.61 | 75 | good(1,45) | good(0.04) | good(1.39) | good(0.05) |
| E10 | 88.1 | 0.55 | 83 | good(1.44) | good(0.05) | good(1.40) | good(0.05) |
| E11 | 79.9 | 0.58 | 80 | good(1.41) | good(0.05) | good(1.37) | good(0.08) |
| E12 | 83.6 | 0.62 | 77 | good(1.41) | good(0.06) | good(1.34) | good(0.07) |
| E13 | 87.5 | 0.69 | 75 | good(1.42) | good(0.06) | good(1.39) | good(0.10) |
| E14 | 84.2 | 0.65 | 69 | good(1.45) | good(0.05) | good(1.32) | good(0.09) |
| E15 | 81.0 | 0.66 | 70 | good(1.42) | good(0.05) | good(1.38) | good(0.06) |
| E16 | 79.9 | 0.68 | 70 | good(1.43) | good(0.05) | good(1.36) | good(0.04) |
| E17 | 82.2 | 0.71 | 73 | good(1.44) | good(0.04) | good(1.35) | good(0.05) |
| E18 | 81.9 | 0.65 | 68 | good(1.44) | good(0.05) | good(1.35) | good(0.05) |
| E19 | 85.7 | 0.44 | 65 | good(1.42) | good(0.05) | good(1.38) | good(0.05) |
| E20 | 86.4 | 0.42 | 60 | good(1.46) | good(0.05) | good(1.32) | good(0.06) |
| E21 | 86.2 | 0.41 | 59 | good(1.43) | good(0.05) | good(1.33) | good(0.07) |
| E22 | 87.1 | 0.42 | 63 | good(1.44) | good(0.05) | good(1.37) | good(0.08) |

TABLE 5

| | electrical characteristics by EPA-800 | | | image quality (under high temp & humidity) by HL-730 | | | |
|---|---|---|---|---|---|---|---|
| | retention | sensitivity | residual | initial image | | after 5,000 printings | |
| specimen | rate Vk5 (%) | E1/2 $\mu J/cm^2$ | potential Vr(V) | entirely black image | entirely white image | entirely black image | entirely white image |
| E23 | 88.0 | 0.42 | 66 | good(1.43) | good(0.04) | good(1.38) | good(0.06) |
| E24 | 86.5 | 0.48 | 70 | good(1.42) | good(0.05) | good(1.40) | good(0.06) |
| E25 | 85.0 | 0.49 | 57 | good(1.42) | good(0.05) | good(1.33) | good(0.07) |
| E26 | 82.9 | 0.52 | 60 | good(1.44) | good(0.05) | good(1.37) | good(0.05) |
| E27 | 82.7 | 0.47 | 58 | good(1.45) | good(0.05) | good(1.36) | good(0.06) |
| E28 | 84.0 | 0.54 | 60 | good(1.43) | good(0.04) | good(1.33) | good(0.05) |
| E29 | 86.0 | 0.48 | 59 | good(1.45) | good(0.04) | good(1.40) | good(0.05) |
| E30 | 81.3 | 0.48 | 65 | good(1.41) | good(0.05) | good(1.37) | good(0.08) |
| E31 | 83.6 | 0.55 | 70 | good(1.43) | good(0.05) | good(1.37) | good(0.09) |
| E32 | 84.0 | 0.53 | 78 | good(1.42) | good(0.05) | good(1.41) | good(0.06) |
| E33 | 86.0 | 0.49 | 80 | good(1.42) | good(0.04) | good(1.37) | good(0.06) |
| E34 | 81.4 | 0.74 | 90 | good(1.40) | good(0.05) | good(1.36) | good(0.05) |
| E35 | 78.6 | 0.68 | 86 | good(1.44) | good(0.05) | good(1.34) | good(0.05) |
| E36 | 86.7 | 0.88 | 88 | good(1.45) | good(0.05) | good(1.31) | good(0.06) |
| E37 | 85.6 | 0.92 | 96 | good(1.40) | good(0.04) | good(1.39) | good(0.04) |
| E38 | 82.5 | 0.70 | 75 | good(1.44) | good(0.05) | good(1.38) | good(0.07) |
| E39 | 84.5 | 0.95 | 89 | good(1.38) | good(0.05) | good(1.37) | good(0.06) |
| E40 | 82.6 | 0.91 | 94 | good(1.41) | good(0.05) | good(1.40) | good(0.05) |
| E41 | 88.6 | 0.87 | 87 | good(1.41) | good(0.05) | good(1.40) | good(0.05) |

TABLE 5-continued

| | electrical characteristics by EPA-800 | | | image quality (under high temp & humidity) by HL-730 | | | |
|---|---|---|---|---|---|---|---|
| | retention | sensitivity | residual | initial image | | after 5,000 printings | |
| specimen | rate Vk5 (%) | E1/2 $\mu J/cm^2$ | potential Vr(V) | entirely black image | entirely white image | entirely black image | entirely white image |
| E42 | 84.4 | 0.84 | 90 | good(1.37) | good(0.04) | good(1.29) | good(0.08) |
| E43 | 81.9 | 0.90 | 93 | good(1.39) | good(0.05) | good(1.33) | good(0.08) |
| E44 | 79.6 | 1.05 | 112 | good(1.35) | good(0.05) | good(1.34) | good(0.08) |

TABLE 6

| | electrical characteristics by EPA-800 | | | image quality (under high temp & humidity) by HL-730 | | | |
|---|---|---|---|---|---|---|---|
| | retention | sensitivity | residual | initial image | | after 5,000 printings | |
| specimen | rate Vk5 (%) | E1/2 $\mu J/cm^2$ | potential Vr(V) | entirely black image | entirely white image | entirely black image | entirely white image |
| C1 | 84.8 | 0.54 | 68 | good(1.42) | good(0.04) | good(1.35) | poor(0.15)B |
| C2 | 83.7 | 0.55 | 71 | good(1.42) | good(0.05) | poor(1.26)A | poor(0.14)B |
| C3 | 87.6 | 0.68 | 66 | good(1.43) | good(0.05) | poor(1.21)A | poor(0.13)B |
| C4 | 86.0 | 0.43 | 59 | good(1.40) | good(0.04) | good(1.34) | poor(0.16)B |
| C5 | 82.2 | 0.47 | 56 | good(1.44) | good(0.05) | poor(1.27)A | poor(0.15)B |
| C6 | 85.5 | 0.91 | 87 | good(1.39) | good(0.04) | good(1.32) | poor(0.15)B |
| C7 | 85.9 | 0.89 | 94 | good(1.43) | good(0.05) | good(1.33) | poor(0.14)B |
| C8 | 84.5 | 0.70 | 75 | good(1.43) | good(0.05) | poor(1.20)A | poor(0.15)B |
| C9 | 83.0 | 0.94 | 91 | good(1.44) | good(0.05) | poor(1.14)A | poor(0.19)B |
| C10 | 81.8 | 0.96 | 90 | good(1.41) | good(0.06) | poor(1.22)A | poor(0.16)B |
| C11 | 86.1 | 0.90 | 86 | good(1.40) | good(0.05) | good(1.30) | poor(0.14)B |
| C12 | 83.5 | 0.82 | 90 | good(1.38) | good(0.05) | poor(1.27)A | poor(0.24)B |
| C13 | 80.5 | 0.88 | 89 | good(1.39) | good(0.04) | good(1.32) | poor(0.28)B |
| C14 | 80.4 | 1.10 | 100 | good(1.39) | good(0.04) | poor(1.3)A | poor(0.26)B |
| C15 | 89.0 | 1.24 | 115 | poor(1.21)A | good(0.05) | poor(1.19)A | good(0.11) |

TABLE 7

| | electrical characteristics by EPA-800 | | | image quality (under high temp & humidity) by HL-730 | | | |
|---|---|---|---|---|---|---|---|
| | retention | sensitivity | residual | initial image | | after 5,000 printings | |
| specimen | rate Vk5 (%) | E1/2 $\mu J/cm^2$ | potential Vr(V) | entirely black image | entirely white image | entirely black image | entirely white image |
| C16 | 90.1 | 1.23 | 160 | poor(1.15)A | good(0.05) | poor(1.22)A | poor(0.16)B |
| C17 | 91.4 | 1.18 | 157 | poor(1.27)A | good(0.04) | poor(1.07)A | poor(0.20)B |
| C18 | 89.3 | 1.20 | 160 | poor(1.09)A | good(0.05) | poor(1.13)A | good(0.07) |
| C19 | 90.0 | 1.21 | 160 | poor(1.11)A | good(0.05) | poor(1.19)A | poor(0.28)B |
| C20 | 89.8 | 1.17 | 158 | poor(1.25)A | good(0.05) | poor(1.21)A | poor(0.19)B |
| C21 | 88.8 | 1.21 | 154 | poor(1.22)A | good(0.05) | poor(1.09)A | poor(0.24)B |

Evaluation of Photoconductor Examples 1 to 44 and Comparative Examples 1 to 21

Evaluation of electrical characteristics was conducted on plate-shaped photoconductors using an electrostatic copying-paper testing apparatus: type EPA-8100 manufactured by Kawaguchi Electric Works Co., Ltd., as described below.

The surface of the photoconductor specimen was charged in the dark up to about +600 V under an environment having a temperature of 23° C. and a relative humidity of 50%. Then, the retention rate of surface potential in 5 seconds until light exposure was obtained. The retention rate is defined by the expression indicated below.

$$\text{retention rate } Vk5\ (\%) = V5/V0 \times 100$$

Here, V0 is the surface voltage just after the end of charging, and V5 is the surface potential at 5 seconds after the end of charging (or just before start of light exposure).

Similarly, the surface of the photoconductor specimen was charged up to about +600 V. Then, the surface of the photoconductor was irradiated with monochromatic light generated by a halogen lamp and filtered to have a wavelength of 780 nm and intensity of 1.0 $\mu W/cm^2$ for 5 seconds, so as to obtain the sensitivity $E_{1/2}(\mu J/cm^2)$ defined as an amount of exposed light required to attenuate the surface potential from +600 V to +300 V. Also, the residual potential Vr (V), defined as the surface potential at the end of the irradiation for 5 seconds was obtained.

Durability in actual printings was evaluated on a drum-shaped photoconductor mounted on a laser printer HL-730 manufactured by Brother Co., Ltd. An entirely black image and an entirely white image were printed under an environment having a temperature of 30° C. and a relative humidity of 75% (high temperature and high humidity environment). Evaluation of initial image was conducted by measuring density of the images using a densitometer: Macbeth RD914. Then, an image of printed area percentage of 5% was printed on 5,000 sheets of paper. After the 5,000 sheets of printings, the entirely black image and the entirely white image were printed to evaluate the image quality after 5,000 printings.

The results of these evaluations are shown in Tables 4 to 7.

In Tables 4 to 7, the numerals in the parenthesis in the columns for image quality, e.g., 'poor (1.21) A', are image density values measured by Macbeth densitometer. The standard image density value was set at 0.04 for a white image and at 1.77 for a black image.

Mark A for poor images, e.g., 'poor (1.21) A', means that printing of an entirely black image generated a partially faint and uneven image.

Mark B for poor images, e.g., 'poor (0.15) B', means that printing of an entirely white image generated numerous dots called fogging in a whole sheet.

Tables 4 to 7 shows that the photoconductors of Comparative Examples 15 to 21, containing no electron transport substance, caused high residual potential and resulted in the printed images of low density for an entirely black image under a high temperature and humidity environment. Also, Tables 4 to 7 indicate that the photoconductors of Comparative Examples 1 to 14, containing no biphenyl compound, resulted in the printed images displaying fogging for an entirely white image in the 5,000 sheets of test printings under a high temperature and humidity environment. In contrast, the photoconductors of the present invention, containing electron transport substance and a biphenyl compound, exhibited low residual potential, and generated no image defect in the initial printing and even after 5,000 printings under a high temperature and humidity environment. Thus, the photoconductors according to the present invention exhibited excellent residual potential and image characteristics.

According to the present invention, an electrophotographic photoconductor comprises a conductive substrate, and a single-layer photosensitive layer including at least a resin binder, a charge generation substance, a hole transport substance, and an electron transport substance. The photosensitive layer contains a biphenyl derivative. Such a photoconductor of the present invention exhibits low residual potential and excellent stability in various environments. Thus, the present invention provides an electrophotographic photoconductor having excellent characteristics. The photoconductors of the present invention are useful in printers, copiers, and facsimile machines employing electrophotographic technology.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photoconductor comprising;

a conductive substrate;

a single-layer photosensitive layer disposed on said conductive substrate;

said single-layer photosensitive layer including a resin binder, a charge generation substance, a hole transport substance, and an electron transport substance;

said single-layer photosensitive layer containing a biphenyl compound;

said biphenyl compound is represented by the following structural formula (BP1):

(BP1)

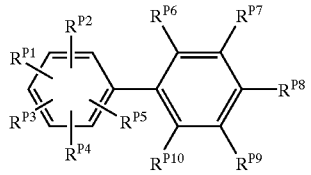

wherein $R^{P1}$ is selected from the group consisting of a hydrogen atom, an optionally substituted aryl group, an optionally substituted aralkyl group, and a cycloalkyl group; each of $R^{P2}$ to $R^{P10}$ is independently selected from the group consisting of a hydrogen atom, a halogen atom, an alkyl group of 1 to 18 carbon atoms, an alkoxyl group of 1 to 18 carbon atoms, a hydroxyl group, an alkyl halide group, a cyano group, nitro group, and an alkyl-substituted amino group optionally forming a ring with a nitrogen atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group; and said electron transport substance includes a compound represented by the following structural formula (ET2):

(ET2)

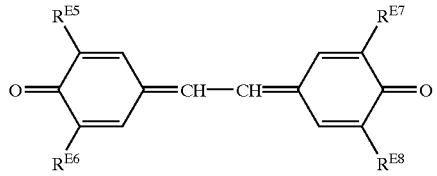

wherein each of $R^{E5}$ to $R^{E8}$ is independently selected from the group consisting of a hydrogen atom, an alkyl group of 1 to 12 carbon atoms, an alkoxyl group of 1 to 12 carbon atoms, an optionally substituted aryl group, a cycloalkyl group, an optionally substituted aralkyl group, and an alkyl halide group; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group.

2. The electrophotographic photoconductor according to claim 1, further comprising:

an undercoat layer interposed between said single-layer photosensitive layer and said conductive substrate.

3. The electrophotographic photoconductor according to claim 1, wherein said biphenyl compound is selected from the group consisting of a biphenyl, an o-terphenyl, a m-terphenyl, a p-terphenyl, a p-benzylbiphenyl, and a hydrogenated terphenyl.

4. The electrophotographic photoconductor according to claim 1, wherein said hole transport substance is selected from the group consisting of a compound represented by the following structural formula (HT1):

(HT1)

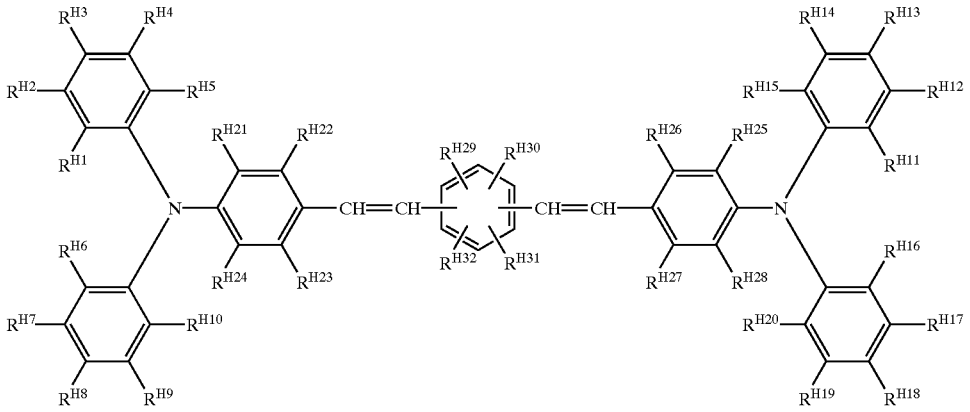

wherein each of $R^{H1}$ to $R^{H32}$ is independently selected from the group consisting of a hydrogen atom, an alkyl group of 1 to 6 carbon atoms, and an alkoxyl group of 1 to 6 carbon atoms, a compound represented by a compound represented by the following structural formula (HT2):

(HT2)

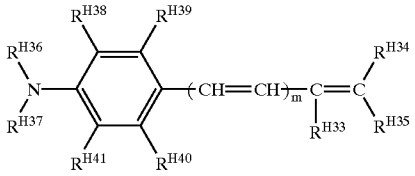

wherein $R^{H33}$ is selected from the group consisting of a hydrogen atom and an alkyl group of 1 to 6 carbon atoms; each of $R^{H34}$ and $R^{H35}$ is independently selected from the group consisting of a hydrogen atom, an alkyl group of 1 to 6 carbon atoms, an alkoxyl group of 1 to 6 carbon atoms, and an optionally substituted aryl group, $R^{H34}$ and $R^{H35}$ optionally bonding each other to form a ring, directly or through a carbon chain, an oxygen atom, or a sulfur atom; each of $R^{H36}$ and $R^{H37}$ is independently selected from the group consisting of an alkyl group of 1 to 12 carbon atoms, an optionally substituted cycloalkyl group of 3 to 12 carbon atoms, an optionally substituted aryl group, and an optionally substituted aralkyl group; each of $R^{H38}$ to $R^{H41}$ is independently selected from the group consisting of a hydrogen atom, an alkyl group of 1 to 6 carbon atoms, an alkoxyl group of 1 to 6 carbon atoms, and an optionally substituted aryl group; two or more of the $R^{H36}$ to $R^{H41}$ optionally bond one another to form a ring, directly or through a carbon chain, an oxygen atom, or a sulfur atom; m is 0 or 1; the substituent being selected from the group consisting of a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, and an alkyl-substituted amino group; two or more of these substituent groups optionally bond one another to form a ring, directly or through a carbon chain, an oxygen atom, or a sulfur atom, a compound represented by the following structural formula (HT3):

(HT3)

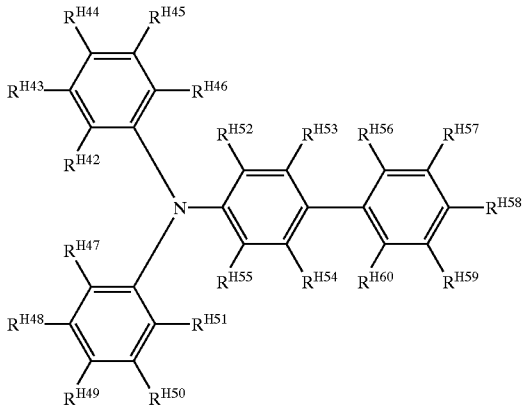

wherein each of $R^{H42}$ to $R^{H60}$ is independently selected from the group consisting of a hydrogen atom, a halogen atom, an alkyl group of 1 to 12 carbon atoms, an alkoxyl group of 1 to 12 carbon atoms, an alkyl-substituted amino group, and an optionally substituted aryl group, two or more of $R^{H42}$ to $R^{H60}$ optionally bonding one another to form a ring, directly or through a carbon chain, an oxygen atom, or a sulfur atom the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group, two or more of these substituent groups optionally bonding one another to form a ring, directly or through a carbon chain, an oxygen atom, or a sulfur atom, a compound represented by the following structural formula (HT4):

(HT4)

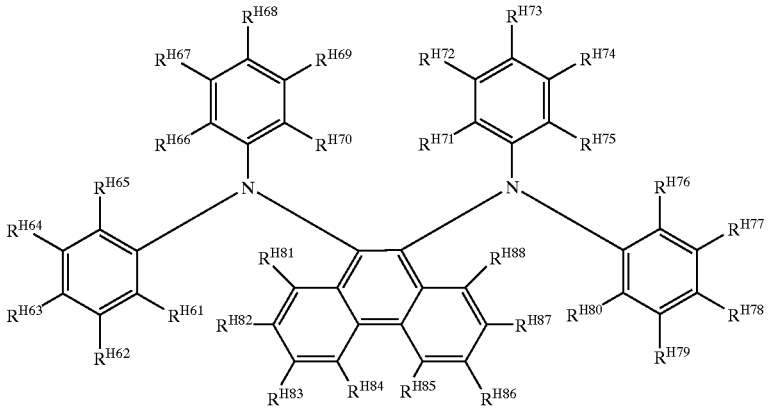

wherein each of $R^{H61}$ to $R^{H88}$ is independently selected from the group consisting of a hydrogen atom, a halogen atom, an aryl group, an alkyl group of 1 to 12 carbon atoms, an alkoxyl group of 1 to 12 carbon atoms, and an optionally substituted aryl group; the substituent being selected from the group consisting of a halogen atom, an alkyl group of 1 to 6 carbon atoms, and an alkoxyl group of 1 to 6 carbon atoms, and a compound represented by the following structural formula (HT5):

(HT5)

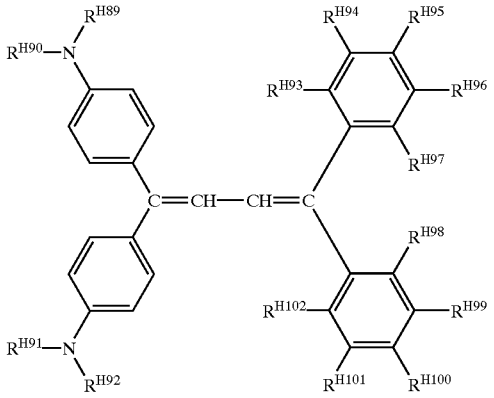

wherein each of $R^{H89}$ to $R^{H92}$ is independently selected from the group consisting of an alkyl group of 1 to 6 carbon atoms and an optionally substituted aralkyl group; each of $R^{H93}$ to $R^{H102}$ is independently selected from the group consisting of a hydrogen atom, a halogen atom, an alkyl group of 1 to 6 carbon atoms, and an alkoxyl group of 1 to 6 carbon atoms; the substituent being selected from the group consisting of a halogen atom, an alkyl group of 1 to 6 carbon atoms, and an alkoxyl group of 1 to 6 carbon atoms.

5. The electrophotographic photoconductor according to claim 1, wherein at least one binder resin is a a polycarbonate having a structural unit represented by the following general formula (BD1) as a principal repeating unit:

(BD1)

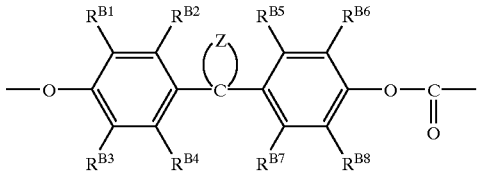

wherein each of $R^{B1}$ to $R^{B8}$ is independently selected from the group consisting of a hydrogen atom, an alkyl group of 1 to 6 carbon atoms, an optionally substituted aryl group, a cycloalkyl group, and an halogen atom; Z is a group of atoms needed to form an optionally substituted carbon ring; the substituent being selected from the group consisting of an alkyl group of 1 to 6 carbon atoms and a halogen atom.

6. An electrophotographic photoconductor according to claim 1, wherein at least one charge generation substance is X-type metal-free phthalocyanine.

7. An electrophotographic photoconductor comprising;

a conductive substrate;

a single-layer photosensitive layer disposed on said conductive substrate;

said single-layer photosensitive layer including a resin binder, a charge generation substance, a hole transport substance, and an electron transport substance;

said single-layer photosensitive layer containing a biphenyl compound;

said biphenyl compound is represented by the following structural formula (BP1):

(BP1)

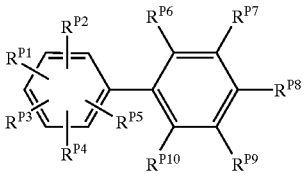

wherein $R^{P1}$ is selected from the group consisting of a hydrogen atom, an optionally substituted aryl group, an optionally substituted aralkyl group, and a cycloalkyl group; each of $R^{P2}$ to $R^{P10}$ is independently selected from the group consisting of a hydrogen atom, a halogen atom, an alkyl group of 1 to 18 carbon atoms, an alkoxyl group of 1 to 18 carbon atoms, a hydroxyl group, an alkyl halide group, a cyano group, nitro group, and an alkyl-substituted amino group optionally forming a ring with a nitrogen atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group; and said electron transport substance includes a compound represented by the following structural formula (ET3):

(ET3)

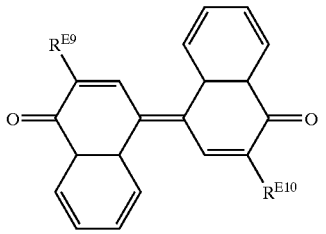

wherein each of $R^{E9}$ to $R^{E10}$ is independently selected from the group consisting of a hydrogen atom, an alkyl group of 1 to 12 carbon atoms, an alkoxyl group of 1 to 12 carbon atoms, an optionally substituted aryl group, a cycloalkyl group, an optionally substituted aralkyl group, and an alkyl halide group; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group.

8. The electrophotographic photoconductor according to claim 7, wherein said hole transport substance is selected from the group consisting of a compound represented by the following structural formula (HT1):

(HT1)

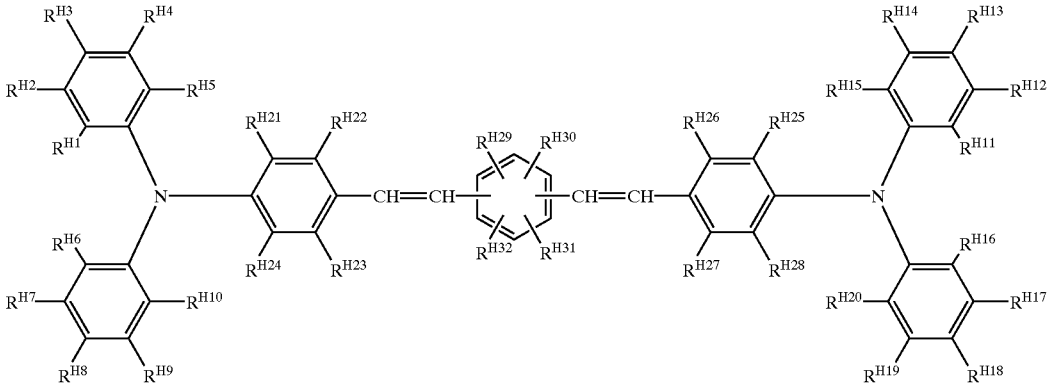

wherein each of $R^{H1}$ to $R^{H32}$ is independently selected from the group consisting of a hydrogen atom, an alkyl group of 1 to 6 carbon atoms, and an alkoxyl group of 1 to 6 carbon atoms, a compound represented by a compound represented by the following structural formula (HT2):

(HT2)

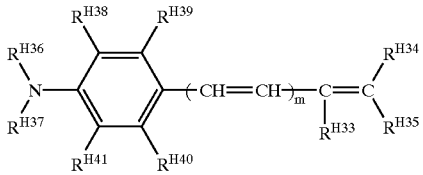

wherein $R^{H33}$ is selected from the group consisting of a hydrogen atom and an alkyl group of 1 to 6 carbon atoms; each of $R^{H34}$ and $R^{H35}$ is independently selected from the group consisting of a hydrogen atom, an alkyl group of 1 to 6 carbon atoms, an alkoxyl group of 1 to 6 carbon atoms, and an optionally substituted aryl group, $R^{H34}$ and $R^{H35}$ optionally bonding each other to form a ring, directly or through a carbon chain, an oxygen atom, or a sulfur atom; each of $R^{H36}$ and $R^{H37}$ is independently selected from the group consisting of an alkyl group of 1 to 12 carbon atoms, an optionally substituted cycloalkyl group of 3 to 12 carbon atoms, an optionally substituted aryl group, and an optionally substituted aralkyl group; each of $R^{H38}$ to $R^{H41}$ is independently selected from the group consisting of a hydrogen atom, an alkyl group of 1 to 6 carbon atoms, an alkoxyl group of 1 to 6 carbon atoms, and an optionally substituted aryl group; two or more of the $R^{H36}$ to $R^{H41}$ optionally bond one another to form a ring, directly or through a carbon chain, an oxygen atom, or a sulfur atom; m is 0 or 1; the substituent being selected from the group consisting of a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, and an alkyl-substituted amino group; two or more of these substituent groups optionally bond one another to form a ring, directly or through a carbon chain, an oxygen atom, or a sulfur atom, a compound represented by the following structural formula (HT3):

(HT3)

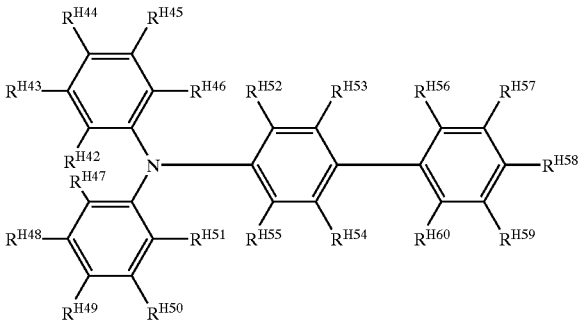

wherein each of $R^{H42}$ to $R^{H60}$ is independently selected from the group consisting of a hydrogen atom, a halogen atom, an alkyl group of 1 to 12 carbon atoms, an alkoxyl group of 1 to 12 carbon atoms, an alkyl-substituted amino group, and an optionally substituted aryl group, two or more of $R^{H42}$ to $R^{H60}$ optionally bonding one another to form a ring, directly or through a carbon chain, an oxygen atom, or a sulfur atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group, two or more of these substituent groups optionally bonding one another to form a ring, directly or through a carbon chain, an oxygen atom, or a sulfur atom, a compound represented by the following structural formula (HT4):

(HT4)

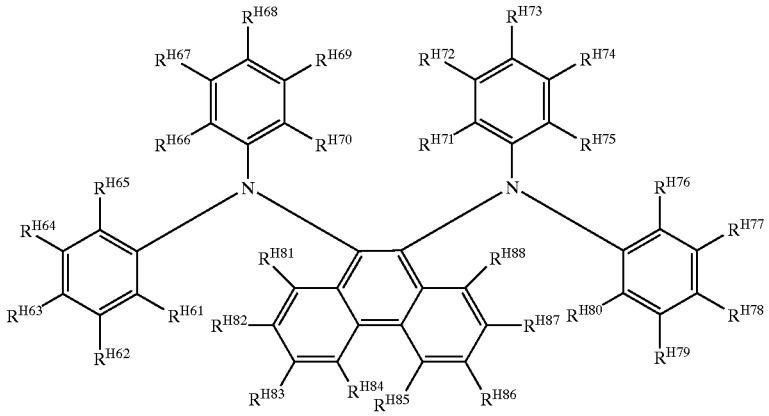

wherein each of $R^{H61}$ to $R^{H88}$ is independently selected from the group consisting of a hydrogen atom, a halogen atom, an aryl group, an alkyl group of 1 to 12 carbon atoms, an alkoxyl group of 1 to 12 carbon atoms, and an optionally substituted aryl group; the substituent being selected from the group consisting of a halogen atom, an alkyl group of 1 to 6 carbon atoms, and an alkoxyl group of 1 to 6 carbon atoms, and a compound represented by the following structural formula (HT5):

(HT5)

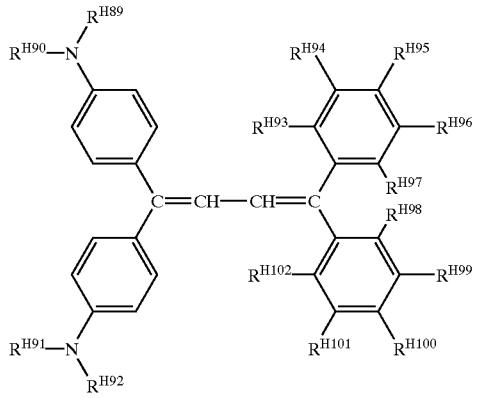

wherein each of $R^{H89}$ to $R^{H92}$ is independently selected from the group consisting of an alkyl group of 1 to 6 carbon atoms and an optionally substituted aralkyl group; each of $R^{H93}$ to $R^{H102}$ is independently selected from the group consisting of a hydrogen atom, a halogen atom, an alkyl group of 1 to 6 carbon atoms, and an alkoxyl group of 1 to 6 carbon atoms; the substituent being selected from the group consisting of a halogen atom, an alkyl group of 1 to 6 carbon atoms, and an alkoxyl group of 1 to 6 carbon atoms.

9. The electrophotographic photoconductor according to claim 7, wherein at least one binder resin is a polycarbonate having a structural unit represented by the following general formula (BD1) as a principal repeating unit:

(BD1)

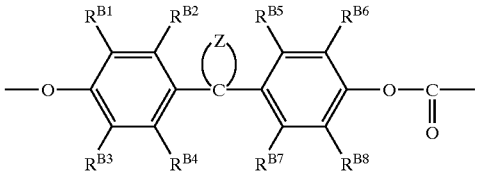

wherein each of $R^{B1}$ to $R^{B8}$ is independently selected from the group consisting of a hydrogen atom, an alkyl group of 1 to 6 carbon atoms, an optionally substituted aryl group, a cycloalkyl group, and an halogen atom; Z is a group of atoms needed to form an optionally substituted carbon ring; the substituent being selected from the group consisting of an alkyl group of 1 to 6 carbon atoms and a halogen atom.

10. An electrophotographic photoconductor comprising;

a conductive substrate;

a single-layer photosensitive layer disposed on said conductive substrate;

said single-layer photosensitive layer including a resin binder, a charge generation substance, a hole transport substance, and an electron transport substance;

said single-layer photosensitive layer containing a biphenyl compound;

said biphenyl compound is represented by the following structural formula (BP1):

(BP1)

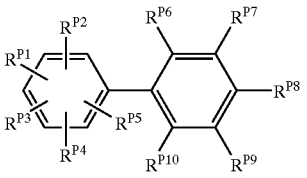

wherein $R^{P1}$ is selected from the group consisting of a hydrogen atom, an optionally substituted aryl group, an optionally substituted aralkyl group, and a cycloalkyl group; each of $R^{P2}$ to $R^{P10}$ is independently selected from the group consisting of a hydrogen atom, a halogen atom, an alkyl group of 1 to 18 carbon atoms, an alkoxyl group of 1 to 18 carbon atoms, a hydroxyl group, an alkyl halide group, a cyano group, nitro group, and an alkyl-substituted amino group optionally forming a ring with a nitrogen atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group; and said electron transport substance includes a compound represented by the following structural formula (ET4):

(ET4)

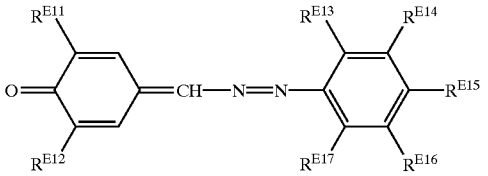

wherein each of $R^{E11}$ and $R^{E12}$ is independently selected from the group consisting of a hydrogen atom, an alkyl group of 1 to 12 carbon atoms, an alkoxyl group of 1 to 12 carbon atoms, an optionally substituted aryl group, a cycloalkyl group, an optionally substituted aralkyl group, and an alkyl halide group; each of $R^{E13}$ to $R^{E17}$ is independently selected from the group consisting of a hydrogen atom, a halogen atom, an alkyl group of 1 to 12 carbon atoms, an alkoxyl group of 1 to 12 carbon atoms, an optionally substituted aryl group, an optionally substituted aralkyl group, an optionally substituted phenoxy group, and an alkyl halide group, two or more of the groups optionally being bonded to form a ring; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group.

11. The electrophotographic photoconductor according to claim 10, wherein said hole transport substance is selected from the group consisting of a compound represented by the following structural formula (HT1):

(HT1)

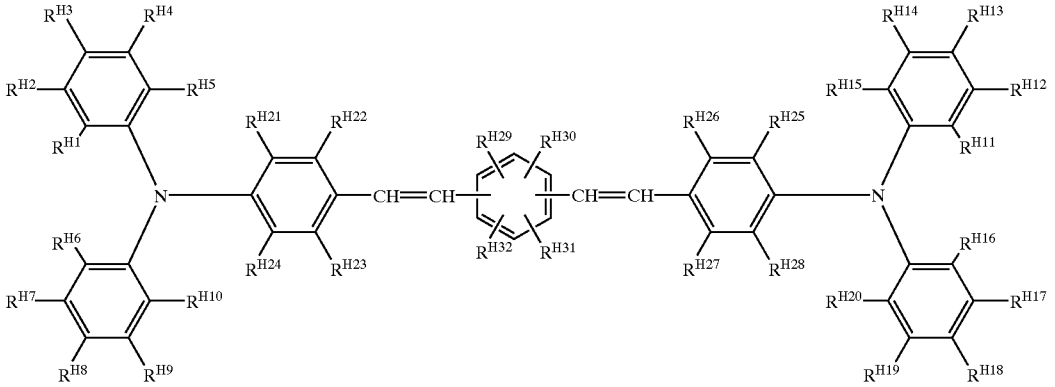

wherein each of $R^{H1}$ to $R^{H32}$ is independently selected from the group consisting of a hydrogen atom, an alkyl group of 1 to 6 carbon atoms, and an alkoxyl group of 1 to 6 carbon atoms, a compound represented by a compound represented by the following structural formula (HT2):

(HT2)

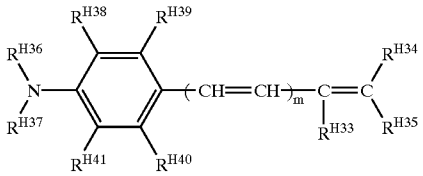

wherein $R^{H33}$ is selected from the group consisting of a hydrogen atom and an alkyl group of 1 to 6carbon atoms; each of $R^{H34}$ and $R^{H35}$ is independently selected from the group consisting of a hydrogen atom, an alkyl group of 1 to 6 carbon atoms, an alkoxyl group of 1 to 6 carbon atoms, and an optionally substituted aryl group, $R^{H34}$ and $R^{H35}$ optionally bonding each other to form a ring, directly or through a carbon chain, an oxygen atom, or a sulfur atom; each of $R^{H36}$ and $R^{H37}$ is independently selected from the group consisting of an alkyl group of 1 to 12 carbon atoms, an optionally substituted cycloalkyl group of 3 to 12 carbon atoms, an optionally substituted aryl group, and an optionally substituted aralkyl group; each of $R^{H38}$ to $R^{H41}$ is independently selected from the group consisting of a hydrogen atom, an alkyl group of 1 to 6 carbon atoms, an alkoxyl group of 1 to 6 carbon atoms, and an optionally substituted aryl group; two or more of the $R^{H36}$ to $R^{H41}$ optionally bond one another to form a ring, directly or through a carbon chain, an oxygen atom, or a sulfur atom; m is 0 or 1; the substituent being selected from the group consisting of a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, and an alkyl-substituted amino group; two or more of these substituent groups optionally bond one another to form a ring, directly or through a carbon chain, an oxygen atom, or a sulfur atom, a compound represented by the following structural formula (HT3):

(HT3)

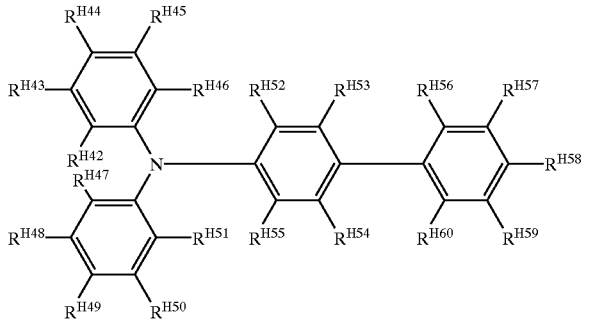

wherein each of $R^{H42}$ to $R^{H60}$ is independently selected from the group consisting of a hydrogen atom, a halogen atom, an alkyl group of 1 to 12 carbon atoms, an alkoxyl group of 1 to 12 carbon atoms, an alkyl-substituted amino group, and an optionally substituted aryl group, two or more of $R^{H42}$ to $R^{H60}$ optionally bonding one another to form a ring, directly or through a carbon chain, an oxygen atom, or a sulfur atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group, two or more of these substituent groups optionally bonding one another to form a ring, directly or through a carbon chain, an oxygen atom, or a sulfur atom, a compound represented by the following structural formula (HT4):

(HT4)

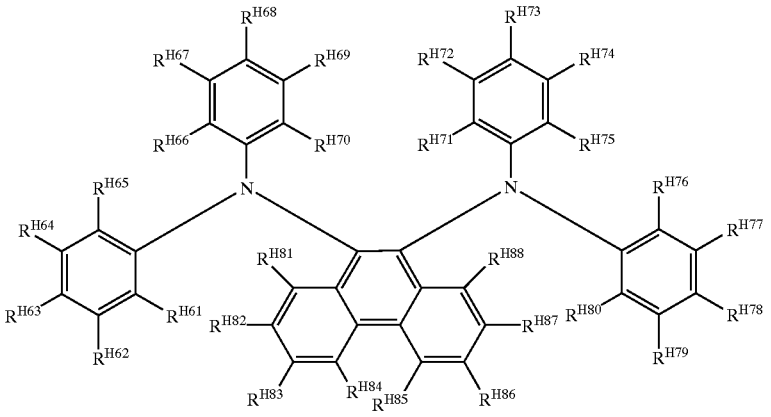

wherein each of $R^{H61}$ to $R^{H88}$ is independently selected from the group consisting of a hydrogen atom, a halogen atom, an aryl group, an alkyl group of 1 to 12 carbon atoms, an alkoxyl group of 1 to 12 carbon atoms, and an optionally substituted aryl group; the substituent being selected from the group consisting of a halogen atom, an alkyl group of 1 to 6 carbon atoms, and an alkoxyl group of 1 to 6 carbon atoms, and a compound represented by the following structural formula (HT5):

(HT5)

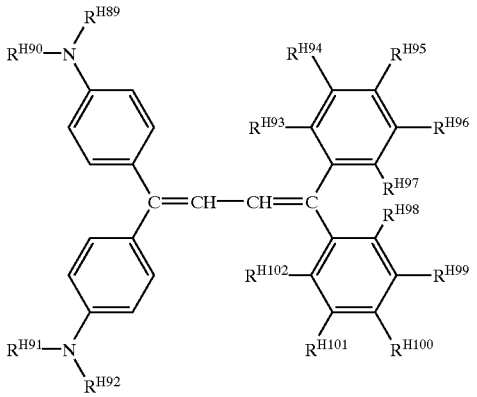

wherein each of $R^{H89}$ to $R^{H92}$ is independently selected from the group consisting of an alkyl group of 1 to 6 carbon atoms and an optionally substituted aralkyl group; each of $R^{H93}$ to $R^{H102}$ is independently selected from the group consisting of a hydrogen atom, a halogen atom, an alkyl group of 1 to 6 carbon atoms, and an alkoxyl group of 1 to 6 carbon atoms; the substituent being selected from the group consisting of a halogen atom an alkyl group of 1 to 6 carbon atoms, and an alkoxyl group of 1 to 6 carbon atoms.

12. The electrophotographic photoconductor according to claim 10, wherein at least one binder resin is a a polycarbonate having a structural unit represented by the following general formula (BD1) as a principal repeating unit:

(BD1)

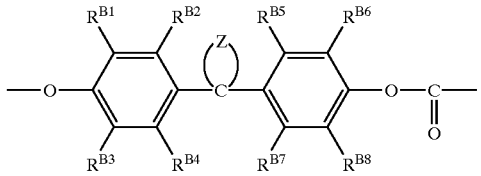

wherein each of $R^{B1}$ to $R^{B8}$ is independently selected from the group consisting of a hydrogen atom, an alkyl group of 1 to 6 carbon atoms, an optionally substituted aryl group, a cycloalkyl group, and an halogen atom; Z is a group of atoms needed to form an optionally substituted carbon ring; the substituent being selected from the group consisting of an alkyl group of 1 to 6 carbon atoms and a halogen atom.

13. An electrophotographic photoconductor comprising;

a conductive substrate;

a single-layer photosensitive layer disposed on said conductive substrate;

said single-layer photosensitive layer including a resin binder, a charge generation substance, a hole transport substance, and an electron transport substance;

said single-layer photosensitive layer containing a biphenyl compound;

said biphenyl compound is represented by the following structural formula (BP1):

(BP1)

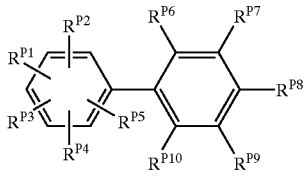

wherein $R^{P1}$ is selected from the group consisting of a hydrogen atom, an optionally substituted aryl group, an optionally substituted aralkyl group, and a cycloalkyl group; each of $R^{P2}$ to $R^{P10}$ is independently selected from the group consisting of a hydrogen atom, a halogen atom, an alkyl group of 1 to 18 carbon atoms, an alkoxyl group of 1 to 18 carbon atoms, a hydroxyl group, an alkyl halide group, a cyano group, nitro group, and an alkyl-substituted amino group optionally forming a ring with a nitrogen atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group; and said electron transport substance includes a compound represented by the following structural formula (ET5):

(ET5)

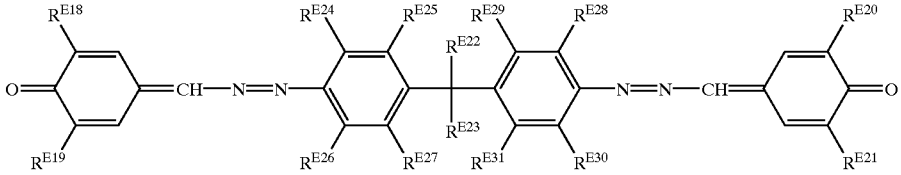

wherein each of $R^{E18}$ to $R^{E21}$ is independently selected from the group consisting of a hydrogen atom, an alkyl group of 1 to 12 carbon atoms, an alkoxyl group of 1 to 12 carbon atoms, an optionally substituted aryl group, a cycloalkyl group, an optionally substituted aralkyl group, and an alkyl halide group; each of $R^{E22}$ and $R^{E23}$ is independently from the group consisting of a hydrogen atom, and an alkyl group of 1 to 12 carbon atoms; each of $R^{E24}$ to $R^{E31}$ is independently selected from the group consisting of a hydrogen atom, a halogen atom, an alkyl group of 1 to 12 carbon atoms, an alkoxyl group of 1 to 12 carbon atoms, an optionally substituted aryl group, and an alkyl halide group; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group.

14. The electrophotographic photoconductor according to claim 13, wherein said hole transport substance is selected from the group consisting of a compound represented by the following structural formula (HT1):

(HT1)

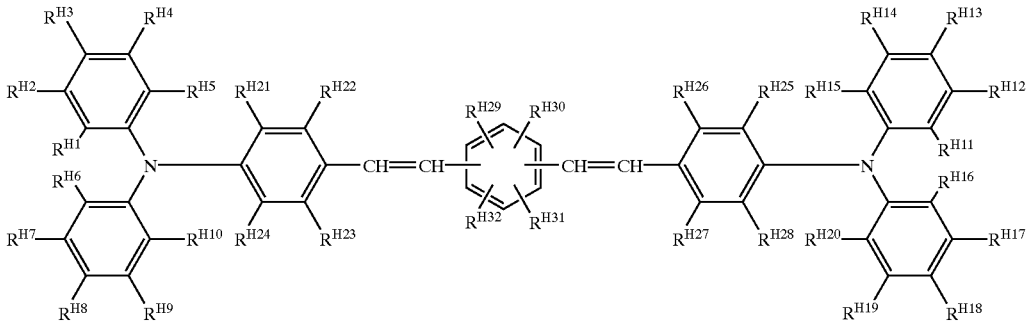

wherein each of $R^{H1}$ to $R^{H32}$ is independently selected from the group consisting of a hydrogen atom, an alkyl group of 1 to 6 carbon atoms, and an alkoxyl group of 1 to 6 carbon atoms, a compound represented by a compound represented by the following structural formula (HT2):

(HT2)

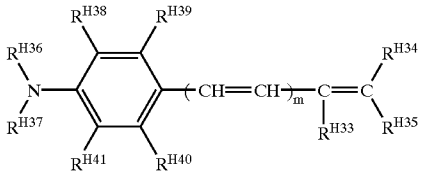

wherein $R^{H33}$ is selected from the group consisting of a hydrogen atom and an alkyl group of 1 to 6 carbon atoms; each of $R^{H34}$ and $R^{H35}$ is independently selected from the group consisting of a hydrogen atom, an alkyl group of 1 to 6 carbon atoms, an alkoxyl group of 1 to 6 carbon atoms, and an optionally substituted aryl group, $R^{H34}$ and $R^{H35}$ optionally bonding each other to form a ring, directly or through a carbon chain, an oxygen atom, or a sulfur atom; each of $R^{H36}$ and $R^{H37}$ is independently selected from the group consisting of an alkyl group of 1 to 12 carbon atoms, an optionally substituted cycloalkyl group of 3 to 12 carbon atoms, an optionally substituted aryl group, and an optionally substituted aralkyl group; each of $R^{H38}$ to $R^{H41}$ is independently selected from the group consisting of a hydrogen atom, an alkyl group of 1 to 6 carbon atoms, an alkoxyl group of 1 to 6 carbon atoms, and an optionally substituted aryl group; two or more of the $R^{H36}$ to $R^{H41}$ optionally bond one another to form a ring, directly or through a carbon chain, an oxygen atom, or a sulfur atom; m is 0 or 1; the substituent being selected from the group consisting of a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, and an alkyl-substituted amino group; two or more of these substituent groups optionally bond one another to form a ring, directly or through a carbon chain, an oxygen atom, or a sulfur atom, a compound represented by the following structural formula (HT3):

(HT3)

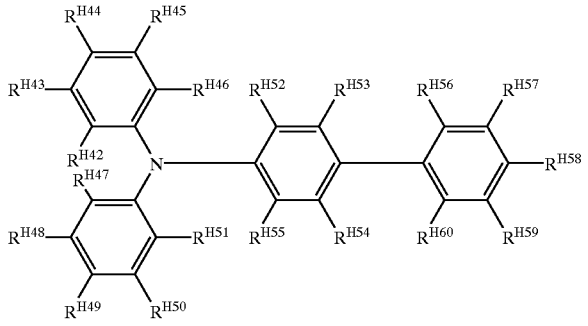

wherein each of $R^{H42}$ to $R^{H60}$ is independently selected from the group consisting of a hydrogen atom, a halogen atom, an alkyl group of 1 to 12 carbon atoms, an alkoxyl group of 1 to 12 carbon atoms, an alkyl-substituted amino group, and an optionally substituted aryl group, two or more of $R^{H42}$ to $R^{H60}$ optionally bonding one another to form a ring, directly or through a carbon chain, an oxygen atom, or a sulfur atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group, two or more of these substituent groups optionally bonding one another to form a ring, directly or through a carbon chain, an oxygen atom, or a sulfur atom, a compound represented by the following structural formula (HT4):

(HT4)

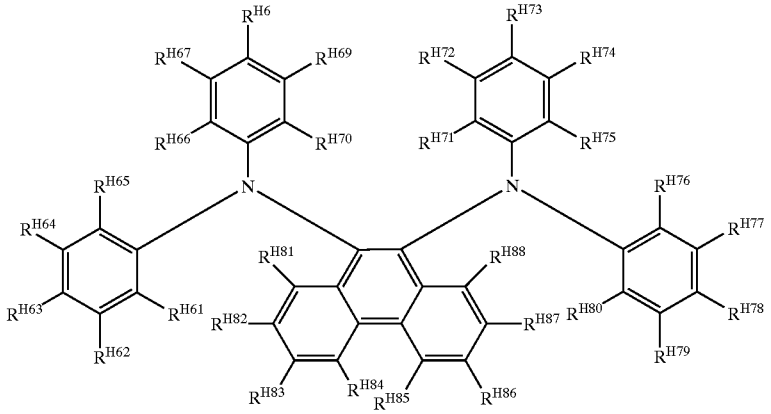

wherein each of $R^{H61}$ to $R^{H88}$ is independently selected from the group consisting of a hydrogen atom, a halogen atom, an aryl group, an alkyl group of 1 to 12 carbon atoms, an alkoxyl group of 1 to 12 carbon atoms, and an optionally substituted aryl group; the substituent being selected from the group consisting of a halogen atom, an alkyl group of 1 to 12 carbon atoms, and an alkoxyl group of 1 to 12 carbon atoms, and a compound represented by the following structural formula (HT5):

(HT5)

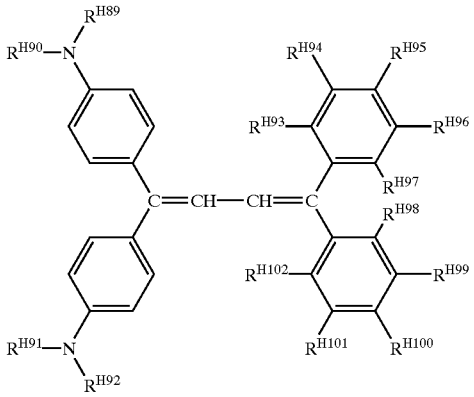

wherein each of $R^{H89}$ to $R^{H92}$ is independently selected from the group consisting of an alkyl group of 1 to 6 carbon atoms and an optionally substituted aralkyl group; each of $R^{H93}$ to $R^{H102}$ is independently selected from the group consisting of a hydrogen atom, a halogen atom, an alkyl group of 1 to 6 carbon atoms, and an alkoxyl group of 1 to 6 carbon atoms; the substituent being selected from the group consisting of a halogen atom, an alkyl group of 1 to 6 carbon atoms, and an alkoxyl group of 1 to 6 carbon atoms.

15. The electrophotographic photoconductor according to claim 13, wherein at least one binder resin is a a polycarbonate having a structural unit represented by the following general formula (BD1) as a principal repeating unit:

(BD1)

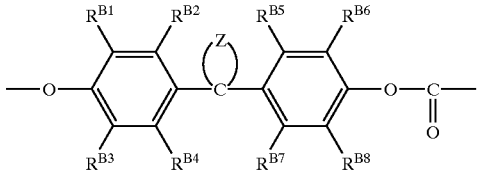

wherein each of $R^{B1}$ to $R^{B8}$ is independently selected from the group consisting of a hydrogen atom, an alkyl group of 1 to 6 carbon atoms, an optionally substituted aryl group, a cycloalkyl group, and an halogen atom; Z is a group of atoms needed to form an optionally substituted carbon ring; the substituent being selected from the group consisting of an alkyl group of 1 to 6 carbon atoms and a halogen atom.

16. An electrophotographic photoconductor comprising;

a conductive substrate;

a single-layer photosensitive layer disposed on said conductive substrate;

said single-layer photosensitive layer including a resin binder, a charge generation substance, a hole transport substance, and an electron transport substance;

said single-layer photosensitive layer containing a biphenyl compound;

said biphenyl compound is represented by the following structural formula (BP1):

(BP1)

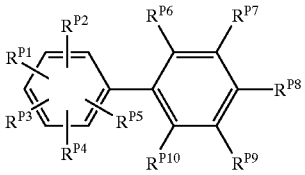

wherein $R^{P1}$ is selected from the group consisting of a hydrogen atom, an optionally substituted aryl group, an optionally substituted aralkyl group, and a cycloalkyl group; each of $R^{P2}$ to $R^{P10}$ is independently selected from the group consisting of a hydrogen atom, a halogen atom, an alkyl group of 1 to 18 carbon atoms, an alkoxyl group of 1 to 18 carbon atoms, a hydroxyl group, an alkyl halide group, a cyano group, nitro group, and an alkyl-substituted amino group optionally forming a ring with a nitrogen atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group; and said electron transport substance includes a compound represented by the following structural formula (ET10):

(ET10)

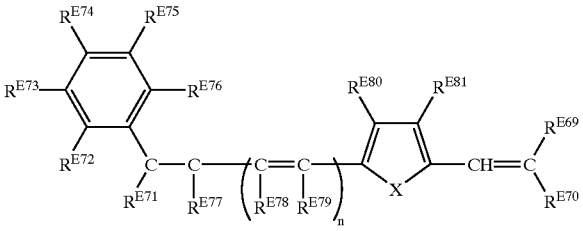

wherein each of $R^{E69}$ and $R^{E70}$ is independently selected from the group consisting of a cyano group and alkoxycarbonyl group; $R^{E71}$ is selected from the group consisting of a hydrogen atom, an alkyl group of 1 to 12 carbon atoms, and an optionally substituted aryl group; each of $R^{E72}$ to $R^{E76}$ is independently selected from the group consisting of a hydrogen atom, a halogen atom, an alkyl group of 1 to 12 carbon atoms, an alkoxyl group, an optionally substituted aryl group, an alkyl halide group, and alkyl-substituted amino group; each of $R^{E77}$ to $R^{E79}$ is independently selected from the group consisting of a hydrogen atom and an alkyl group of 1 to 12 carbon atoms: each of $R^{E80}$ and $R^{E81}$ is independently selected from the group consisting of a hydrogen atom, halogen atom, an alkyl group of 1 to 12 carbon atoms, and an optionally substituted aryl group; X is one of a sulfur atom and an oxygen atom; n is 0 or 1; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group.

17. The electrophotographic photoconductor according to claim 16, wherein said hole transport substance is selected from the group consisting of a compound represented by the following structural formula (HT1):

(HT1)

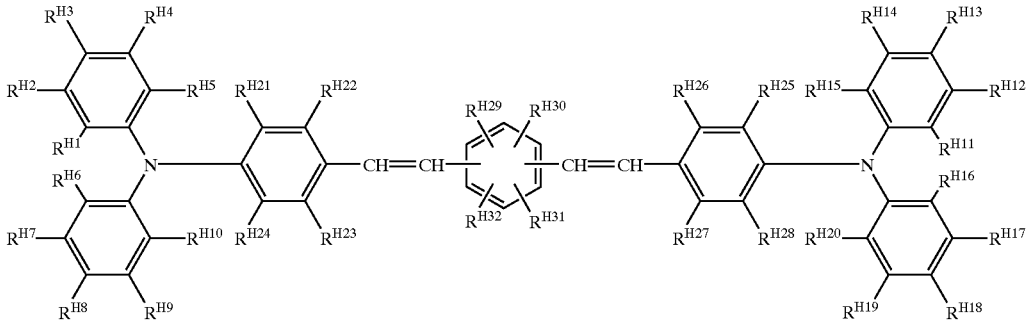

wherein each of $R^{H1}$ to $R^{H32}$ is independently selected from the group consisting of a hydrogen atom, an alkyl group of 1 to 6 carbon atoms, and an alkoxyl group of 1 to 6 carbon atoms, a compound represented by a compound represented by the following structural formula (HT2):

(HT2)

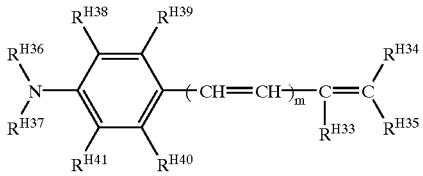

wherein $R^{H33}$ is selected from the group consisting of a hydrogen atom and an alkyl group of 1 to 6 carbon atoms; each of $R^{H34}$ and $R^{H35}$ is independently selected from the group consisting of a hydrogen atom, an alkyl group of 1 to 6 carbon atoms, an alkoxyl group of 1 to 6 carbon atoms, and an optionally substituted aryl group, $R^{H34}$ and $R^{H35}$ optionally bonding each other to form a ring, directly or through a carbon chain, an oxygen atom, or a sulfur atom; each of $R^{H36}$ and $R^{H37}$ is independently selected from the group consisting of an alkyl group of 1 to 12 carbon atoms, an optionally substituted cycloalkyl group of 3 to 12 carbon atoms, an optionally substituted aryl group, and an optionally substituted aralkyl group; each of $R^{H38}$ to $R^{H41}$ is independently selected from the group consisting of a hydrogen atom, an alkyl group of 1 to 6 carbon atoms, an alkoxyl group of 1 to 6 carbon atoms, and an optionally substituted aryl group; two or more of the $R^{H36}$ to $R^{H41}$ optionally bond one another to form a ring, directly or through a carbon chain, an oxygen atom, or a sulfur atom; m is 0 or 1; the substituent being selected from the group consisting of a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, and an alkyl-substituted amino group; two or more of these substituent groups optionally bond one another to form a ring, directly or through a carbon chain, an oxygen atom, or a sulfur atom, a compound represented by the following structural formula (HT3):

(HT3)

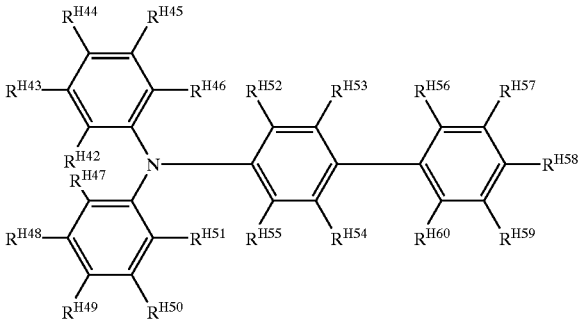

wherein each of $R^{H42}$ to $R^{H60}$ is independently selected from the group consisting of a hydrogen atom, a halogen atom, an alkyl group of 1 to 12 carbon atoms, an alkoxyl group of 1 to 12 carbon atoms, an alkyl-substituted amino group, and an optionally substituted aryl group, two or more of $R^{H42}$ to $R^{H60}$ optionally bonding one another to form a ring, directly or through a carbon chain, an oxygen atom, or a sulfur atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group, two or more of these substituent groups optionally bonding one another to form a ring, directly or through a carbon chain, an oxygen atom, or a sulfur atom, a compound represented by the following structural formula (HT4):

(HT4)

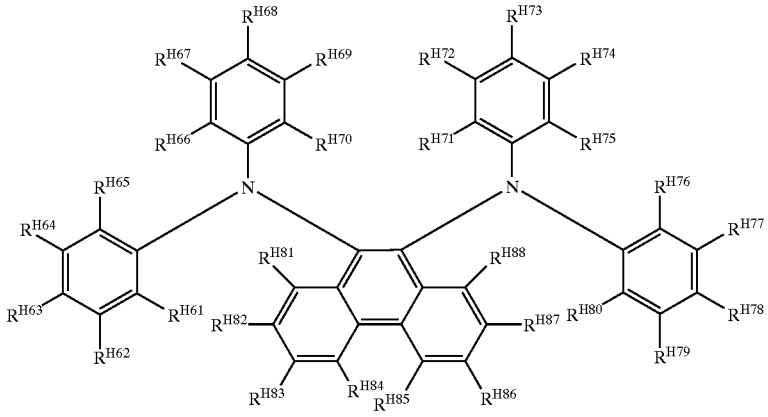

wherein each of $R^{H61}$ to $R^{H88}$ is independently selected from the group consisting of a hydrogen atom, a halogen atom, an aryl group, an alkyl group of 1 to 12 carbon atoms, an alkoxyl group of 1 to 12 carbon atoms, and an optionally substituted aryl group; the substituent being selected from the group consisting of a halogen atom, an alkyl group of 1 to 6 carbon atoms, and an alkoxyl group of 1 to 6 carbon atoms, and a compound represented by the following structural formula (HT5):

(HT5)

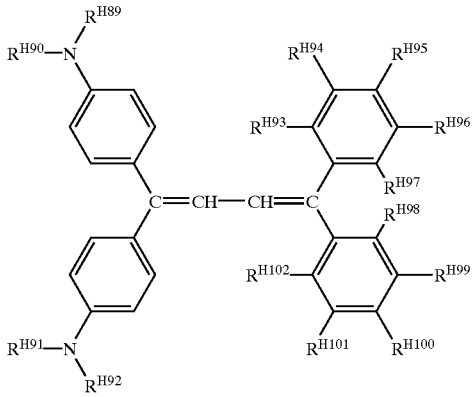

wherein each of $R^{H89}$ to $R^{H92}$ is independently selected from the group consisting of an alkyl group of 1 to 6 carbon atoms and an optionally substituted aralkyl group; each of $R^{H93}$ to $R^{H102}$ is independently selected from the group consisting of a hydrogen atom, a halogen atom, an alkyl group of 1 to 6 carbon atoms, and an alkoxyl group of 1 to 6 carbon atoms; the substituent being selected from the group consisting of a halogen atom, an alkyl group of 1 to 6 carbon atoms, and an alkoxyl group of 1 to 6 carbon atoms.

18. The electrophotographic photoconductor according to claim 16, wherein at least one binder resin is a a polycarbonate having a structural unit represented by the following general formula (BD1) as a principal repeating unit:

(BD1)

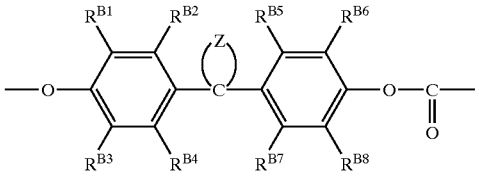

wherein each of $R^{B1}$ to $R^{B8}$ is independently selected from the group consisting of a hydrogen atom, an alkyl group of 1 to 6 carbon atoms, an optionally substituted aryl group a cycloalkyl group, and an halogen atom; Z is a group of atoms needed to form an optionally substituted carbon ring, the substituent being selected from the group consisting of an alkyl group of 1 to 6 carbon atoms and a halogen atom.

19. An electrophotographic photoconductor comprising;

a conductive substrate;

a single-layer photosensitive layer disposed on said conductive substrate;

said single-layer photosensitive layer including a resin binder, a charge generation substance, a hole transport substance, and an electron transport substance;

said single-layer photosensitive layer containing a biphenyl compound;

said biphenyl compound is represented by the following structural formula (BP1):

(BP1)

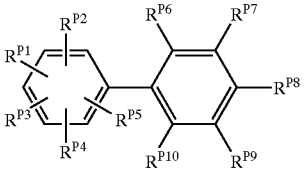

wherein $R^{P1}$ is selected from the group consisting of a hydrogen atom, an optionally substituted aryl group, an optionally substituted aralkyl group, and a cycloalkyl group; each of $R^{P2}$ to $R^{P10}$ is independently selected from the group consisting of a hydrogen atom, a halogen atom, an alkyl group of 1 to 18 carbon atoms, an alkoxyl group of 1 to 18 carbon atoms, a hydroxyl group, an alkyl halide group, a cyano group, nitro group, and an alkyl-substituted amino group optionally forming a ring with a nitrogen atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group; and said electron transport substance includes a compound selected from the group consisting of a compound represented by the following structural formula (ET11), a compound represented by the following structural formula (ET12), and a compound represented by the following structural formula (ET13):

(ET11)

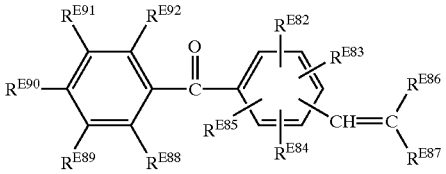

(ET12)

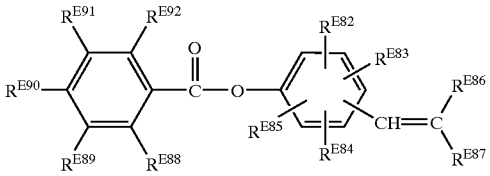

(ET13)

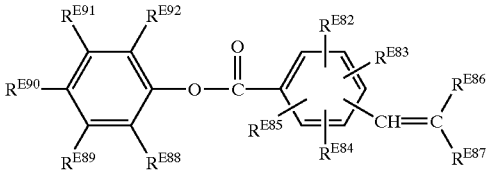

wherein each of $R^{E82}$ to $R^{E85}$ is independently selected from the group consisting of a hydrogen atom and a halogen atom; each of $R^{E86}$ and $R^{E87}$ is independently selected from the group consisting of a cyano group and an alkoxycarbonyl group; and each of $R^{E88}$ to $R^{E92}$ is independently selected from the group consisting of a hydrogen atom, a halogen atom, an alkyl group of 1 to 6 carbon atoms, a nitro group, and a cyano group.

20. The electrophotographic photoconductor according to claim 19, wherein said hole transport substance is selected from the group consisting of a compound represented by the following structural formula (HT1):

(HT1)

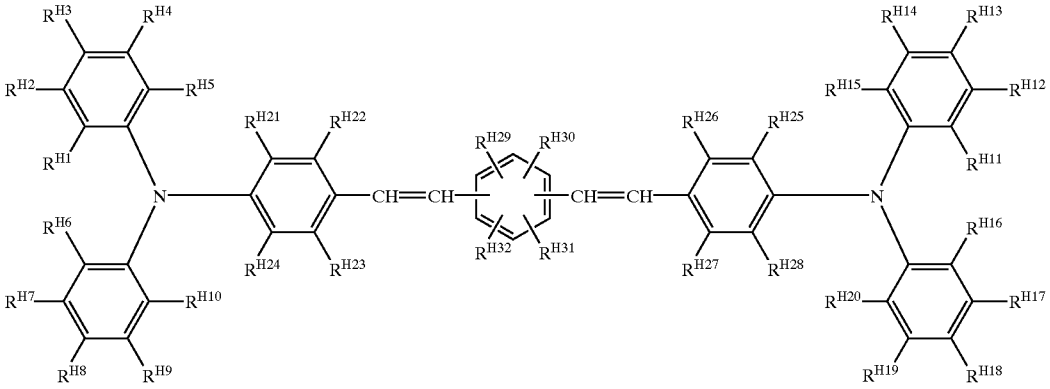

wherein each of $R^{H1}$ to $R^{H32}$ is independently selected from the group consisting of a hydrogen atom, an alkyl group of 1 to 6 carbon atoms, and an alkoxyl group of 1 to 6 carbon atoms, a compound represented by a compound represented by the following structural formula (HT2):

(HT2)

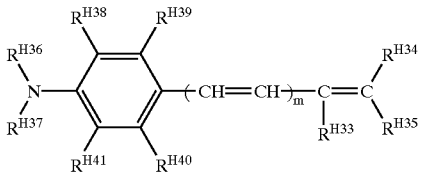

wherein $R^{H33}$ is selected from the group consisting of a hydrogen atom and an alkyl group of 1 to 6 carbon atoms; each of $R^{H34}$ and $R^{H35}$ is independently selected from the group consisting of a hydrogen atom, an alkyl group of 1 to 6 carbon atoms, an alkoxyl group of 1 to 6 carbon atoms, and an optionally substituted aryl group, $R^{H34}$ and $R^{H35}$ optionally bonding each other to form a ring, directly or through a carbon chain, an oxygen atom, or a sulfur atom; each of $R^{H36}$ and $R^{H37}$ is independently selected from the group consisting of an alkyl group of 1 to 12 carbon atoms, an optionally substituted cycloalkyl group of 3 to 12 carbon atoms, an optionally substituted aryl group, and an optionally substituted aralkyl group; each of $R^{H38}$ to $R^{H41}$ is independently selected from the group consisting of a hydrogen atom, an alkyl group of 1 to 6 carbon atoms an alkoxyl group of 1 to 6 carbon atoms, and an optionally substituted aryl group; two or more of the $R^{H36}$ to $R^{H41}$ optionally bond one another to form a ring, directly or through a carbon chain, an oxygen atom, or a sulfur atom; m is 0 or 1; the substituent being selected from the group consisting of a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, and an alkyl-substituted amino group; two or more of these substituent groups optionally bond one another to form a ring, directly or through a carbon chain, an oxygen atom, or a sulfur atom, a compound represented by the following structural formula (HT3):

(HT3)

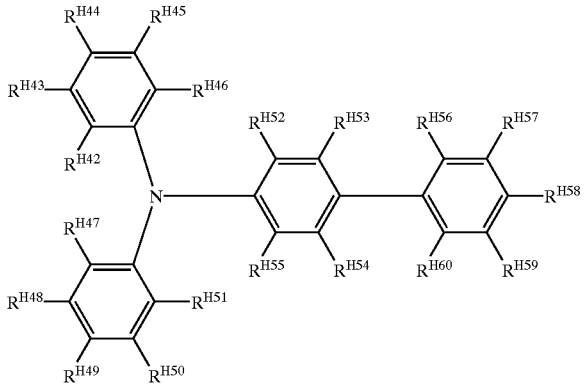

wherein each of $R^{H42}$ to $R^{H60}$ is independently selected from the group consisting of a hydrogen atom, a halogen atom, an alkyl group of 1 to 12 carbon atoms, an alkoxyl group of 1 to 12 carbon atoms, an alkyl-substituted amino group, and an optionally substituted aryl group, two or more of $R^{H42}$ to $R^{H60}$ optionally bonding one another to form a ring, directly or through a carbon chain, an oxygen atom, or a sulfur atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group, two or more of these substituent groups optionally bonding one another to form a ring, directly or through a carbon chain, an oxygen atom, or a sulfur atom, a compound represented by the following structural formula (HT4):

(HT4)

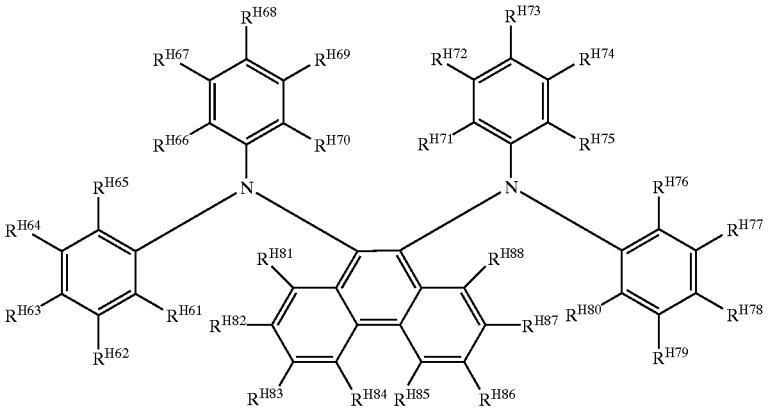

wherein each of $R^{H61}$ to $R^{H88}$ is independently selected from the group consisting of a hydrogen atom, a halogen atom, an aryl group, an alkyl group of 1 to 12 carbon atoms, an alkoxyl group of 1 to 12 carbon atoms, and an optionally substituted aryl group; the substituent being selected from the group consisting of a halogen atom, an alkyl group of 1 to 6 carbon atoms, and an alkoxyl group of 1 to 6 carbon atoms, and a compound represented by the following structural formula (HT5):

(HT5)

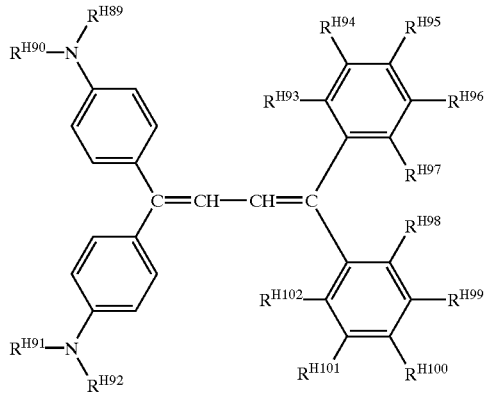

wherein each of $R^{H89}$ to $R^{H92}$ is independently selected from the group consisting of an alkyl group of 1 to 6 carbon atoms and an optionally substituted aralkyl group; each of $R^{H93}$ to $R^{H102}$ is independently selected from the group consisting of a hydrogen atom, a halogen atom, an alkyl group of 1 to 6 carbon atoms, and an alkoxyl group of 1 to 6 carbon atoms; the substituent being selected from the group consisting of a halogen atom, an alkyl group of 1 to 6 carbon atoms, and an alkoxyl group of 1 to 6 carbon atoms.

21. The electrophotographic photoconductor according to claim 19, wherein at least one binder resin is a a polycarbonate having a structural unit represented by the following general formula (BD1) as a principal repeating unit:

(BD1)

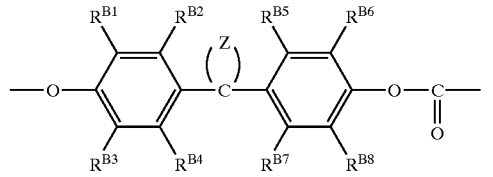

wherein each of $R^{B1}$ to $R^{B8}$ is independently selected from the group consisting of a hydrogen atom, an alkyl group of 1 to 6 carbon atoms, an optionally substituted aryl group, a cycloalkyl group, and an halogen atom: Z is a group of atoms needed to form an optionally substituted carbon ring; the substituent being selected from the group consisting of an alkyl group of 1 to 6 carbon atoms and a halogen atom.

22. An electrophotographic photoconductor comprising;

a conductive substrate;

a single-layer photosensitive layer disposed on said conductive substrate;

said single-layer photosensitive layer including a resin binder, a charge generation substance, a hole transport substance, and an electron transport substance;

said single-layer photosensitive layer containing a biphenyl compound;

said biphenyl compound is represented by the following structural formula (BP1):

(BP1)

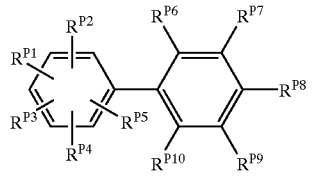

wherein $R^{P1}$ is selected from the group consisting of a hydrogen atom, an optionally substituted aryl group, an optionally substituted aralkyl group, and a cycloalkyl group; each of $R^{P2}$ to $R^{P10}$ is independently selected from the group consisting of a hydrogen atom, a halogen atom, an alkyl group of 1 to 18 carbon atoms, an alkoxyl group of 1 to 18 carbon atoms, a hydroxyl group, an alkyl halide group, a cyano group, nitro group, and an alkyl-substituted amino group optionally forming a ring with a nitrogen atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group; and said electron transport substance includes a compound selected from the group consisting of a compound represented by the following structural formula (ET14) and a compound represented by the following structural formula (ET15):

(ET14)

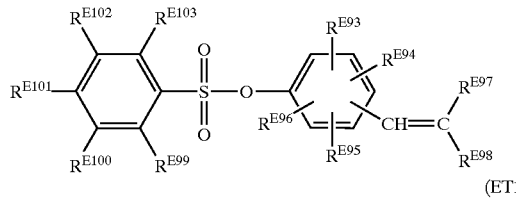

(ET15)

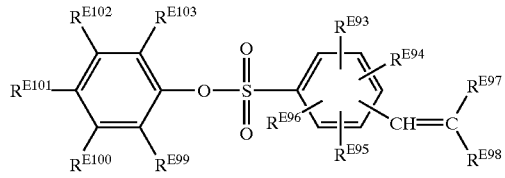

wherein each of $R^{E93}$ to $R^{E96}$ is independently selected from the group consisting of a hydrogen atom and a halogen atom; each of $R^{E97}$ and $R^{E98}$ is independently selected from the group consisting of a cyano group and an alkoxycarbonyl group; and each of $R^{E99}$ to $R^{E103}$ is independently selected from the group consisting of a hydrogen atom, a halogen atom, an alkyl group of 1 to 6 carbon atoms, a nitro group, and a cyano group.

23. The electrophotographic photoconductor according to claim 22, wherein said hole transport substance is selected from the group consisting of a compound represented by the following structural formula (HT1):

(HT1)

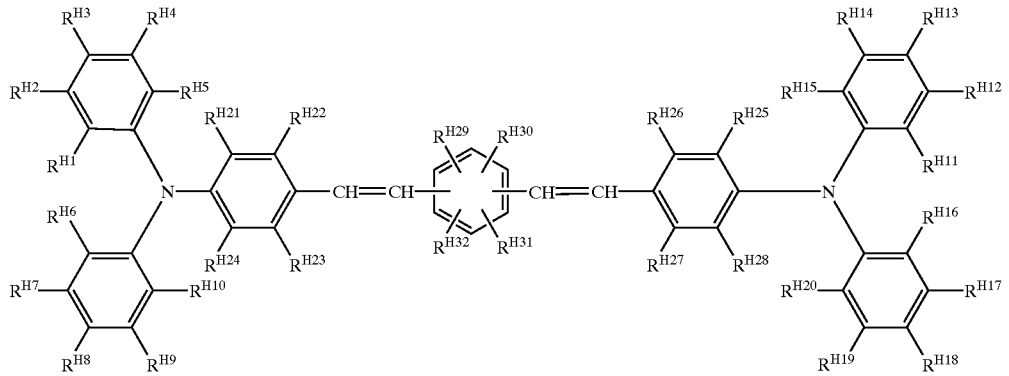

wherein each of $R^{H1}$ to $R^{H32}$ is independently selected from the group consisting of a hydrogen atom, an alkyl group of 1 to 6 carbon atoms, and an alkoxyl group of 1 to 6 carbon atoms, a compound represented by a compound represented by the following structural formula (HT2):

(HT2)

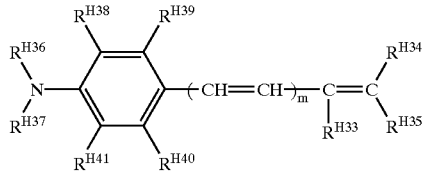

wherein $R^{H33}$ is selected from the group consisting of a hydrogen atom and an alkyl group of 1 to 6 carbon atoms; each of $R^{H34}$ and $R^{H35}$ is independently selected from the group consisting of a hydrogen atom, an alkyl group of 1 to 6 carbon atoms, an alkoxyl group of 1 to 6 carbon atoms, and an optionally substituted aryl group, $R^{H34}$ and $R^{H35}$ optionally bonding each other to form a ring, directly or through a carbon chain, an oxygen atom, or a sulfur atom; each of $R^{H36}$ and $R^{H37}$ is independently selected from the group consisting of an alkyl group of 1 to 12 carbon atoms, an optionally substituted cycloalkyl group of 3 to 12 carbon atoms, an optionally substituted aryl group, and an optionally substituted aralkyl group; each of $R^{H38}$ to $R^{H41}$ is independently selected from the group consisting of a hydrogen atom, an alkyl group of 1 to 6 carbon atoms, an alkoxyl group of 1 to 6 carbon atoms, and an optionally substituted aryl group; two or more of the $R^{H36}$ to $R^{H41}$ optionally bond one another to form a ring, directly or through a carbon chain, an oxygen atom, or a sulfur atom; m is 0 or 1; the substituent being selected from the group consisting of a halogen atom, an alkyl group of 1 to 6 carbon atoms, an alkoxyl group of 1 to 6 carbon atoms, an optionally substituted aryl group, a hydroxyl group, a cyano group, an amino group, a nitro group, an alkyl halide group, and an alkyl-substituted amino group; two or more of these substituent groups optionally bond one another to form a ring, directly or through a carbon chain, an oxygen atom, or a sulfur atom, a compound represented by the following structural formula (HT3):

(HT3)

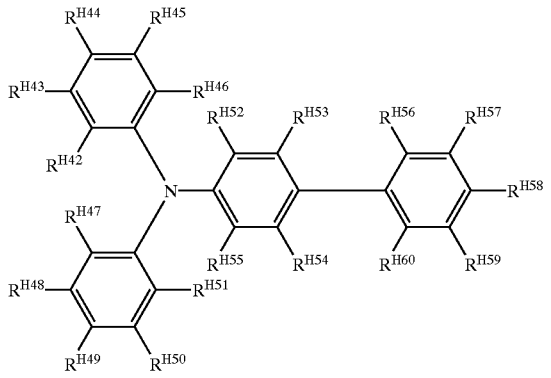

wherein each of $R^{H42}$ to $R^{H60}$ is independently selected from the group consisting of a hydrogen atom, a halogen atom, an alkyl group of 1 to 12 carbon atoms, an alkoxyl group of 1 to 12 carbon atoms, an alkyl-substituted amino group, and an optionally substituted aryl group, two or more of $R^{H42}$ to $R^{H60}$ optionally bonding one another to form a ring, directly or through a carbon chain, an oxygen atom, or a sulfur atom; the substituent being selected from the group consisting of a halogen atom, an alkyl group of 1 to 6 carbon atoms, an alkoxyl group of 1 to 6 carbon atoms, a hydroxyl group, a cyano group, an amino group, a nitro group, and an alkyl halide group, two or more of these substituent groups optionally bonding one another to form a ring, directly or through a carbon chain, an oxygen atom, or a sulfur atom, a compound represented by the following structural formula (HT4):

(HT4)

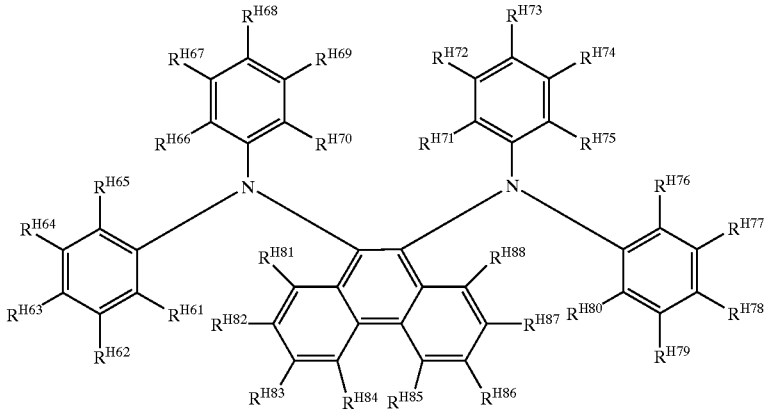

wherein each of $R^{H61}$ to $R^{H88}$ is independently selected from the group consisting of a hydrogen atom, a halogen atom, an aryl group, an alkyl group of 1 to 12 carbon atoms, an alkoxyl group of 1 to 12 carbon atoms, and an optionally substituted aryl group; the substituent being selected from the group consisting of a halogen atom, an alkyl group of 1 to 6 carbon atoms, and an alkoxyl group of 1 to 6 carbon atoms, and a compound represented by the following structural formula (HT5):

(HT5)

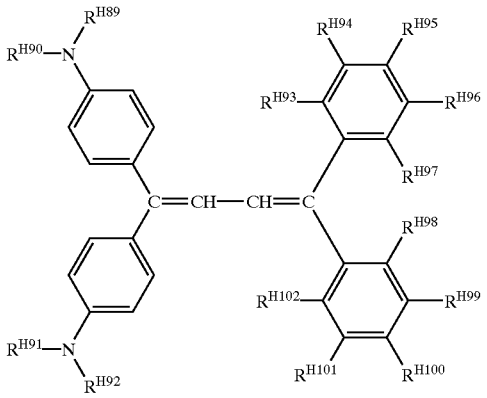

wherein each of $R^{H89}$ to $R^{H92}$ is independently selected from the group consisting of an alkyl group of 1 to 6 carbon atoms and an optionally substituted aralkyl group; each of $R^{H93}$ to $R^{H102}$ is independently selected from the group consisting of a hydrogen atom, a halogen atom, an alkyl group of 1 to 6 carbon atoms, and an alkoxyl group of 1 to 6 carbon atoms; the substituent being selected from the group consisting of a halogen atom, an alkyl group of 1 to 6 carbon atoms, and an alkoxyl group of 1 to 6 carbon atoms.

24. The electrophotographic photoconductor according to claim 22, wherein at least one binder resin is a a polycarbonate having a structural unit represented by the following general formula (BD1) as a principal repeating unit:

(BD1)

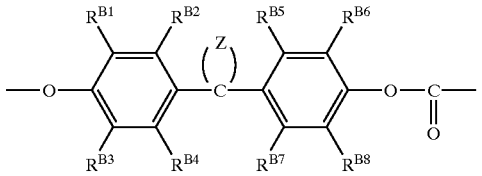

wherein each of $R^{B1}$ to $R^{B8}$ is independently selected from the group consisting of a hydrogen atom, an alkyl group of 1 to 6 carbon atoms, an optionally substituted aryl group, a cycloalkyl group, and an halogen atom; Z is a group of atoms needed to form an optionally substituted carbon ring; the substituent being selected from the group consisting of an alkyl group of 1 to 6 carbon atoms and a halogen atom.

* * * * *